US007975891B2

(12) United States Patent
Aoki

(10) Patent No.: US 7,975,891 B2
(45) Date of Patent: Jul. 12, 2011

(54) STAPLER

(75) Inventor: Akira Aoki, Gunma (JP)

(73) Assignee: MAX Co., Ltd., Tokyo (JP)

( * ) Notice: Subject to any disclaimer, the term of this patent is extended or adjusted under 35 U.S.C. 154(b) by 199 days.

(21) Appl. No.: 12/377,079

(22) PCT Filed: Aug. 8, 2007

(86) PCT No.: PCT/JP2007/065543
§ 371 (c)(1),
(2), (4) Date: Feb. 10, 2009

(87) PCT Pub. No.: WO2008/018508
PCT Pub. Date: Feb. 14, 2008

(65) Prior Publication Data

US 2010/0155450 A1 Jun. 24, 2010

(30) Foreign Application Priority Data

Aug. 11, 2006 (JP) ..... 2006-220741

(51) Int. Cl.
*B25C 5/02* (2006.01)
*B25C 5/04* (2006.01)
*B25C 5/11* (2006.01)

(52) U.S. Cl. ..... 227/88; 227/120; 227/131

(58) Field of Classification Search ..... 227/71, 227/76, 88, 82, 120, 131
See application file for complete search history.

(56) References Cited

U.S. PATENT DOCUMENTS

| | | | | |
|---|---|---|---|---|
| 3,319,863 | A * | 5/1967 | Dritz | 227/71 |
| 3,596,820 | A | 8/1971 | Lou | |
| 7,021,512 | B1 | 4/2006 | Nakamura | |
| 2004/0169058 | A1 | 9/2004 | Mochizuki | |

FOREIGN PATENT DOCUMENTS

| | | | |
|---|---|---|---|
| JP | 2002168216 A | | 6/2002 |
| JP | 2002355803 A | | 12/2002 |
| JP | 2006205262 A | * | 8/2006 |

OTHER PUBLICATIONS

David, Radu, European Search Report for EP 07792210, Sep. 3, 2009, The Hague.

* cited by examiner

*Primary Examiner* — Rinaldi I Rada
*Assistant Examiner* — Nathaniel Chukwurah
(74) *Attorney, Agent, or Firm* — Chernoff, Vilhauer, McClung & Stenzel

(57) ABSTRACT

To provide a staple using insertion-cutting blades that are manufacturable inexpensively, by which the strength of the insertion-cutting blades that are necessary when penetrating binding sheets is secured and the penetration of a staple through the binding sheets is executed reliably. The stapler is constituted by including a handle, a frame and a base. The frame is provided, in the vicinity of the front edge portion of a feeding path through which the interlinked staples are fed, with a driver executing the penetration of the staple with respect to the binding sheets. Punching blades are mounted respectively on the right and the left of a staple push down unit at the lower edge portion of the driver main body portion. Each punching blade has a predetermined length and is provided with a blade edge at one edge portion. Also, each punching blade is provided, in the vicinity of the edge portion including the blade edge, with a protrusion portion which has a slope surface at least on a side of the blade edge and which is protruded by a predetermined amount thereof. Here, the protrusion portion is not formed with the full width of the cutting blade, and each cutting blade has a linear portion that is continuous from one edge portion to the other edge portion in the longitudinal direction.

4 Claims, 104 Drawing Sheets

FIG. 18A
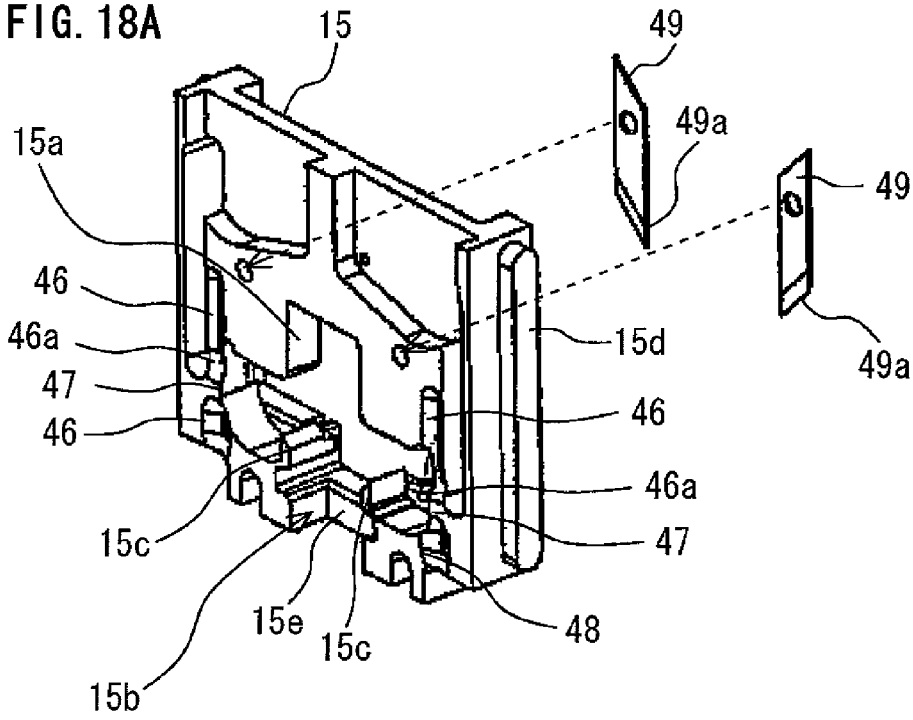
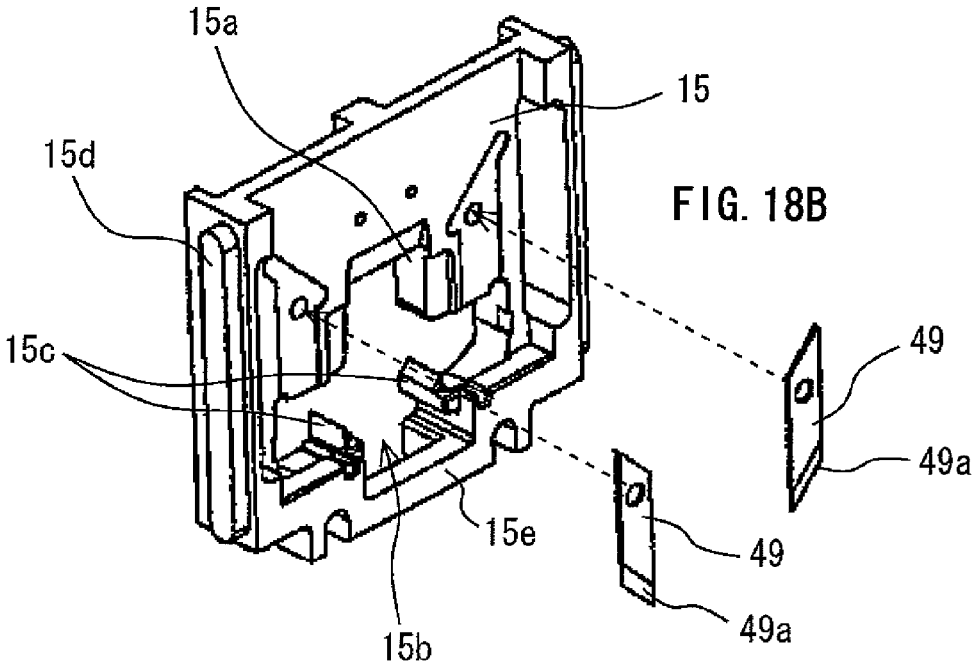
FIG. 18B

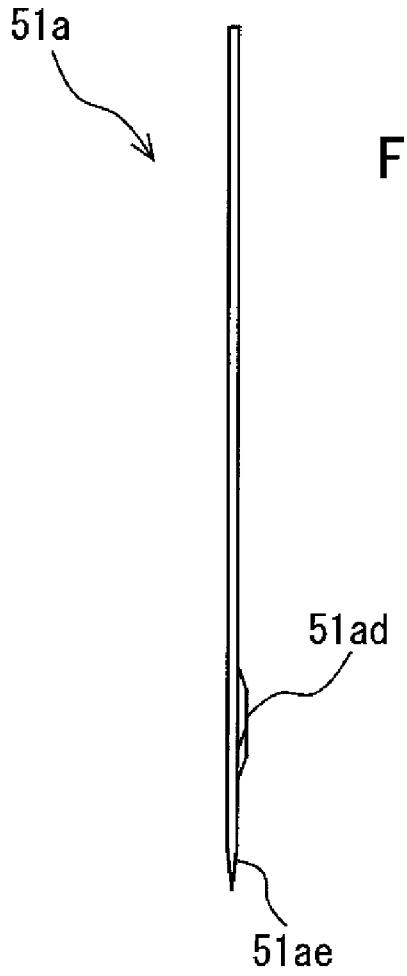
FIG. 21C
FIG. 21D
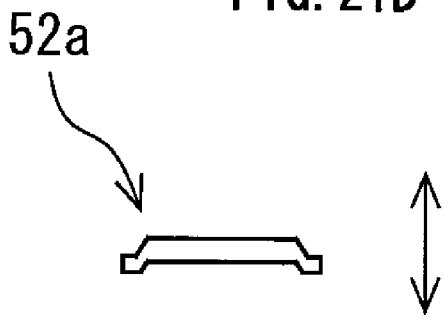

FIG. 22A
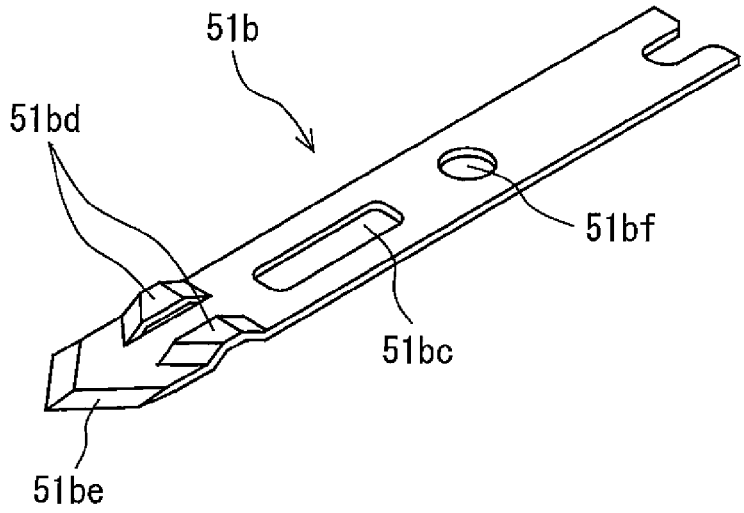
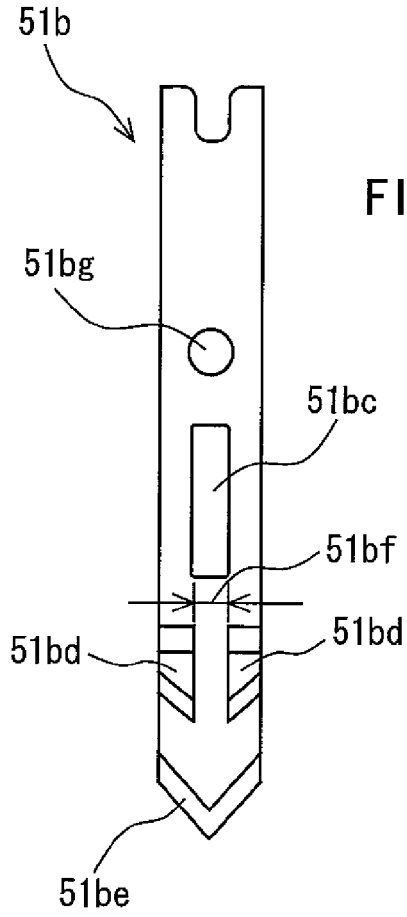
FIG. 22B

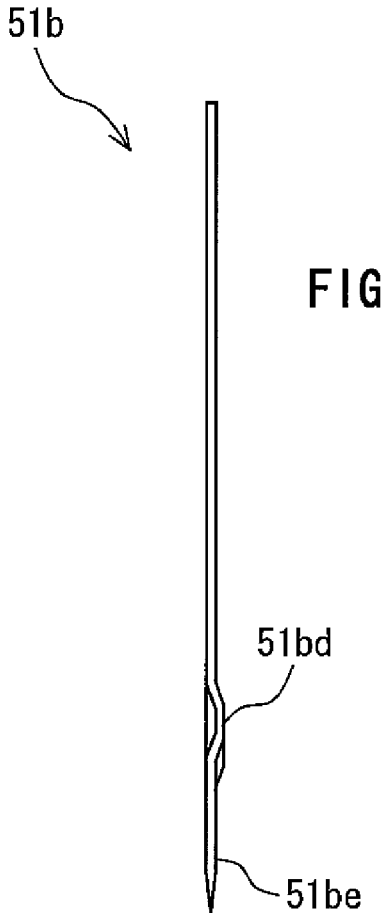
FIG. 22C
FIG. 22D
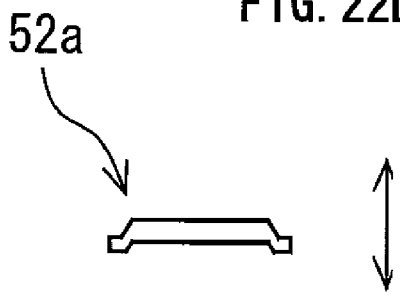

STAPLER

This is a national stage application filed under 35 USC 371 based on International Application No. PCT/JP2007/065543 filed Aug. 8, 2007, and claims priority under 35 USC 119 of Japanese Patent Application No. 2006-220747 filed Aug. 11, 2006.

TECHNICAL FIELD

The present invention relates to a stapler which binds binding sheets by a paper-made staple. In more detail, it relates one in which by providing insertion-cutting blades each having a protrusion portion formed by protruding a portion thereof in a width direction as insertion-cutting blades which forms notch opening for executing penetration of a staple through the binding sheets, it is made possible, by using the insertion-cutting blades which are manufacturable inexpensively, to execute the penetration of the staple to the binding sheets reliably in which the strength of the insertion-cutting blade necessary when penetrating the binding sheets is secured.

BACKGROUND ART

From the past, there has been used a stapler for binding the binding sheets by means of a metal-made staple. In case of binding paper-sheets by using such a stapler by means of a metal-made staple, there sometimes happens a case in which it is requested to separate the paper-sheets and the staple when the paper-sheets are processed by a paper shredder or for the reason of recycling. Also, in view of the safety problem, it is not preferable to bind documents used in a work section handling food articles by means of a metal-made staple.

Also, differently from the above description, there has been proposed a stapler which binds binding sheets by means of a staple formed by a soft raw material of paper or the like (for example, see Japanese Patent Application Publication No. 2001-300865).

The stapler disclosed in the Japanese Patent Application publication No. 2001-300865 is one which binds binding sheets by means of a paper-made staple shaped in a shape in which both the edges thereof are bent in one direction beforehand. The stapler disclosed in the Japanese Patent Application publication No. 2001-300865 is one in which notch openings are formed in the binding sheets by a cutter, both the leg portions of the staple penetrate these notch openings and thereafter, both the leg portions are bent along a staple receiving table and are bonded together.

DISCLOSURE OF THE INVENTION

However, the stapler disclosed in the above-mentioned Japanese Patent Application Publication No. 2001-300865 has the problems as follows. In the stapler disclosed in the Japanese Patent Application Publication No. 2001-300865, a staple penetrates the binding sheets with both the leg portions thereof being attached on the inside of two pieces of cutters. Consequently, in the vicinity of the lower edge portions of the facing surfaces of the two pieces of cutters, protrusion portions of approximately triangular shapes in cross-sections, which are formed over the full widths of the cutters, are provided.

If such a cutter including a protrusion portion formed over the full width is molded by a press process, the cutters become in a state of being bent by their full widths at the protrusion portions. Consequently, in a longitudinal direction of the cutter, a bent waveform shape without a linear portion, which becomes continuous from one edge portion to the other edge portion, so that there is a problem that the strength of the cutter when penetrating the binding sheets cannot be secured.

Also, in case of molding by a die-cast process, the cutter does not become in a bent shape, so that the strength of the cutter when penetrating the binding sheets can be secured, but there is a problem that the manufacturing cost thereof will become expensive as compared with the press process.

The present invention is invented in order to solve such problems and has an object to provide a stapler using an inexpensively manufacturable insertion-cutting blade, which can secure the strength of an insertion-cutting blade that is necessary when penetrating the binding sheets and can execute penetration of the staple to the binding sheets reliably.

In order to solve the problems mentioned above, a stapler relating to the present invention including cutting-off means for cutting off a staple positioned at a leading portion of interlinked staples from the interlinked staples in which a plurality of approximately straight lined paper-made staples are interlinked in parallel, shaping means for shaping the staple cut off by the cutting-off means such that a crown portion and leg portions bent approximately perpendicularly from the right and left sides of the crown portion are formed, penetration means for penetrating both the leg portions of the staple shaped by the shaping means through binding sheets, and bending means for bending both the leg portions of the staple penetrated through the binding sheets by the penetration means along the binding sheets and for bonding them mutually, is characterized in that the penetration means includes a pushing unit for pushing down the staple with respect to the binding sheets, and two pieces of insertion-cutting blades which are provided concurrently at an interval in response to a length of the crown portion and which are provided with protrusion portions formed by protruding portions in the width direction at a predetermined height of the surfaces facing each other, and the respective insertion-cutting blades penetrate the binding sheets in a state in which both the leg portions of the staple that is shaped by the shaping means into a shape in which both the edges thereof are bent to one direction are attached on the surfaces facing each other with respect to the respective insertion-cutting blades on the upside of the respective protrusion portions and at the same time, the staple is pushed down by the pushing unit with respect to the binding sheets.

In the stapler relating to the present invention, binding sheets are bound by means of the paper-made staple as follows. Depending on the cutting-off means, a staple positioned at a leading portion of the interlinked staples is cut off from the interlinked staples in which approximately straight lined paper-made staples are interlinked. The staple cut off from the interlinked staples is shaped by shaping means into a shape in which both the edges thereof are bent to one direction such that predetermined lengths from both the edge portions will form leg portions.

Both the leg portions of the staple shaped into a shape in which both the edges are bent to one direction penetrate the binding sheets by penetration means, and both the penetrated leg portions of the staple are bent by bending means and bonded mutually.

Here, penetration of both the leg portions of the staple by means of the penetration means is executed as follows. It is made to be in a state in which both the leg portions of the staple shaped into a shape in which both the edges thereof are bent to one direction are attached on mutually facing surfaces of respective insertion-cutting blades on the upper side of respective protrusion portions. In such a state, the respective insertion-cutting blades penetrate the binding sheets and at the same time, the staple is pushed down by the pushing unit with respect to the binding sheets.

At that time, notch openings of the binding sheets are formed largely by the protrusion portions provided at the respective insertion-cutting blades. The respective insertion-cutting blades and both the leg portions of the staple penetrate these largely formed cutting holes. Also, each of the protrusion portions is formed by protruding a portion in the width direction of each of the insertion-cutting blades and each of the insertion-cutting blades has a shape with a linear portion that is continuous from one edge portion to the other edge portion in a longitudinal direction thereof, so that the strength of each of the insertion-cutting blades when penetrating the binding sheets is secured.

Further, each of the protrusion portions is formed by protruding a portion in the width direction of each of the insertion-cutting blades by a press process which is inexpensive as compared with a die-cast process.

The stapler of the present invention is provided with the insertion-cutting blades each having a shape in which a linear portion that is continuous from one edge portion to the other edge portion in a longitudinal direction as an insertion-cutting blades which form notch openings for executing penetration of the staple at the binding sheets by forming protrusion portions by protruding portions in the width direction thereof. Thus, the strength of the insertion-cutting blades when penetrating the binding sheets is secured and it becomes possible to execute penetration of the staple to the binding sheets reliably.

Also, the protrusion portions of the cutting blades of the stapler of the present invention are ones formed by protruding portions in the width direction thereof, so that they can be manufactured by a press process, which is inexpensive as compared with a die-cast process.

BRIEF DESCRIPTION OF DRAWINGS

FIG. 18A is an explanatory diagram showing a constitution example of a forming plate;

FIG. 18B is an explanatory diagram showing a constitution example of the forming plate;

FIG. 21C is an explanatory diagram showing a constitution example of the first punching blade;

FIG. 21D is an explanatory diagram showing a shape of the first punch hole;

FIG. 22A is an explanatory diagram showing a constitution example of a second punching blade;

FIG. 22B is an explanatory diagram showing a constitution example of the second punching blade;

FIG. 22C is an explanatory diagram showing a constitution example of the second punching blade;

FIG. 22D is an explanatory diagram showing a shape of second punch hole;

FIG. 78 is a cross-sectional view of the stapler showing a state in which cutoff of the staple starts and slider movement starts;

FIG. 79 is a cross-sectional view of the stapler showing a state in which shaping of the staple starts;

FIG. 80 is a cross-sectional view of the stapler showing a state in which rotation of the cam starts;

FIG. 81 is a cross-sectional view of the stapler showing a state in which shaping of the staple is completed;

FIG. 82 is a cross-sectional view of the stapler showing a state in which the protrusion pin runs on the flat portion;

FIG. 83 is a cross-sectional view of the stapler showing a state in which penetration of the staple is completed and the slider is disengaged from the slider holder;

FIG. 84 is a cross-sectional view of the stapler showing a state in which the clincher right is opened to the right direction in the clincher holder;

FIG. 85 is a cross-sectional view of the stapler showing a state in which the clincher left is opened to the left direction in the clincher holder and the cam at the right of the pushing-out unit returns to a stand-by position thereof;

FIG. 86 is a cross-sectional view of the stapler showing a state in which the right leg portion is clinched and the cam at the left of the pushing-out unit returns;

FIG. 87 is a cross-sectional view of the stapler showing a state in which the left leg portion is clinched;

FIG. 88 is a cross-sectional view of the stapler showing a state in which clinch of the staple is completed;

FIG. 89 is a cross-sectional view of the stapler showing a state in which return of the frame is completed and return of the driver starts;

Figure 90:
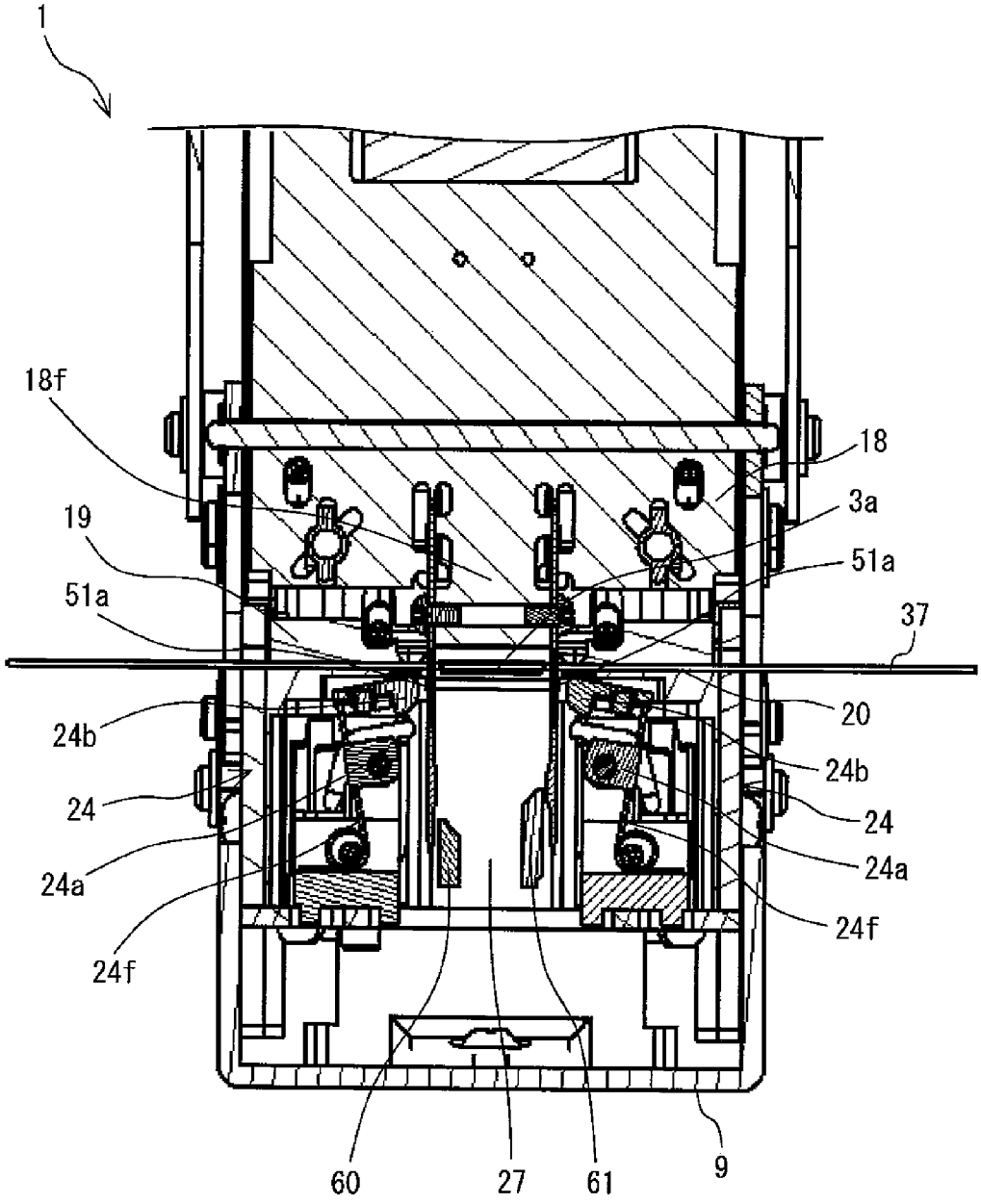
Figure 91:
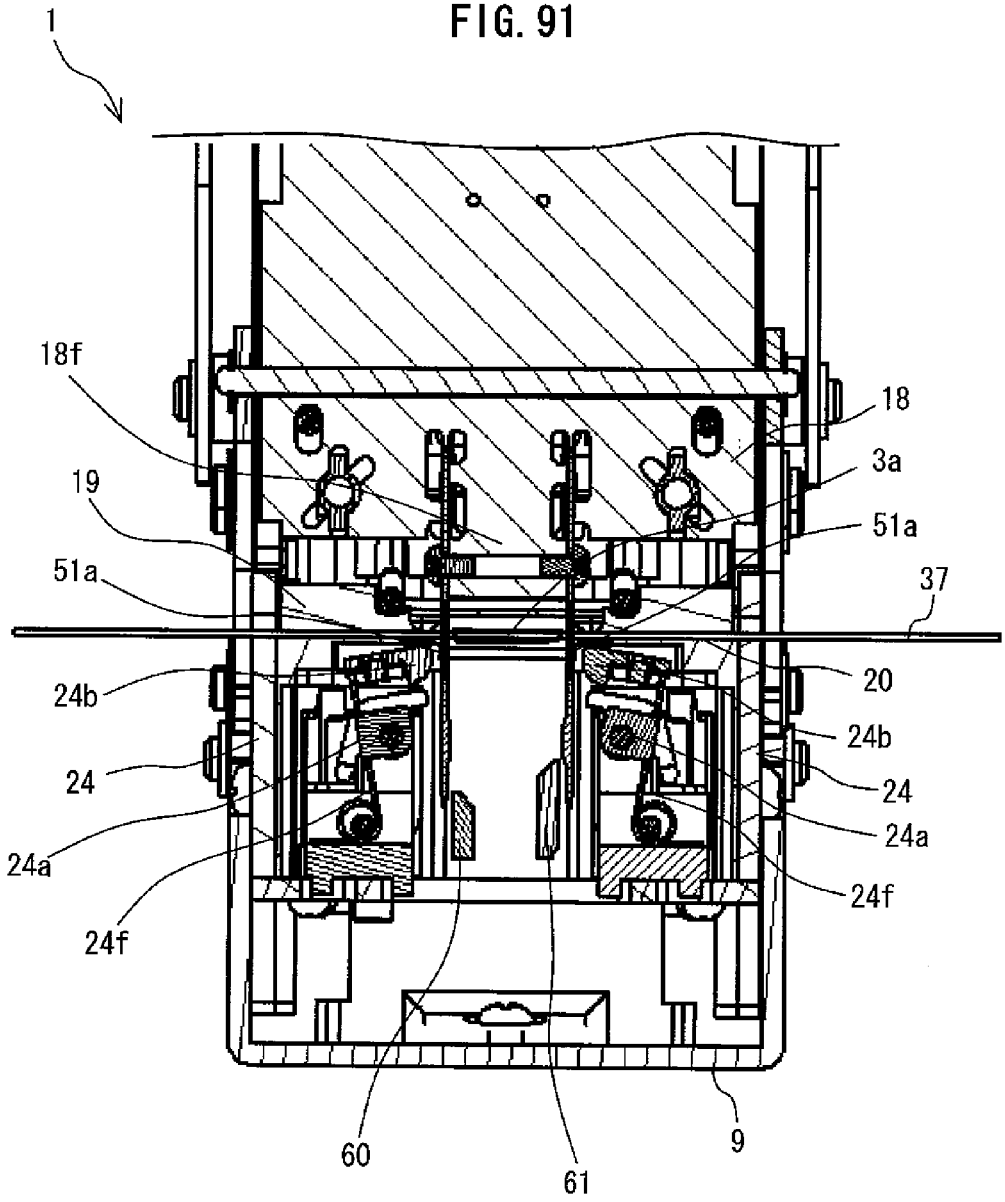
Figure 92:
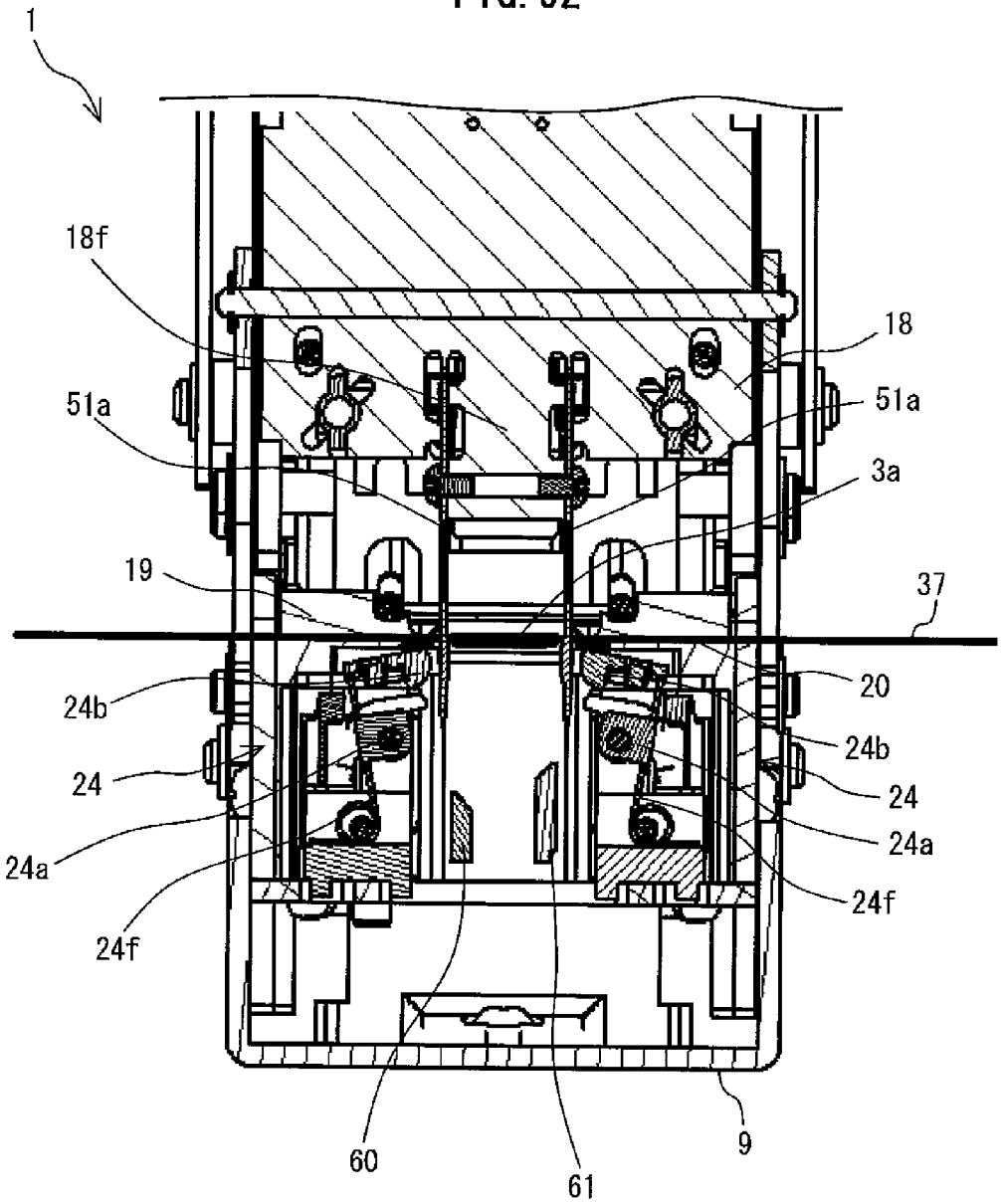
Figure 93:
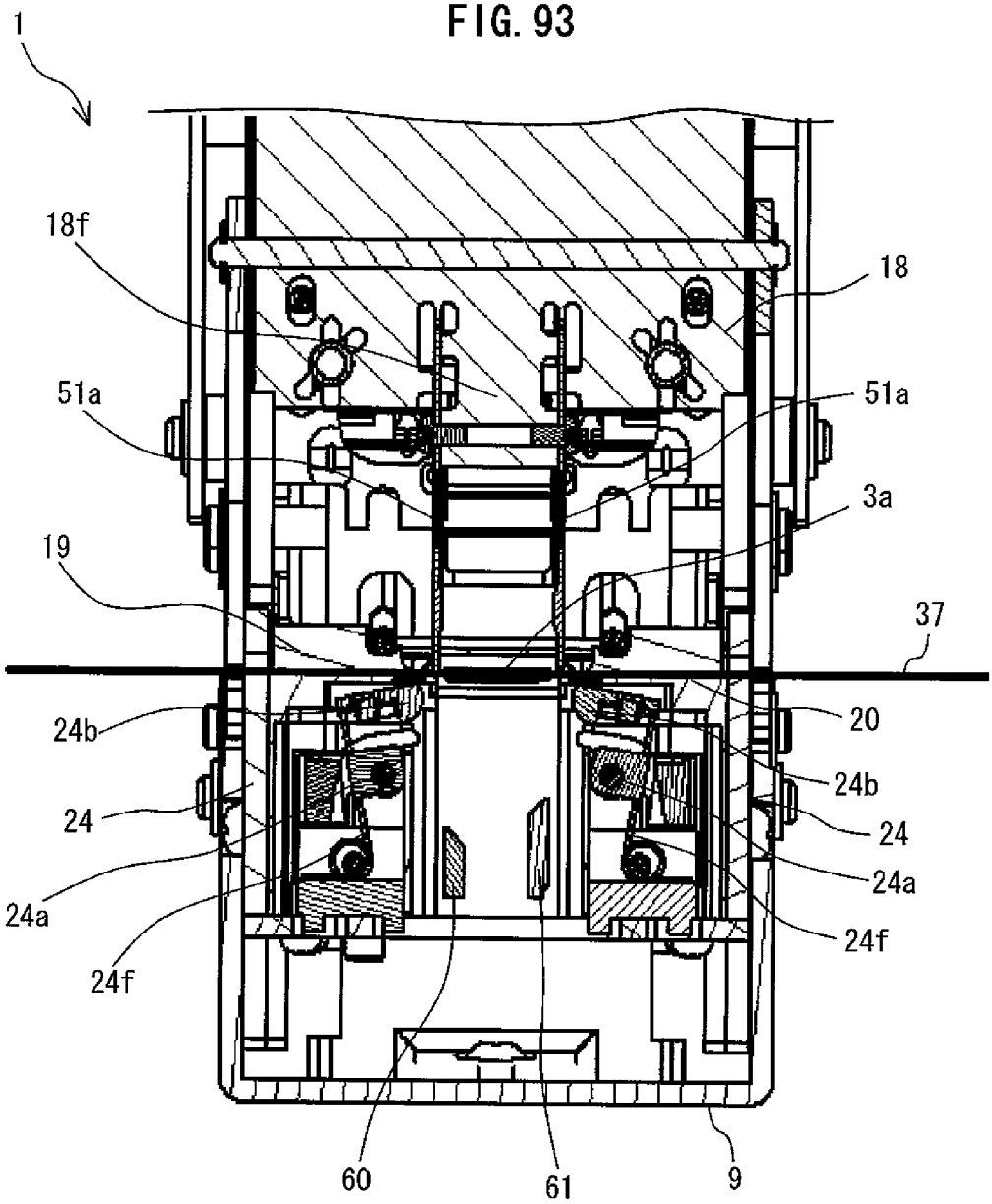
Figure 94:
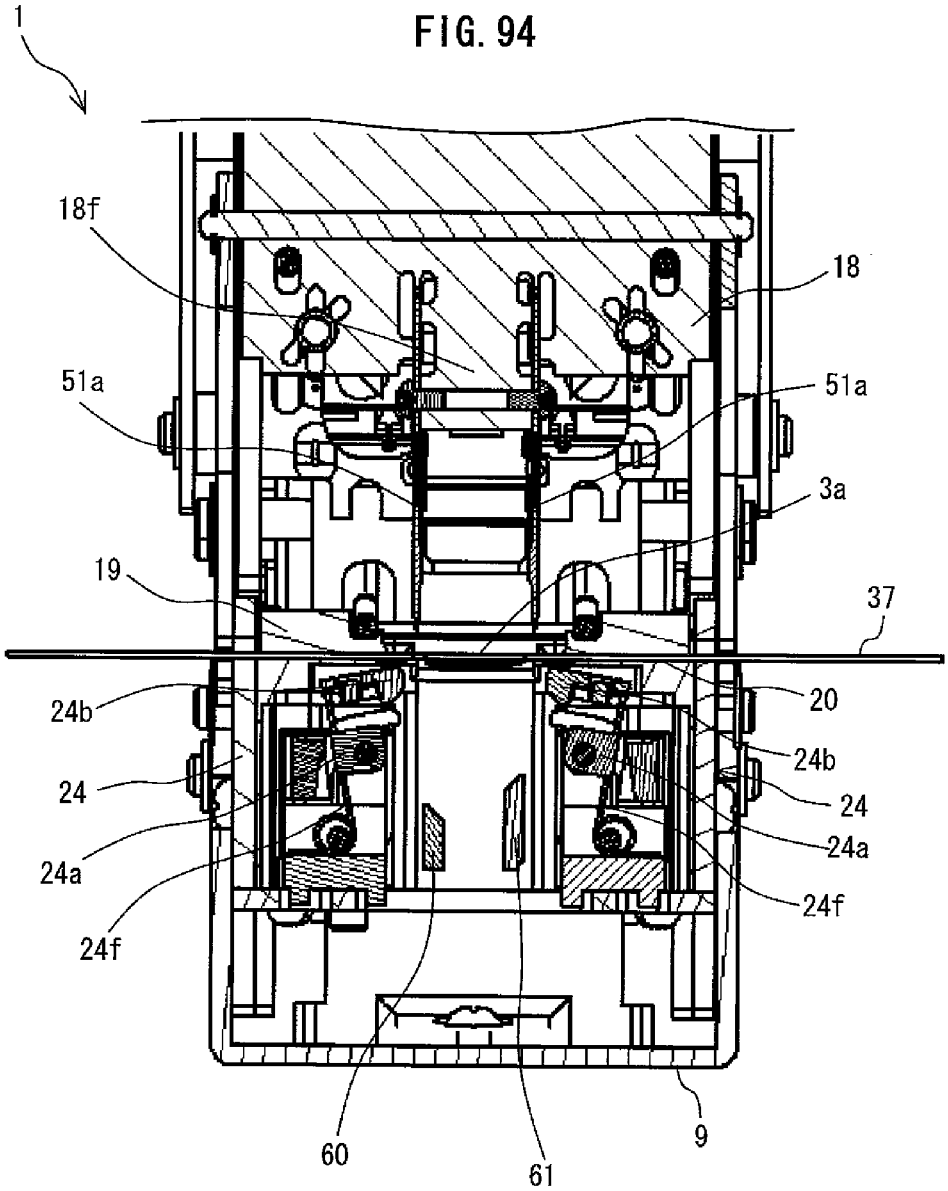
Figure 95:
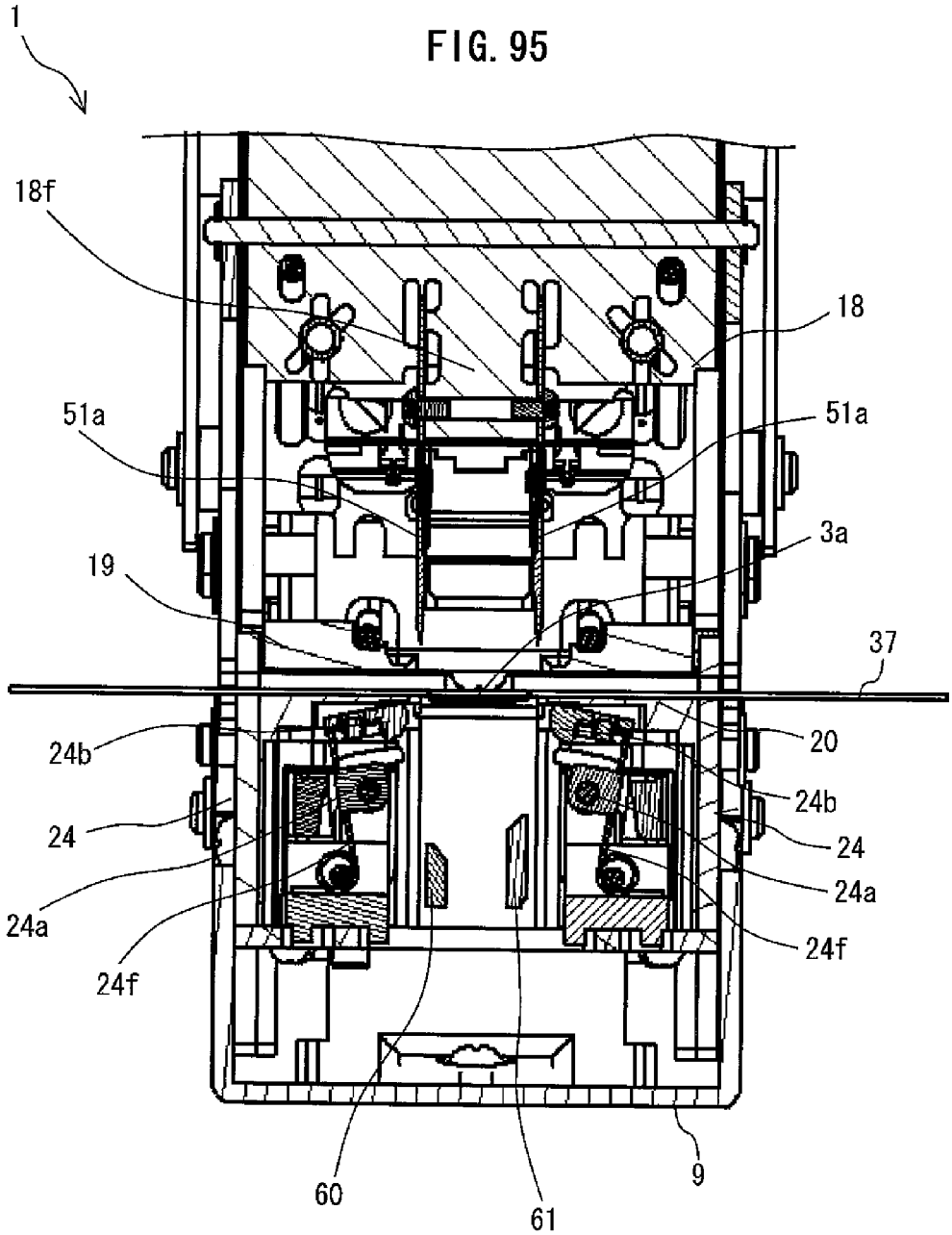
Figure 96A:
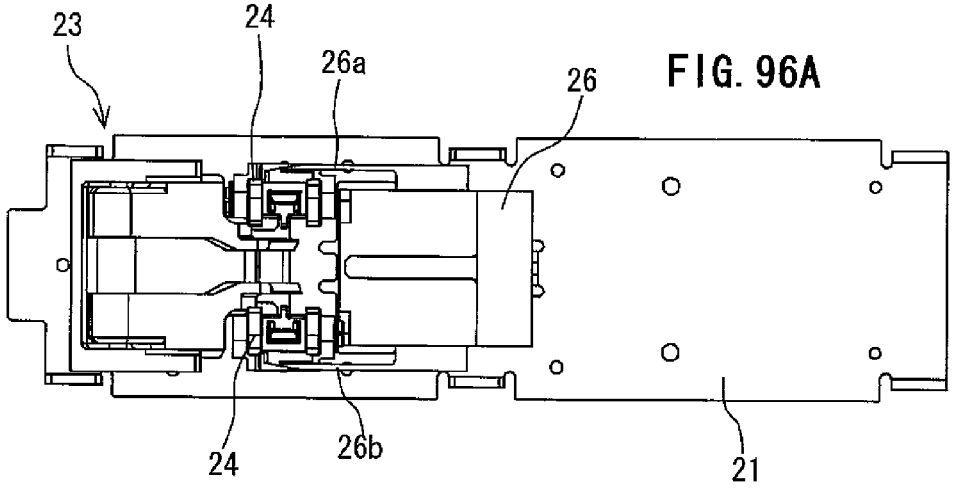
Figure 96B:
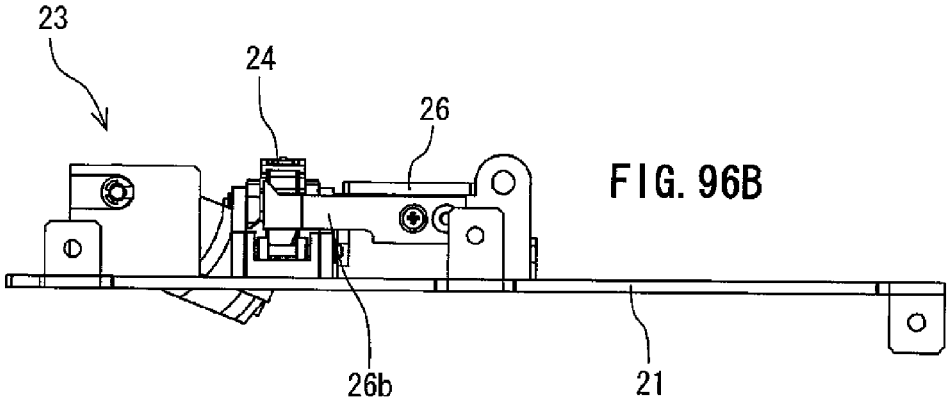
Figure 97A:
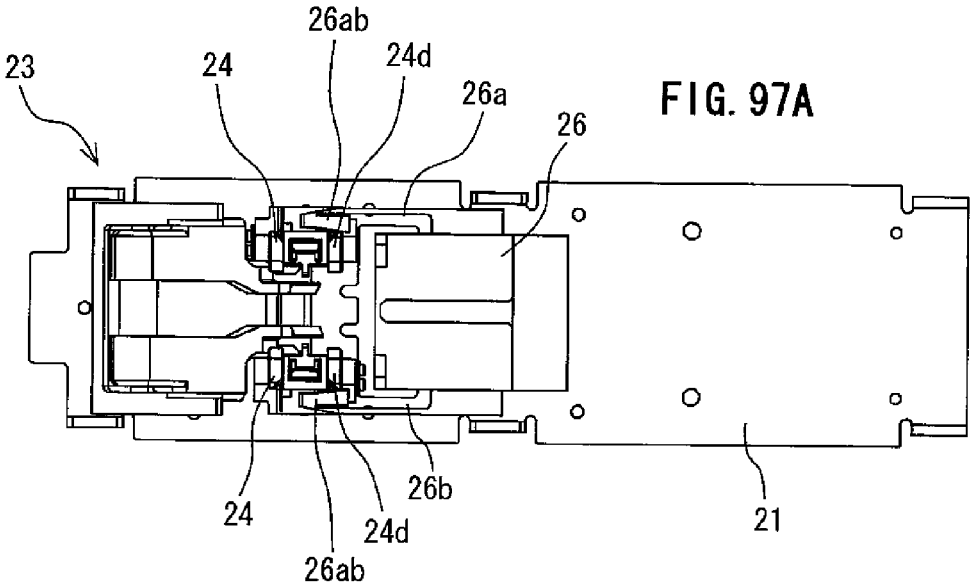
Figure 97B:
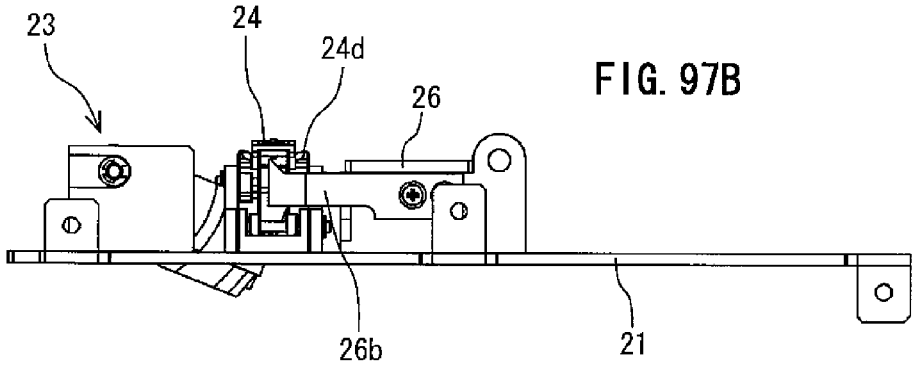
Figure 98A:
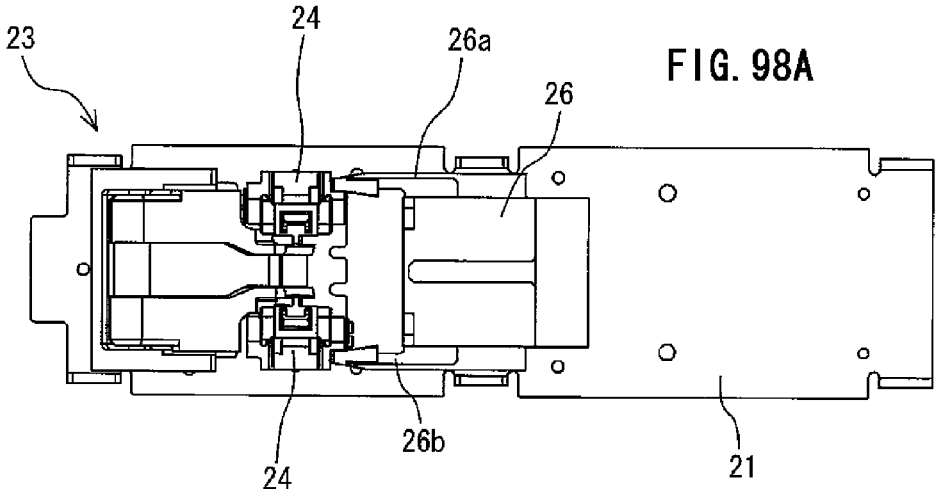
Figure 98B:
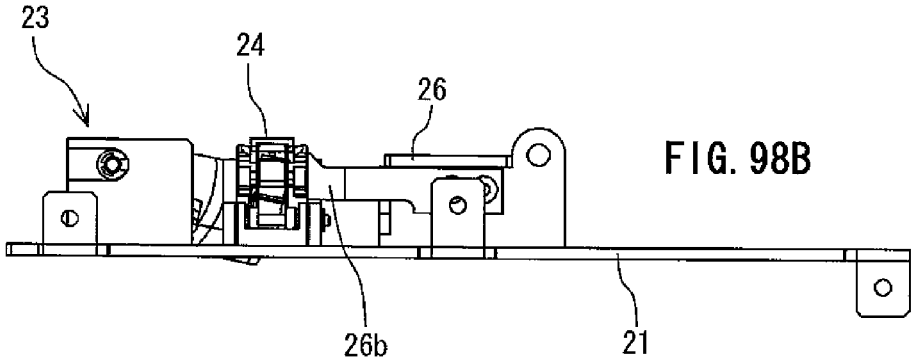

FIG. 90 is a cross-sectional view of the stapler showing a state in which return of the forming plate starts;

FIG. 91 is a cross-sectional view of the stapler showing a state in which both the leg portions are retained by the spread-retainers;

FIG. 92 is a cross-sectional view of the stapler showing a state in which return of the forming plate is completed;

FIG. 93 is a cross-sectional view of the stapler showing a state in which the pusher starts movement frontward;

FIG. 94 is a cross-sectional view of the stapler showing a state in which return of the paper-sheet pusher starts;

FIG. 95 is a cross-sectional view of the stapler showing a state just before return of the pusher;

FIG. 96A is an explanatory diagram showing a staple bending unit in a stand-by state thereof;

FIG. 96B is an explanatory diagram showing the staple bending unit in the stand-by state;

FIG. 97A is an explanatory diagram showing the staple bending unit in a state in which rotation of a cam starts;

FIG. 97B is an explanatory diagram showing the staple bending unit in a state in which rotation of the cam starts;

FIG. 98A is an explanatory diagram showing the staple bending unit in a state in which penetration of a staple is completed and a slider is disengaged from a slider holder; and FIG. 98B is an explanatory diagram showing the staple bending unit in a state in which penetration of the staple is completed and the slider is disengaged from the slider holder.

BEST MODE FOR CARRYING OUT THE INVENTION

Hereinafter, it will be explained with respect to exemplified embodiments of a stapler of the present invention with reference to the drawings. First, it will be explained with respect to constitutions of a stapler 1 of the present invention and a staple 3 used in the stapler 1.

<Configurations of Stapler and Staple>

(1) Outline of Stapler 1

Figure 1:
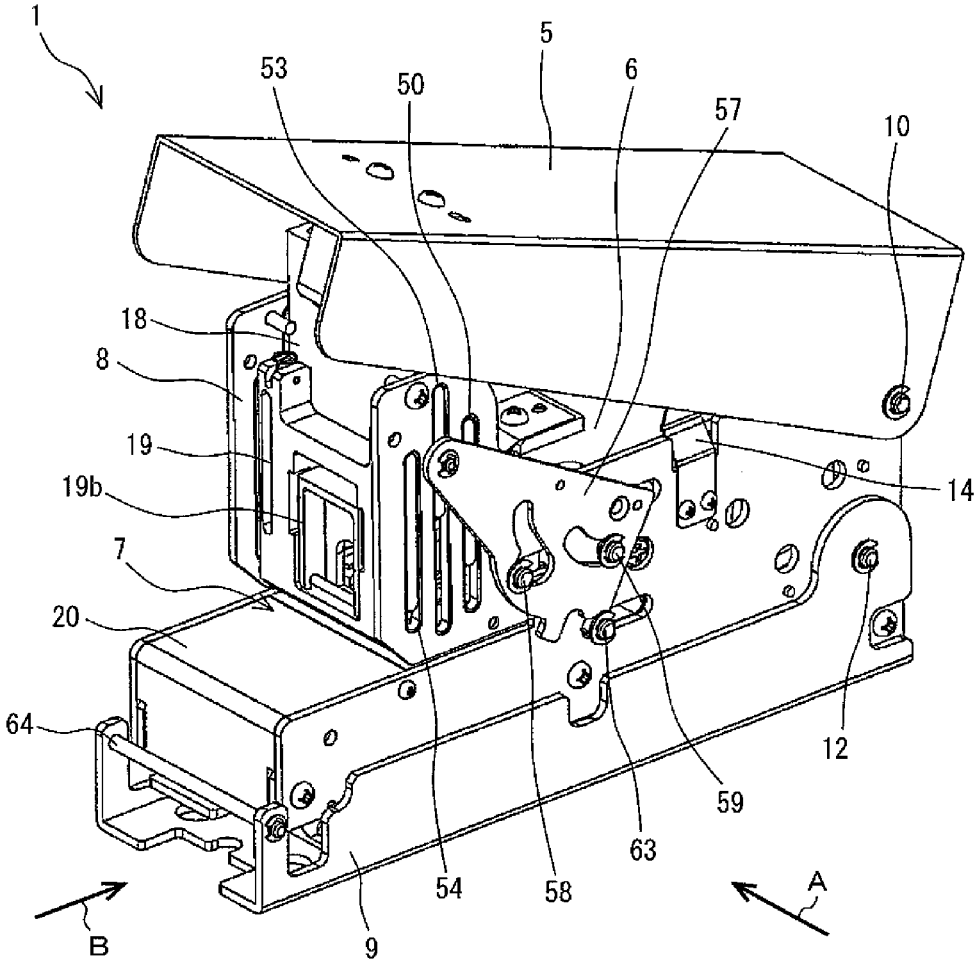
FIG. 1 is an explanatory diagram showing a constitution example of a stapler of the present invention.
Figure 2:
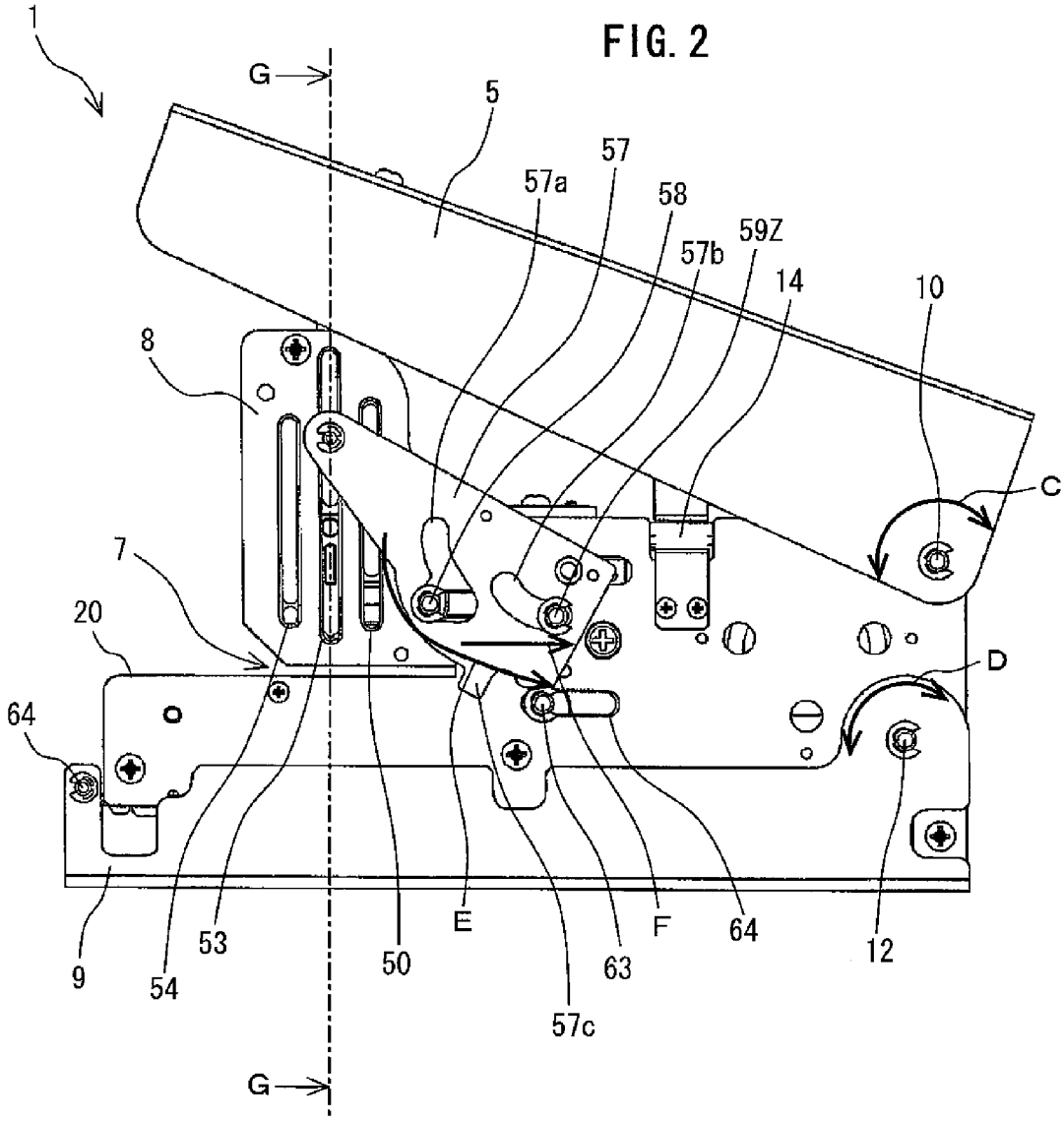
FIG. 2 is an explanatory diagram showing a constitution example of the stapler of the present invention.
Figure 3:
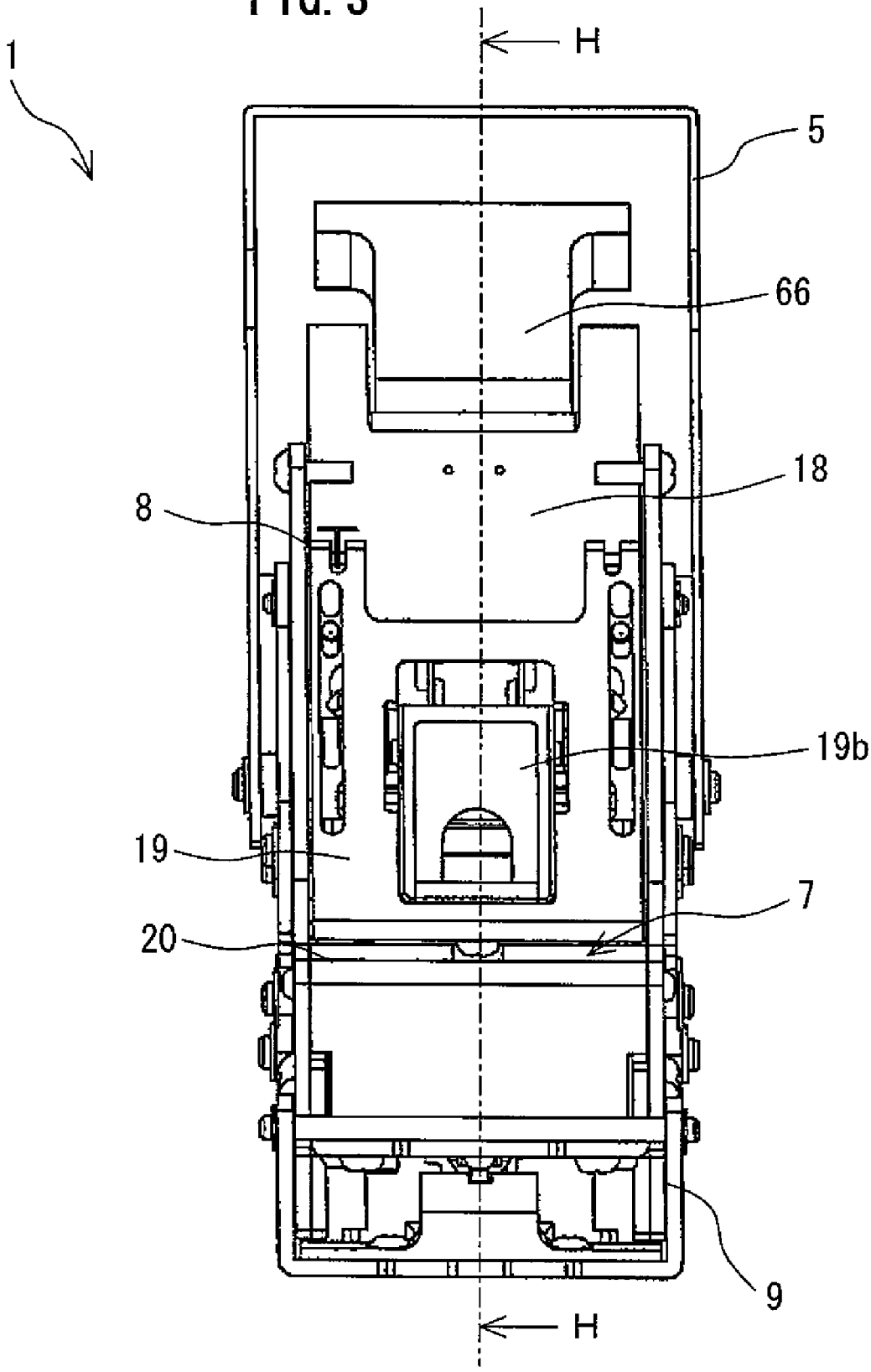
FIG. 3 is an explanatory diagram showing a constitution example of the stapler of the present invention.

The stapler 1 is one which binds binding sheets as a binding object by using a paper-made staple 3 mentioned later. FIG. 1 to FIG. 3 are explanatory diagrams showing an outline of the stapler 1. FIG. 1 is a perspective view showing the stapler 1, FIG. 2 is a side view showing a state seen from an arrow A in FIG. 1, and FIG. 3 is a front view showing a state seen from an arrow B in FIG. 1. In the following explanation, the left direction of FIG. 2 is made to be the front surface side of the stapler 1 and the right direction of FIG. 2 is made to be the rear surface side of the stapler 1. Also, the left direction of FIG. 3 is made to be the left side of the stapler 1 and the right direction of FIG. 3 is made to be the right side of the stapler 1.

Figure 4:
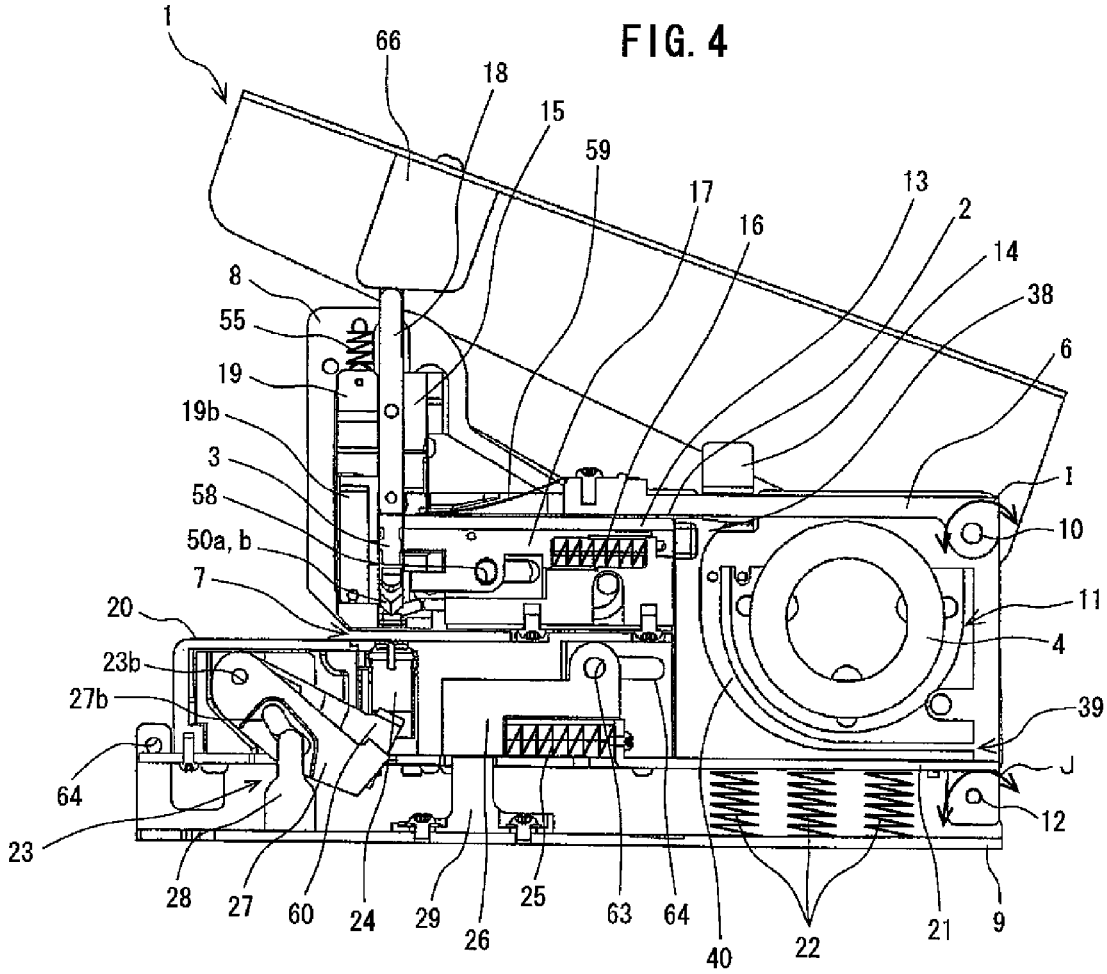
FIG. 4 is an explanatory diagram showing a constitution example of the stapler of the present invention.
Figure 5:
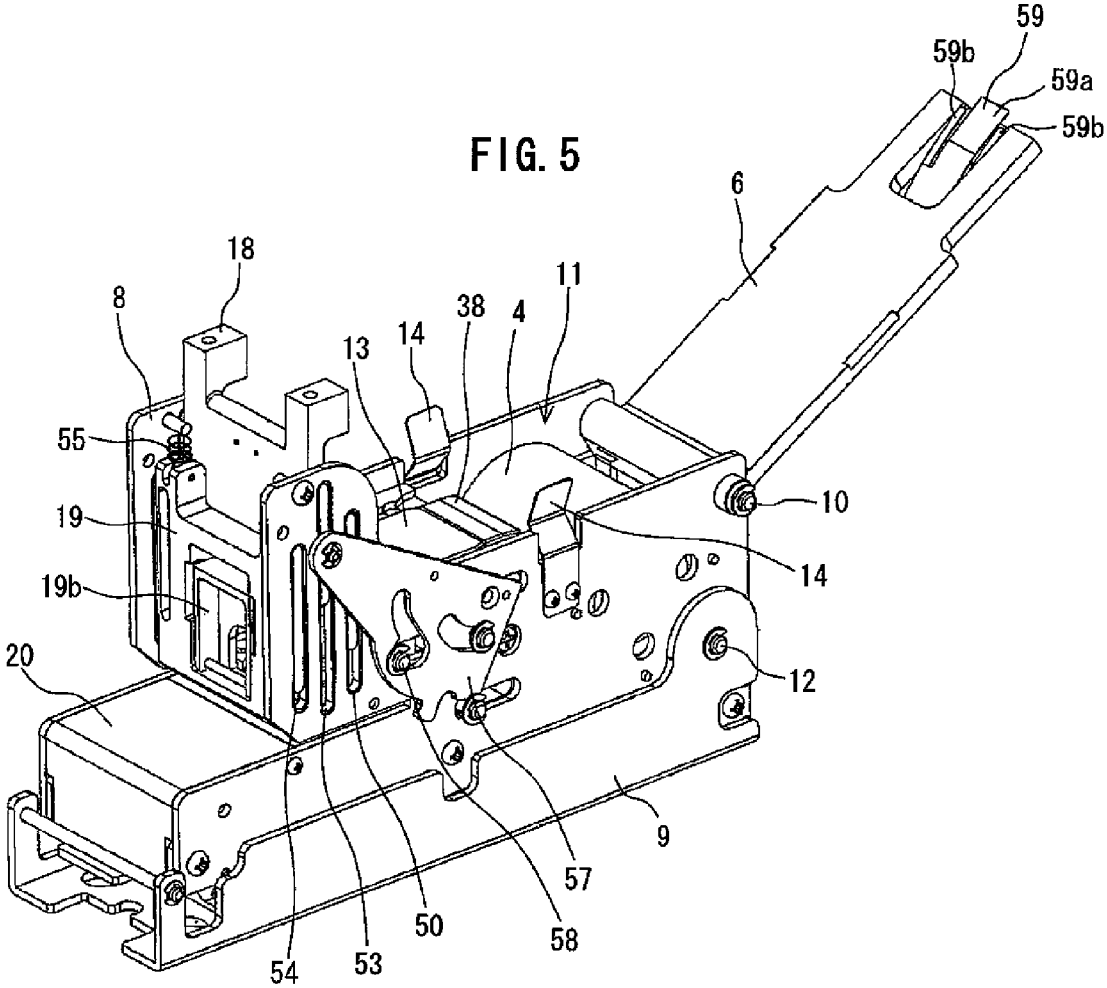
FIG. 5 is an explanatory diagram showing a constitution example of the stapler of the present invention.
Figure 6:
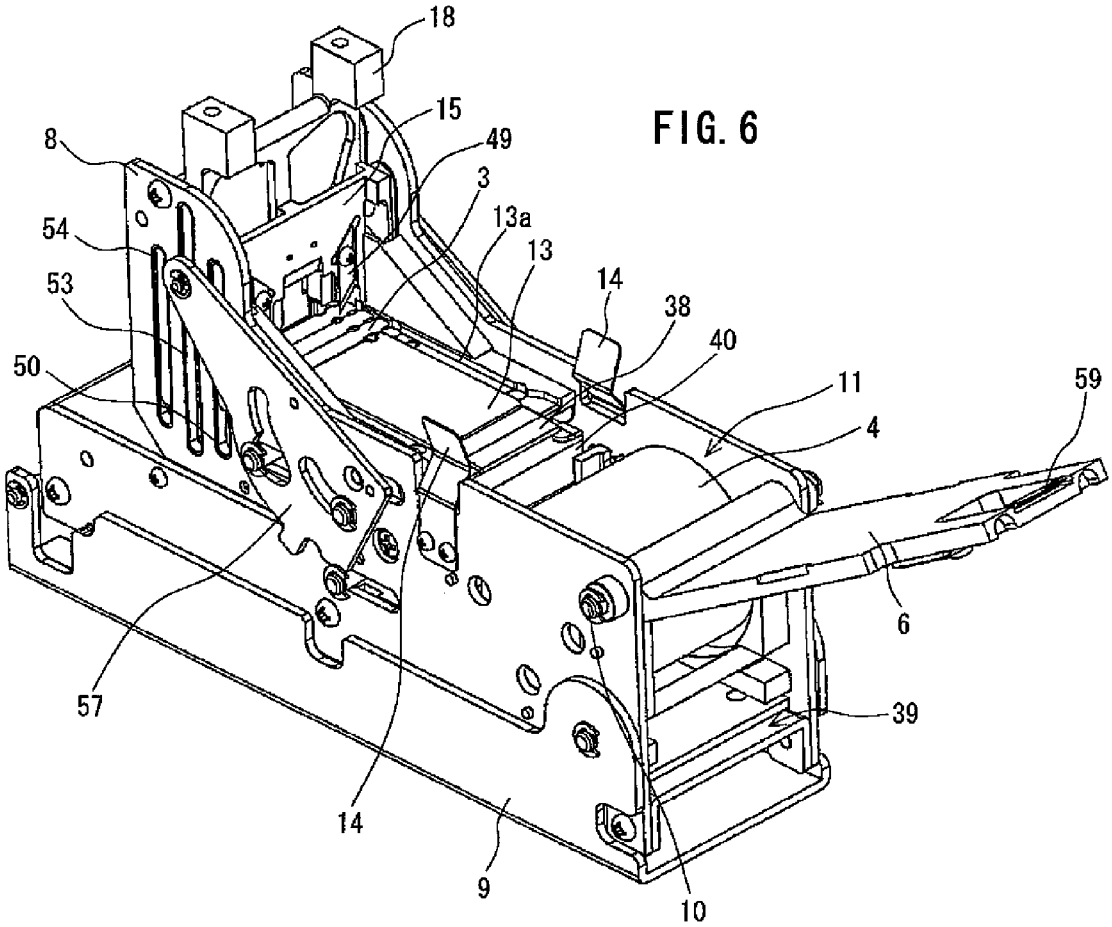
FIG. 6 is an explanatory diagram showing a constitution example of the stapler of the present invention.
Figure 7:
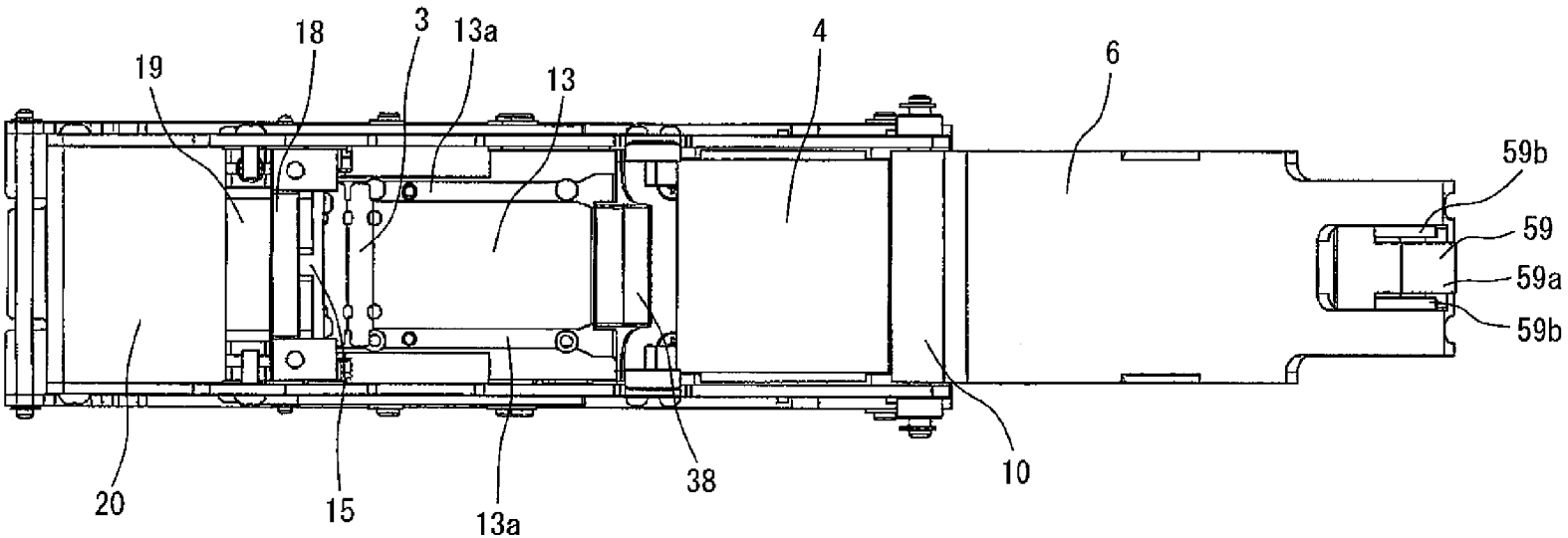
FIG. 7 is an explanatory diagram showing a constitution example of the stapler of the present invention.

FIG. 4 to FIG. 7 are explanatory diagrams showing constitutions in the inside of the stapler 1. FIG. 4 is a cross-sectional view showing an H-H cross-section of FIG. 3. FIG. 5 and FIG. 6 are perspective views showing a state in which a handle 5 is detached and a staple cover 6 mentioned later is opened. FIG. 5 is a perspective view showing a state seen obliquely from the front, and FIG. 6 is a perspective view showing a state seen obliquely from the back-side. FIG. 7 is a plan view showing a state in which the handle 5 is detached and the staple cover 6 mentioned later is opened.

As shown in FIG. 1 to FIG. 3, the stapler 1 is constituted by including the handle 5 pushed down by a user when executing a binding operation, a frame 8 which is positioned downward the handle 5 and includes a paper-sheet insertion port 7 into which binding sheets are inserted or the like, and a base 9 supporting the handle 5 and the frame 8.

As shown by an arrow C in FIG. 2 and by an arrow I in FIG. 4, the handle 5 is mounted on a handle & staple cover rotating shaft 10 rotatably at the upper portion of the rear end of the frame 8. The handle 5 rotates with respect to the frame 8 in a counterclockwise direction of FIG. 2 and FIG. 4 caused by being pushed down by a user when executing a binding operation. Also, when executing the loading of a roll shaped staple 4 to a staple holder 11 of the frame 8, which is mentioned later, or the like, the handle 5 is rotated in clockwise direction of FIG. 2 and FIG. 4 and becomes in a state in which the top surface of the frame 8 is opened.

As shown by an arrow D in FIG. 2 and by an arrow J in FIG. 4, the frame 8 is mounted on a frame rotating shaft 12 rotatably at the rear end of the base 9. Also, as shown in FIG. 4 to FIG. 7, the frame 8 is provided with the staple cover 6 which is mounted rotatably similarly as the handle 5 on the handle & staple cover rotating shaft 10 on the top surface as a staple pusher unit.

Also, the frame 8 is provided with the staple holder 11 as a staple loading unit which loads the roll shaped staple 4 to a rear edge portion thereof. Further, the frame 8 is provided with an approximately plane-surface shaped feeding path 13 as a staple feeding unit which executes the feeding of the staple 3 from the staple holder 11 toward the front. On the right and left sides of the feeding path 13, plate springs 14 are provided and owing to these plate springs 14, the staple cover 6 becomes in a state of being held down with respect to the feeding path 13 as shown in FIG. 4.

Also, the frame 8 is provided, in the vicinity of the front edge portion of the feeding path 13, with a forming plate 15 as a staple cutoff shaping unit for cutting off the staple 3 and for shaping into a shape in which both the edges thereof are bent to one direction depending on the operation of the handle 5. The forming plate 15 is one example of the cutoff shaping means, the cutoff means and the shaping means. Further, the frame 8 is provided with a driver 18 as a staple penetration unit for executing penetration of the staple 3 with respect to the binding sheets depending on the operation of the handle 5. The driver 18 is one example of the penetration means. Further, the frame 8 is provided with a paper-sheet pusher 19 for holding down the binding sheets when executing the cutoff, the shaping and the penetration of the staple 3. The paper-sheet pusher 19 is one example of the pusher means.

Also, the frame 8 is provided, at a lower portion of the feeding path 13, with a pusher spring 16 and a pusher 17 biased forward by the pusher spring 16 as a movement mechanism for moving the staple 3 from the position at which the cutoff and the shaping of the staple 3 are executed to the position at which the penetration of the staple 3 is executed as mentioned above. There is provided, on the downward side of the forming plate 15, the driver 18, the paper-sheet pusher 19 and the pusher 17, with the paper-sheet insertion port 7 into which the binding sheets of the binding object are inserted and a table 20 on which the binding sheets 37 are placed.

At the lower portion of the table 20, there are provided with a bending unit for bending both the leg portions of the staple 3 penetrated through the binding sheets at the penetrate position along the binding sheets and for mutually bonding both the bent leg portions. The stapler 1 is provided, as the bending unit, with a clincher unit 23 mounted on a bending unit installation table 21 which becomes a bottom portion of the frame 8, a pushing-out unit 24 and a slider 26 biased forward by a slider spring 25.

Also, the stapler 1 is provided, as the bending unit, with a clincher lifter 28 for supporting a clincher center 27 and for fixing the position thereof on the base 9. The bending unit is one example of the bending means. Further, the stapler 1 is provided with a slider holder 29 for supporting the slider and a return spring 22 for supporting the bending unit installation table 21.

The stapler 1 is one which is provided with such a constitution and executes an operation for binding the binding sheets placed on the table 20 in the paper-sheet insertion port 7 by means of the staple 3 based on the operation of the handle 5 by a user.

Next, it will be explained with respect to details of the configurations of respective portions of the stapler 1 and details of the configuration of the staple 3. First, it will be explained with respect to the constitutions of the staple 3 used for binding the binding sheets by the stapler 1 and of the interlinked staples 2 in which the staples 3 are interlinked.

(2) Configuration of Staple 3

Figure 8A:
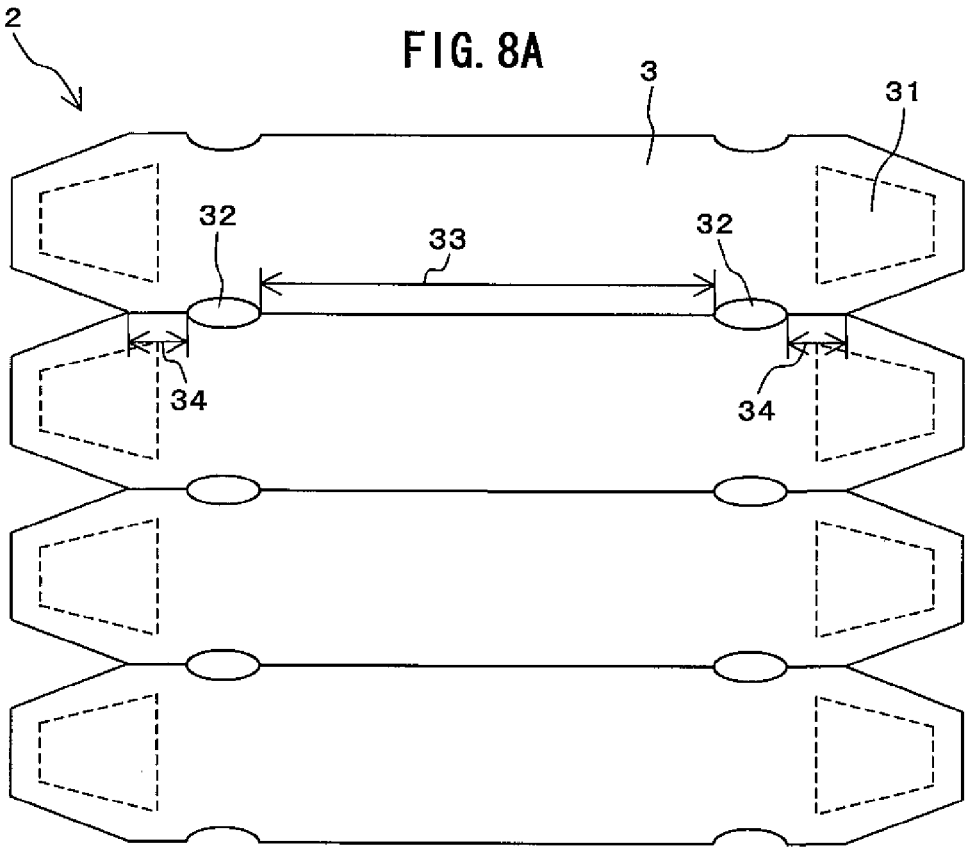
FIG. 8A is an explanatory diagram showing a constitution example of staples used in the stapler of the present invention.
Figure 8B:
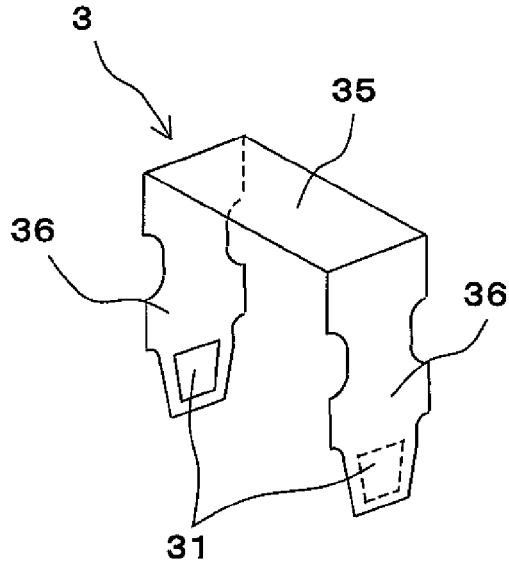
FIG. 8B is an explanatory diagram showing a constitution example of a staple used in the stapler of the present invention.
Figure 8C:
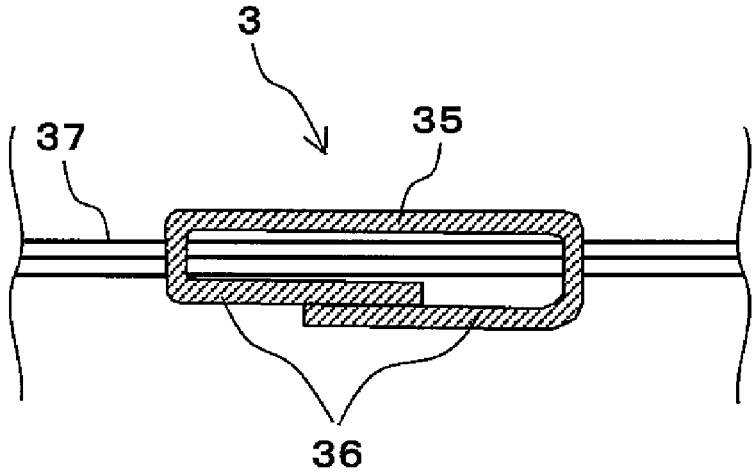
FIG. 8C is an explanatory diagram showing a constitution example of a staple used in the stapler of the present invention.
Figure 9A:
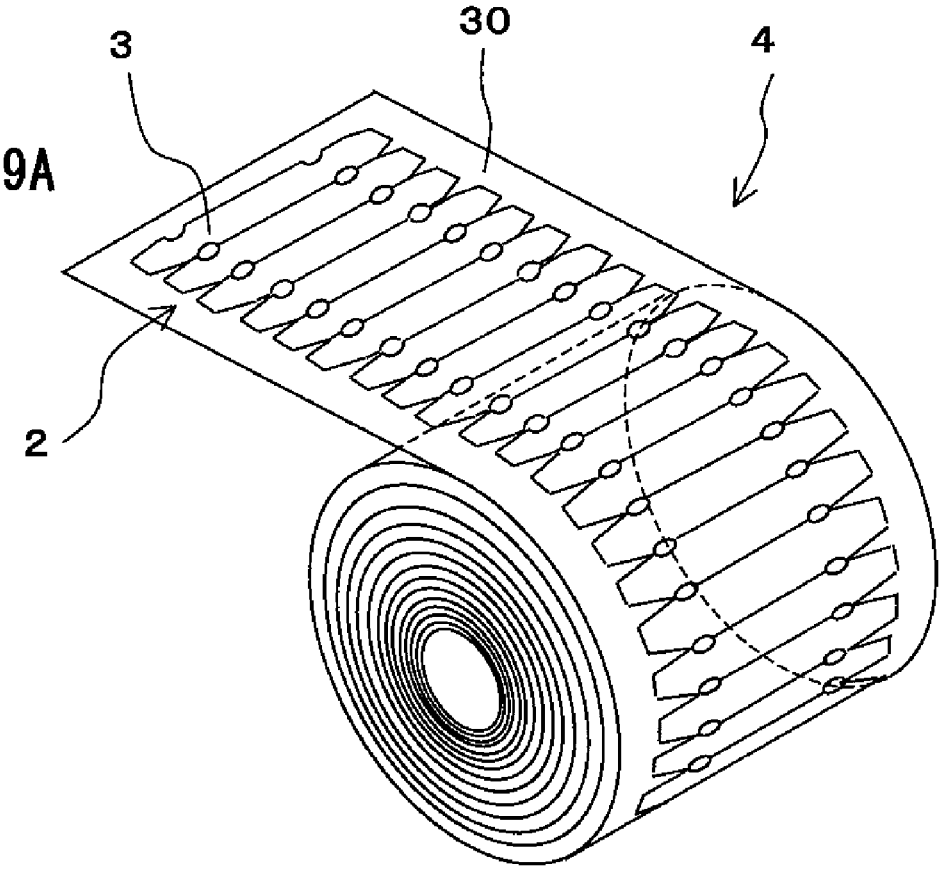
FIG. 9A is an explanatory diagram showing a constitution example of staples used in the stapler of the present invention.
Figure 9B:
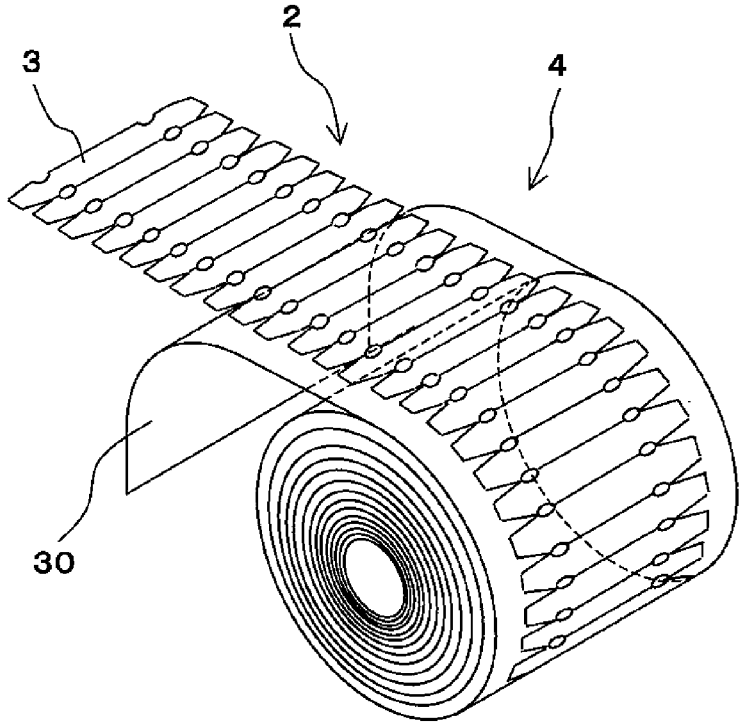
FIG. 9B is an explanatory diagram showing a constitution example of the staples used in the stapler of the present invention.

FIG. 8A, FIG. 8B, FIG. 8C, FIG. 9A and FIG. 9B are explanatory diagrams showing constitutions with respect to a staple 3 and with respect to interlinked staples 2 in which a plurality of the staples 3 are interlinked in parallel. FIG. 8A is a plan view showing details of the interlinked staples 2. FIG. 8B is a perspective view of the staple 3 showing a state shaped into a shape in which both the edges thereof are bent to one direction, and FIG. 8C is a cross-sectional view showing a state of binding the binding sheets 37 by the staple 3. FIG. 9A and FIG. 9B are explanatory diagrams showing states in which the interlinked staples 2 are attached to a release coated paper 30 and are wound in a roll shape as a roll shaped staple 4. The staple 3, the interlinked staples 2 and the roll shaped staple 4 have, for example, such constitutions as follows.

As shown in FIG. 8A, a plurality of the staples 3, each of which has an elongated and approximately straight lined shape, are interlinked in parallel, so that the interlinked staples 2 are constituted. Each of the staples 3 has, for example, the width in the up and down direction (interlinking direction of staples 3) in FIG. 8A of around 5 mm to 10 mm, and the width in the right and left direction (longitudinal direction of staple 3) in FIG. 8A of around 30 mm to 40 mm. The vicinities of the edge portions in the longitudinal direction of each of the staples 3 are formed in trapezoidal shapes and tapered toward the tips thereof. Also, each of the staples 3 is provided with adhesion portions 31 coated with adhesive agent on the rear surface (surfaces attached with the release coated paper 30) at the vicinities of the edge portions in the longitudinal direction thereof.

Also, elliptical feeding holes 32 are formed at predetermined positions from both the edge portions of the side by which the staple 3 is interlinked. A portion between two feeding holes 32 is made as a slit portion 33 and the staples 3 are cut off perfectly. Portions on the outside of the two feeding holes 32 until both the edge portions of the side by which the staples 3 are interlinked become in a state in which, as staple interlinking portions 34, the respective staples 3 are interlinked. It should be noted that the feeding holes 32 may be provided to have perfect circular shapes or long-hole shapes if feeding claws 44 mentioned later can be engaged therewith.

Also, the staple 3 at the edge portion is cut off from the interlinked staples 2 shown in FIG. 8A by the stapler 1 and as shown in FIG. 8B, it is shaped into a shape in which a crown portion 35 and leg portions 36 bent approximately perpendicularly from the right and left sides of the crown portion 35 are formed and both the edges thereof are bent to one direction. With respect to the staple 3 shaped into a shape in which both the edges are bent to one direction, as shown in FIG. 8C, both the leg portions 36 penetrating the binding sheets 37 are bent along the binding sheets 37, so that the binding sheets 37 and the adhesion portion 31 of one of the leg portion 36 are bonded and adhesion portion 31 of one of the leg portion 36 and the other leg portion 36 are bonded, respectively.

With respect to the staple 3 shown in FIG. 8A, FIG. 8B and FIG. 8C, a configuration is employed in which adhesion portions 31 are provided on the rear surface thereof at the vicinities of both the edge portions in the longitudinal direction. However, an adhesion portion 31 may be provided on the rear surface only at the vicinity of one leg portion. In this case, the leg portion 36 without the adhesion portion 31 is bent along the binding sheets 37 and thereafter, the leg portion 36 with the adhesion portion 31 is bent along the binding sheets 37, and the leg portion 36 without the adhesion portion 31 and the leg portion 36 with the adhesion portion 31 are bonded mutually.

Also, as shown in FIG. 9A, the interlinked staples 2 are attached on the release coated paper 30 and are wound therewith, in their stand-by state. As shown in FIG. 9B, a predetermined length of release coated paper 30 from the leading portion is peeled and they are loaded on the stapler 1. It will be mentioned later with respect to the detailed loading method onto the stapler 1.

(3) Constitution Example of Staple Loading Unit

Figure 10:
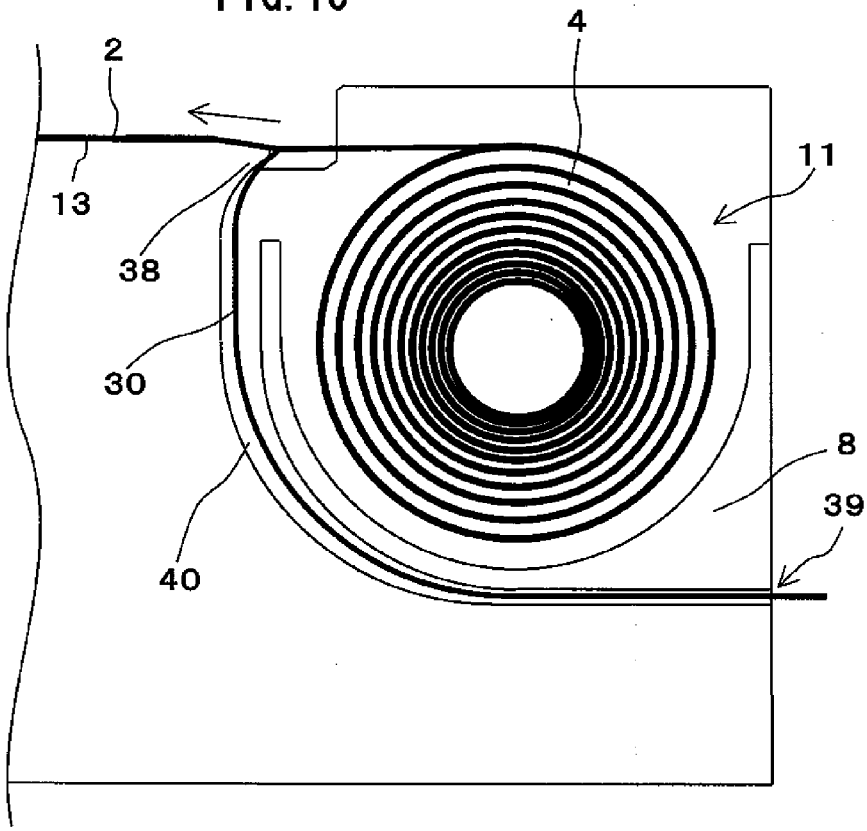
FIG. 10 is an explanatory diagram showing a constitution example of a staple loading unit.

Next, it will be explained with respect to a constitution example of a staple loading unit of the stapler 1. FIG. 10 is an explanatory diagram showing a state in which the roll shaped staple 4 is loaded on the staple loading unit. As a staple loading unit for loading the roll shaped staple 4, the stapler 1 is provided with the staple holder 11 at the rear edge portion of the frame 8. As mentioned above and as shown in FIG. 5 to FIG. 7, it becomes possible by opening the handle 5 and the staple cover 6 to make an access to the staple holder 11 which is a staple loading unit.

Also, as shown in FIG. 4, FIG. 10 and the like, the feeding path 13 for executing the feed of the interlinked staples 2 peeled from the release coated paper 30 is provided at the upper portion of the frame 8 from the staple holder 11 toward the front which is provided with the staple cutoff shaping unit or the like. At the starting edge of this feeding path 13, there is included a protrusion-shaped peeling block 38 formed in response to the shape of the release coated paper 30. The peeling block 38 is one example of the peeling means. Also, there is provided with a release coated paper discharge path 40 from the downward portion of this peeling block 38 to a release coated paper outlet 39 provided on the rear end surface of the frame 8 by way of the downward portion of the roll shaped staple 4 placed in the staple holder 11.

By including such a constitution, the staple loading unit is loaded with the roll shaped staple 4 and the interlinked staples 2 as follows. As shown in FIG. 10, the release coated paper 30 is peeled by the peeling block 38 from the interlinked staples 2 with the release coated paper 30 which are pulled out from the roll shaped staple 4 loaded in the staple holder 11. The interlinked staples 2 from which the release coated paper 30 is peeled are fed in the feeding path 13 and the peeled release coated paper 30 is discharged from the release coated paper outlet by way of the release coated paper discharge path 40.

(4) Constitution Example of Staple Feed—Cutoff Shaping—Penetration Unit—Pusher Unit Next, it will be explained with respect to a constitution example of a staple feeding unit for executing the feed of the interlinked staples 2 from which the release coated paper 30 is peeled, a staple cutoff shaping unit for executing the cutoff of the staple 3 positioned at the edge portion of the fed interlinked staples 2 therefrom and the shaping thereof, and a staple penetration unit for executing the penetration of the shaped staple 3 with respect to the binding sheets.

Figure 11A:
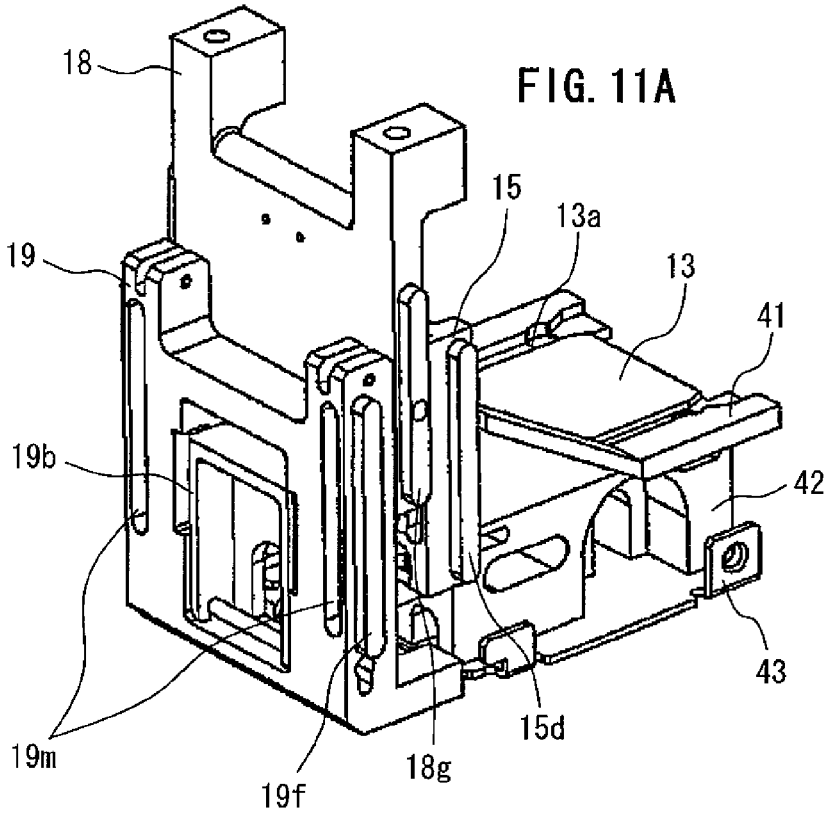
FIG. 11A is an explanatory diagram showing a constitution example of a staple feeding unit—cutoff shaping unit—penetration unit.
Figure 11B:
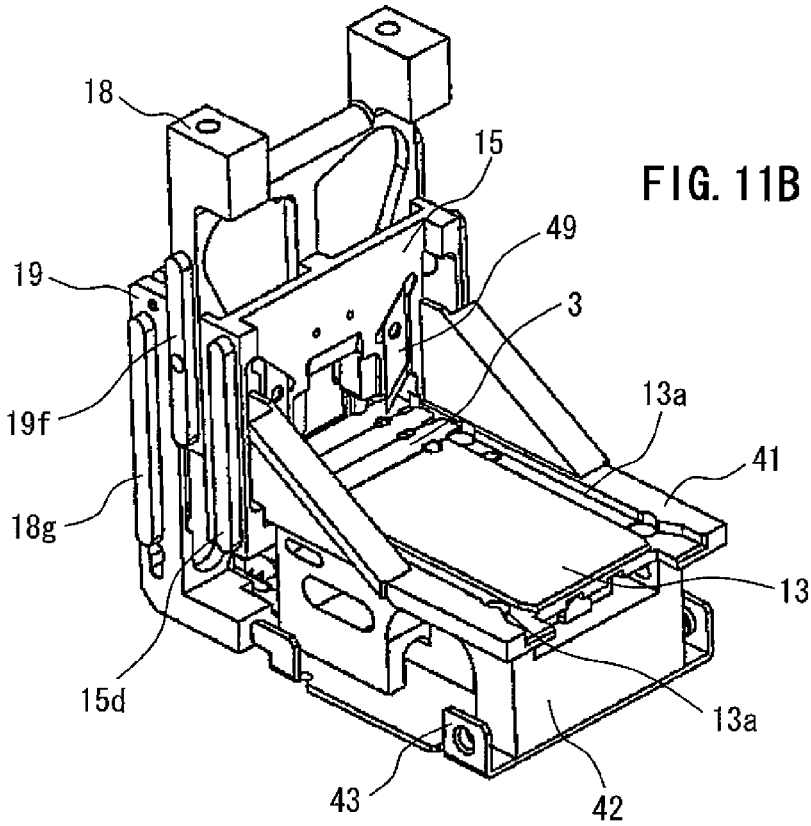
FIG. 11B is an explanatory diagram showing a constitution example of the staple feeding unit—cutoff shaping unit—penetration unit.
Figure 12A:
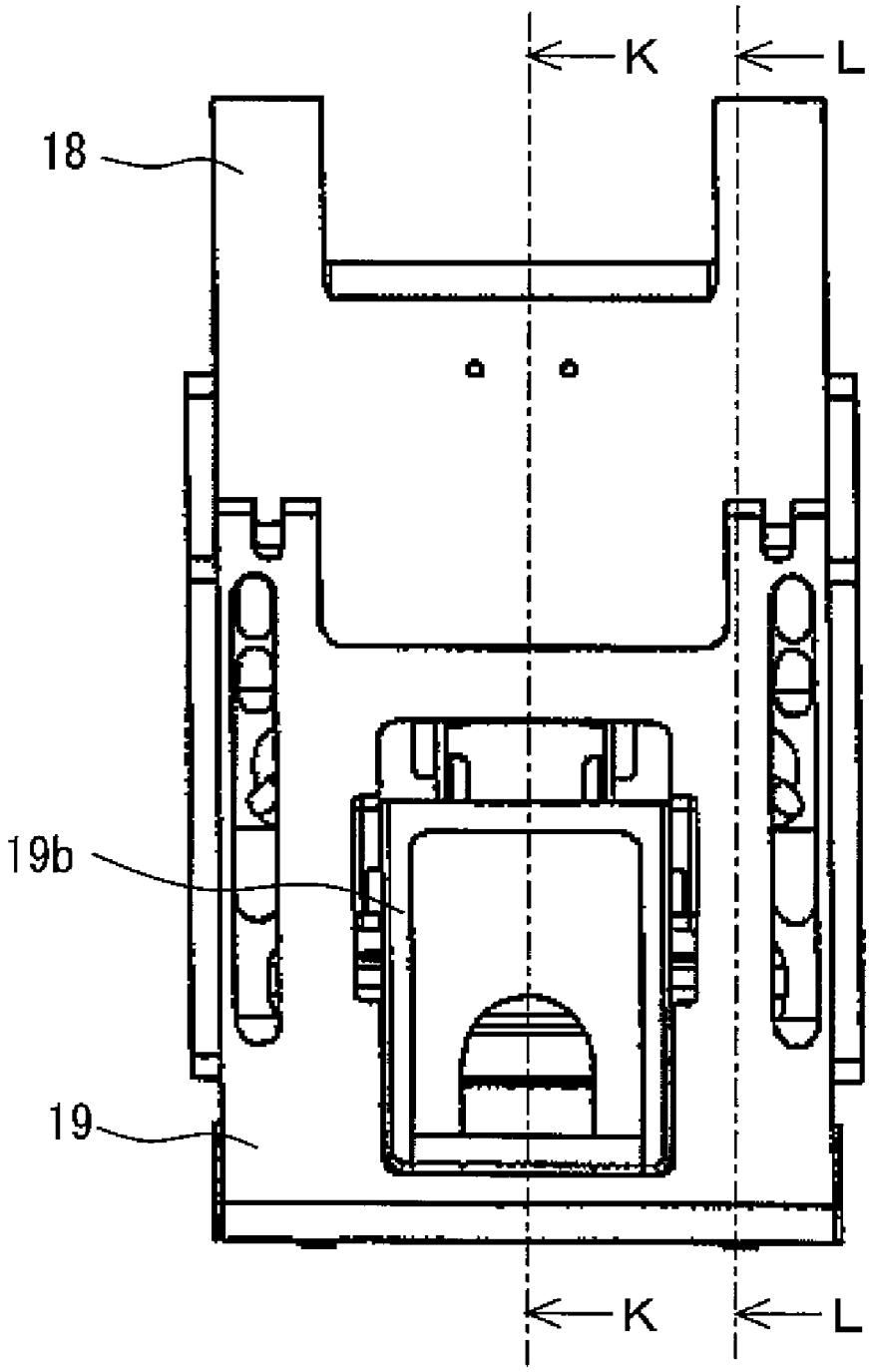
FIG. 12A is an explanatory diagram showing a constitution example of the staple feeding unit—cutoff shaping unit—penetration unit.
Figure 12B:
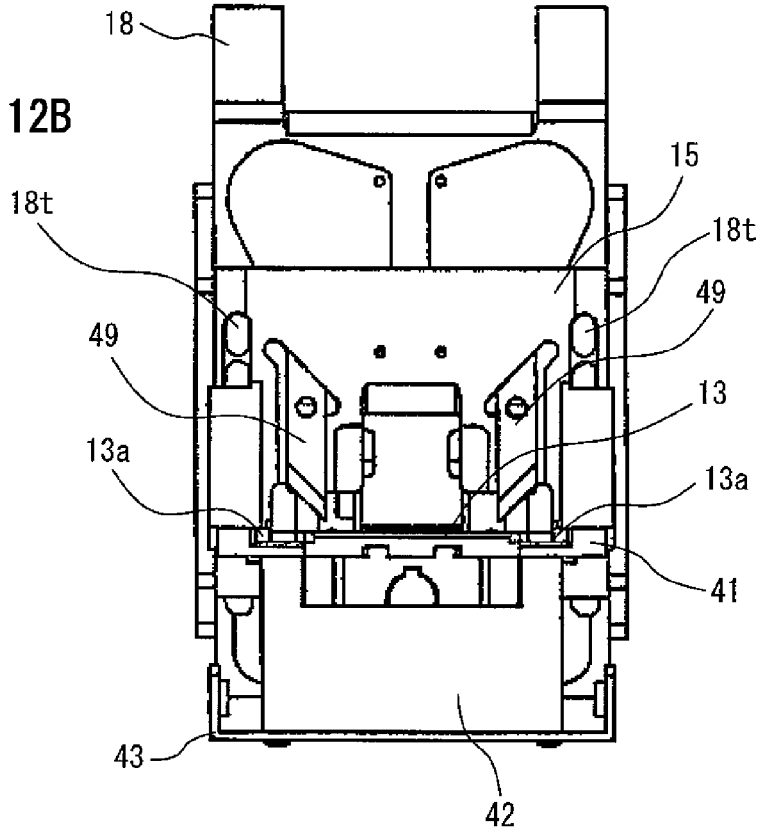
FIG. 12B is an explanatory diagram showing a constitution example of the staple feeding unit—cutoff shaping unit—penetration unit.
Figure 13A:
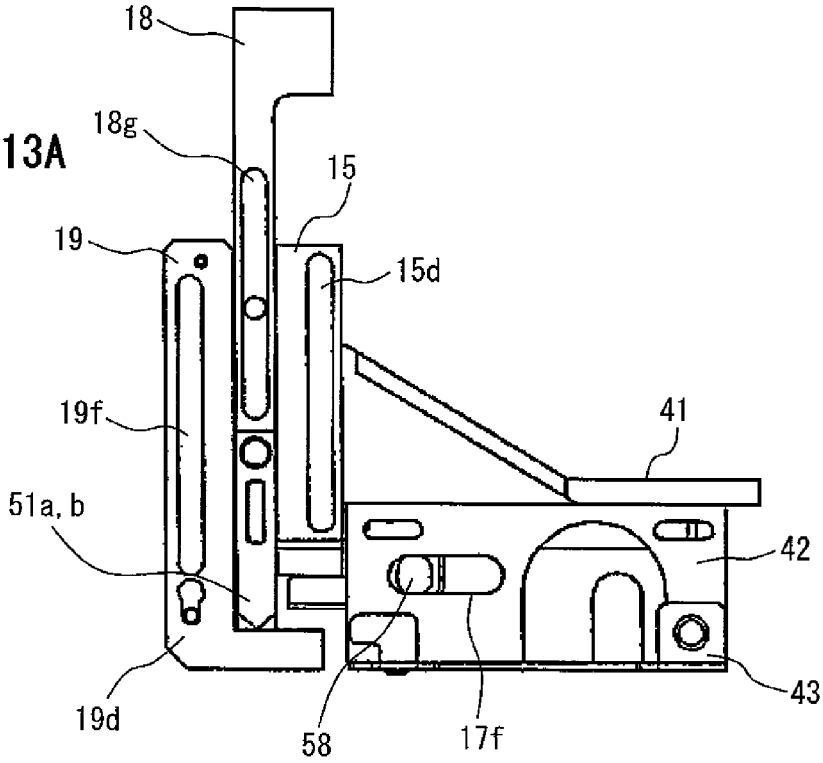
FIG. 13A is an explanatory diagram showing a constitution example of the staple feeding unit—cutoff shaping unit—penetration unit.
Figure 13B:
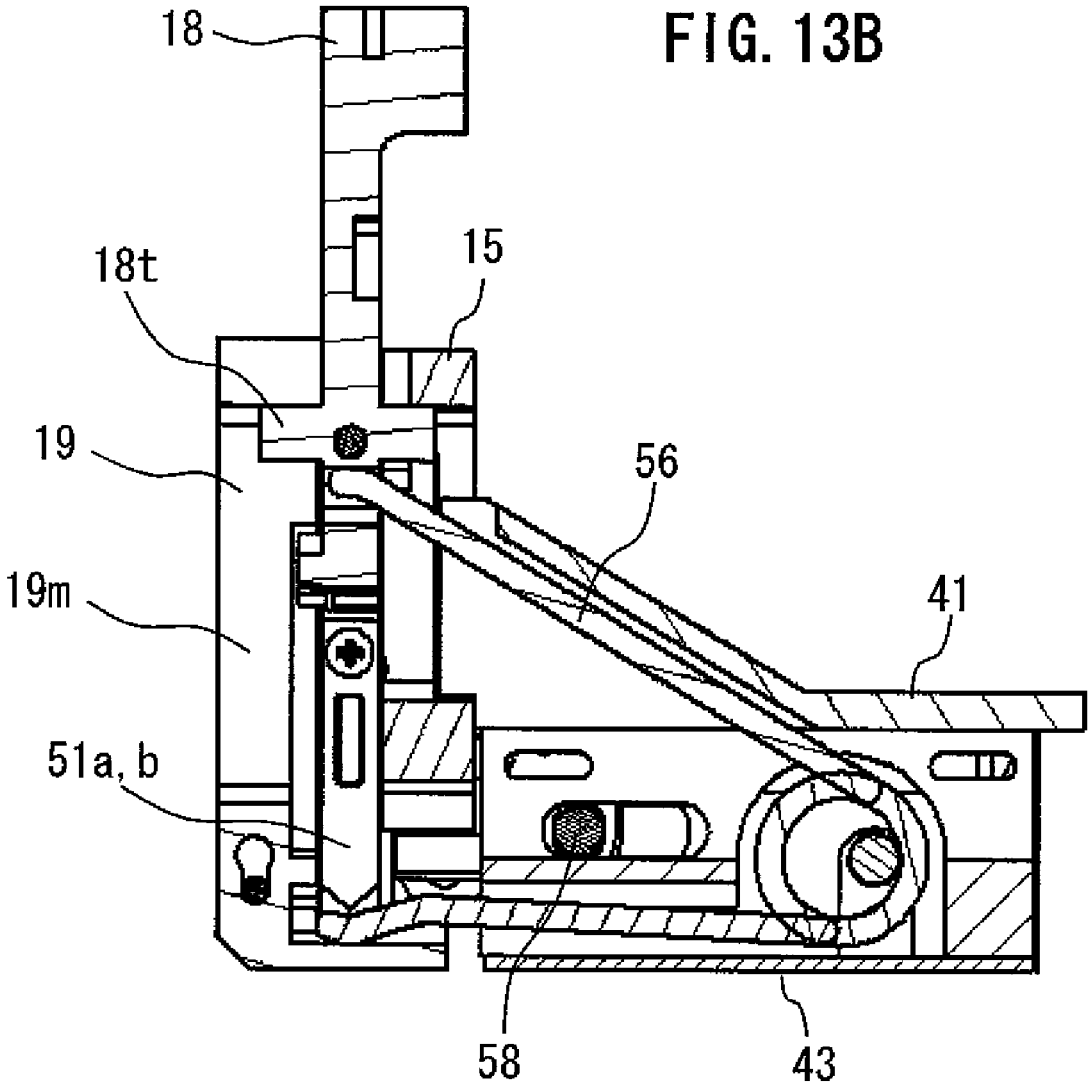
FIG. 13B is an explanatory diagram showing a constitution example of the staple feeding unit—cutoff shaping unit—penetration unit.
Figure 14:
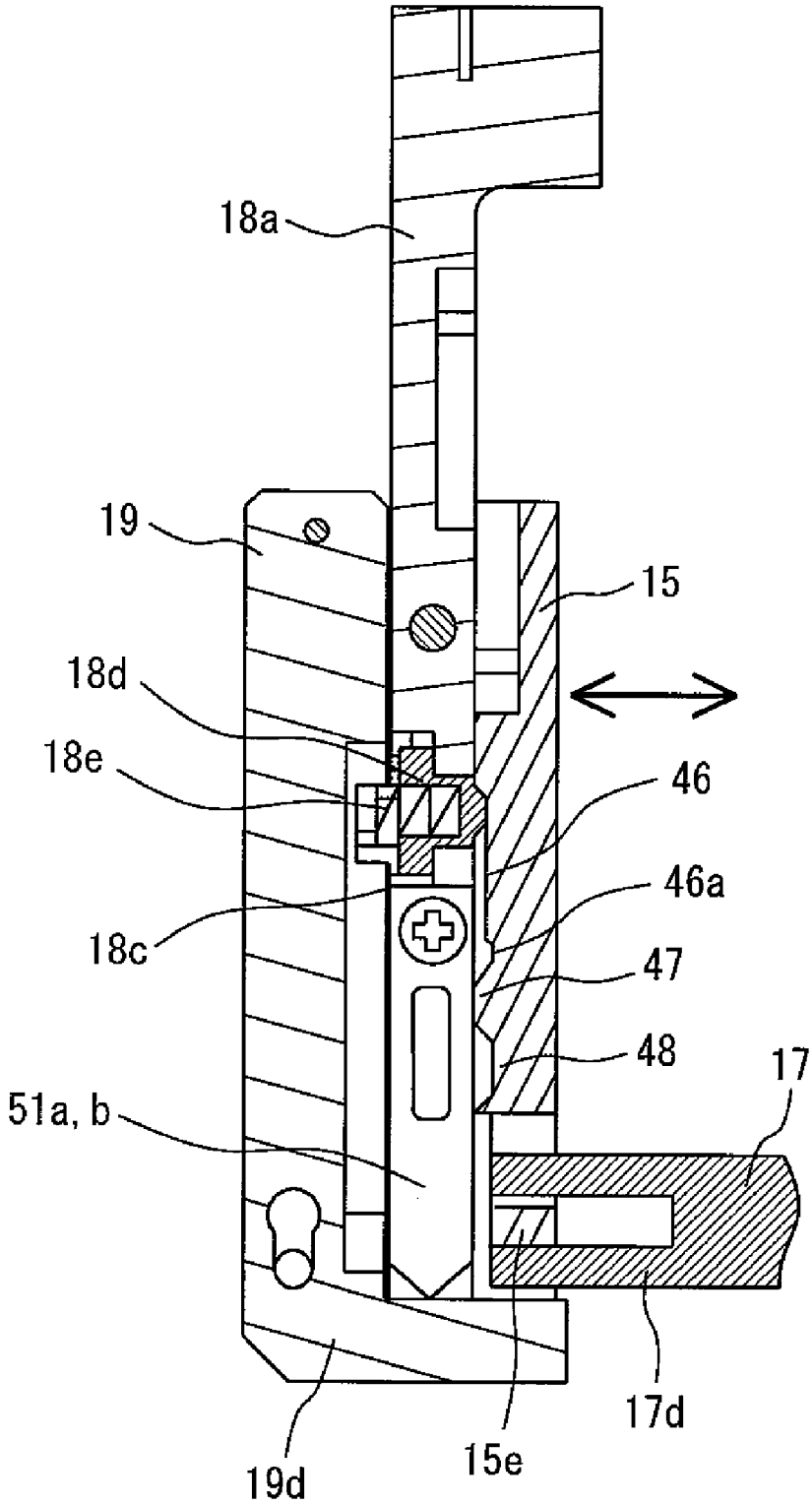
FIG. 14 is a cross-sectional view of a main portion of the staple feeding unit—cutoff shaping unit—penetration unit.

FIG. 11A, FIG. 11B, FIG. 12A, FIG. 12B, FIG. 13A and FIG. 13B are explanatory diagrams showing the staple feeding unit, the staple cutoff shaping unit and the staple penetration unit. FIG. 11A is a perspective view of the staple feeding unit—cutoff shaping unit—penetration unit showing a state seeing obliquely from the front. FIG. 11B is a perspective view of the staple feeding unit—cutoff shaping unit—penetration unit showing a state seeing obliquely from the backside and for the sake of explanation, there is shown a state in which the staple 3 is placed at a portion of the feeding path 13. FIG. 12A is a front view of the staple feeding unit—cutoff shaping unit—penetration unit, and FIG. 12B is a rear view of the staple feeding unit—cutoff shaping unit—penetration unit. FIG. 13A is a side view of the staple feeding unit—cutoff shaping unit—-penetration unit showing a state seeing from the left direction, and FIG. 13B is a cross-sectional view thereof showing an L-L cross-section of FIG. 12A. Also, FIG. 14 is a cross-sectional view of a main portion of the staple feeding unit, the staple cutoff shaping unit and the staple penetration unit, and shows a K-K cross-section of FIG. 12A.

As shown in FIG. 4, the staple feeding unit, the staple cutoff shaping unit and the staple penetration unit are provided on the front side of the staple loading unit at the upper portion of the frame 8. As shown in FIG. 11A, FIG. 11B, FIG. 12A, FIG. 12B, FIG. 13A and FIG. 13B, the stapler 1 is provided with a feeding path portion 41, a pusher holder 42, a feeding path installation table 43 and the like as a staple feeding unit for feeding the interlinked staples 2. Also, the stapler 1 is provided with the forming plate 15 as a staple cutoff shaping unit for cutting off the staple 3 positioned at the edge portion of the interlinked staples 2 therefrom and for shaping it, and the driver 18 as a staple penetration unit for penetrating the cut-off and shaped staple 3 with respect to the binding sheets. Also, the frame 8 is provided with the paper-sheet pusher 19 for holding down the binding sheets when executing the cutoff, the shaping and the penetration of the staple 3. These are located from the position of the staple loading unit forward in the order of the feeding path portion 41, the forming plate 15, the driver 18 and the paper-sheet pusher 19.

Figure 15:
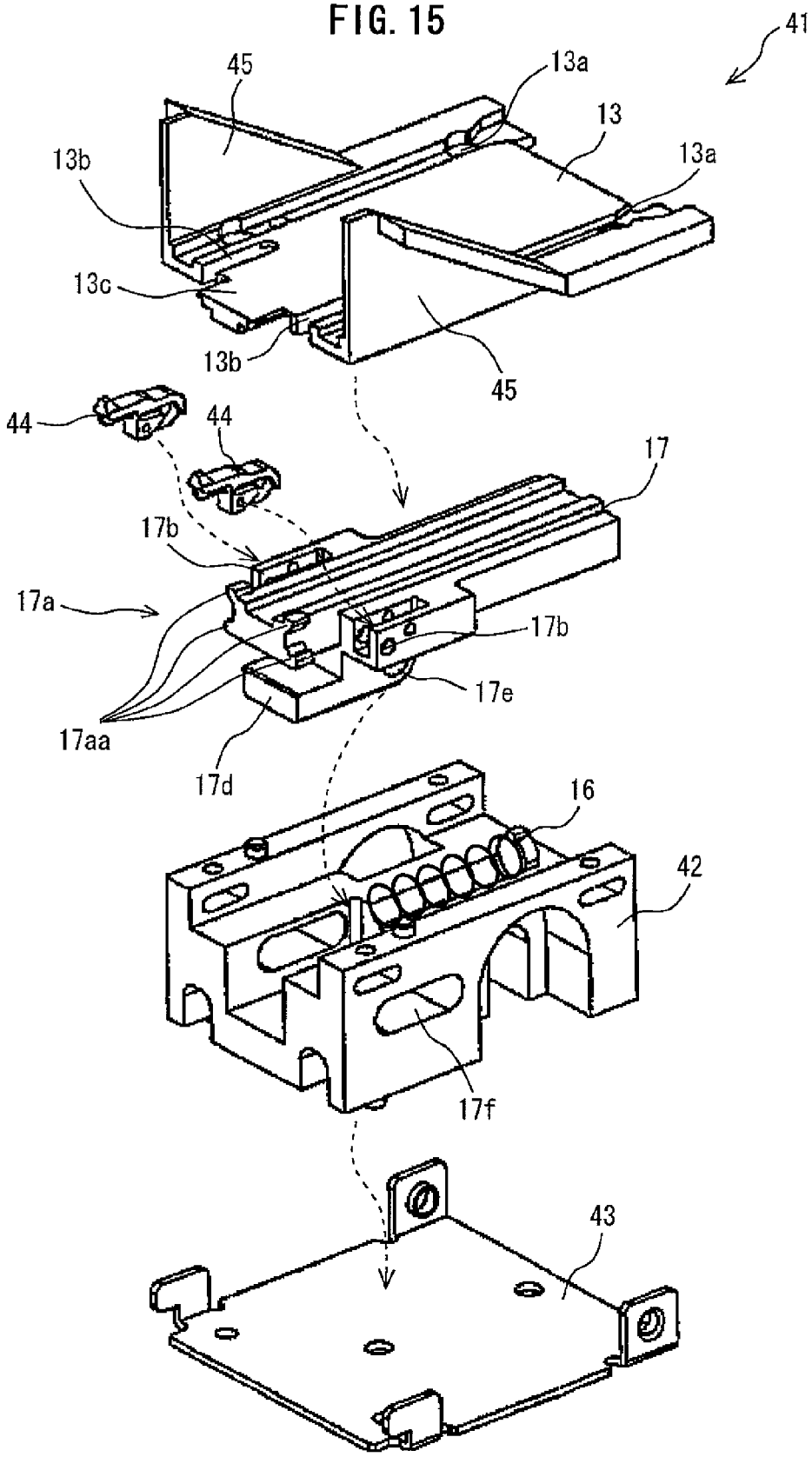
FIG. 15 is an exploded constitution diagram of the staple feeding unit.

First, it will be explained with respect to a constitution of the staple feeding unit. FIG. 15 is an exploded perspective view showing a constitution of the staple feeding unit. As shown in FIG. 15, the staple feeding unit is constituted by including the feeding path portion 41, the pusher 17, the pusher spring 16, the pusher holder 42 and the feeding path installation table 43.

The feeding path portion 41 includes the flat plate shaped feeding path 13 having the width in response to the width in the longitudinal direction of each of the staples 3 in the interlinked staples 2. Also, there are provided on both the side portions of the feeding path 13 with feeding path grooves 13*a* in the pass-through path which the adhesion portions 31 provided on the rear surface of the staple 3 pass through. Further, at the front edge portion of the feeding path 13, there are provided with feeding claw grooves 13*b* by which feeding claws 44 attached on the pusher 17 mentioned later protrude on the feeding path 13. Also, at the front edge portion of the feeding path 13, there is provided with a receiving table portion 13*c* with which a staple shaping unit 15*a* of the forming plate 15 mentioned later is fitted.

Further, the feeding path portion 41 is provided with triangle shaped side plates 45 at both the edges of the front portion of the feeding path 13. As shown in FIG. 13B, a screw coil spring 56 is positioned within this side plate 45 in a state in which the staple feeding unit, the staple cutoff shaping unit and the staple penetration unit are assembled.

Figure 16:
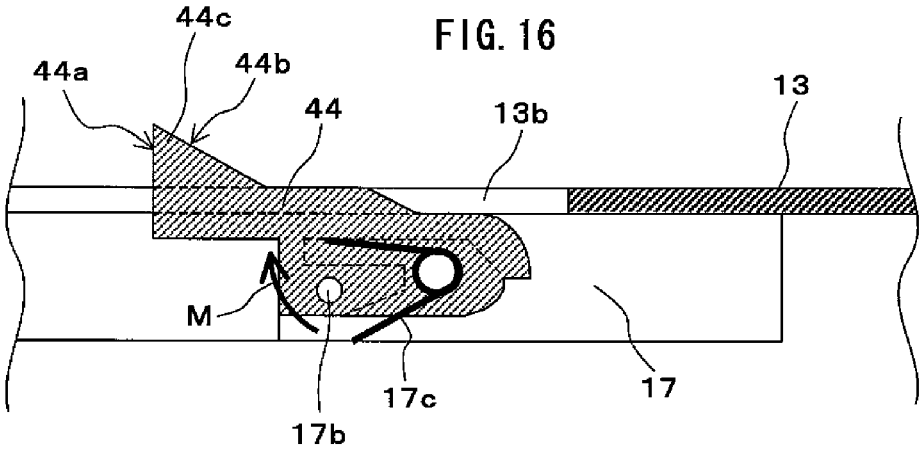
FIG. 16 is a cross-sectional view of a main portion of a feeding path portion—pusher.

FIG. 16 is a cross-sectional view of a main portion of the feeding path portion 41 and the pusher 17. The pusher 17 is positioned at a lower portion of the feeding path portion 41 in a state in which the stapler 1 is assembled. At the front edge portion, the pusher 17 is provided with a staple pushing unit 17*a* which has protrusion portions 17*aa* at the four corners. Also, the pusher 17 is provided with the feeding claws 44 mounted rotatably on a feeding claw rotating shaft 17*b* at the positions in response to the feeding claw grooves 13*b* of the feeding path portion 41.

As shown in FIG. 16, each of the feeding claws 44 is biased to a direction shown by an arrow M depending on a feeding claw spring 17*c*. Also, the protrusion portion of each of the feeding claws 44 from each of the feeding paths 13 is formed with its front surface being formed vertically as an engaging slope surface 44*a* and its rear surface being formed obliquely as a non-engaging slope surface 44*b*. Also, the pusher 17 is provided with an L-shaped arm 17*d* formed in an L-shape at a lower portion and a pusher shaft hole 17*e*.

The pusher holder 42 has a shape of a rectangular body for retaining the feeding path portion 41 and the pusher 17. The pusher holder 42 includes a pusher shaft long hole 17*f* of a long hole shape at a position corresponding to the pusher shaft hole 17*e* of the placed pusher 17. By inserting a pusher shaft 58, which is not shown, into the pusher shaft hole 17*e* of the pusher 17 and the pusher shaft long hole 17*f* of the pusher holder 42, the pusher 17 is slidable in the forward and backward direction by a predetermined amount with respect to the pusher holder 42. Also, the pusher holder 42 is provided with the pusher spring 16 for biasing the rear portion of the L-shaped arm 17*d* of the pusher 17 to a forward direction. The pusher holder 42 retaining the feeding path portion 41 and the pusher 17 is mounted on the frame 8 through the feeding unit installation table 43.

Figure 17A:
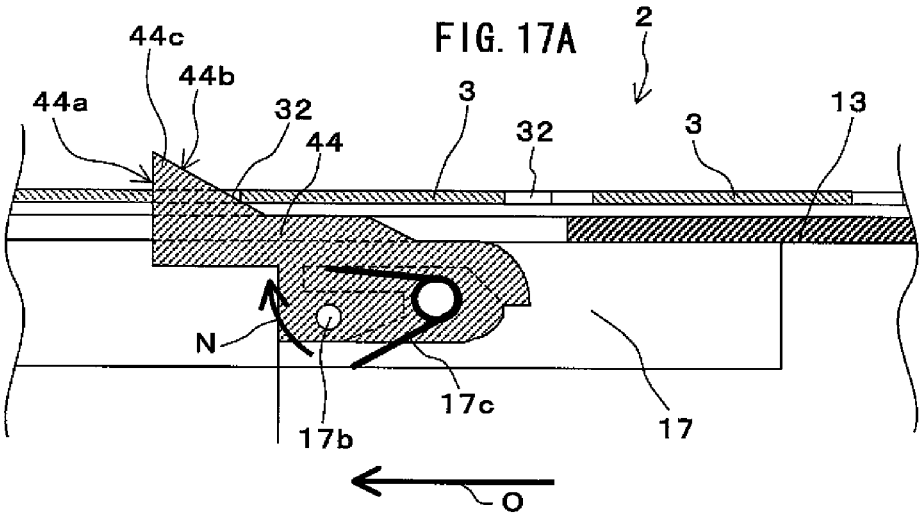
FIG. 17A is an explanatory diagram showing a staple feeding method.
Figure 17B:
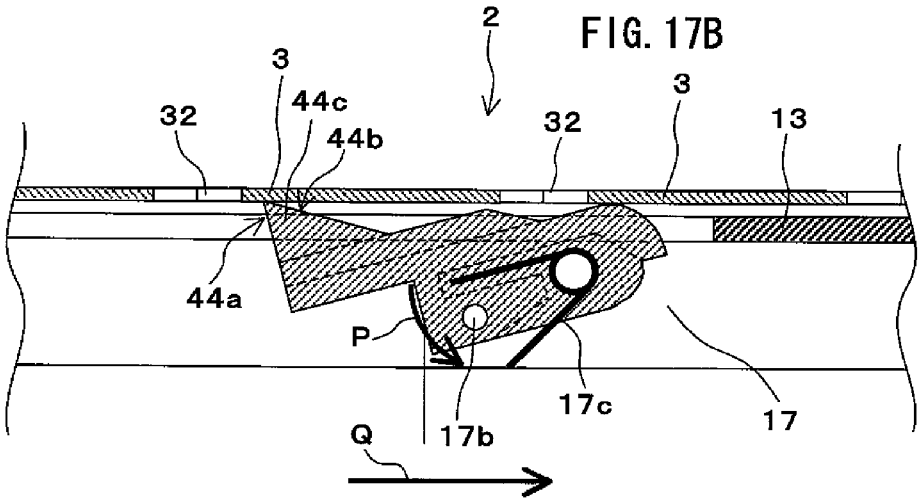
FIG. 17B is an explanatory diagram showing the staple feeding method.

Here, it will be explained with respect to a feeding method of the interlinked staples 2 on the feeding path 13 by means of the feeding claws 44 mounted on the pusher 17. FIG. 17A and FIG. 17B are explanatory diagrams of the feeding method of the interlinked staples 2 by means of the feeding claws 44 mounted on the pusher 17. FIG. 17A shows a state in which the feeding claws 44 mounted on the pusher 17 move forward, and FIG. 17B shows a state in which the feeding claws 44 mounted on the pusher 17 move backward.

As shown in FIG. 17A, when moving the pusher 17 forward, the interlinked staples 2 are moved forward on the feeding path 13 by engaging the protrusion portions of the feeding claws 44 biased to a direction of an arrow N with the feeding holes 32 of the interlinked staples 2 by means of the engaging slope surfaces 44*a* positioned at the forward position. Also, as shown in FIG. 17B, when the pusher 17 moves backward, the protrusion portions of the feeding claws 44 become in a non-engagement state with the feeding holes 32 of the interlinked staples 2 by means of the non-engaging slope surfaces 44*b* positioned backward, and the feeding claws 44 rotate as shown by an arrow P and move backward.

Figure 18C:
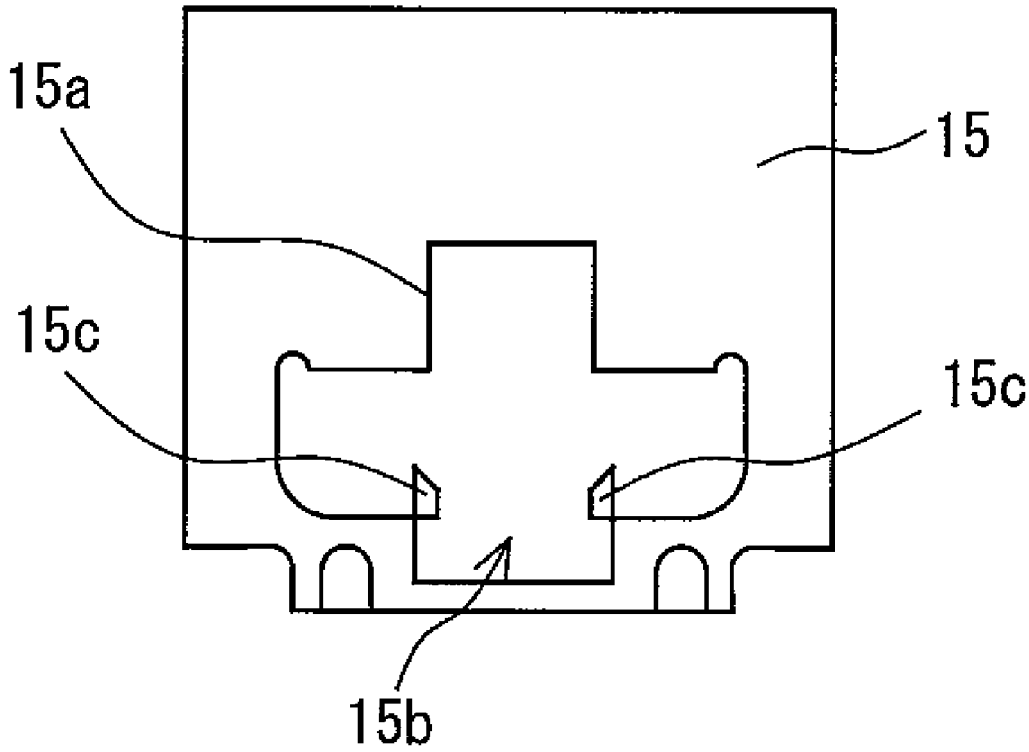
FIG. 18C is an explanatory diagram showing a constitution example of the forming plate.

Next, it will be explained with respect to a constitution example of the forming plate 15 constituting the staple shaping cutting unit. FIG. 18A, FIG. 18B and FIG. 18C are explanatory diagrams showing a constitution of the forming plate 15. FIG. 18A is a perspective view thereof showing a state seen obliquely from the front, and FIG. 18B is a perspective view thereof showing a state seen obliquely from the back-side. FIG. 18C is a front view of the forming plate 15 and shows a part of the constitution in a simplified state.

As shown in FIG. 18A, FIG. 18B and FIG. 18C, the forming plate 15 has a plate-formed shape including an opening portion at the center thereof and having a predetermined thickness. At the upper portion of the opening portion, the staple shaping unit 15*a* having a shape in which the lower portion thereof is opened and which is fitted with the receiving table portion 13*c* of the above-mentioned feeding path portion 41 is provided. A portion lower than the staple shaping unit 15*a* is opened with a predetermined width that is wider than that of the staple shaping unit 15*a*. Also, at the lower portion of the opening portion, a staple pushing unit insertion portion 15*b* into which the staple pushing unit 17*a* of the above-mentioned pusher 17 is inserted is provided.

Further, in the opening portion of the forming plate 15, protrusion shaped spread-retainers 15*c* formed such that slope surfaces thereof are faced to each other from both the edges of the staple pushing unit insertion portion 15*b* toward the upward direction are provided.

Also, the forming plate 15 is provided with groove portions at the right and the left of the opening portion on the front surface side (side on which the driver 18 is located). As shown in FIG. 14 and FIG. 18A, first, V-grooves 46 each of which is formed for a predetermined length in the up and down direction by a predetermined depth are provided as the groove portions. A lower edge portion 46*a* of each of the V-grooves 46 is formed deeply as compared with other portions. A V-groove 48 having the same depth as that of the lower edge portion 46*a* of the V-groove 46 is included at the downward place from the V-groove 46 sandwiching a flat portion 47 of a predetermined length.

Further, the forming plate 15 is attached with two cutting blades 49 as interlinking portion cutting blades on the rear surface side (side on which the staple feeding unit is located). Each of the cutting blades 49 is mounted on the forming plate 15 in a state in which each blade edge 49*a* is faced obliquely to the outside and at the same time, in a state in which the blade edge is protruded by a predetermined amount in the opening portion.

Further, the forming plate 15 is provided with convex portions 15*d* at the right and the left, which are fitted with the side grooves 50 of the frame 8 shown in FIG. 5 and FIG. 6. Thus, the forming plate 15 can be slid with respect to the frame 8 in the up and down direction.

Figure 19A:
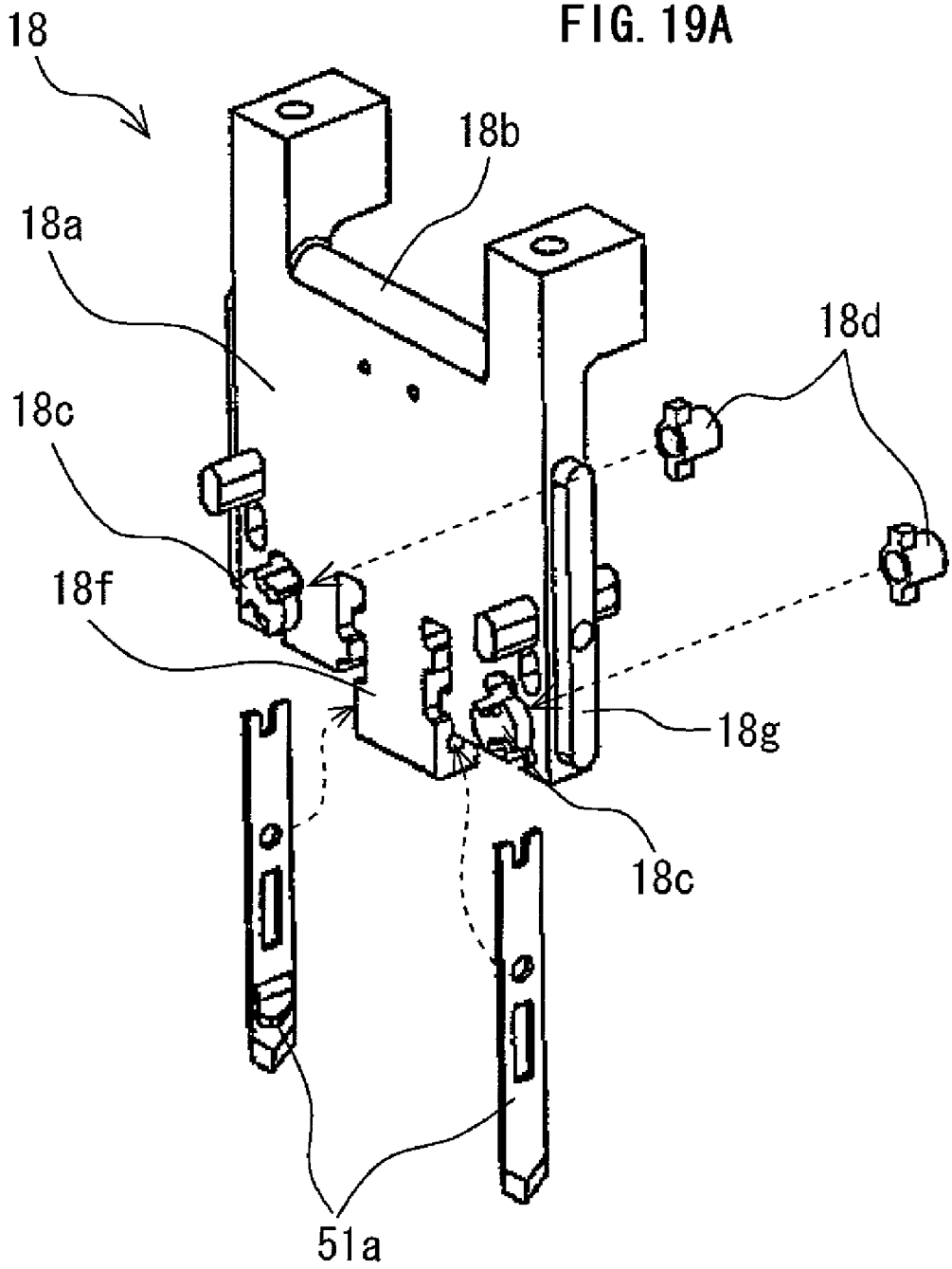
FIG. 19A is an exploded constitution diagram of a driver.
Figure 19B:
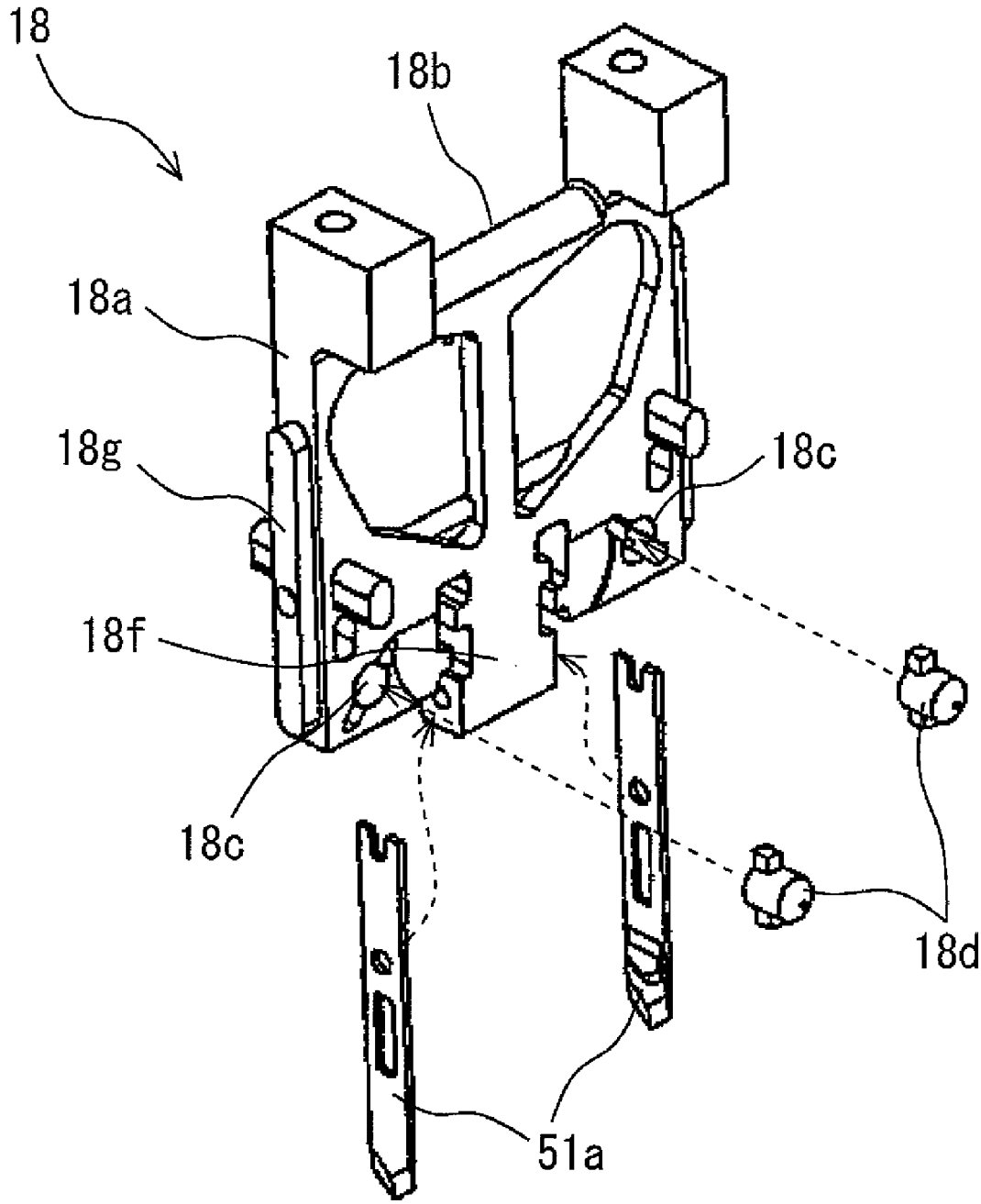
FIG. 19B is an exploded constitution diagram of the driver.
Figure 20:
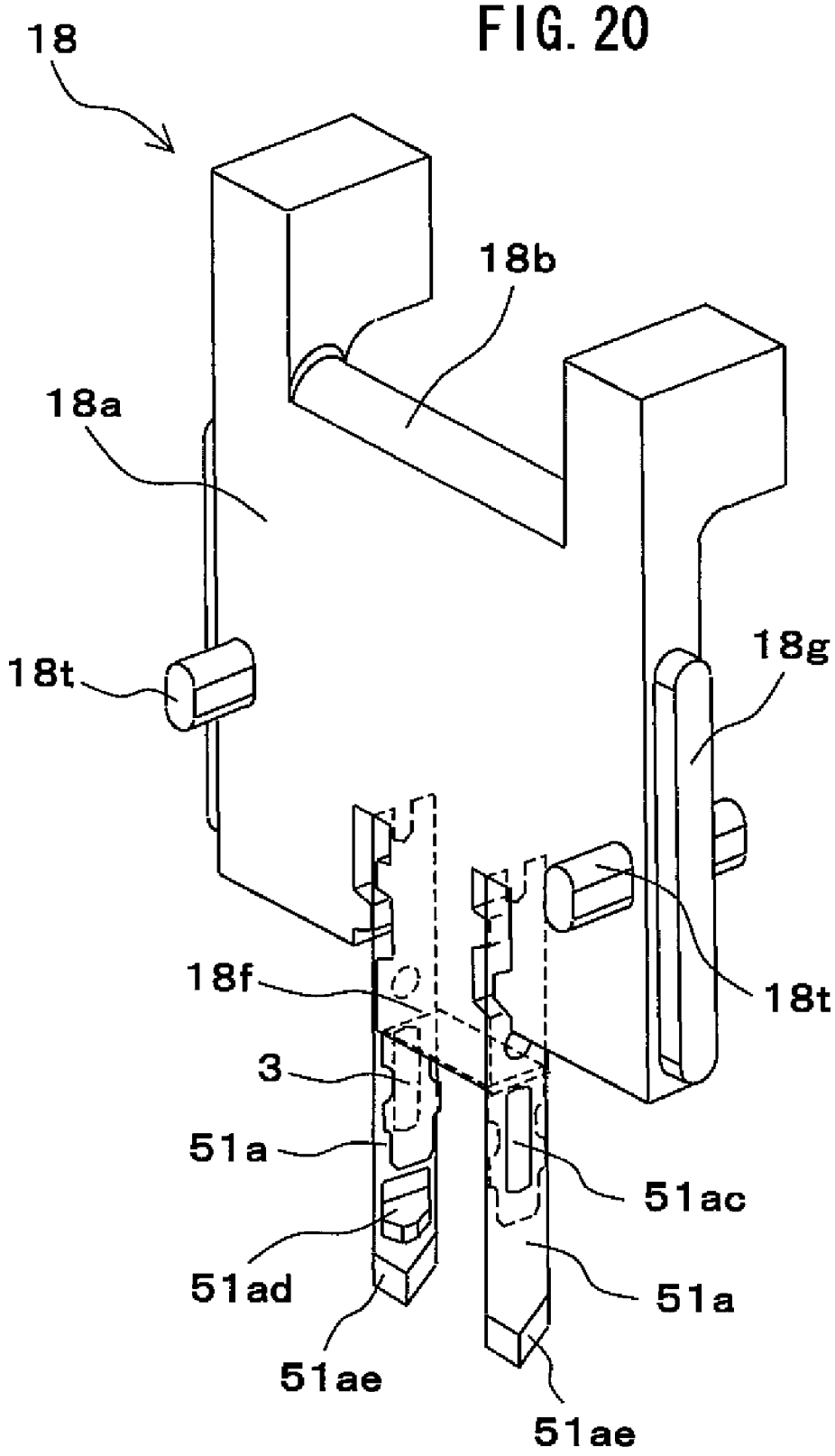
FIG. 20 is an explanatory diagram showing a constitution example of the driver.

Next, it will be explained with respect to a constitution example of the driver 18 constituting a staple penetration unit. FIG. 19A is an exploded perspective view of the driver 18 showing a state seeing obliquely from the front, and FIG. 19B is an exploded perspective view of the driver 18 showing a state seeing obliquely from the back-side. FIG. 20 is a perspective view thereof showing a state in which punching blades 51 (51*a*, 51*b*) as insertion-cutting blades are attached to a main body portion thereof and the staple 3 having a shape in which both the edges thereof are bent to one direction is positioned within the punching blades 51.

The driver 18 is provided with the plate shaped driver main body portion 18*a* having a predetermined thickness, protrusion pins 18*d*, and two pieces of punching blades 51. The driver main body portion 18*a* is provided, at the upper edge portion, with a driver pusher contact unit 18*b* on which a driver pusher 66 provided on the rear surface of the handle 5 shown in FIG. 4 is contacted.

Also, with respect to the driver main body portion 18*a*, the protrusion pins 18*d* are attached to protrusion pin mounting portions 18*c* in the vicinity of the lower edge portion and in the vicinity of both the right and left edge portions. As shown in FIG. 14, each of the protrusion pins 18*d* is formed so as to have a configuration in which the tip portion has a conical shape and the inside portion is hollow and is attached to the driver 18 in a state of having a protrusion pin spring 18*e* which is a compressed spring, in the inside portion. Thus, the protrusion pins 18*d* is slidable in the forward and backward direction as shown by an arrow in FIG. 14 and also, are mounted on the driver main body portion 18*a* in a state of being biased in the rear surface direction (direction in which the forming plate 15 is positioned) by the protrusion pin springs 18*e*.

Also, the conical shaped portion of the tip portion of each of the protrusion pins 18*d* has a shape in response to the V-groove 46 and the V-groove 48 included in the forming plate 15. Further, when the protrusion pin 18*d* stays in the V-groove 46, a portion of the conical shaped portion of the protrusion pin 18*d* becomes in a state of being positioned in the groove, and when the protrusion pin 18*d* stays in the lower edge portion 46*a* of the V-groove 46 and the V-groove 48, the protrusion pin 18*d*, the V-groove 46 and the V-groove 48 have shapes which become in a state in which all of the conical shaped portion of the protrusion pin 18*d* is positioned in the groove.

Figure 21A:
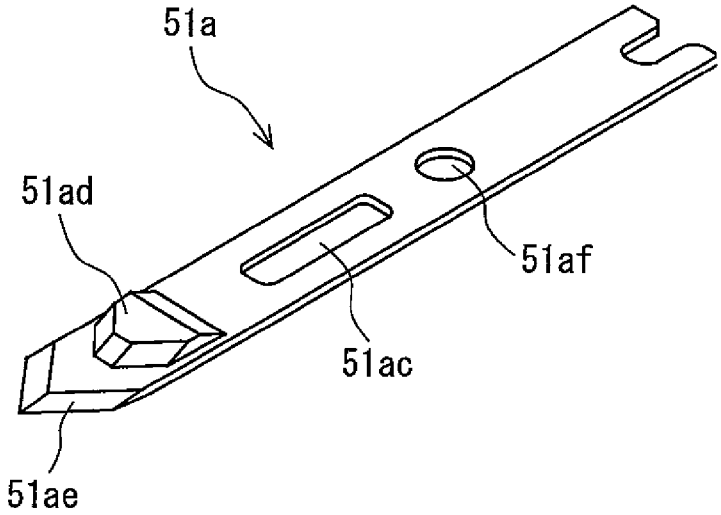
FIG. 21A is an explanatory diagram showing a constitution example of a first punching blade.
Figure 21B:
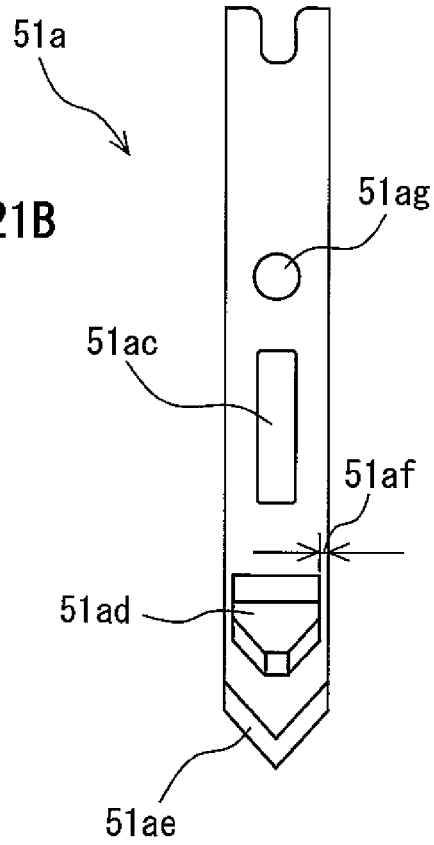
FIG. 21B is an explanatory diagram showing a constitution example of the first punching blade.

Also, the driver main body portion 18*a* is provided, at the center of the lower edge portion thereof, with a staple push down unit 18*f* of a rectangular body, which is protruded by a predetermined amount with the width in response to the crown portion 35 of the staple 3 of FIG. 8B. There are mounted at the right and the left of the staple push down unit 18*f* with punching blades 51 respectively as shown in FIG. 20. Here, it will be explained with respect to constitutions of the punching blades 51. First, it will be explained with respect to the constitution of the first punching blade 51*a* as a first exemplified example of the punching blades 51. FIG. 21A, FIG. 21B and FIG. 21C are explanatory diagrams showing the constitution of the first punching blade 51*a*. FIG. 21A is a perspective view of the first punching blade 51*a*, FIG. 21B is a side view of the first punching blade 51*a*, and FIG. 21C is a front view of the first punching blade 51*a*.

As shown in FIG. 21A, FIG. 21B and FIG. 21C, the first punching blade 51*a* has a predetermined length and is provided with a blade edge 51*ae* at one edge portion thereof. Also, the first punching blade 51*a* is provided, in the vicinity of the edge portion including the blade edge 51*ae*, with a protrusion portion 51*ad* which has a slope surface at least on a side of the blade edge 51*ae* and which is protruded by a predetermined amount. Here, the protrusion portion 51*ad* is not formed with the full width of the first punching blade 51*a*, and the first punching blade 51*a* includes, as shown in FIG. 21B, linear portions 51*af*, each of which is continuous from one edge portion to the other edge portion in the longitudinal direction. Consequently, a predetermined strength is possessed against the bending with respect to the paper right and left direction of the state shown in FIG. 21C. Also, it is possible to form the protrusion portion 51*ad* inexpensively by a press process compared with a mold process.

Further, the first punching blade 51*a* includes a predetermined shaped push-out hole 51*ac* at the center portion thereof and includes a mounting hole 51*ag* for being mounted on the staple push down unit 18*f* of the driver main body portion 18*a* upward the push-out hole 51*ac*. By penetrating the first punching blade 51*a* having such a constitution through the binding sheets, a notch opening 52*a* having a shape as shown in FIG. 21D is formed.

Next, it will be explained with respect to a constitution of the second punching blade 51*b* as a second exemplified example of the punching blades 51. FIG. 22A, FIG. 22B and FIG. 22C are explanatory diagrams showing constitutions of the second punching blade 51*b*. FIG. 22A is a perspective view of the second punching blade 51*b*, FIG. 22B is a side view of the second punching blade 51*b*, and FIG. 22C is a front view of the second punching blade 51*b*.

As shown in FIG. 22A, FIG. 22B and FIG. 22C, the second punching blade 51*b* has a predetermined length similarly as the first punching blade 51*a* and is provided with a blade edge 51*be* at one edge portion. Also, the second punching blade 51*b* is provided, in the vicinity of the edge portion including the blade edge 51*be*, with two protrusion portions 51*bd*, each of which has a slope surface at least on a side of the blade edge 51*be* and which is protruded by a predetermined amount. Here, the two protrusion portions 51*bd* are provided at both the edge portions in the width direction of the second punching blade 51*b*. Namely, the protrusion portions 51*bd* is, similarly as the protrusion portion 51*ad* shown in FIG. 21B, not formed with the full width of the second punching blade 51*b* either, and the second punching blade 51*b* includes, as shown in FIG. 22B, a linear portion 51*bf* that is continuous from one edge portion to the other edge portion in the longitudinal direction.

Consequently, a predetermined strength is possessed against the bending with respect to the paper right and left direction of the state shown in FIG. 22C. Also, it is possible to form the protrusion portion 51*bd* inexpensively by a press process compared with a mold process.

Further, the second punching blade 51*b* includes a predetermined shaped push-out hole 51*bc* at the center portion thereof and includes a mounting hole 51*bg* for being mounted on the staple push down unit 18*f* of the driver main body portion 18*a* upward the push-out hole 51*bc*. By penetrating the second punching blade 51*b* having such a constitution through the binding sheets, a notch opening 52*b* having a shape as shown in FIG. 22D is formed.

Back to FIG. 19A, FIG. 19B and FIG. 20, the driver main body portion 18*a* is provided with convex portions 18*g* at the right and the left and they are fitted with side grooves 56 of the frame 8 shown in FIG. 5 and FIG. 6. Thus, the driver main body portion 18*a* can be slid up and down with respect to the frame 8.

Figure 23A:
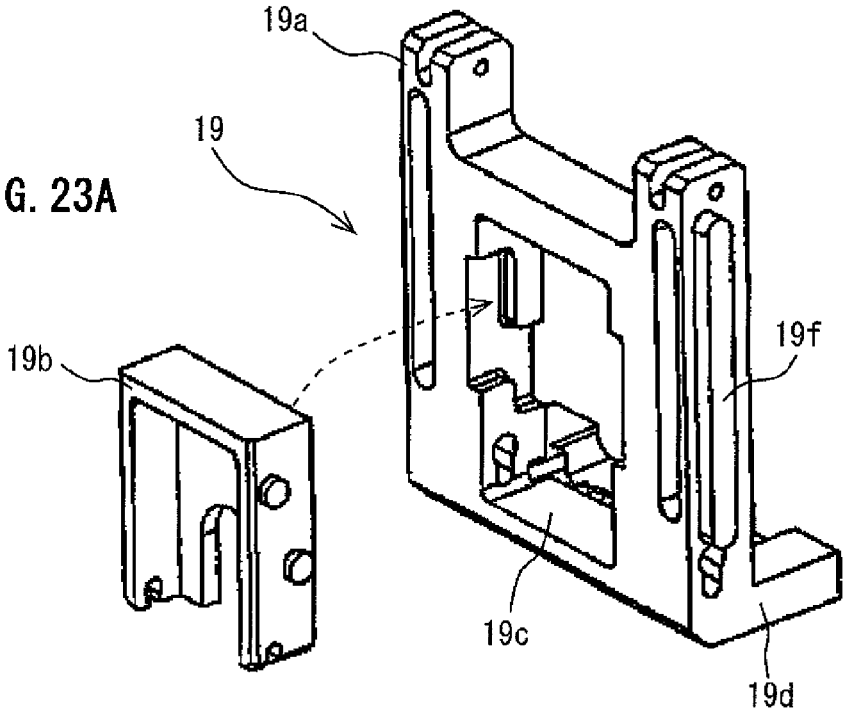
FIG. 23A is an exploded constitution diagram of a paper-sheet pusher.
Figure 23B:
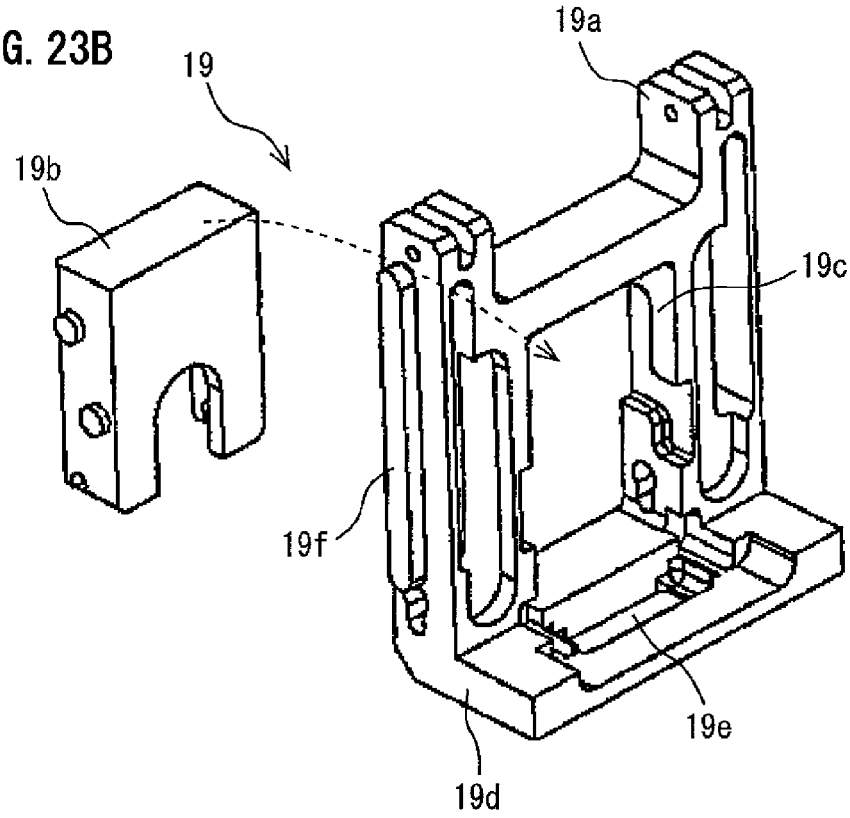
FIG. 23B is an exploded constitution diagram of the paper-sheet pusher.

Next, it will be explained with respect to a constitution of the paper-sheet pusher 19 for holding down the binding sheets with respect to the table 20 when executing the penetration of the staple 3 with respect to the binding sheets by means of the staple penetration unit and executing the bending and bonding of both the leg portions of the staple 3 by means of staple bending unit mentioned later. FIG. 23A and FIG. 23B are explanatory diagrams showing constitutions of the paper-sheet pusher 19. FIG. 23A is an exploded perspective view of the paper-sheet pusher 19 showing a state seeing obliquely from the front, and FIG. 23B is an exploded perspective view of the paper-sheet pusher 19 showing a state seeing obliquely from the back-side.

As shown in FIG. 23A and FIG. 23B, the paper-sheet pusher 19 is provided with a paper-sheet pusher main body portion 19*a* of an L-shaped cross-section having a predetermined thickness and a square window 19*b*. The paper-sheet pusher main body portion 19*a* is provided at the center portion with a square window hole 19*c* to which the square window 19*b* is attached open/close-freely. Also, the paper-sheet pusher main body portion 19*a* is provided, at a lower edge portion, with a paper-sheet pusher unit 19*d* and a staple binding hole 19*e* used during the staple penetration by means of the staple penetration unit is included at the center of the paper-sheet pusher unit 19*d*.

Further, the paper-sheet pusher main body portion 19*a* is provided with convex portions 19*f* at the right and the left and they are fitted with side grooves 54 of the frame 8 shown in FIG. 5 and FIG. 6. Thus, the driver main body portion 18*a* can be slid up and down with respect to the frame 8.

Next, it will be explained with respect to the constitution of the support in the up and down direction of the forming plate 15, the driver 18 and the paper-sheet pusher 19. As mentioned above, the forming plate 15 includes the convex portions 15*d* at the side portions, the driver main body portion 18*a* includes the convex portions 18*g* at the side portions, and the paper-sheet pusher main body portion 19*a* includes convex portions 19*f* at the side portions. Depending on a fact that the respective convex portions are fitted with the side grooves 50, the side grooves 53 and the side grooves 54 of the frame 8 and are slid, the forming plate 15, the driver 18 and the paper-sheet pusher 19 become movable in the up and down direction at predetermined positions respectively.

First, as shown in FIG. 14, in a stand-by state, the forming plate 15 becomes in a state in which the lower edge portion 15*e* thereof is placed on the upper portion of the L-shaped arm 17*d* of the pusher 17. Also, as shown in FIG. 4 and the like, the paper-sheet pusher 19 is attached to the frame 8 and becomes in a state of being pulled upward by a tension spring 55. An upper dead point of the paper-sheet pusher 19 in the stand-by state is fixed by the side grooves 54 of the frame 8 and the convex portions 19*f* of the paper-sheet pusher main body portion 19*a*.

Also, as shown in FIG. 13B, the screw coil spring 56 is provided between the paper-sheet pusher main body portion 19*a* and the driver main body portion 18*a*, biases the paper-sheet pusher main body portion 19*a* downward, and concurrently biases the driver main body portion 18*a* upward. Namely, in a stand-by state, the driver main body portion 18*a* is biased upward with respect to the paper-sheet pusher 19 and the upper dead point of the driver main body portion 18*a* is fixed by the upper portions of the paper-sheets pushing grooves 19*m* and driver protrusions 18*t* protruding to the front face side of the driver main body portion 18*a*.

Also, as shown in FIG. 2, links 57 are mounted rotatably at the side portions of the driver main body portion 18*a*. The links 57 are engaged with the pusher shaft 58 slidably by long holes 57*a* and are engaged with a shaft 59Z slidably by long holes 57*b*. Here, by pushing down the handle 5 so that the driver main body portion 18*a* is descended, the links 57 rotate to the direction shown by an arrow E in FIG. 2. By rotating the links 57, the pusher shaft 58 is moved from the long hole 57*a* to the direction shown by an arrow F.

Thus, the pusher 17 shown in FIG. 4 and the like moves back and a lower edge portion 15*e* of the forming plate 15 is disengaged from the upper portion of the L-shaped arm 17*d* of the pusher 17, so that the forming plate 15 can descend.

Also, the side grooves 54, the side grooves 53 and the side grooves 50 of the frame 8 are provided with collar portions, for example, hemmed by resins or the like in order to improve slide ability with respect to the convex portions 19*f*, the convex portions 18*g* and the convex portions 15*d*.

Figure 24A:
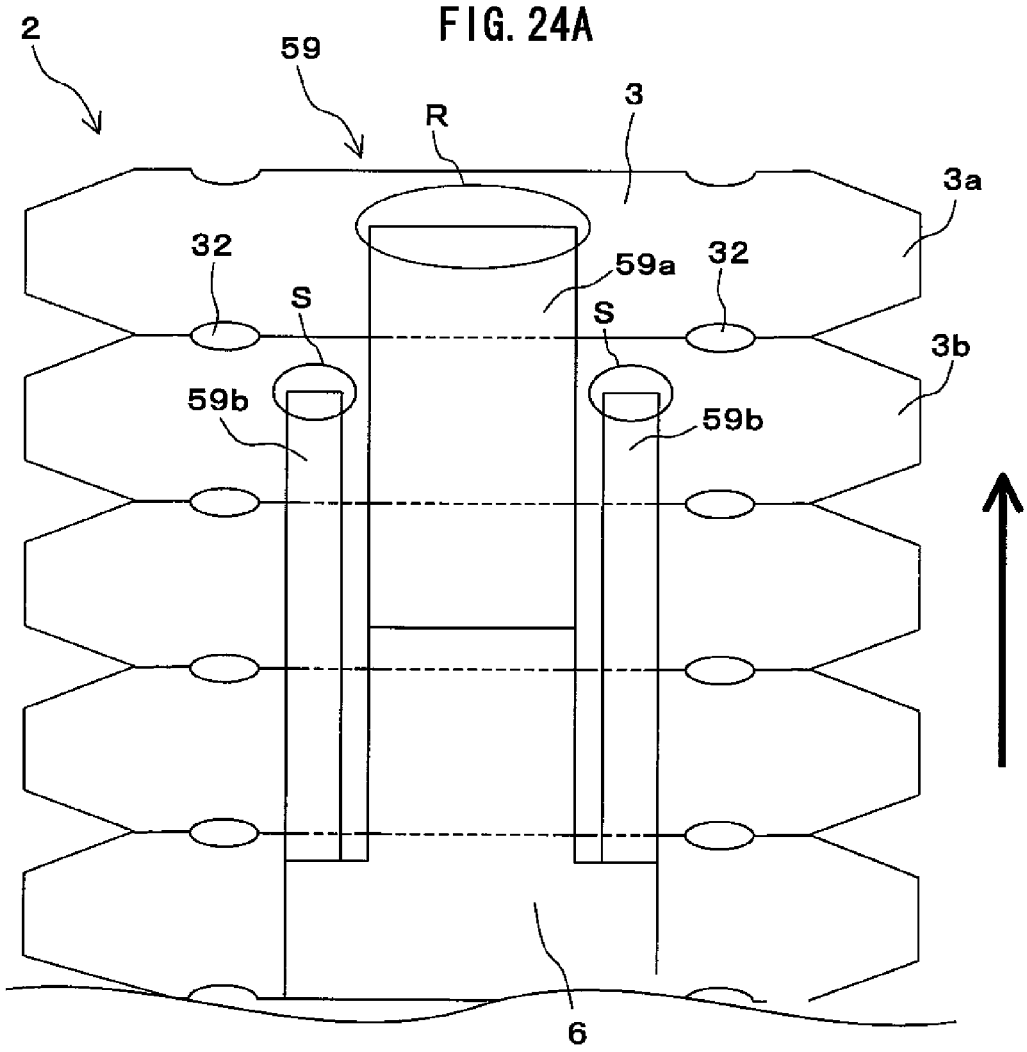
FIG. 24A is an explanatory diagram showing a constitution example of a staple pusher unit.
Figure 24B:
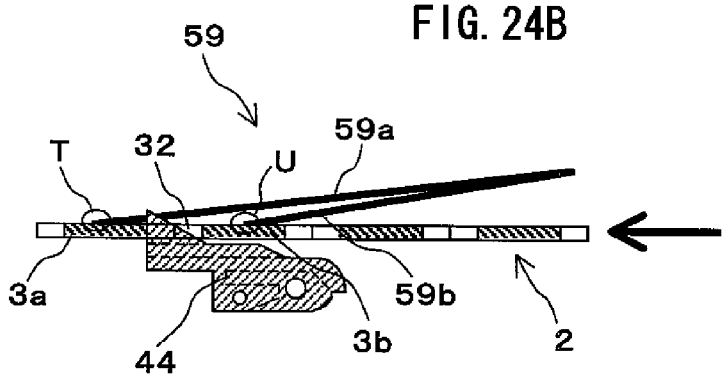
FIG. 24B is an explanatory diagram showing a constitution example of the staple pusher unit.

Next, it will be explained with respect to a constitution example of the staple cover 6 and a reverse stopper spring 59 provided for the staple cover 6 as a staple pusher unit. FIG. 24A and FIG. 24B are explanatory diagrams showing a constitution of the staple pusher unit. FIG. 24A is a plan view showing a state in which the staples 3 of the interlinked staples 2 are held down by the reverse stopper spring 59, and FIG. 24B is a side view showing a state in which the staples 3 of the interlinked staples 2 are held down by the reverse stopper spring 59.

As shown in FIG. 5 to FIG. 7, the stapler 1 is provided with the staple cover 6 that is mounted rotatably on the handle & staple cover rotating shaft 10 at the rear edge portion of the upper end of the frame 8. The staple cover 6 has a width in response to the width of the frame and as shown in FIG. 4, is held down by the plate springs 14 in a state of covering the interlinked staples 2 on the feeding path 13.

Also, the reverse stopper spring 59, which is one example of a pusher piece, is provided at the edge portion of the staple cover 6 on the reverse side with respect to the mounting portion to the handle & staple cover rotating shaft 10. The reverse stopper spring 59 is formed by a thin plate-shaped metal having elasticity and is constituted by including a first reverse stopper spring 59*a* positioned at the center and second reverse stopper springs 59*b* positioned at both the sides of the first reverse stopper spring 59*a*.

Here, the first reverse stopper spring 59*a* is long compared with the second reverse stopper springs 59*b* and in a state in which the staple cover 6 is held down by the plate spring 14, a staple 3*a* positioned downward the forming plate 15 which is the above-mentioned staple cutoff shaping unit is, as shown by R of FIG. 24A and by T of FIG. 24B, held down with respect to the feeding path 13 by the edge portion thereof. Also, as shown by S of FIG. 24A and by U of FIG. 24B, the second reverse stopper springs 59*b* hold down a staple 3*b* positioned at the neighboring place on a side of the staple loading unit of the staple 3*a* with respect to the feeding path 13 by the edge portion thereof.

Also, as shown in FIG. 24A and FIG. 24B, the first reverse stopper spring 59*a* and the second reverse stopper spring 59*b* of the reverse stopper springs 59 hold down the staple 3*a* and the staple 3*b* by the respective edge portions with respect to the feeding path 13 in an oblique posture in which the rear surface side (staple loading unit side) of the stapler 1 is positioned upward. Consequently, in a state in which the staple 3*a* and the staple 3*b* are held down with respect to the feeding path 13 by the first reverse stopper spring 59*a* and the second reverse stopper spring 59*b* respectively, it is possible to move the interlinked staples 2 in the direction shown by respective arrows in FIG. 24A and FIG. 24B.

Next, it will be explained with respect to a cutoff, shaping and feeding method by a staple cutoff shaping unit for the staple 3 positioned at the edge portion of the interlinked staples 2 by using FIG. 25A to FIG. 25E and the like. FIG. 25A, FIG. 25B, FIG. 25C, FIG. 25D and FIG. 25E are explanatory diagrams with respect to the cutoff, shaping and feeding method of the staple 3, and the interlinked staples 2, the reverse stopper springs 59 and the feeding claws 44 are shown by a cutoff state. In FIG. 25A, FIG. 25B, FIG. 25C, FIG. 25D and FIG. 25E, the staples positioned backward than the staple shaped into a shape in which both the edges thereof are bent to one direction are shown in a state of not being cut off.

Figure 25A:
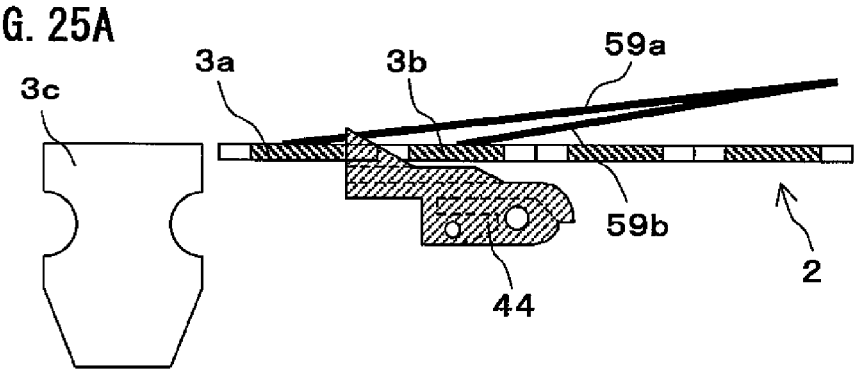
FIG. 25A is an explanatory diagram showing a staple cutoff—shaping—feeding method.

FIG. 25A shows the staples 3, the reverse stopper springs 59 and the feeding claws 44 respectively in a stand-by state of the stapler 1. The staple 3*a* is, similarly as in FIG. 24A and FIG. 24B, the staple 3 at the edge portion on the leading side of the interlinked staples 2 and is positioned on the receiving table portion 13*c* downward the forming plate 15. The staple 3*b* is the staple 3 positioned at the neighboring place on a side of the staple loading unit of the staple 3*a*, and the staple 3*c* is the staple 3 positioned downward the driver 18 in a state shaped into a shape in which both the edges thereof are already bent to one direction and cut off from the interlinked staples 2 by the cutting blade 49 mentioned later. It should be noted that the staple 3*c* is not indicated in the figures after FIG. 25B.

Figure 25B:
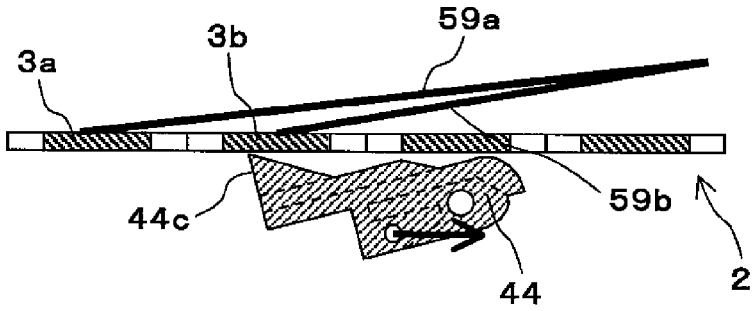
FIG. 25B is an explanatory diagram showing the staple cutoff—shaping—feeding method.
Figure 25C:
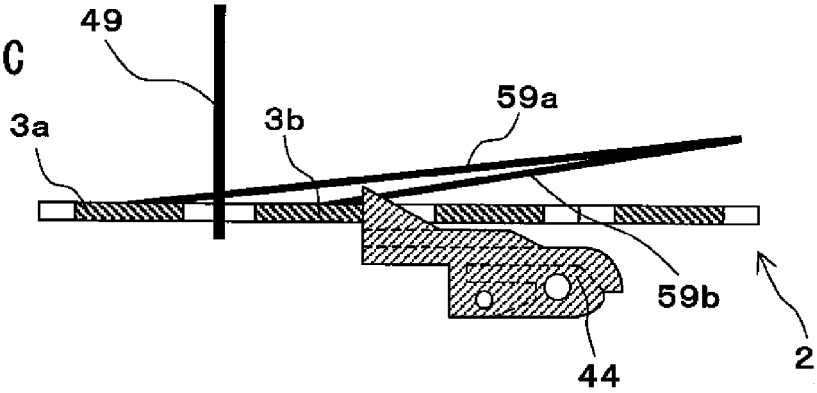
FIG. 25C is an explanatory diagram showing the staple cutoff—shaping—feeding method.
Figure 25D:
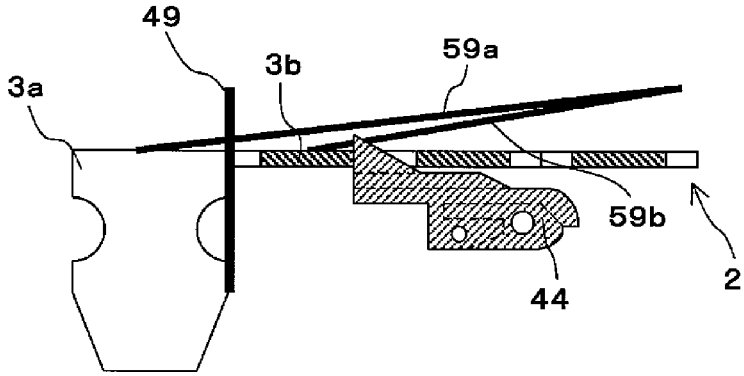
FIG. 25D is an explanatory diagram showing the staple cutoff—shaping—feeding method.
Figure 25E:
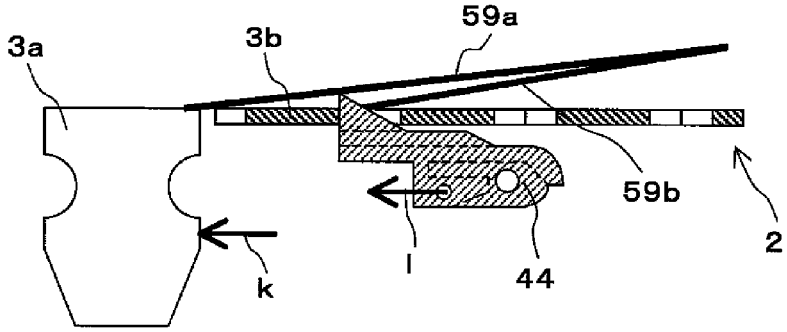
FIG. 25E is an explanatory diagram showing the staple cutoff—shaping—feeding method.

FIG. 25B shows a state in which the feeding claws 44 are moved in a downward position. FIG. 25C shows a state in which the staple 3*a* and the staple 3*b* are being cut off at the interlinking portion by the cutting blade 49. FIG. 25D shows a state in which the staple 3*a* is being shaped by the forming plate 15. FIG. 25E shows a state in which the interlinked staples 2 are moved by the feeding claws 44 and the staple 3*a* is moved forward by the staple pushing unit 17*a* of the pusher 17.

By pushing down the handle 5 from the stand-by state of the stapler 1 shown in FIG. 25A, the driver 18 descends, the links 57 rotate and the pusher 17 moves backward. Thus, as shown in FIG. 25B and FIG. 25C, the feeding claws 44 rotate and moves backward, engagement units 44*c* of the feeding claws 44 are disengaged from the feeding holes 32 of a side of the staple loading unit (right side of FIG. 25B) of the staple 3*a* and becomes in a state being engaged with the feeding holes 32 of a side of the staple loading unit of the staple 3*b*.

Here, as shown in FIG. 24B, the staple 3*b* is held down with respect to the feeding path 13 shown in FIG. 16 and the like by the second reverse stopper springs 59*b* of the reverse stopper springs 59. Consequently, the staple 3*b* is prevented from being floated up from the feeding path 13 and it becomes possible for the engagement units 44*c* of the feeding claws 44 to be reliably engaged with the feeding holes 32 on the side of the staple loading unit of the staple 3*b*.

Figure 26A:
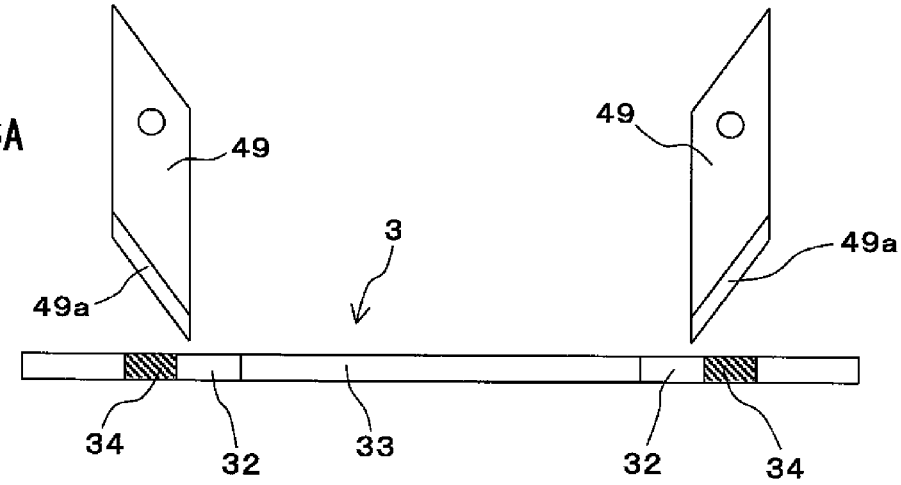
FIG. 26A is an explanatory diagram showing the staple cutoff method.
Figure 26B:
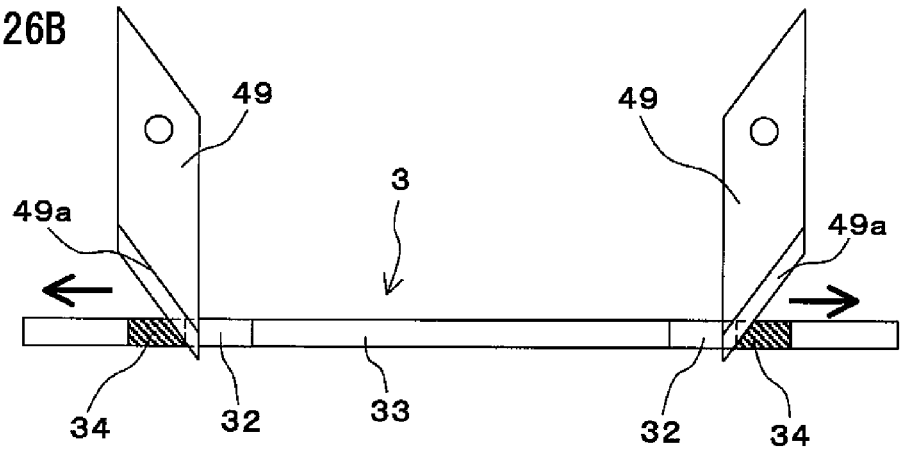
FIG. 26B is an explanatory diagram showing the staple cutoff method.
Figure 26C:
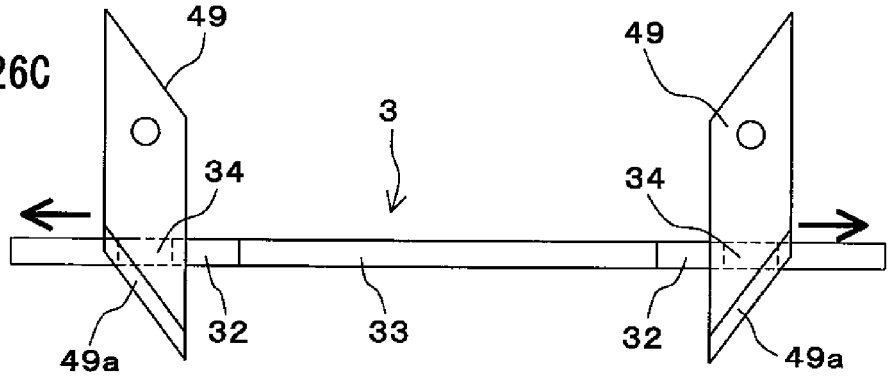
FIG. 26C is an explanatory diagram showing the staple cutoff method.

Also, during the period shown in FIG. 25A to FIG. 25C, the forming plate 15 descends by being pushed down by the driver 18. The details with respect to the push down of the forming plate 15 by the driver 18 will be mentioned later. The interlinking portions between the staple 3*a* and the staple 3*b* are cut off by the cutting blades 49 by descending the forming plate 15 including the cutting blades 49 with respect to the interlinked staples 2. FIG. 26A, FIG. 26B and FIG. 26C are explanatory diagrams in which cutoff of a staple 3 by the cutting blades 49 is shown by time series.

As shown in FIG. 26A, FIG. 26B and FIG. 26C, the respective staple interlinking portions 34 are cut off by blade edges 49*a* of the two cutting blades 49 by descending the two cutting blades 49 with respect to the staple 3. Here, the respective blade edges 49*a* are pushed against in the opposite directions respectively toward the outside from the inside of the staple 3 with respect to the respective staple interlinking portions 34 between the staple 3*a* and the staple 3*b*, and the respective staple interlinking portions 34 are cut off. Thus, on an occasion of the cutoff of the respective staple interlinking portions 34, it becomes in a state in which opposite forces are simultaneously applied to the staple 3*a* and the staple 3*b* in the longitudinal directions of the respective staples 3 by the respective blade edges 49*a*.

Thus, it is unnecessary for supporting the staple 3*a* of a cutoff object and the staple 3*b* adjacent to the staple 3*a* of the cutoff object in wide range, and it becomes possible to execute the cutoff of the staple 3 stably with a simple constitution by holding down by the reverse stopper spring 59.

By descending the forming plate 15 further after the staple interlinking portions 34 of the staple 3*a* and the staple 3*b* have been cut off in FIG. 26C, shaping to a shape in which both the edges of staple 3*a* are bent to one direction is executed. FIG. 27A, FIG. 27B, FIG. 27C, FIG. 28A, FIG. 28B and FIG. 28C are explanatory diagrams in which shaping of a staple 3 by the receiving table portion 13*c* and the forming plate 15 is shown by time series.

As shown in FIG. 27A, FIG. 27B, FIG. 27C and FIG. 28A, with respect to the staple 3*a* which is placed on the receiving table portion 13*c* and which is cut off from adjacent staple 3, the forming plate 15 descends and the receiving table portion 13*c* and the staple shaping unit 15*a* are fitted. Thus, the staple 3*a* is shaped into a shape in which the crown portion 35 and the leg portions 36 which are bent approximately perpendicularly from the crown portion 35 are formed so that both the edges are bent to one direction.

Figure 28A:
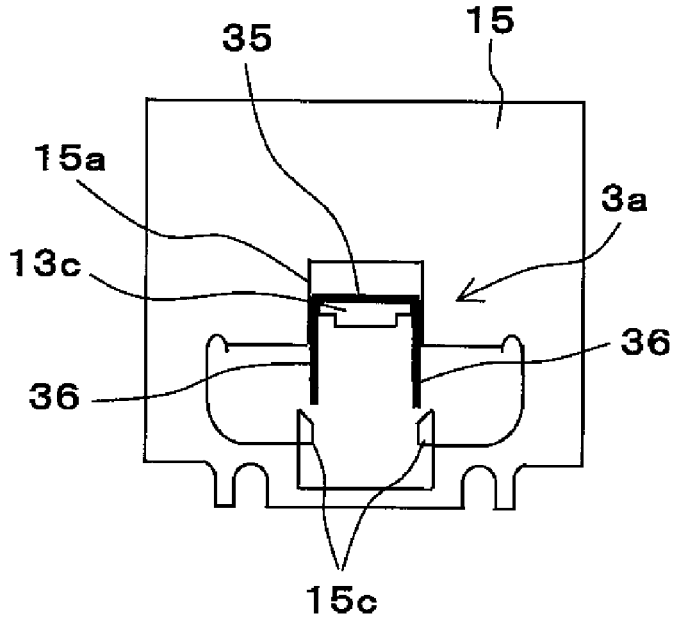
FIG. 28A is an explanatory diagram showing the staple shaping method.
Figure 28B:
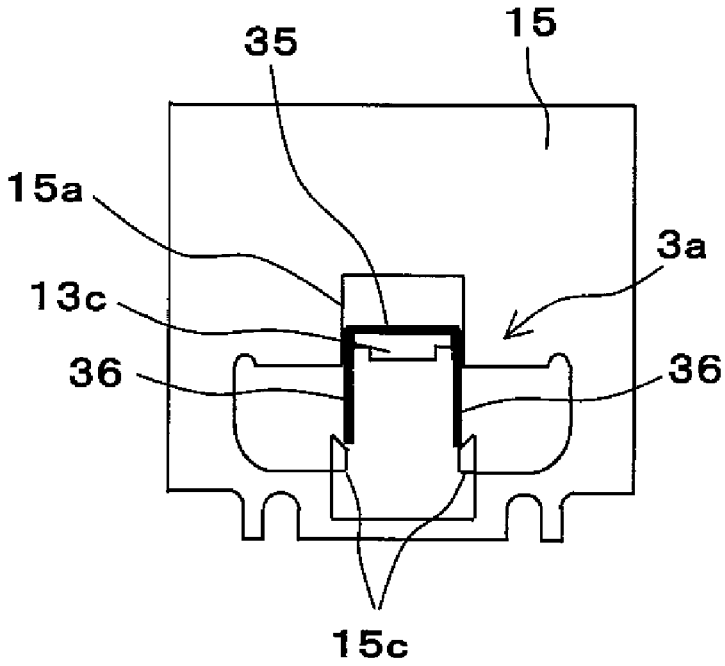
FIG. 28B is an explanatory diagram showing the staple shaping method.
Figure 28C:
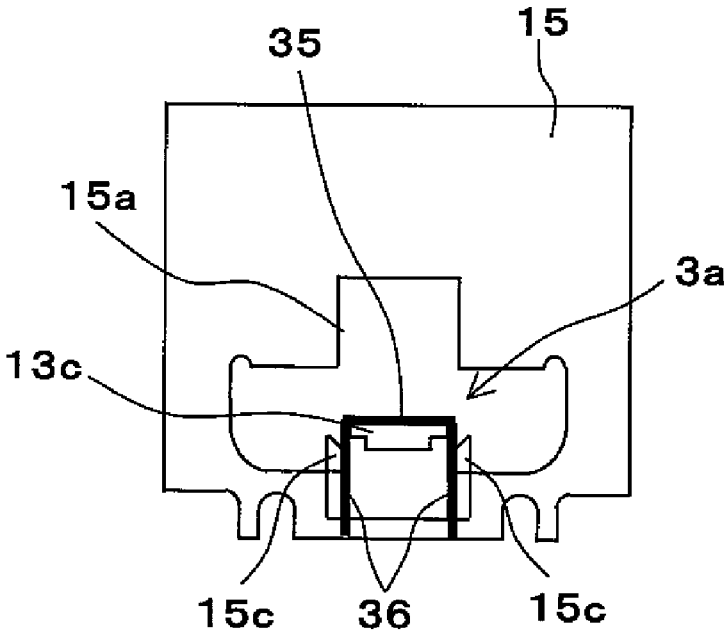
FIG. 28C is an explanatory diagram showing the staple shaping method.
Figure 29:
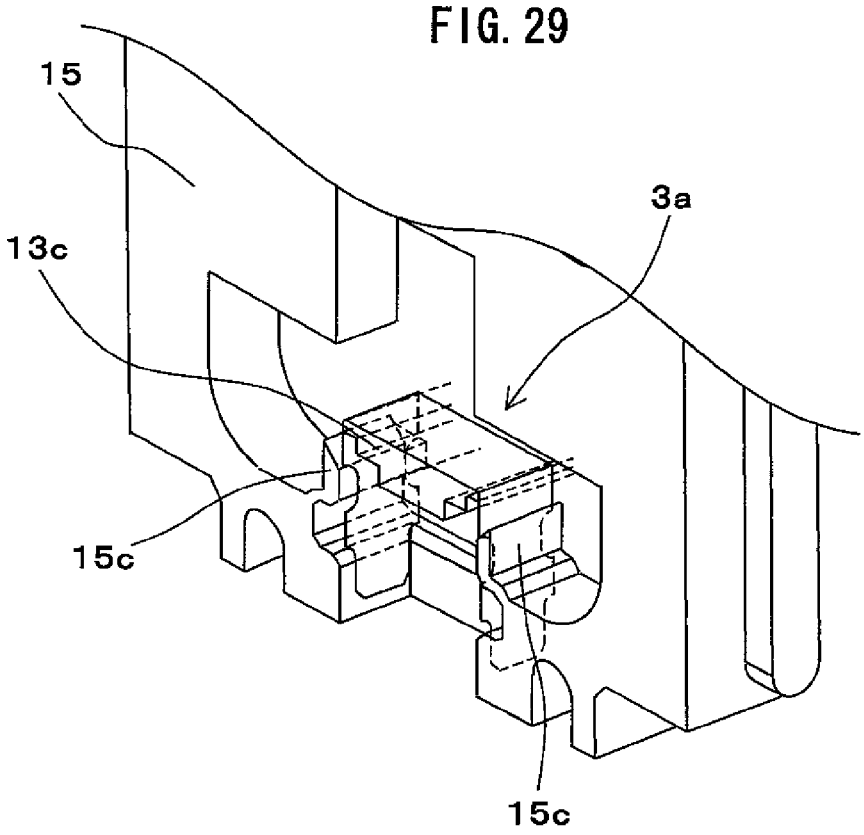
FIG. 29 is an explanatory diagram showing a state in which a staple is retained by spread-retainers.

Also, as shown in FIG. 28A, the staple 3*a* is shaped in a shape in which both the edges are bent to one direction and thereafter, the forming plate 15 also ascends by ascending the driver 18. The details with respect to the ascent of the driver 18 and the forming plate 15 will be mentioned later. Here, as shown in FIG. 28B and FIG. 28C, when the forming plate 15 ascends, both the leg portions 36 of the staple 3*a* which is shaped in a shape in which both the edges are bent to one direction are held down by the spread-retainers 15*c*. FIG. 29 is a perspective view showing a state in which both the leg portions 36 of the staple 3*a* are retained by the spread-retainers 15*c* of the ascending forming plate 15. In this manner, by retaining both the leg portions 36 by the spread-retainers 15*c* from both the outsides, both the leg portions 36 of the staple 3*a* are prevented from being opened by the spring back. Thus, there can be suppressed an influence caused by the spring back after shaping the staple 3*a* into a shape in which both the edges are bent to one direction so that it becomes possible to execute the next process highly accurately.

The forming plate 15 ascends and it becomes in a state of retaining both the leg portions 36 of the staple 3*a* of a shape in which both the edges are bent to one direction by the spread-retainers 15*c* and thereafter, the driver 18 ascends further, the links 57 rotate and the pusher 17 which is biased by the pusher spring 16 moves forward. Based on this fact, as shown by an arrow l of FIG. 25E, the interlinked staples 2 move forward by the feeding claws 44 and, as shown by an arrow k, the staple 3*a* is pushed out forward by the staple pushing unit 17*a* which is not shown. AS the result thereof, the staple 3*a* shown in FIG. 25E becomes in an equivalent state as the staple 3*c* shown in FIG. 25A.

Figure 30A:
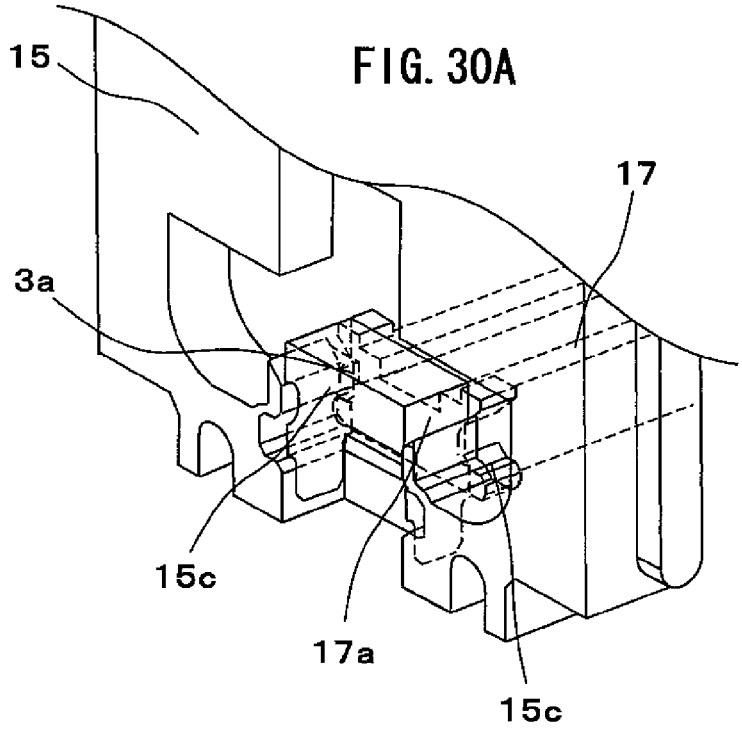
FIG. 30A is an explanatory diagram showing a staple pushing-out method by means of a pusher.
Figure 30B:
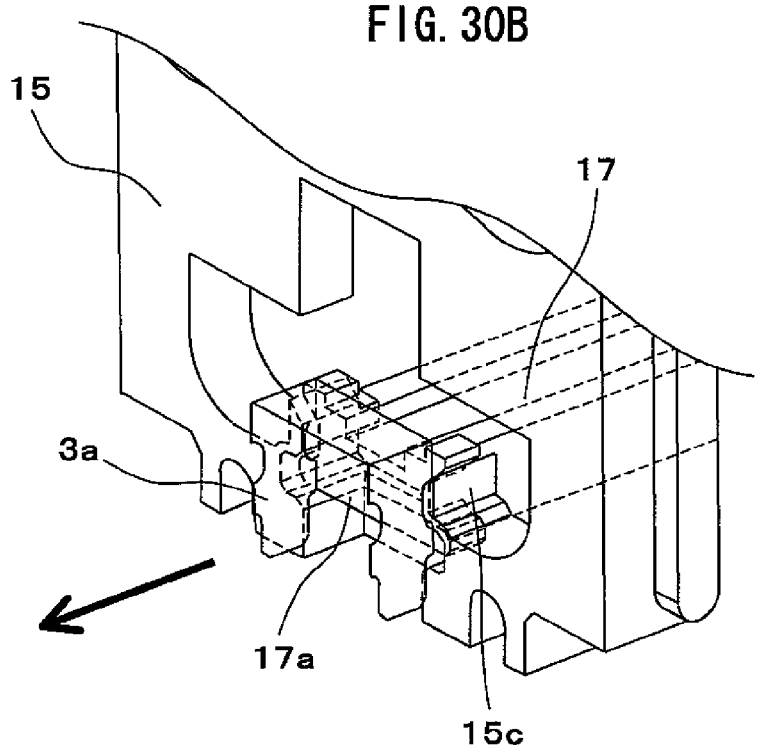
FIG. 30B is an explanatory diagram showing the staple pushing-out method by means of the pusher.
Figure 31:
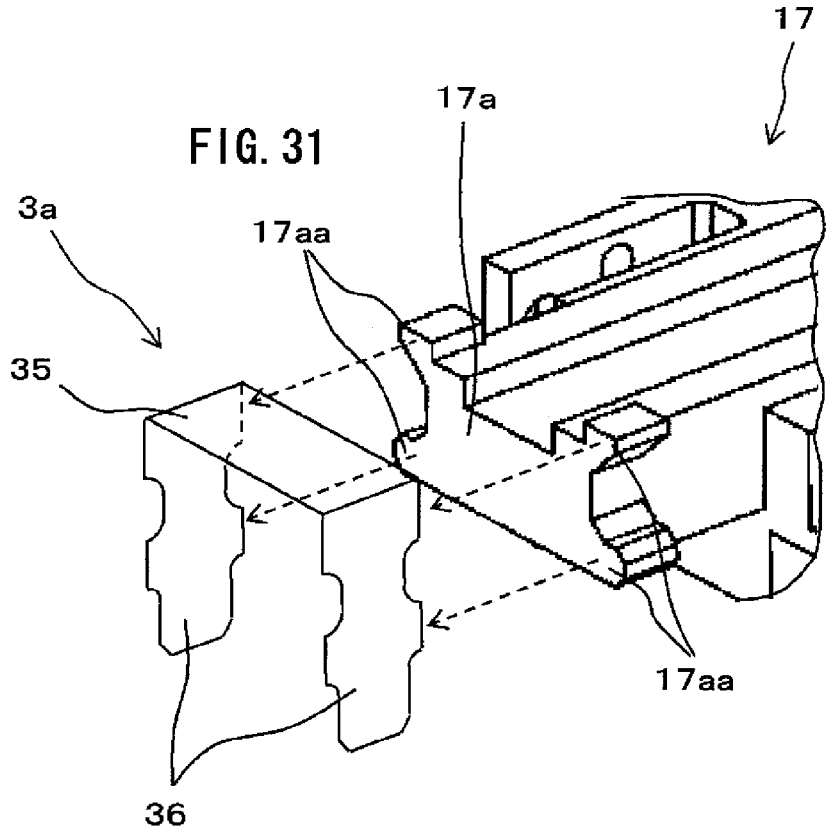
FIG. 31 is an explanatory diagram showing the staple pushing-out method by means of a staple pushing unit.

FIG. 30A, FIG. 30B and FIG. 31 are explanatory diagrams showing a pushing-out method of the staple 3 by the staple pushing unit 17*a* by the pusher 17. As shown in FIG. 30B, by moving the pusher 17 forward, the staple 3 of a shape in which both the edges are bent to one direction is pushed out to a place between two punching blades of the driver 18 from the inside of the forming plate 15 by the staple pushing unit 17. At that time, the push-out of the staple 3*a* by means of the staple pushing unit 17*a* is, as shown in FIG. 31, executed by pushing an upper portion and a lower portion of the rear surface side of both the leg portions 36 of the staple 3 by four protrusion portions 17*aa* which are provided at the staple pushing unit 17*a*.

Thus, the staple 3*a* is never inclined largely and the movement of the staple 3 is executed from the inside of the forming plate 15 to a place between the two punching blades 51 of the driver 18. Consequently, it becomes possible to execute the movement of the staple 3 from the inside of the forming plate 15 to the place between the two punching blades 51 of the driver 18 highly accurately.

Figure 32:
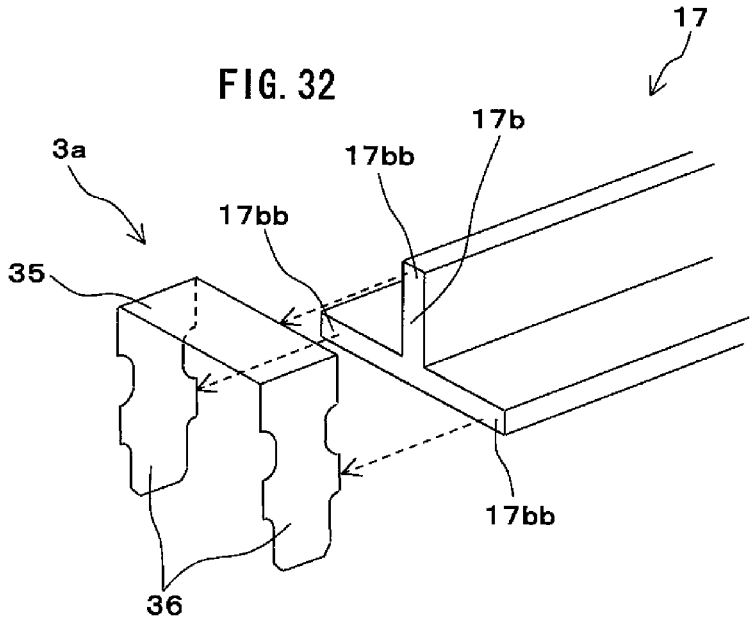
FIG. 32 is an explanatory diagram showing the staple pushing-out method by means of a staple pushing unit of another example.

FIG. 32 is an explanatory diagram showing a staple pushing unit 17*b* of an example of another shape of the pusher 17. As shown in FIG. 32, the staple pushing unit 17*b* may be configured by including three protrusion portions 17*bb*. Depending on the staple pushing unit 17*b* shown in FIG. 32, by pushing the rear surface portion of the crown portion of the staple 3 and the lower portion on the rear surface side of both the leg portions 36 by means of the three protrusion portions 17*bb* provided at the staple push-out portion 17*bb*, the pushing-out of the staple 3*a* is executed.

Thus, similarly as the staple pushing unit 17*a* shown in FIG. 31, the staple 3*a* is never inclined largely and the movement of the staple 3*a* is executed from the inside of the forming plate 15 to a place between the two punching blades 51 of the driver 18, and it becomes possible to execute the movement of the staple 3*a* from the inside of the forming plate 15 to the place between the two punching blades 51 of the driver 18 highly accurately.

Also, in case of using the staple 3 which has an engagement hole at the crown portion 35, the staple pushing unit 17*b* of the pusher 17 may be provided with an engagement unit for being engaged with the crown portion 35 and a pushing unit for pushing the lower portions on the rear surface side of both the leg portions, so that the pushing-out of the staple is executed by pushing the crown portion 35 with the engagement unit and concurrently, by pushing the lower portions on the rear surface side of both the leg portions 36 with the pushing unit.

Thus, similarly as the staple pushing unit 17*a* shown in FIG. 31 and the staple pushing unit 17*b* shown in FIG. 32, the staple 3 is never inclined largely and the movement of the staple 3 is executed from the inside of the forming plate 15 to a place between the two punching blades 51 of the driver 18, and it becomes possible to execute the movement of the staple 3 from the inside of the forming plate 15 to a place between the two punching blades 51 of the driver 18 highly accurately.

(5) Constitution Example of Staple Bending Unit

Next, it will be explained with respect to a constitution example of a staple bending unit which bends both the leg portions 36 of the staple 3 which are penetrated into the binding sheets by a staple penetration unit along the binding sheets 37 and which bonds the binding sheets 37 to the adhesion portion 31 of one leg portion 36 and the one leg portion 36 to the other leg portion 36, respectively.

Figure 33:
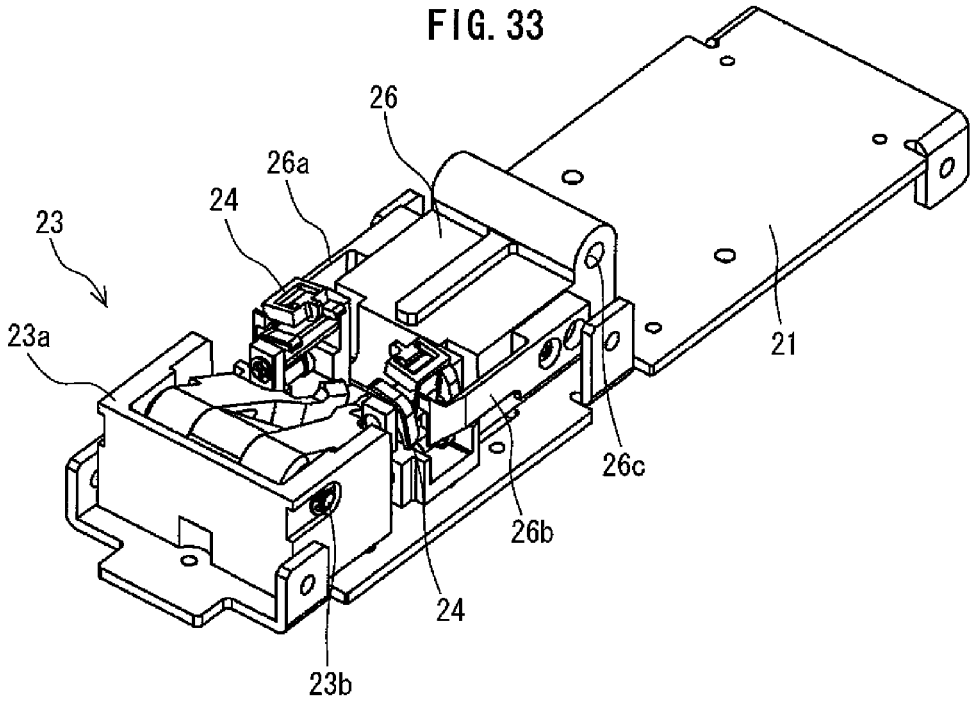
FIG. 33 is an explanatory diagram showing a constitution example of a staple bending unit.
Figure 34A:
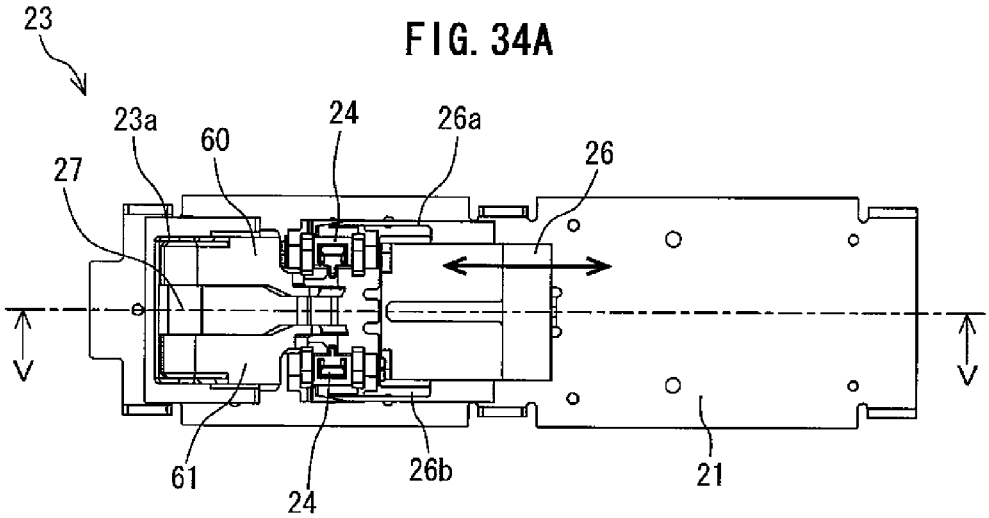
FIG. 34A is an explanatory diagram showing a constitution example of the staple bending unit.
Figure 34B:
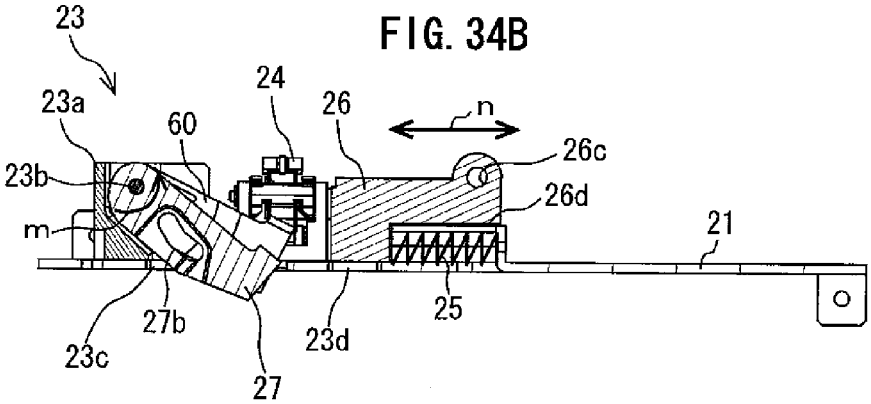
FIG. 34B is an explanatory diagram showing a constitution example of the staple bending unit.
Figure 34C:
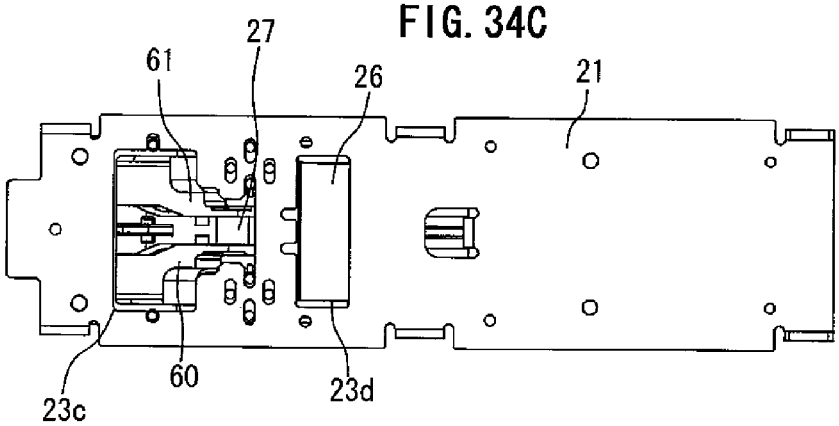
FIG. 34C is an explanatory diagram showing a constitution example of the staple bending unit.

FIG. 33, FIG. 34A, FIG. 34B and FIG. 34C are explanatory diagrams showing a constitution of a portion of the staple bending unit. FIG. 33 is a perspective view of the portion of the staple bending unit showing a constitution thereof. FIG. 34A is a plan view thereof showing a state in which a constitution of the portion of the staple bending unit is seen from the upper side. FIG. 34B is a cross-sectional view thereof showing a constitution of the portion of the staple bending unit, and shows a V-V cross-section of FIG. 34A. FIG. 34C is a plan view thereof showing a state in which a constitution of the portion of the staple bending unit is seen from the lower side.

Figure 35A:
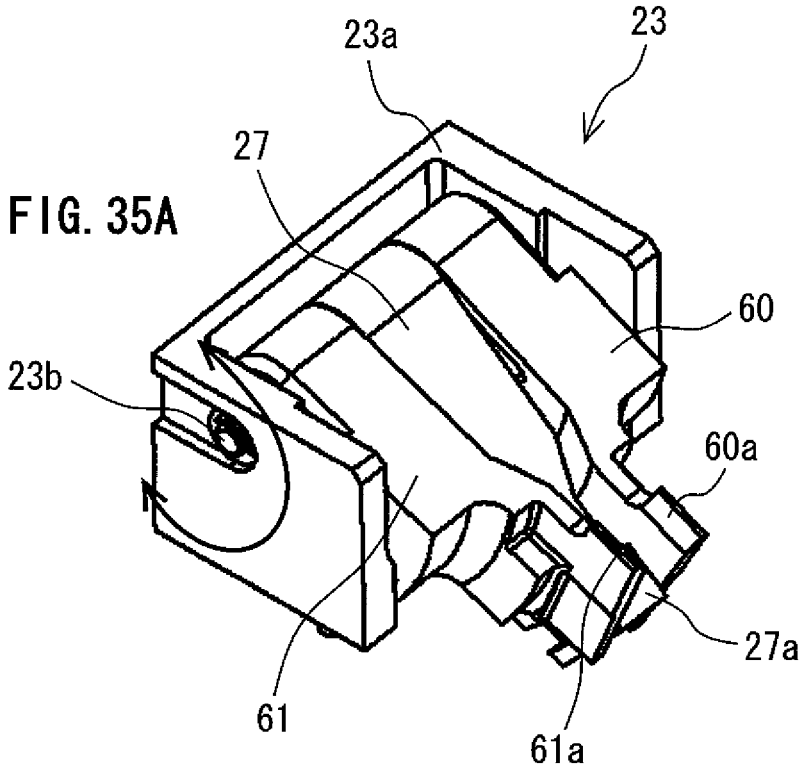
FIG. 35A is an explanatory diagram showing a constitution example of a clincher unit.
Figure 35B:
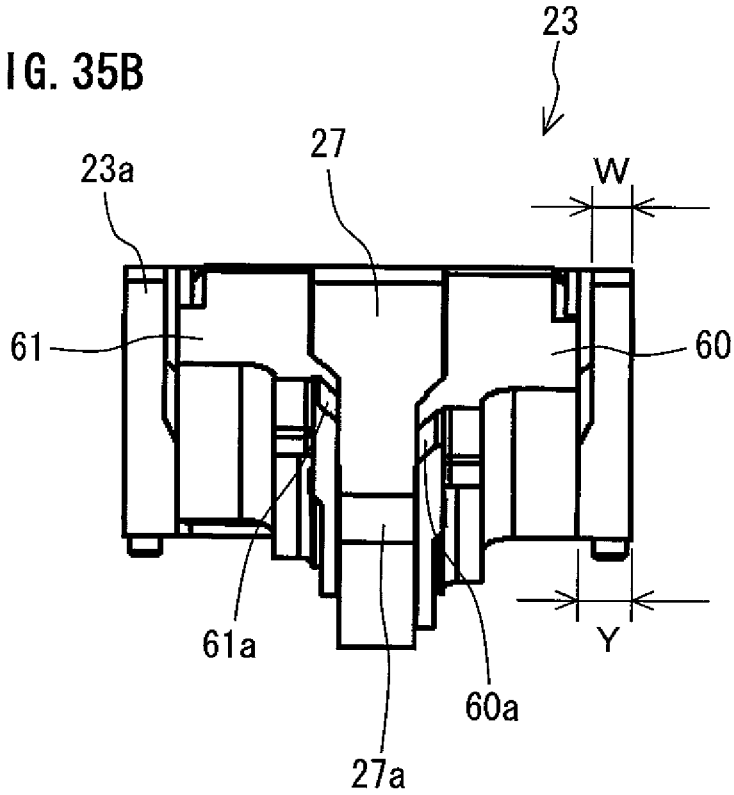
FIG. 35B is an explanatory diagram showing a constitution example of the clincher unit.

As shown in FIG. 33, FIG. 34A, FIG. 34B and FIG. 34C, the staple bending unit is constituted by including the clincher unit 23 attached to the bending unit installation table 21 which is a bottom portion of the frame 8, two pushing-out units 24 and the slider 26. First, it will be explained with respect to a constitution of the clincher unit 23. FIG. 35A and FIG. 35B are explanatory diagrams showing a constitution of the clincher unit 23. FIG. 35A is a perspective view thereof showing a state in which the clincher unit 23 is seen obliquely from the back-side, and FIG. 35B is a rear view of the clincher unit 23.

As shown in FIG. 33, FIG. 34A, FIG. 34B and FIG. 34C, FIG. 35A and FIG. 35B, the clincher unit 23 is constituted by including a rectangular body shaped clincher holder 23*a* whose adjacent two faces are opened, a clincher left 60, a clincher center 27 and a clincher right 61 which are mounted on a clincher shaft 23*b* rotatably in the clincher holder 23*a* as shown by an arrow of FIG. 35A.

The clincher left 60 and the clincher right 61 have shapes becoming the right-left symmetry in each other, they are provided with a bending unit 60*a* and a bending unit 61*a* which are protruded from the clincher holder 23*a* respectively, and they are attached to the clincher holder 23*a* in a state in which the clincher center 27 is sandwiched. Also, the clincher center 27 has a bonding portion 27*a* which is protruded from the clincher holder 23*a*.

Also, screw coil springs, which are not shown, are provided between the clincher left 60 and the clincher center 27 and between the clincher right 61 and the clincher center 27 respectively. Thus, it becomes in a state in which the clincher left 60 is biased upward with respect to the clincher center 27, and the clincher right 61 is biased upward with respect to the clincher center 27.

Also, by groove portions which are not shown and which are provided at the right and the left of the clincher center 27 and by convex portions which are not shown, which are engaged slidably with the groove portions of the right and the left of the clincher center 27, and which are provided at the clincher left 60 and the clincher right 61 respectively, an upper dead point of the clincher left 60 with respect to the clincher center 27 and an upper dead point of the clincher right 61 with respect to the clincher center 27 are fixed. Here, in the stapler 1, for example, the upper dead point of the clincher right 61 with respect to the clincher center 27 is on a higher position than that of the upper dead point of the clincher left 60 with respect to the clincher center 27. Namely, in the stand-by state of the stapler 1, as shown in FIG. 35B or the like, the bending unit 61*a* of the clincher right 61 is on the high position with respect to the bending unit 60*a* of the clincher left 60. The clincher right 61 is one example of the first bending unit, and the clincher left 60 is one example of the second bending unit.

Also, at the position of the bending unit installation table 21 on which the clincher unit 23 is placed, there is formed a clincher opening portion 23*c* as shown in FIG. 34B and FIG. 34C Further, as shown in FIG. 34B, a long hole 27*b* is provided at the clincher center 27. Here, as shown in FIG. 4, the stapler 1 is provided, at the base 9, with the clincher lifter 28, as a portion of the bending unit, for supporting the clincher center 27 and for fixing the position with respect to the base 9. The clincher lifter 28 has the height in response to the base 9, and at an upper edge portion thereof, is provided with a convex portion which is engaged with the long hole 27*b* of the clincher center 27.

As shown by an arrow J of FIG. 4, the position of the clincher center 27 with respect to the base 9 is fixed by rotating the frame 8 with respect to the base 9 on the frame rotating shaft 12 and by changing the position of the convex portion of the clincher lifter 28 in the long hole 27*b* of the clincher center 27. Simultaneously, positions of the clincher left 60 and the clincher right 61 which are biased by the screw coil springs with respect to the clincher center 27 are also fixed.

Also, as shown in FIG. 35B, in each side wall of the clincher holder 23*a*, a lower portion (portion shown by Y) thereof is thicker than an upper portion (portion shown by W) thereof. Consequently, with respect to the width inside the clincher holder 23*a*, the upper portion has broader width than the lower portion. Further, the screw coil springs provided amongst the clincher center 27, the clincher left 60 and the clincher right 61 work also as compressed springs, and biases the clincher left 60 and the clincher right 61 to the directions so that they are pushed and spread to the right and the left with respect to the clincher center 27.

Consequently, the frame 8 rotates counterclockwise in FIG. 4 with respect to the base 9 on the frame rotating shaft 12 so that the clincher center 27 is pushed up by the clincher lifter 28, and by rotating the clincher left 60, the clincher center 27 and the clincher right 61 in the direction shown by an arrow m of FIG. 34B, the clincher left 60 and the clincher right 61 are pushed and spread to the right and the left with respect to the clincher center 27.

Next, it will be explained with respect to constitutions of the pushing-out units 24. Two pushing-out units 24 attached on the bending unit installation table 21 shown in FIG. 33 are provided with the same constitution. Also, the respective pushing-out units 24 are placed on the positions corresponding to the driver 18. FIG. 36A, FIG. 36B, FIG. 36C, FIG. 36D, FIG. 37A, FIG. 37B, FIG. 37C, FIG. 37D, FIG. 37E and FIG. 37F are explanatory diagrams showing a constitution of the pushing-out unit 24. FIG. 36A, FIG. 36B, FIG. 37A, FIG. 37B and FIG. 37C show a state in which a cam 24*a* and a push-out pusher 24*b* which are mentioned later are at the stand-by position thereof. FIG. 36C, FIG. 36D, FIG. 37D, FIG. 37E and FIG. 37F show a state in which the cam 24*a* and the push-out pusher 24*b* which are mentioned later are at the push-out position thereof.

Figure 36A:
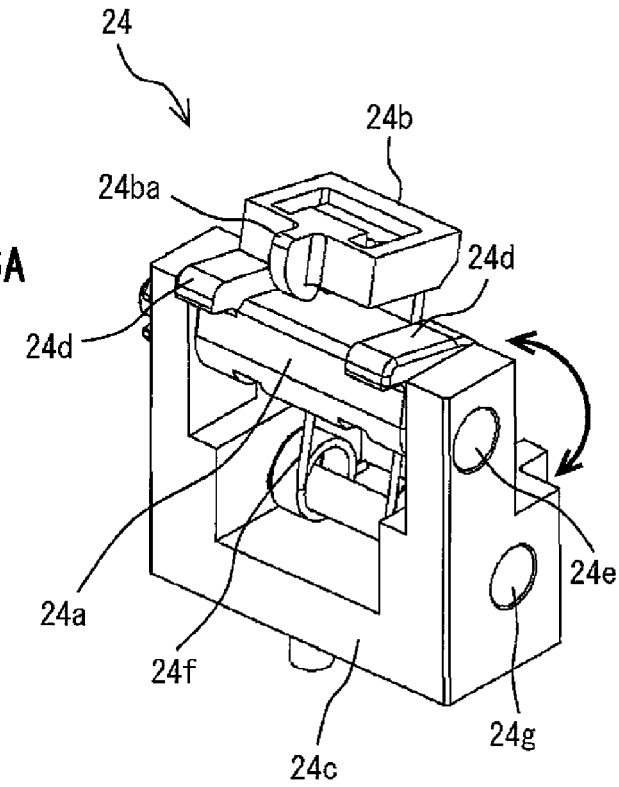
FIG. 36A is an explanatory diagram showing a constitution example of a pushing-out unit.
Figure 36B:
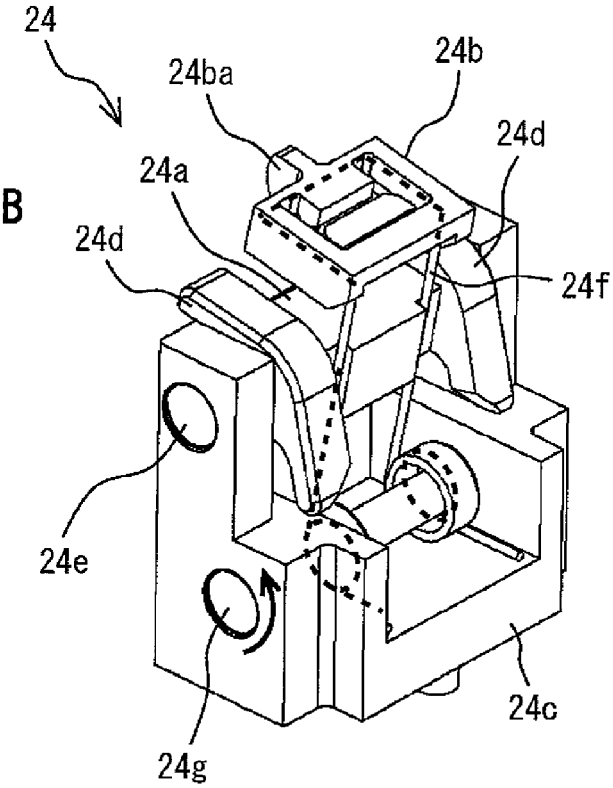
FIG. 36B is an explanatory diagram showing a constitution example of the pushing-out unit.
Figure 36C:
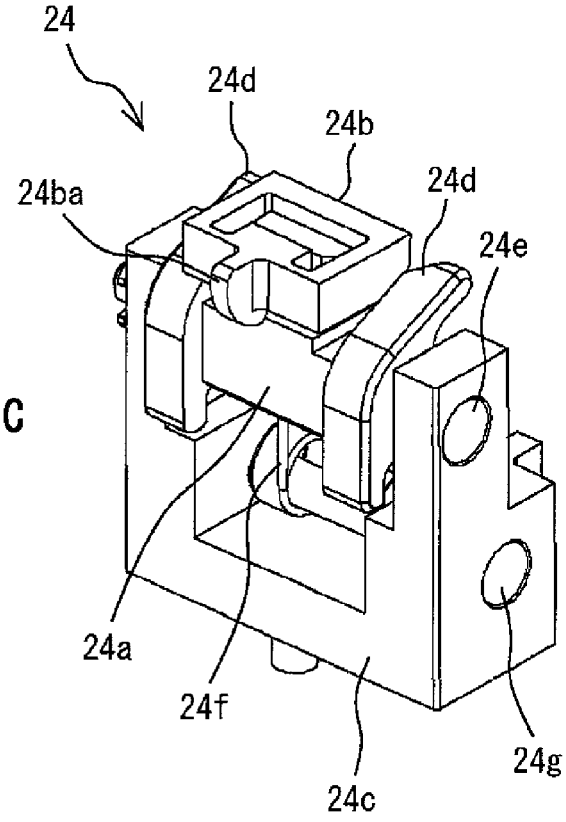
FIG. 36C is an explanatory diagram showing a constitution example of the pushing-out unit.
Figure 36D:
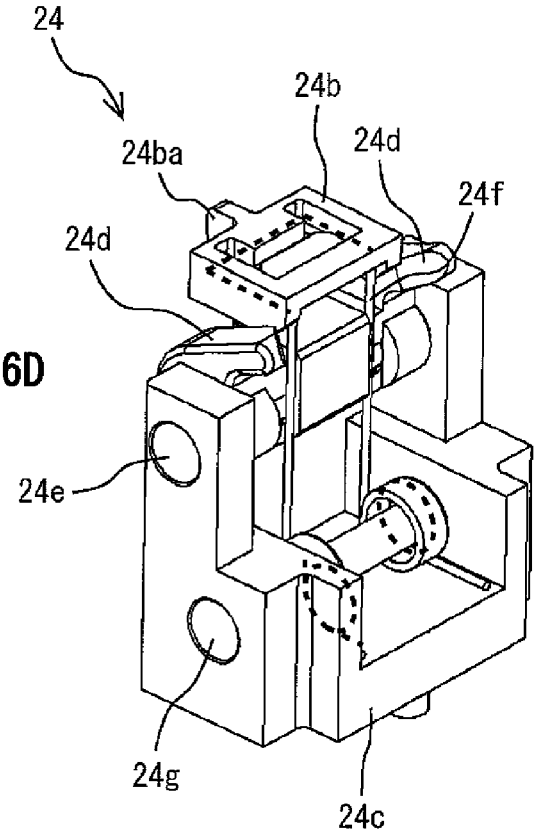
FIG. 36D is an explanatory diagram showing a constitution example of the pushing-out unit.
Figure 37A:
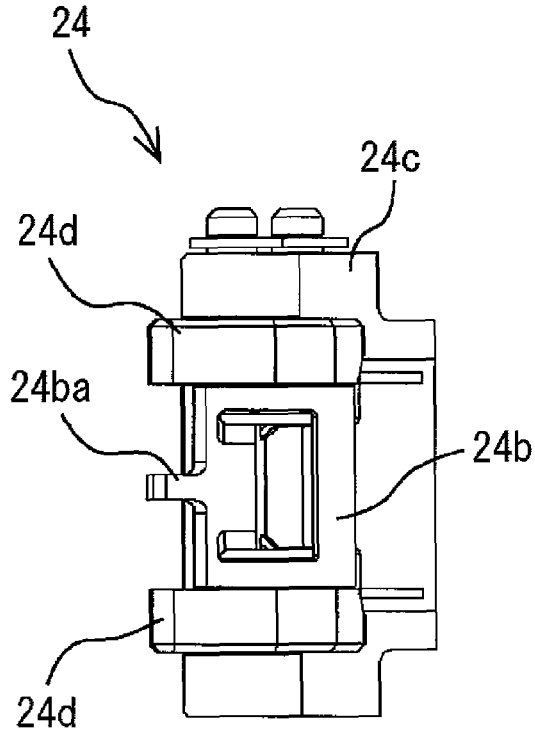
FIG. 37A is an explanatory diagram showing a constitution example of the pushing-out unit.
Figure 37B:
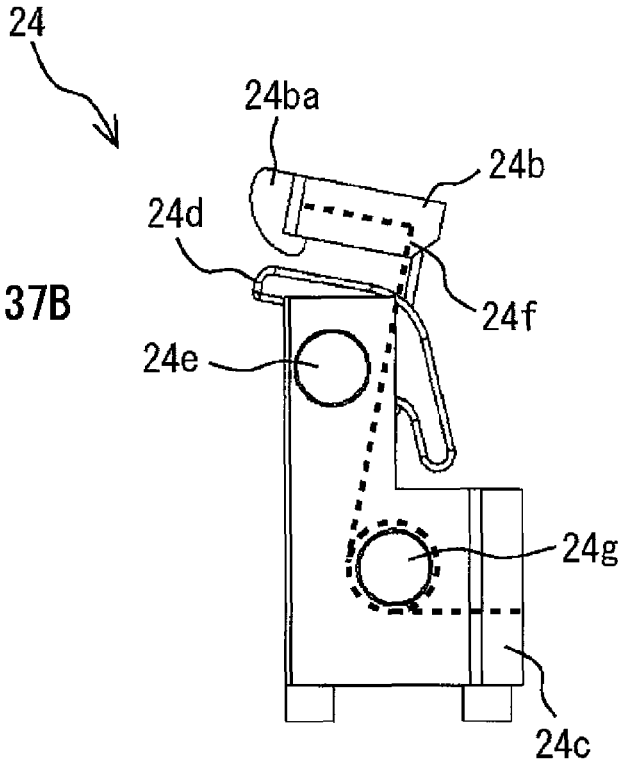
FIG. 37B is an explanatory diagram showing a constitution example of the pushing-out unit.
Figure 37C:
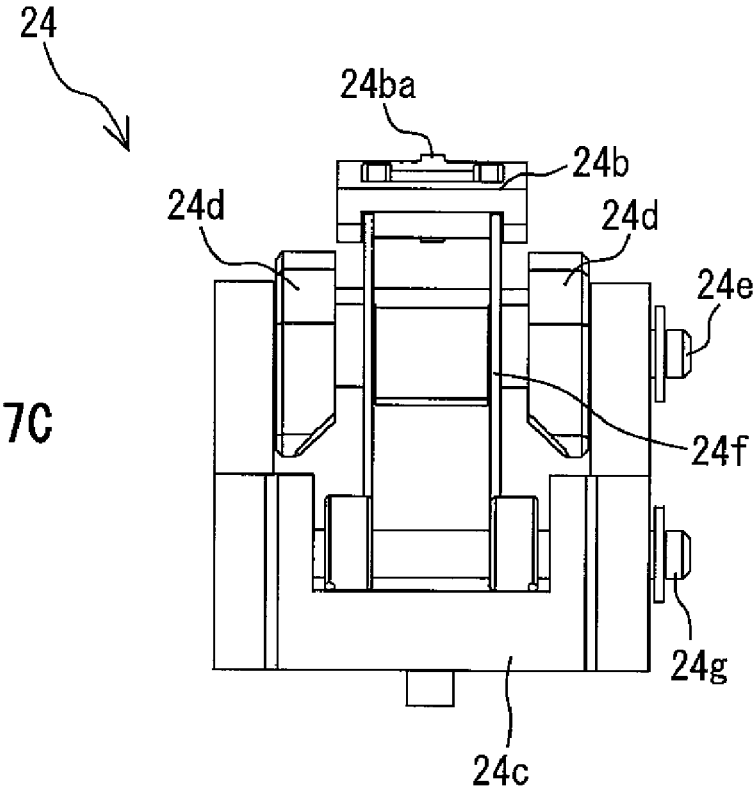
FIG. 37C is an explanatory diagram showing a constitution example of the pushing-out unit.
Figure 37D:
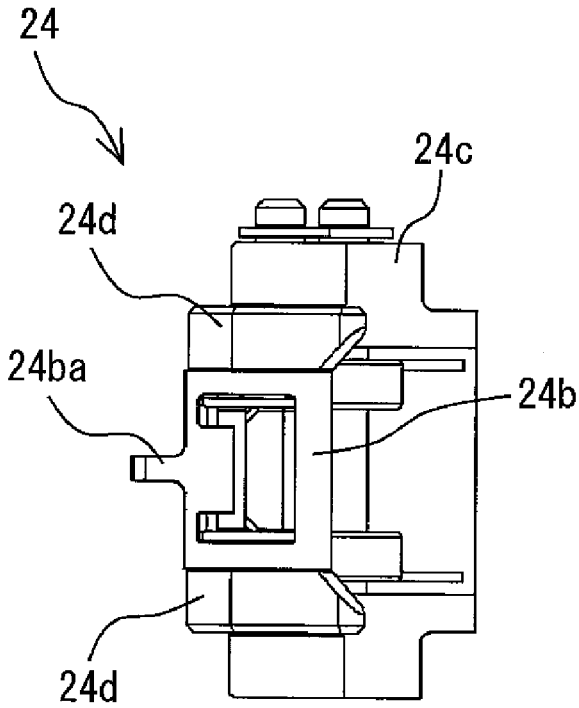
FIG. 37D is an explanatory diagram showing a constitution example of the pushing-out unit.
Figure 37E:
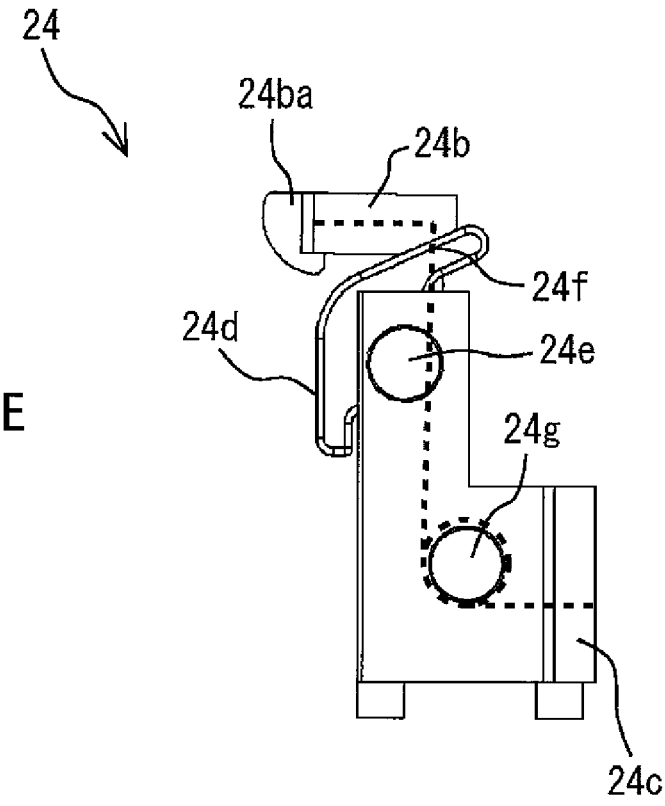
FIG. 37E is an explanatory diagram showing a constitution example of a pushing-out unit.
Figure 37F:
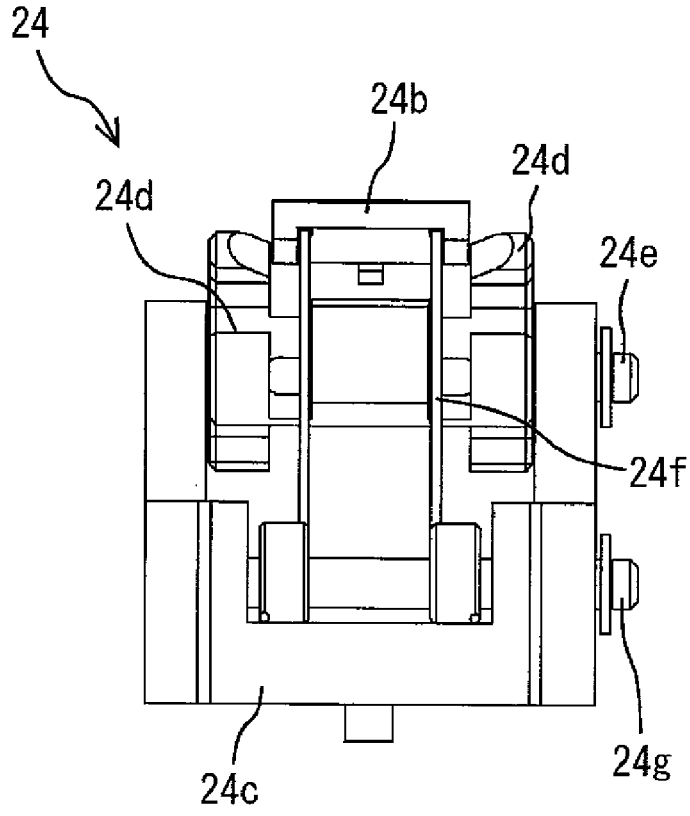
FIG. 37F is an explanatory diagram showing a constitution example of the pushing-out unit.

Also, FIG. 36A, FIG. 36B, FIG. 36C and FIG. 36D are perspective views of the pushing-out unit 24 respectively, FIG. 37A and FIG. 37D are plan views of the pushing-out unit 24, FIG. 37B and FIG. 37E are front views of the pushing-out unit 24, and FIG. 37C and FIG. 37F are side views of the pushing-out unit 24.

As shown in FIG. 36A, FIG. 36B, FIG. 36C, FIG. 36D, FIG. 37A, FIG. 37B, FIG. 37C, FIG. 37D, FIG. 37E and FIG. 37F, the pushing-out unit 24 is constituted by including a pushing-out unit-base 24*c* having a shape in which an upper portion thereof is opened, the cam 24*a* and the push-out pusher 24*b*. The cam 24*a* is provided with claw portions 24*d* each having a curved shape at both the edges, and is mounted rotatably on a cam shaft 24*e* to the pushing-out unit-base 24*c* in the pushing-out unit-base 24*c* as shown by an arrow of FIG. 36A.

The push-out pusher 24*b* includes a rectangular body formed shape, and is attached to an upper end portion of a double torsion spring 24*f*. The double torsion spring 24*f* is attached rotatably on a double torsion spring shaft 24*g* in the pushing-out unit-base 24*c*. Thus, the push-out pusher 24*b* becomes in a state of being biased in an arrow direction shown in FIG. 36B. Also, the push-out pusher 24*b* is provided with an arc shaped push-out portion 24*ba* of thin plate in the direction in which the push-out pusher is biased by the double torsion spring 24*f*. This push-out portion 24*ba* includes an insertable shape for the push-out hole 51*ac* of the first punching blade 51*a* shown in FIG. 21A and FIG. 21B and the push-out hole 51*bc* of the second punching blade 51*b* shown in FIG. 22A and FIG. 22B.

By making the cam 24*a* rotate counterclockwise in FIG. 37B in a state in which the push-out pusher 24*b* is at the stand-by position shown in FIG. 36A, FIG. 36B, FIG. 37A, FIG. 37B and FIG. 37C, the push-out pusher 24*b* which is biased by the double torsion spring 24*f*, as shown in FIG. 36C, FIG. 36D, FIG. 37D, FIG. 37E and FIG. 37F, moves to the push-out position thereof. On the other hand, by making the cam 24*a* rotate clockwise in FIG. 37E in a state in which the push-out pusher 24*b* is at the push-out position, the double torsion spring 24*f* is pushed by the cam 24*a* and the push-out pusher 24*b* moves to the stand-by position.

Figure 38A:
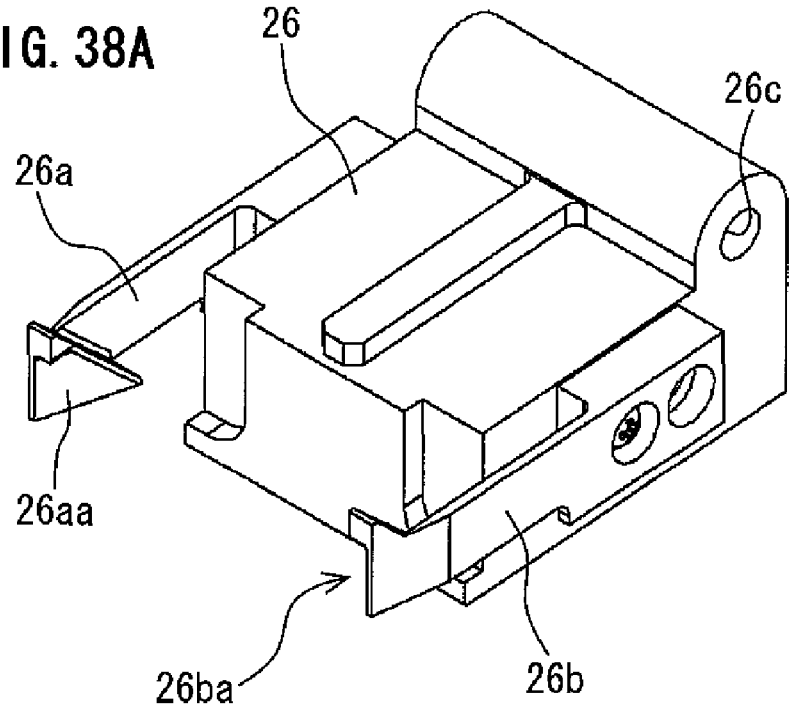
FIG. 38A is an explanatory diagram showing a constitution example of a slider.
Figure 38B:
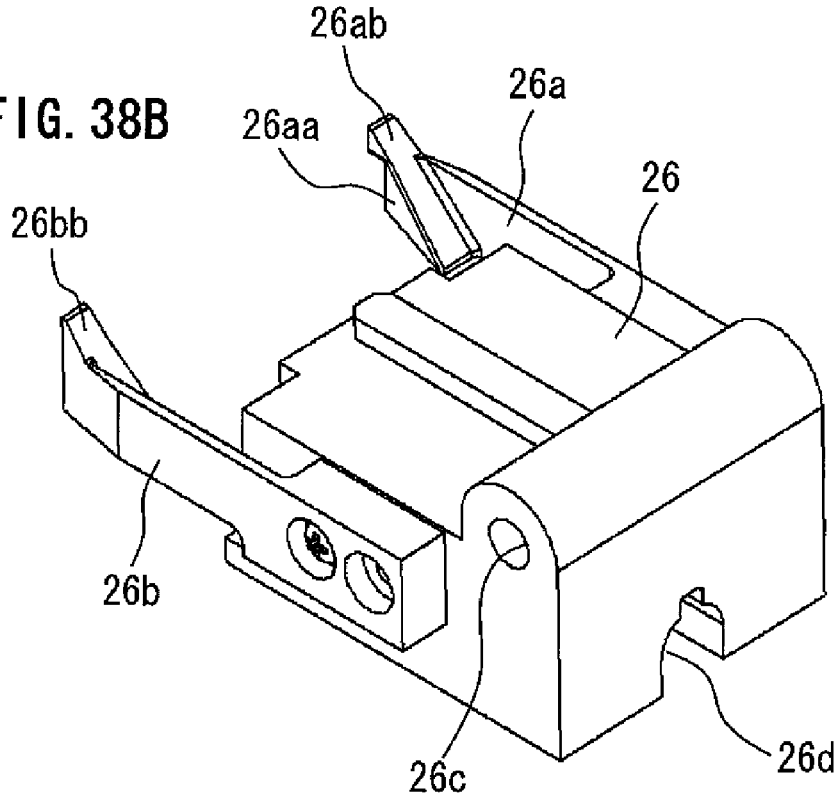
FIG. 38B is an explanatory diagram showing a constitution example of the slider.
Figure 39A:
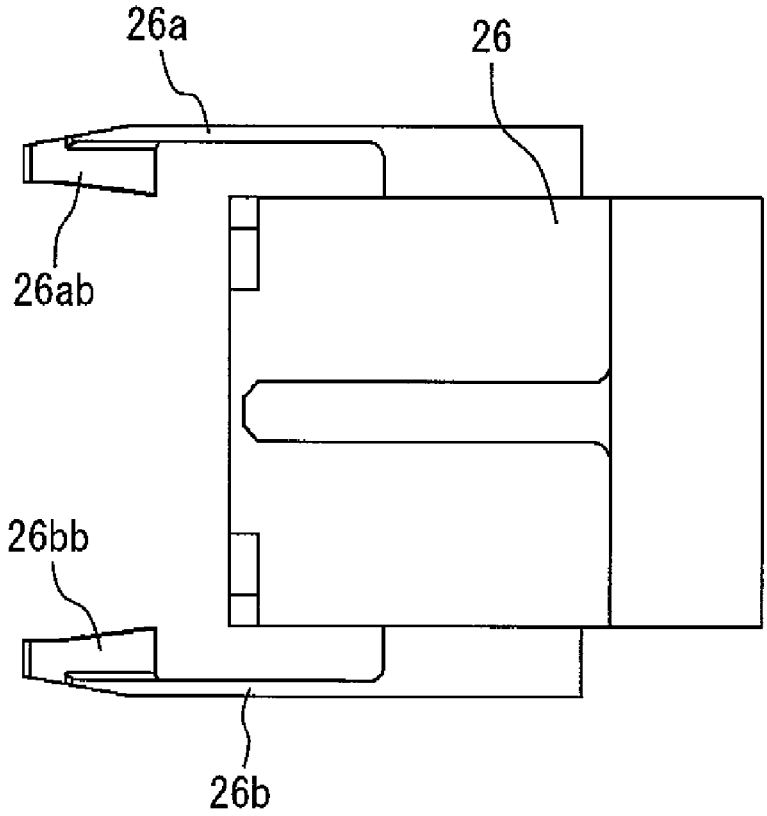
FIG. 39A is an explanatory diagram showing a constitution example of the slider.
Figure 39B:
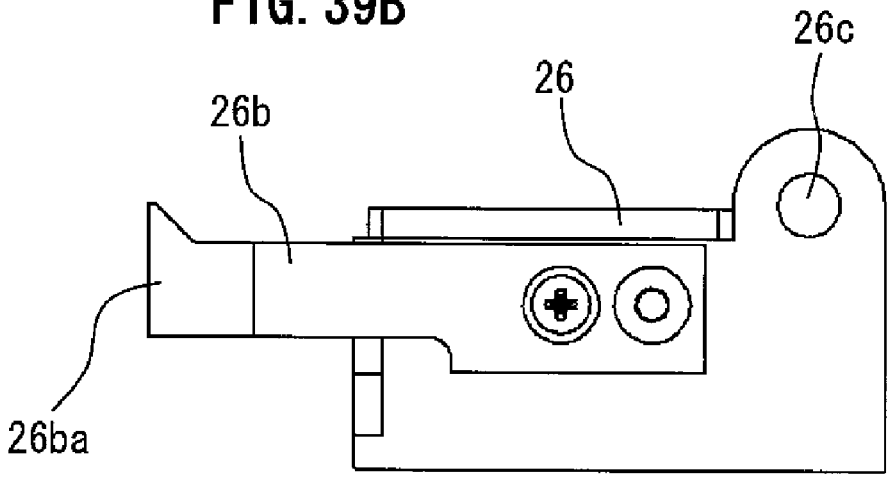
FIG. 39B is an explanatory diagram showing a constitution example of the slider.

Next, it will be explained with respect to a constitution example of the slider 26. FIG. 38A and FIG. 38B, FIG. 39A and FIG. 39B are explanatory diagrams showing a constitution example of the slider 26. FIG. 38A is a perspective view thereof showing a state in which the slider 26 is seen obliquely from the front, and FIG. 38B is a perspective view thereof showing a state in which the slider 26 is seen obliquely from the back-side. FIG. 39A is a plan view of the slider 26, and FIG. 39B is a side view of the slider 26.

As shown in FIG. 38A, FIG. 38B, FIG. 39A and FIG. 39B, the slider 26 has a rectangular body formed shape, and is provided with a slider arm 26*a* and a slider arm 26*b* which extend toward the front from both the edges thereof. The slider arm 26*a* is provided with an arm slope surface 26*aa* and an arm slope surface 26*ab* at the front edge portion thereof. The arm slope surface 26*aa* is formed in the inside of the slider 26, and is formed so as to have an angle faced to the lower side and the front side. The arm slope surface 26*ab* is formed in the inside of the slider 26, and is formed so as to have an angle faced to the upper side and the back side at the rear portion of the side arm slope surface 26*aa*.

The slider arm 26*b* is also provided with an arm slope surface 26*ba* and an arm slope surface 26*bb* at the front edge portion thereof similarly as the slider arm 26*a*. The arm slope surface 26*ba* is formed in the inside of the slider 26 and is formed so as to have an angle faced to the lower side and the front side. The arm slope surface 26*bb* is formed in the inside of the slider 26 and is formed so as to have an angle faced to the upper side and the back side at the rear portion of the side arm slope surface 26*ba*.

Also, the slider 26 is provided with a slider shaft hole 26*c* into which a slider shaft 63 is inserted in the vicinity of the rear edge portion and is attached slidably forward and backward as shown by an arrow of FIG. 34A and an arrow n of FIG. 34B. In a state in which the stapler 1 is assembled, as shown in FIG. 2, the slider shaft 63 becomes in a state of being positioned in a long hole 64 of the frame 8. Here, the links 57 rotate in the direction shown by an arrow E of FIG. 2 by pushing down the handle 5 and by descending the driver main body portion 18*a*, and the slider 26 moves backward by engaging a protrusion portions 57*c* provided at lower end portions of the links 57 with the slider shaft 63 to push the slider shaft 63 backward.

Further, the slider 26 includes a slider spring hole 26*d*, on a rear surface portion thereof, in which the slider spring 25 is placed, and becomes in a state of being biased forward with respect to the bending unit installation table 21 by the slider spring 25 in a state in which the stapler 1 is assembled. Also, as shown in FIG. 34B and FIG. 34C, at a lower portion of the bending unit installation table 21 under the slider 26, a slider hole portion 23*d* of a predetermined size is formed.

Next, it will be explained with respect to the relationship between operations of the pushing-out units 24 and the clincher unit 23. As shown in FIG. 33, FIG. 34A, FIG. 34B and FIG. 34C, the respective pushing-out units 24 are arranged at the positions sandwiching the place in which the bending unit 60*a* of the clincher left 60, the bonding portion 27*a* of the clincher center 27 and the bending unit 61*a* of the clincher right 61 move upward and downward. In a state in which the push-out pusher 24*b* of the each pushing-out unit 24 is at the push-out position, by rotating the clincher left 60, the clincher center 27 and the clincher right 61 in the direction shown by an arrow of FIG. 34B and by pushing up the claw portions 24*d* of the each pushing-out unit 24 by the clincher left 60 and the clincher right 61, the cam 24*a* rotates and the push-out pusher 24*b* moves to the stand-by position.

Next, it will be explained with respect to the relationship between operations of the pushing-out units 24 and the slider 26. In a state shown in FIG. 33, FIG. 34A, FIG. 34B and FIG. 34C, the push-out pusher 24*b* of each of the pushing-out units 24 is at the stand-by position, and front edge portions of the slider arms 26*a*, 26*b* of the slider 26 are between two claw portions 24*d* of each of the pushing-out units 24. By moving the slider 26 backward from that state, the arm slope surface 26*ab* of the slider arm 26*a* and the arm slope surface 26*bb* of the slider arm 26*b* abut against the claw portions 24*d* which are positioned at the rear side of each of the pushing-out units 24, the cam 24*a* rotates and the push-out pusher 24*b* moves to the push-out position.

Also, the push-out pusher 24*b* of each of the pushing-out units 24 is at the stand-by position, and when the slider 26 moves forward from a state in which the front edge portions of the slider arms 26*a*, 26*b* of the slider 26 are disengaged from the place between the two claw portions 24*d* of each of the pushing-out units 24 and are in the back, the arm slope surface 26*aa* of the slider arm 26*a* and the arm slope surface 26*ba* of the slider arm 26*b* abut against the claw portions 24*d* which are positioned at the rear side of each of the pushing-out units 24, so that the slider arms 26*a*, 26*b* are expanded on both the sides, and the front edge portions of the slider arms 26*a*, 26*b* of the slider 26 become in a state of being positioned between the two claw portions 24*d* of each of the pushing-out units 24.

(6) Constitution Example of Other Base Portion

Next, it will be explained with respect to another constitution of the base 9. The stapler 1 is provided with the slider holder 29 for supporting the slider 26. This slider holder 29 is provided at the position corresponding to the slider hole portion 23*d* of the bending unit installation table 21, and becomes in a state of supporting the slider 26 in the stand-by state of the stapler 1, as shown in FIG. 4. The slider becomes in a state of being disengaged from the slider holder 29 by pushing down the handle 5 and by moving the slider 26 backward.

Also, as shown in FIG. 4, the stapler 1 is provided with the return springs 22 for supporting the bending unit installation table 21 on the base 9. The bending unit installation table 21 becomes in a state of being biased clockwise in FIG. 4 on the frame rotating shaft 12 by these return springs 22.

<Operation Example of Stapler>

Figure 40:
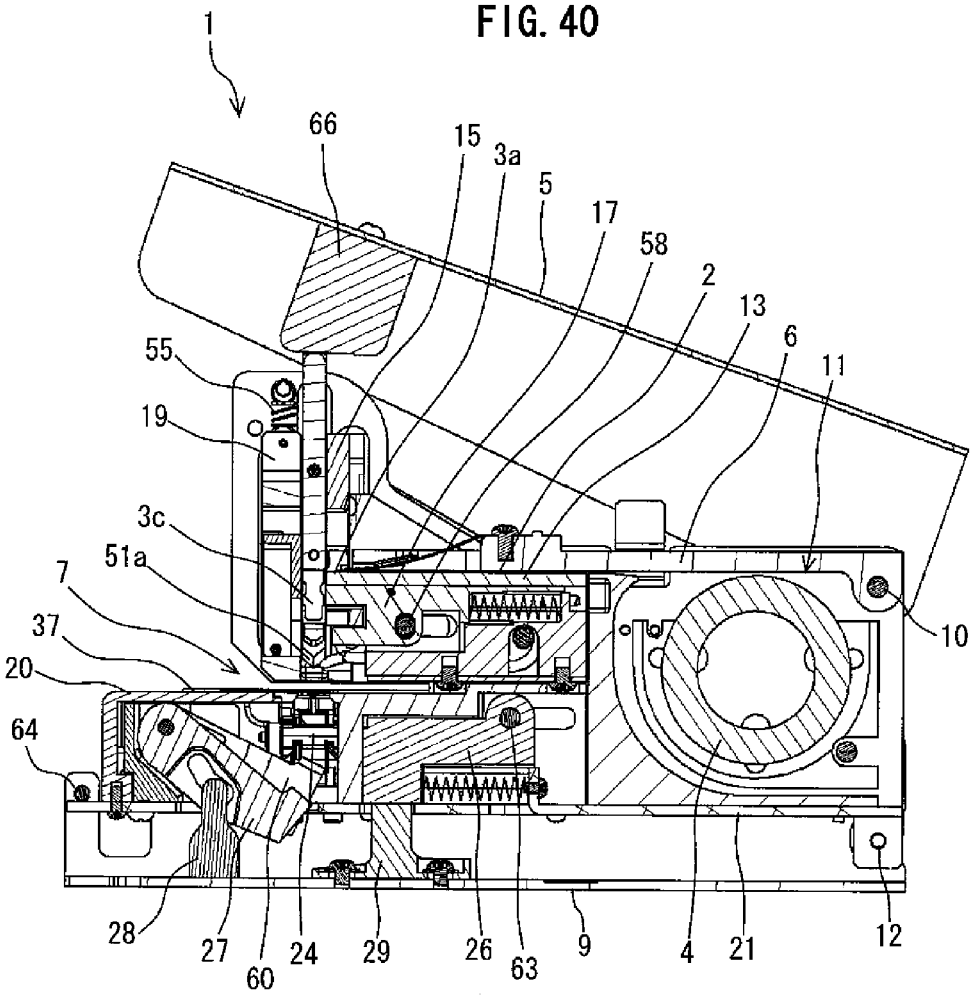
FIG. 40 is a cross-sectional view of a stapler showing a stand-by state thereof.

Next, it will be explained with respect to an operation example of stapler 1. FIG. 40 to FIG. 98B are explanatory diagrams showing operations for binding the binding sheets 37 by using the staple 3 by the stapler 1. FIG. 40 to FIG. 60 are explanatory diagrams showing the stapler 1 in respective states with respect to an H-H cross-section of FIG. 3. FIG. 61 to FIG. 74 are explanatory diagrams showing cross-sections of the paper-sheet pusher 19, the driver main body portion 18*a* and the forming plate 15 in respective states. FIG. 75 to FIG. 95 are explanatory diagrams showing the stapler 1 in respective states with respect to a G-G cross-section of FIG. 2. FIG. 96A to FIG. 98B are explanatory diagrams showing a state of a portion of the staple bending unit in respective states. FIG. 96A, FIG. 97A and FIG. 98A are plan views showing a portion of the staple bending unit, and FIG. 96B, FIG. 97B and FIG. 98B are side views showing the portion of the staple bending unit.

Hereinafter, it will be explained with respect to an operation for binding the binding sheets 37 by using the staple 3 by the stapler 1 with reference to the drawings. FIG. 40, FIG. 61, FIG. 75, FIG. 96A and FIG. 96B are explanatory diagrams showing a state of the respective portions of the stapler 1 in the stand-by state thereof.

In the stand-by state of the stapler 1 shown in FIG. 40, FIG. 61, FIG. 75, FIG. 96A and FIG. 96B, the respective portions of the stapler 1 become in the following states. In the stand-by state of the stapler 1, the roll shaped staple 4 is loaded in the staple holder 11, and as shown in FIG. 10, the interlinked staples 2 pulled out from the roll shaped staple 4 are placed on the feeding path 13 in a state in which the release coated paper 30 is peeled therefrom. Also, the release coated paper 30 peeled from the interlinked staples is placed in a state of being discharged from the release coated paper outlet 39 provided at a rear portion of the stapler 1 through the release coated paper discharge path 40.

Also, at the receiving table portion 13*c* of the feeding path 13 which is a lower portion of the forming plate 15, the staple 3*a* of a leading portion of the interlinked staples 2 is positioned. Further, in the punching blades 51 of the driver 18, there is positioned the staple 3*c* which is shaped in a shape in which both the edges are bet to one direction.

Also, in the stand-by state of the stapler 1, the paper-sheet pusher 19 is biased upward with respect to the frame 8 by the tension spring 55, and is positioned at an upper end portion which is fixed by the convex portions 19*f* and the side grooves 54. The driver 18 is biased upward with respect to the paper-sheet pusher 19 by the screw coil springs 56, and is positioned in a state in which the driver protrusions 18*t* and upper portions of the paper-sheet pusher grooves 19*m* are abutted. The forming plate 15 is positioned at an upper end portion, which is fixed by the convex portions 15*d* and the side grooves 50, by the protrusion pins 18*d* of the driver 18.

Further, in the stand-by state of the stapler 1, the pusher 17 is biased forward by the pusher spring 16, and the staple pushing units 17*a* become in a state of being attached in contact with the punching blades 51 of the driver 18. Also, the slider 26 is biased forward by the slider spring 25 and becomes in a state of being put on the slider holder 29 which is provided at the base 9.

Also, in the stand-by state of the stapler 1, the bending unit installation table 21 which becomes a bottom portion of the frame 8 is biased upward by the return springs 22 of the base 9, and a front edge portion of the bending unit installation table 21 becomes in a state of being attached in contact with a shaft 64 which is fixed at base 9.

Figure 41:
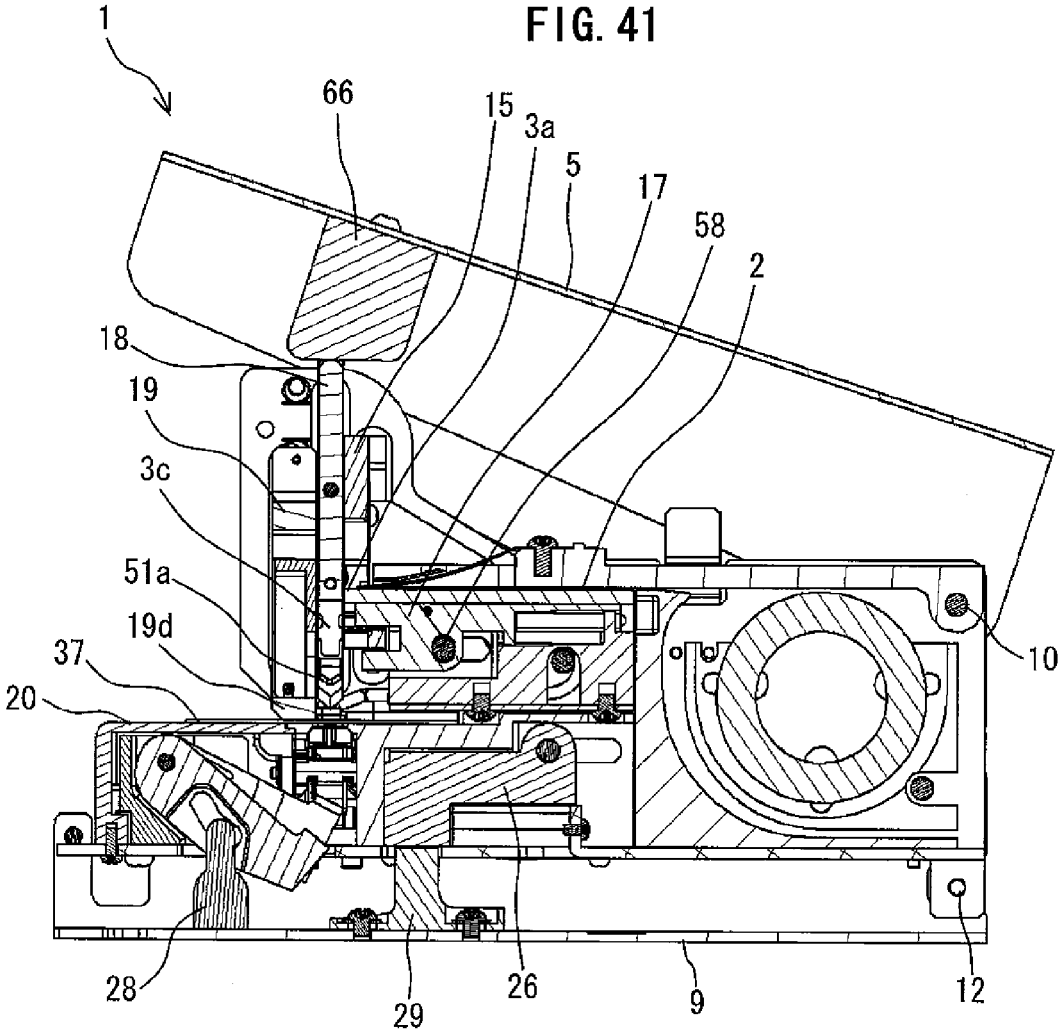
FIG. 41 is a cross-sectional view of the stapler showing a state in which a paper-sheet pusher is placed on a table.
Figure 62:
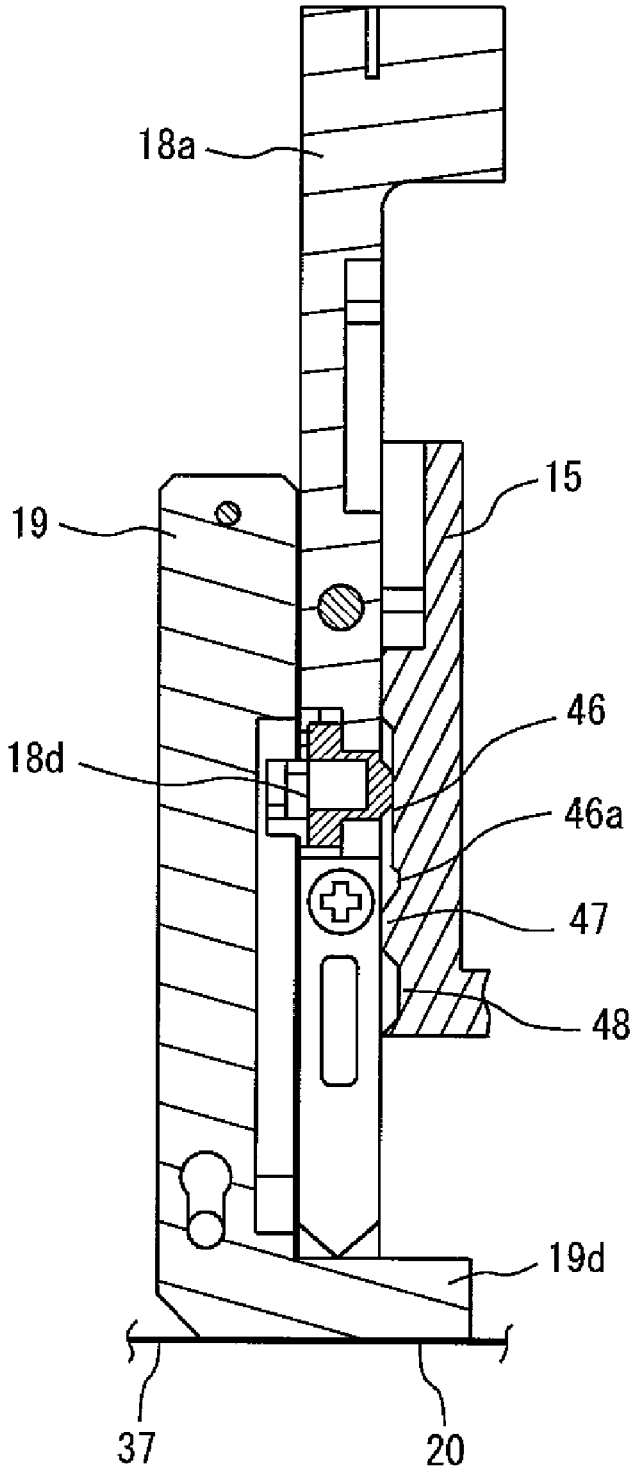
FIG. 62 is a cross-sectional view of the stapler cutoff shaping unit—penetration unit showing a state in which the paper-sheet pusher is placed on the table.
Figure 76:
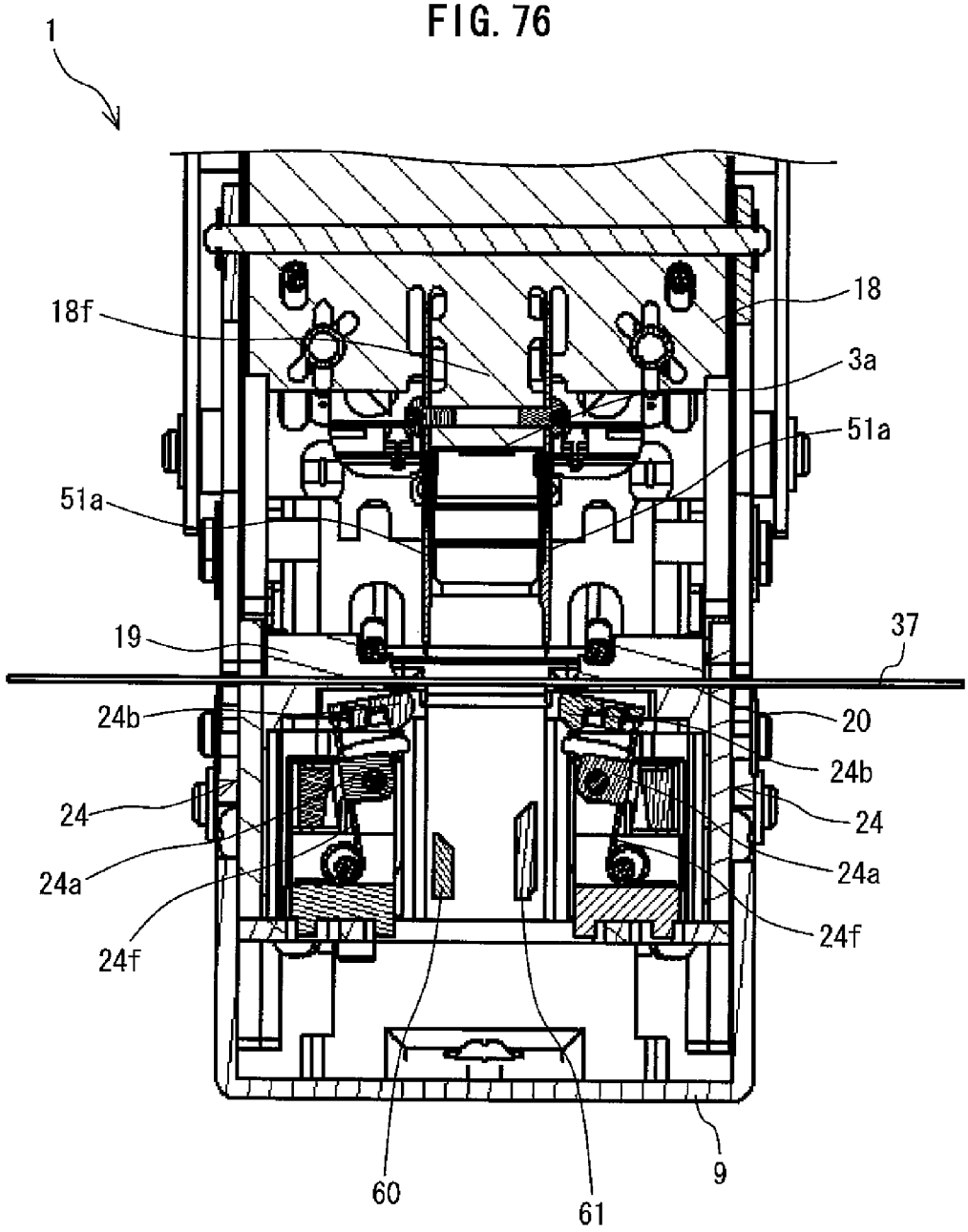
FIG. 76 is a cross-sectional view of the stapler showing a state in which the paper-sheet pusher is placed on the table.

FIG. 41, FIG. 62 and FIG. 76 are explanatory diagrams showing a state of the respective portions of the stapler 1 in a state in which the paper-sheet pusher 19 is contacted on the binding sheets 37 on the table 20. The handle 5 rotates counterclockwise in FIG. 41 on the handle & staple cover rotating shaft 10 by pushing down the handle 5 by a user from the stand-by state shown in FIG. 40 or the like, and the driver 18 is pushed down by the driver pusher 66. Here, as shown in FIG. 13B, the screw coil spring 56 is provided between the paper-sheet pusher main body portion 19*a* and the driver main body portion 18*a*, biases the paper-sheet pusher main body portion 19*a* downward, and concurrently biases the driver main body portion 18*a* upward.

Consequently, by pushing down the driver 18, the paper-sheet pusher 19 is also pushed down downward and as shown in FIG. 41, FIG. 62 and FIG. 76, the binding sheets 37 on the table 20 becomes in a state of being held down by the paper-sheet pusher unit 19*d* of the paper-sheet pusher 19.

Figure 61:
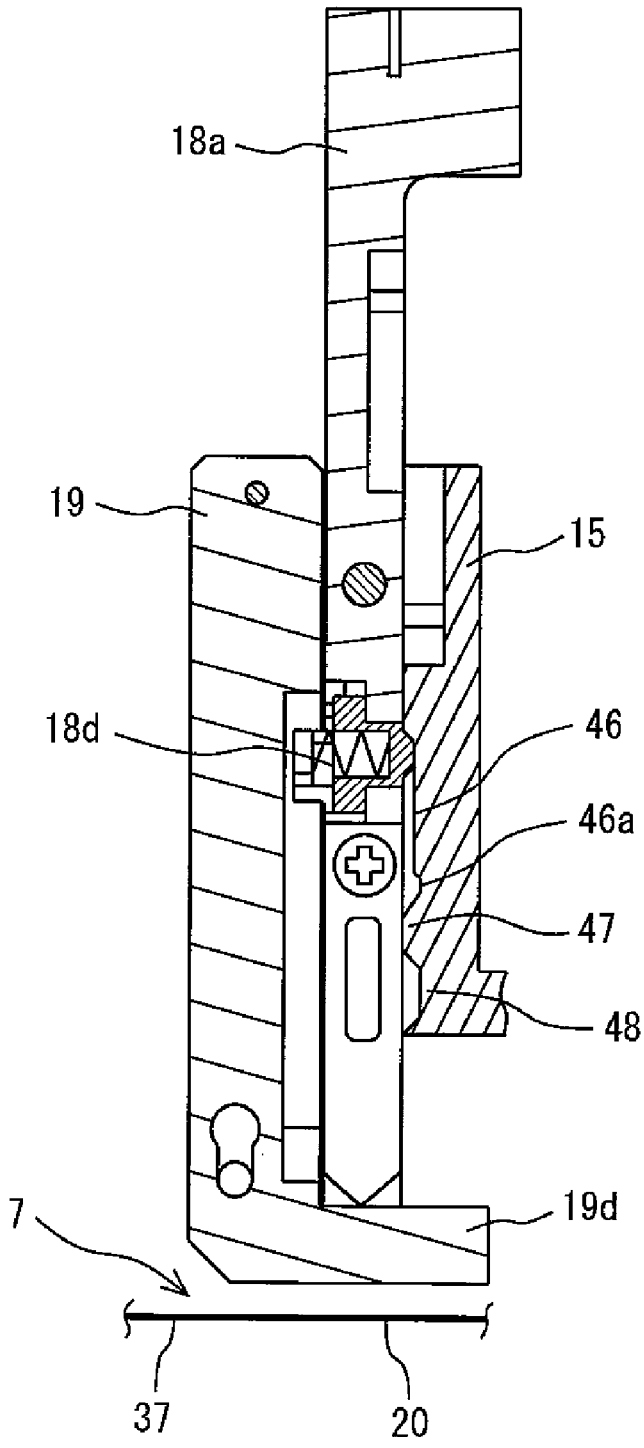
FIG. 61 is a cross-sectional view of a stapler cutoff shaping unit—penetration unit showing a stand-by state thereof.

Also, by pushing down the driver 18, the links 57 rotate in the direction shown by an arrow E of FIG. 2, the pusher shafts 58 engaged with the long holes 57*a* are pushed backward and the pusher 17 starts moving backward. Namely, as shown in FIG. 25B, an engagement with respect to the feeding holes 32 of the interlinked staples 2 by the feeding claws 44 attached to the pusher 17 is disengaged and the back movement starts. Also, as shown in FIG. 61 and FIG. 62, the protrusion pins 18*d* of the driver 18 move in the V-grooves 46 of the forming plate 15.

Figure 42:
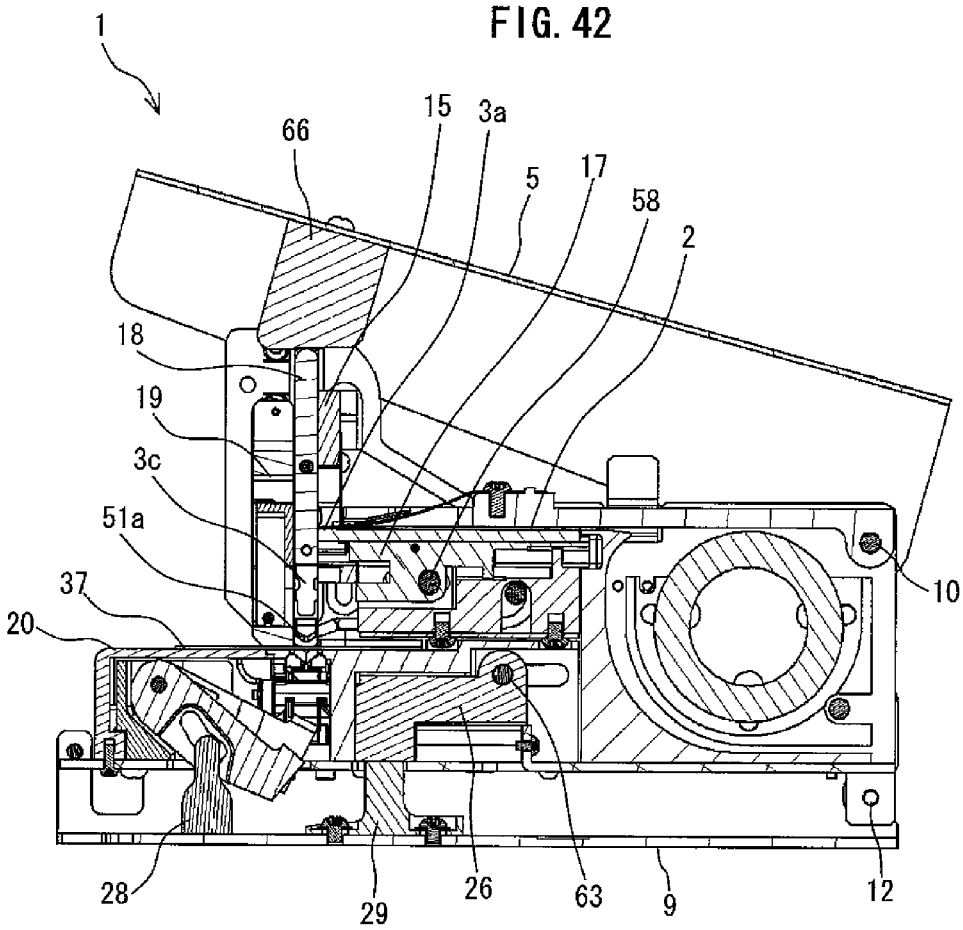
FIG. 42 is a cross-sectional view of the stapler showing a state in which actuation of a forming plate starts.
Figure 63:
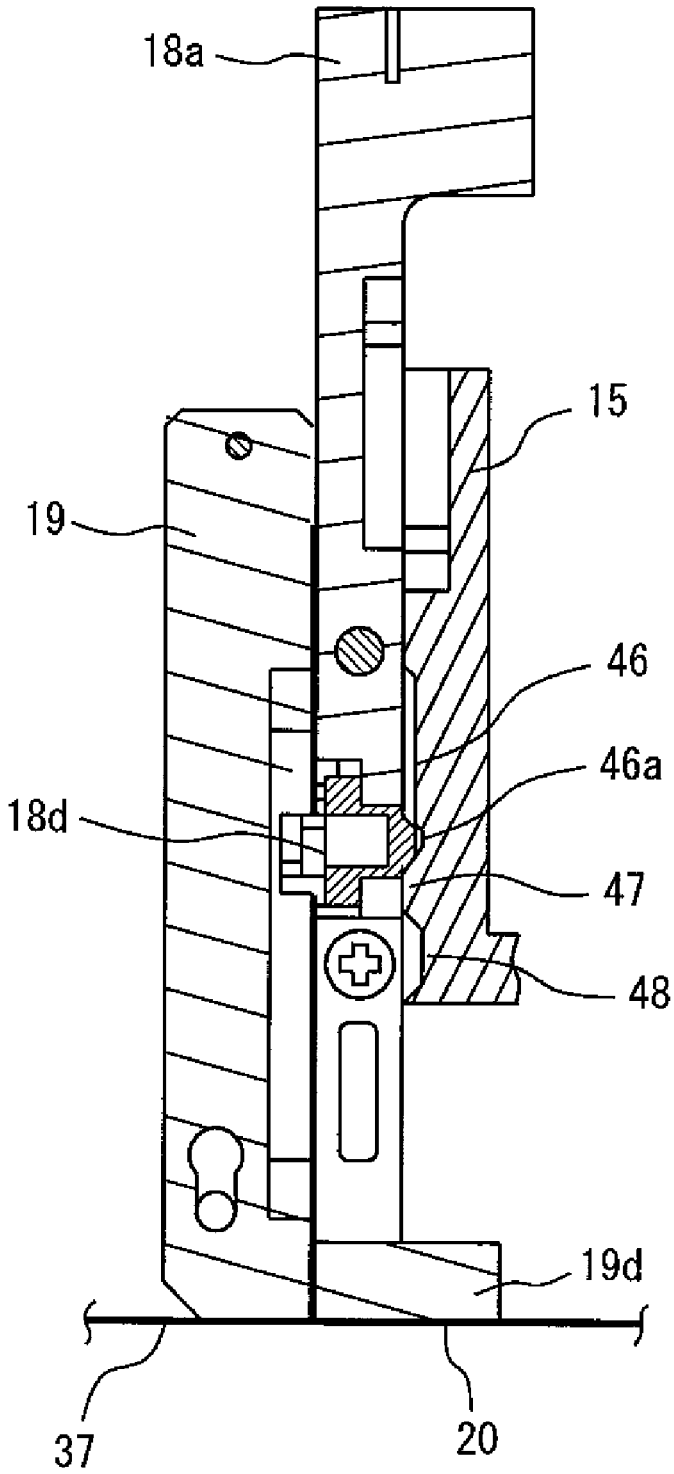
FIG. 63 is a cross-sectional view of the stapler cutoff shaping unit—penetration unit showing a state in which actuation of the forming plate starts.
Figure 77:
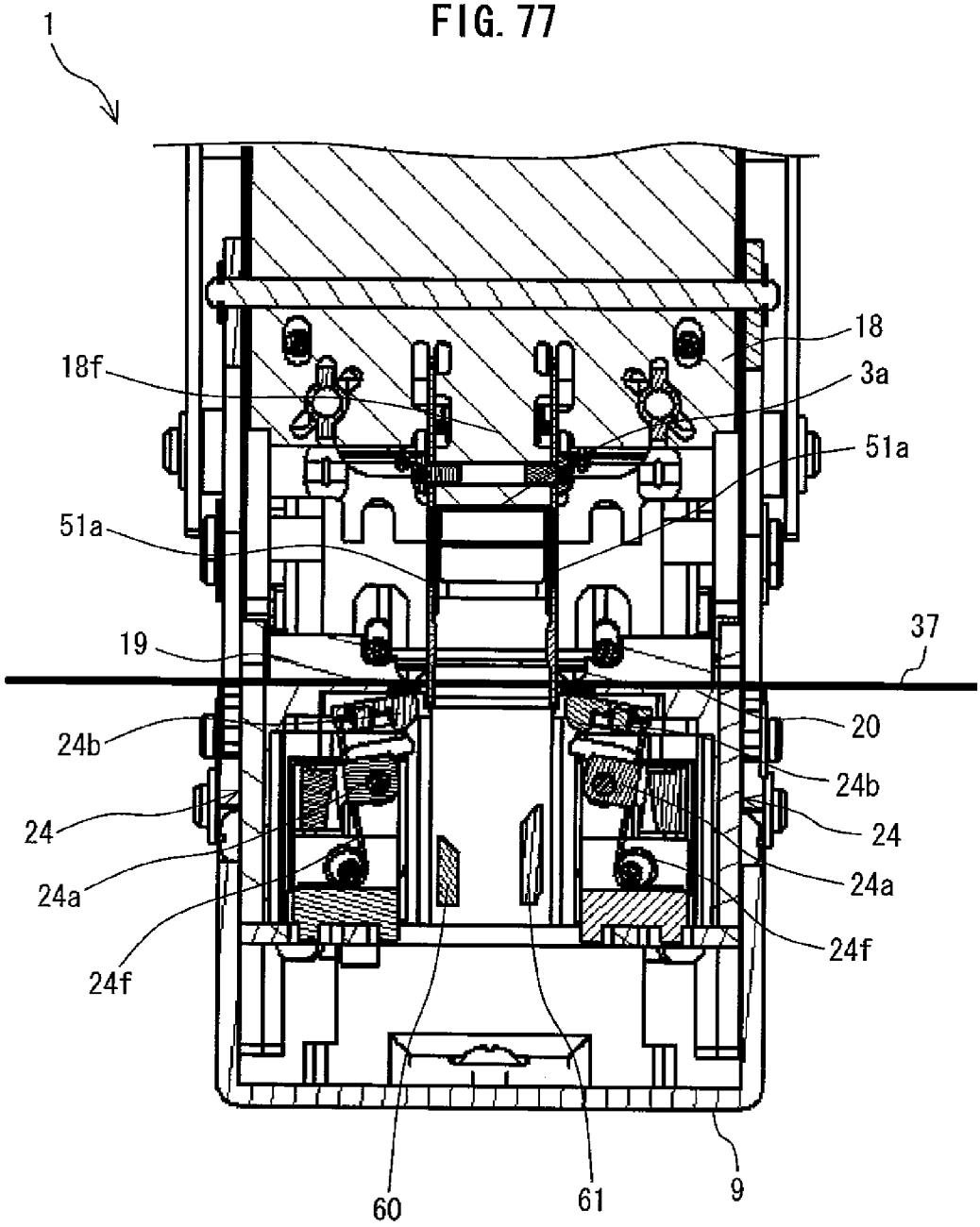
FIG. 77 is a cross-sectional view of the stapler showing a state in which actuation of the forming plate starts.

FIG. 42, FIG. 63 and FIG. 77 are explanatory diagrams showing a state of the respective portions of the stapler 1 in a state in which actuation of the forming plate 15 starts. By pushing down the handle 5 further from a state in which the paper-sheet pusher 19 shown in FIG. 41, FIG. 62 and FIG. 76 is contacted, the handle 5 rotates counterclockwise in FIG. 42 on the handle & staple cover rotating shaft 10 and the driver 18 is pushed down further by the driver pusher 66. Thus, as shown in FIG. 42 and FIG. 77, the punching blades 51 attached to the driver 18 penetrates the binding sheets 37 which are placed on the table 20 and which are held down by the paper-sheet pusher 19.

Also, by pushing down the driver 18 further, the links 57 rotate further in the direction shown by an arrow E of FIG. 2, the pusher shaft 58 engaged with the long hole 57*a* is pushed backward and the pusher 17 moves backward further. Thus, the lower end portion 15*e* of the forming plate 15 shown in FIG. 14 becomes in a state of being disengaged from the L-shaped arm 17*d* of the pusher 17.

Also, as shown in FIG. 63, the protrusion pins 18*d* of the driver 18 move in the V-grooves 46 of the forming plate 15, and arrives at the lower end portions 46*a* of the V-grooves 46. The forming plate 15 starts descending together with the driver 18 in a state in which the protrusion pins 18*d* are engaged with the lower end portions 46*a* of the V-grooves 46 by descending the driver 18 further, after arriving the protrusion pins 18*d* of the driver 18 at the lower end portions 46*a* of the V-grooves 46.

Figure 43:
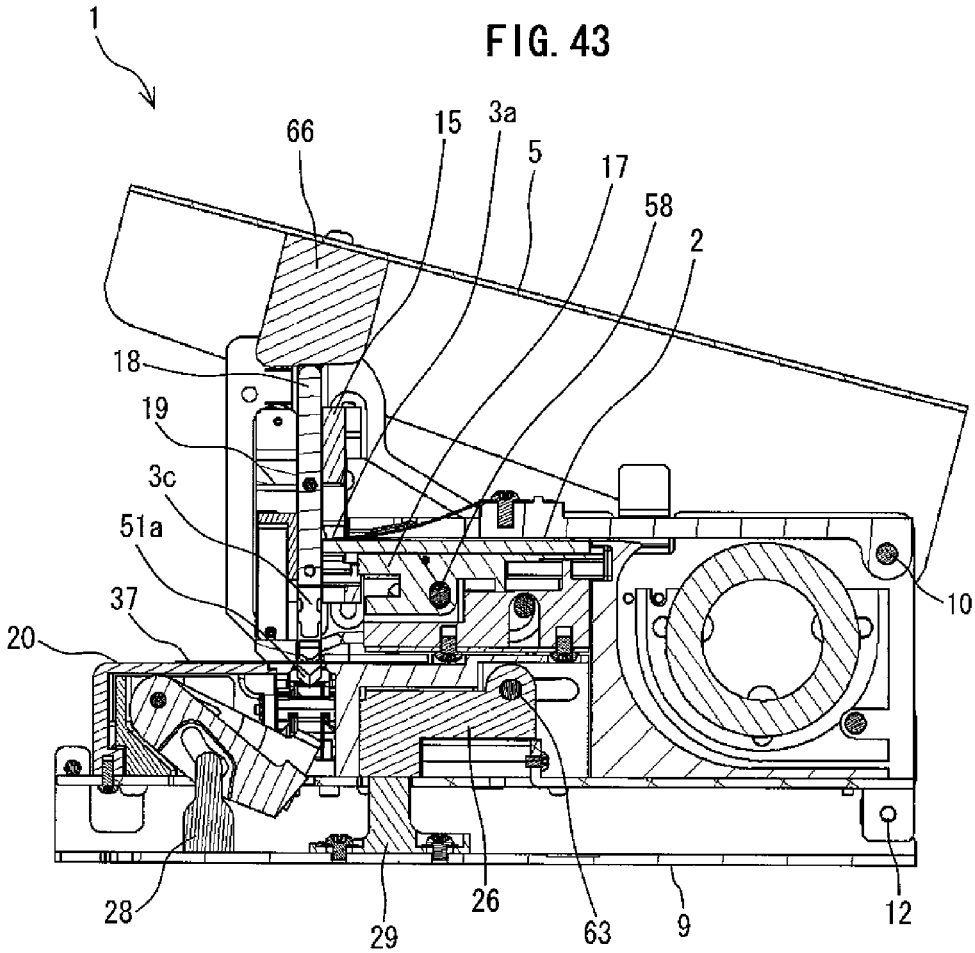
FIG. 43 is a cross-sectional view of the stapler showing a state in which cutoff of a staple starts and a movement of the slider starts.
Figure 64:
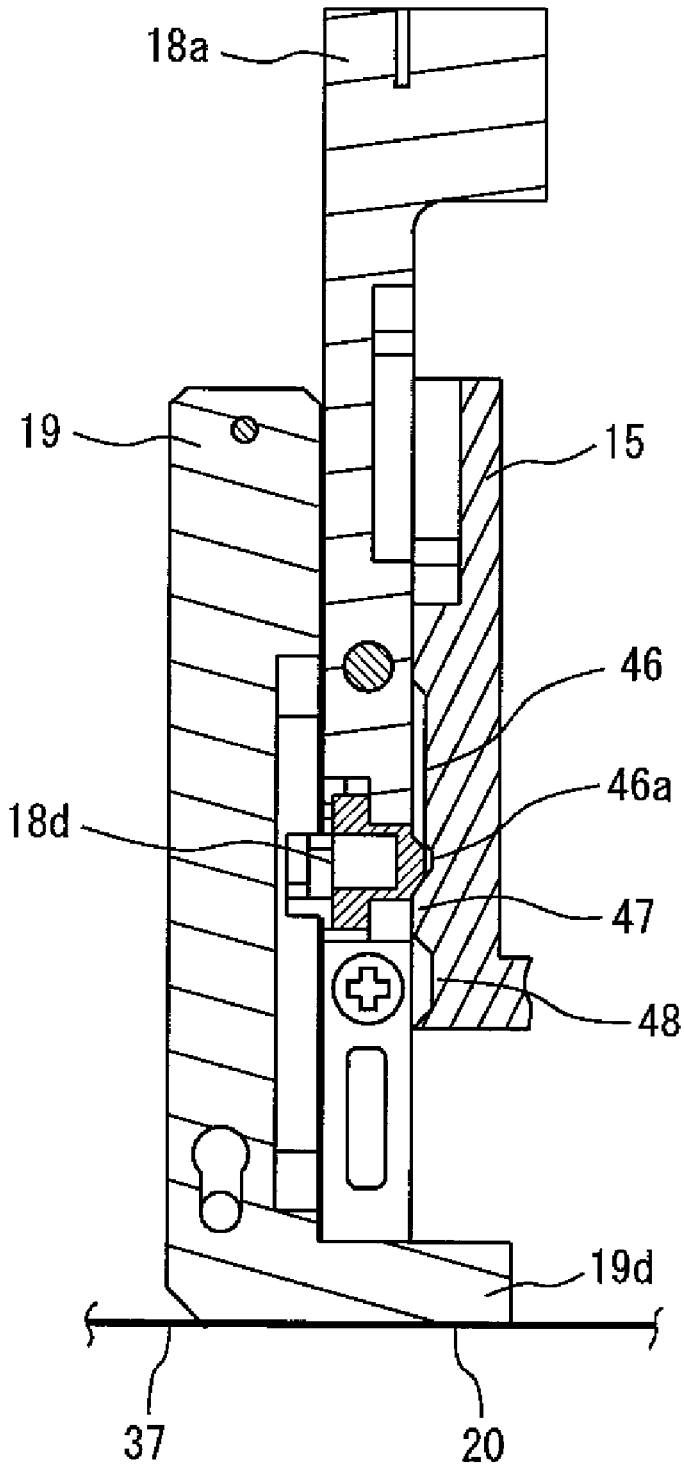
FIG. 64 is a cross-sectional view of the stapler cutoff shaping unit—penetration unit showing a state in which cutoff of a staple starts and slider movement starts.
Figure 78:
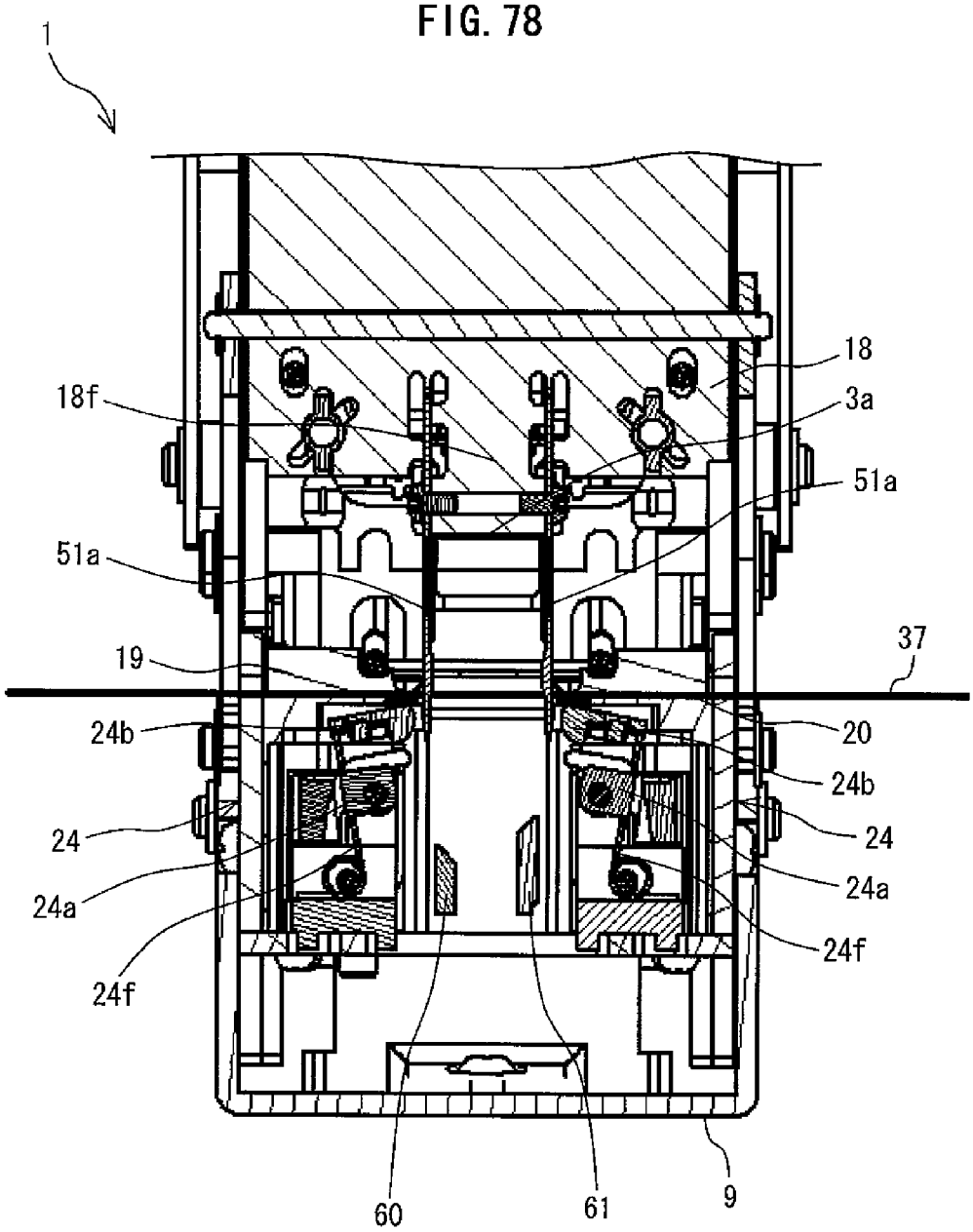

FIG. 43, FIG. 64 and FIG. 78 are explanatory diagrams showing a state of the respective portions of the stapler 1 in a state in which cutoff of the staple 3*a* starts and the movement of the slider 26 starts. The handle 5 rotates counterclockwise in FIG. 43 on the handle & staple cover rotating shaft 10 by pushing down the handle 5 further from a state in which actuation of the forming plate 15 started, which is shown in FIG. 42, FIG. 63 and FIG. 77, and the driver 18 is pushed down further by the driver pusher 66. Thus, as shown in FIG. 43 and FIG. 78, the punching blades 51 attached to the driver 18 penetrate further the binding sheets 37 which are placed on the table 20 and which are held down by the paper-sheet pusher 19.

Also, by descending the driver 18, as shown in FIG. 64, the forming plates 15 descend together with the driver 18 in a state in which the protrusion pins 18*d* are engaged with the lower end portions 46*a* of the V-grooves 45. Thus, as shown in FIG. 25C, the staple interlinking portions 34 by which the staple 3*a* positioned at a leading portion of the interlinked staples 2 is linked with the staple 3*b* continuously contacted thereto are cut off by the cutting blades 49 which are attached to the forming plate 15.

Also, by pushing down the driver 18, the links 57 rotate in the direction shown by an arrow E of FIG. 2 and the slider starts moving backward together with the slider shaft 63 engaged with the protrusion portions 57*c* of the links 57.

Figure 44:
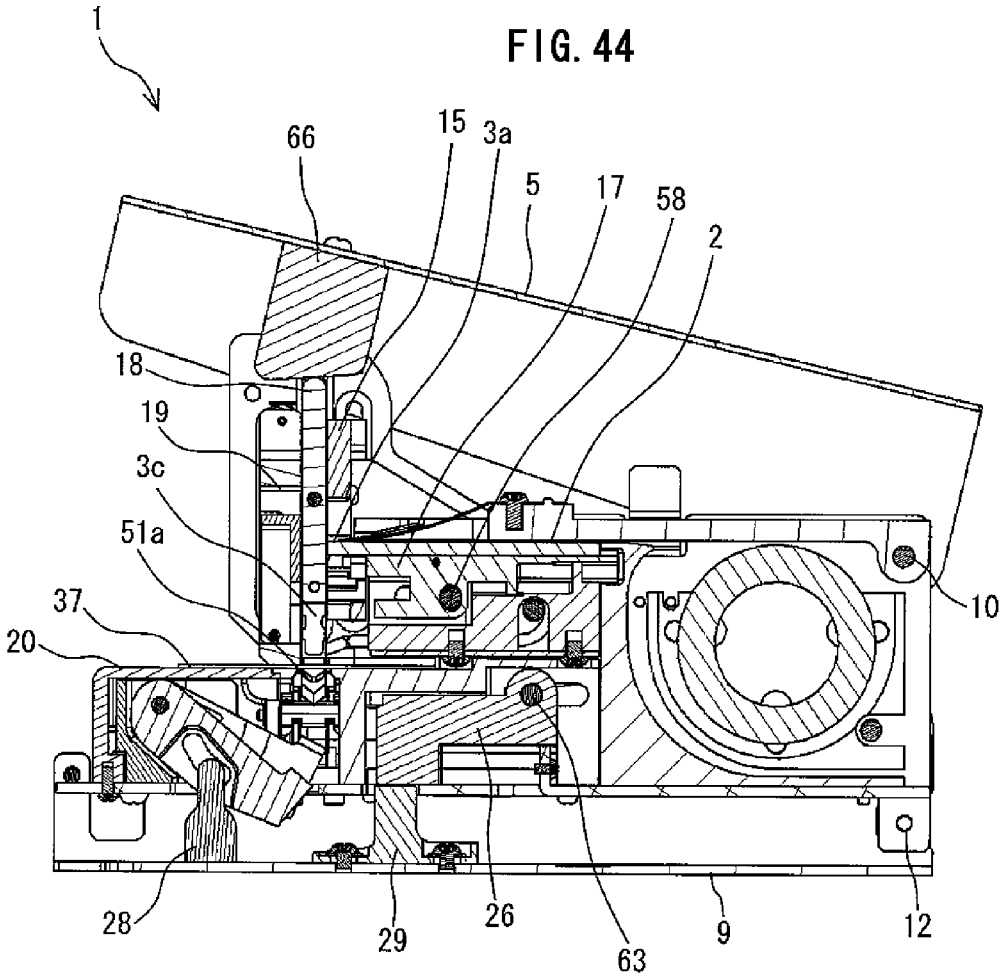
FIG. 44 is a cross-sectional view of the stapler showing a state in which shaping of a staple starts.
Figure 45:
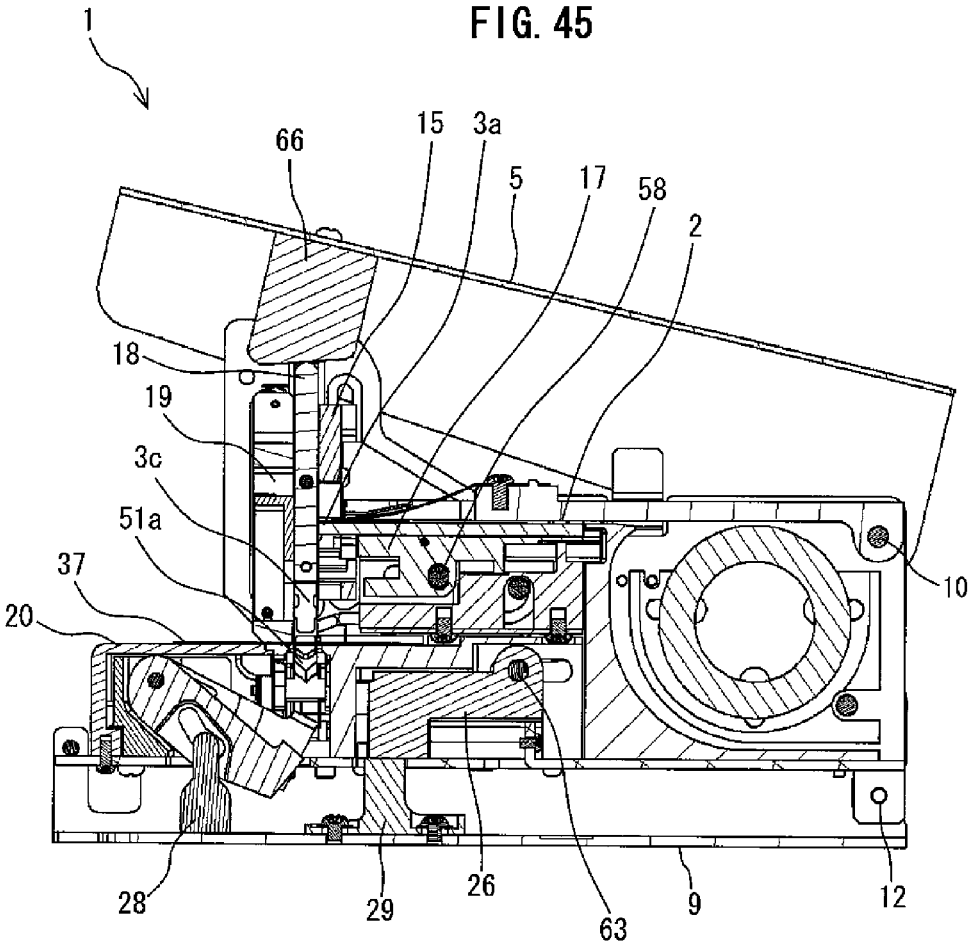
FIG. 45 is a cross-sectional view of the stapler showing a state in which a rotation of a cam starts.
Figure 65:
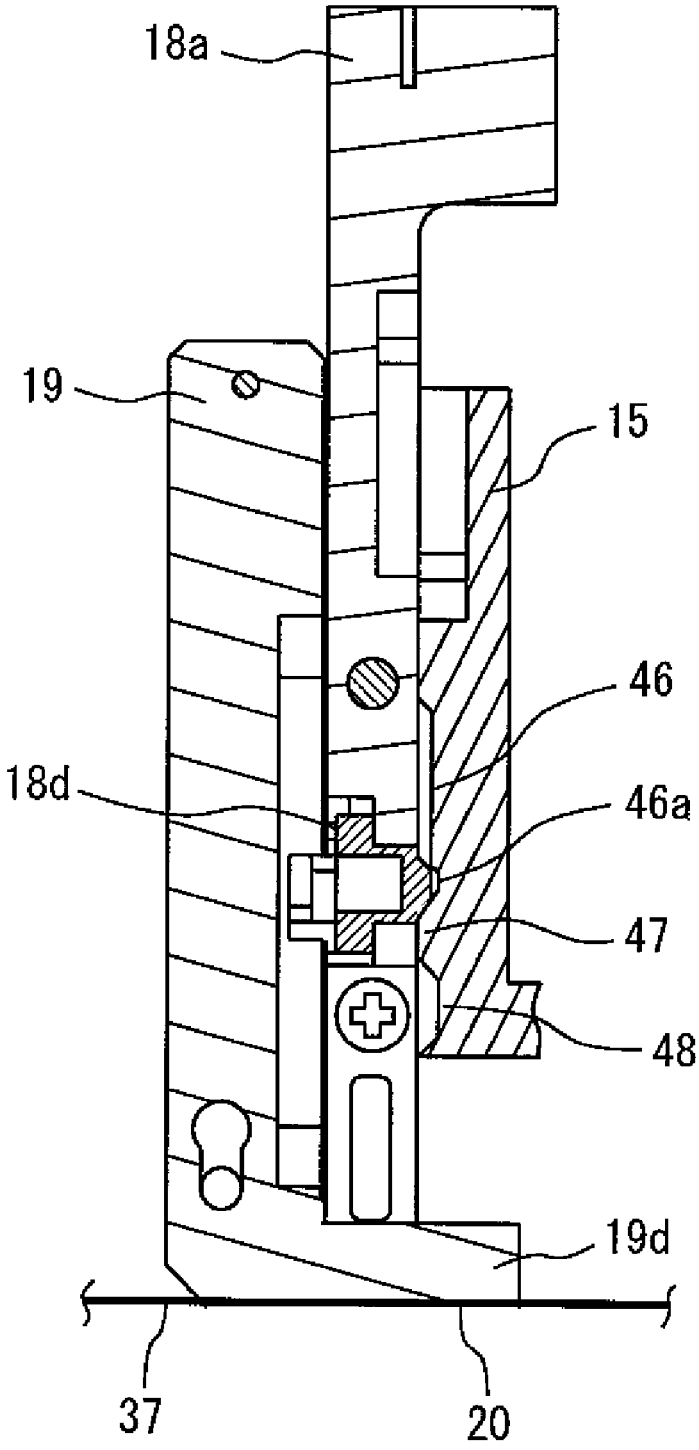
FIG. 65 is a cross-sectional view of the stapler cutoff shaping unit—penetration unit showing a state in which shaping of a staple starts.
Figure 79:
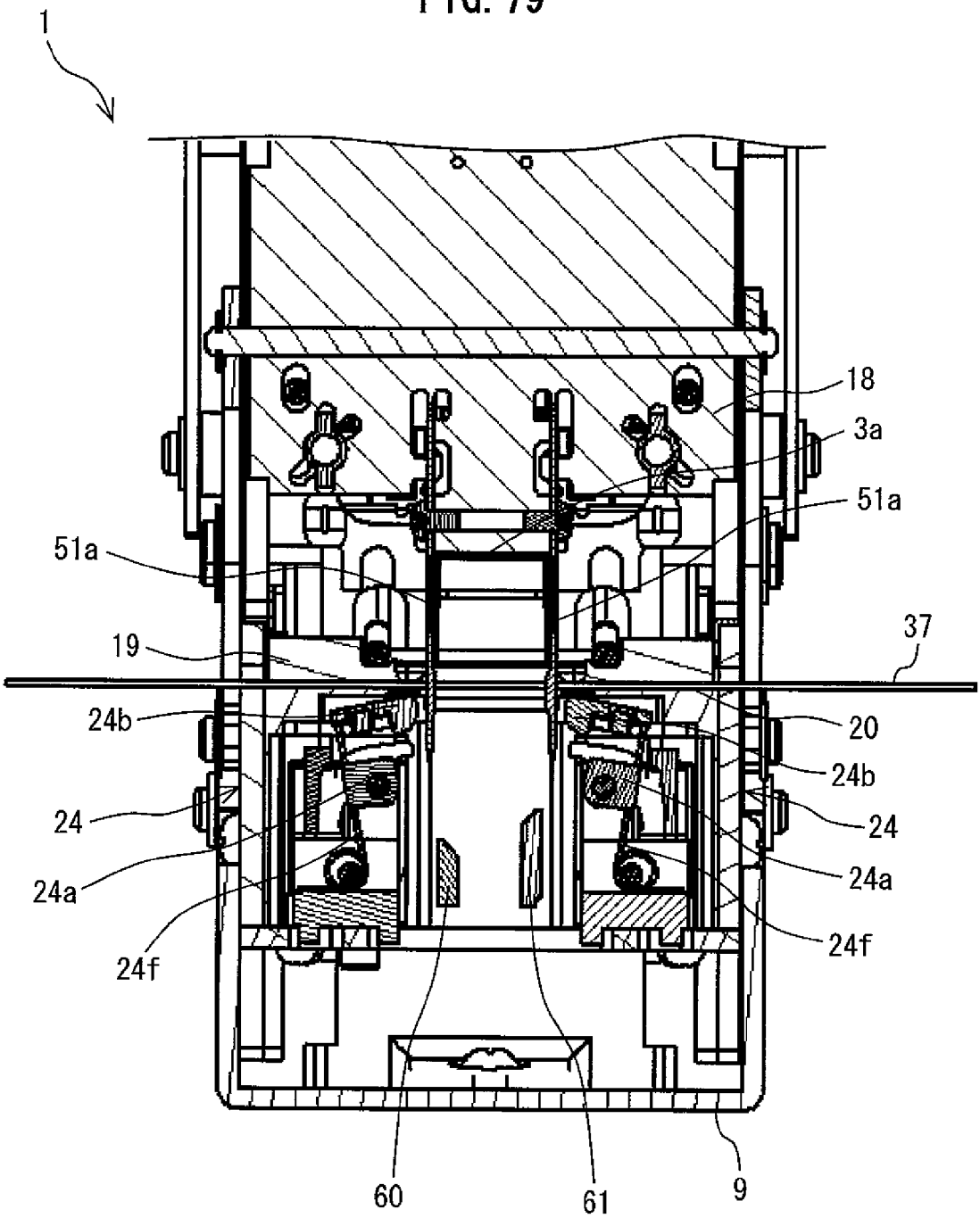

FIG. 44, FIG. 65 and FIG. 79 are explanatory diagrams showing a state of the respective portions of the stapler 1 in a state in which shaping of the staple 3*a* starts. By pushing down the handle 5 further from a state in which cutoff of the staple 3*a* starts and the movement of the slider 26 starts, which is shown in FIG. 43, FIG. 64 and FIG. 78, the handle 5 rotates counterclockwise in FIG. 44 on the handle & staple cover rotating shaft 10 and the driver 18 is pushed down further by the driver pusher 66. Thus, as shown in FIG. 44 and FIG. 79, the punching blades 51 attached to the driver 18 penetrate further the binding sheets 37 which are placed on the table 20 and which are held down by the paper-sheet pusher 19.

Figure 27A:
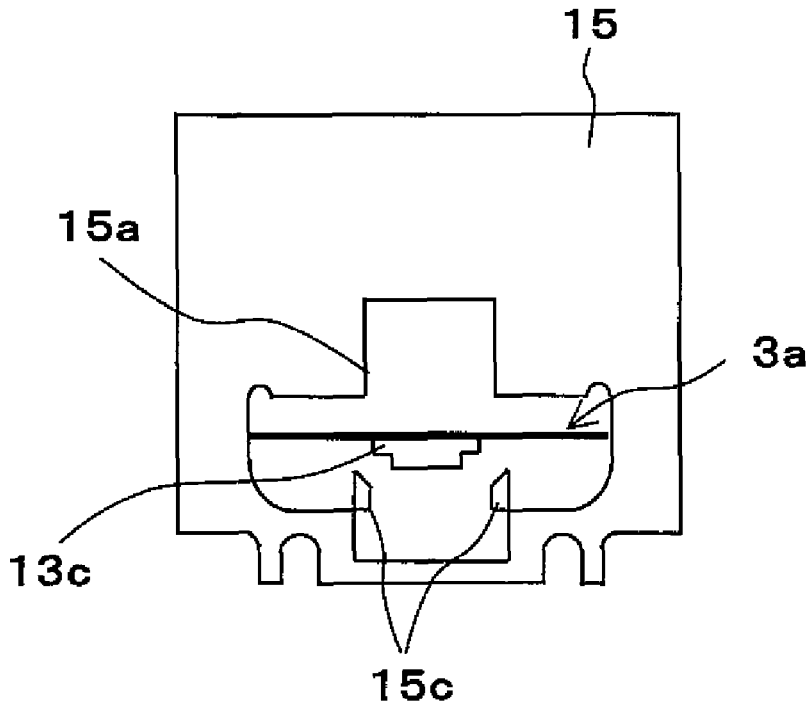
FIG. 27A is an explanatory diagram showing the staple shaping method.
Figure 27B:
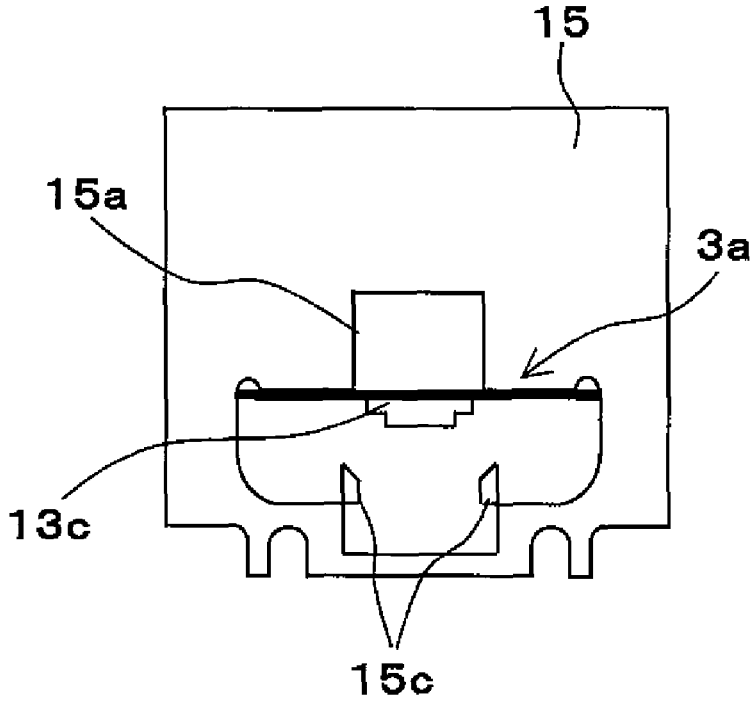
FIG. 27B is an explanatory diagram showing the staple shaping method.
Figure 27C:
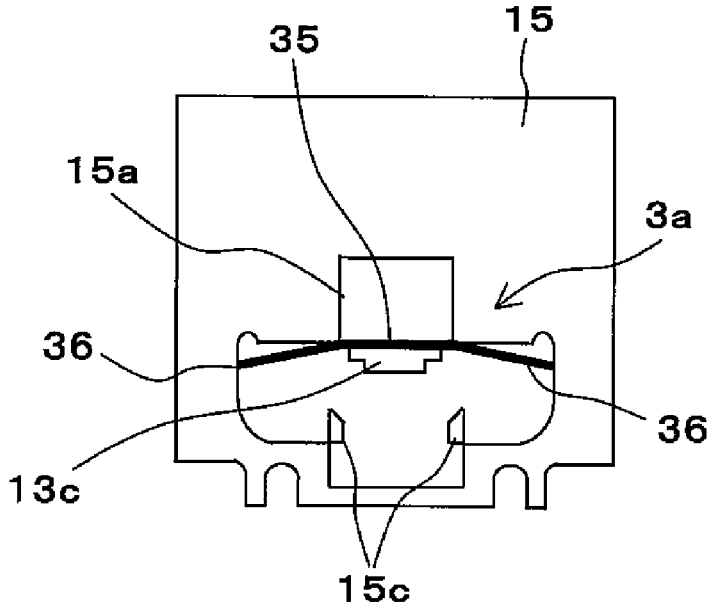
FIG. 27C is an explanatory diagram showing the staple shaping method.

Also, by pushing down the driver 18, as shown in FIG. 65, the forming plate 15 descends together with the driver 18 in a state in which the protrusion pins 18*d* are engaged with the lower end portions 46*a* of the V-grooves 46. Thus, as shown in FIG. 27C, shaping of the staple 3*a* which is placed on the receiving table portion 13*c* starts by the staple shaping unit 15*a* of the forming plate 15.

Also, the links 57 rotate in the direction shown by an arrow E of FIG. 2 by pushing down the driver 18 further and the slider 26 moves backward together with the slider shaft 63 which is engaged with the protrusion portions 57*c* of the links 57.

FIG. 45, FIG. 80, FIG. 97A and FIG. 97B are explanatory diagrams showing the respective portions of the stapler 1 in a state in which rotation of the cam 24*a* starts. The driver 18 is pushed down, the links 57 rotate in the direction shown by an arrow E of FIG. 2 and the slider 26 moves backward together with the slider shaft 63 which is engaged with the protrusion portions 57*c* of the links 57.

Figure 80:
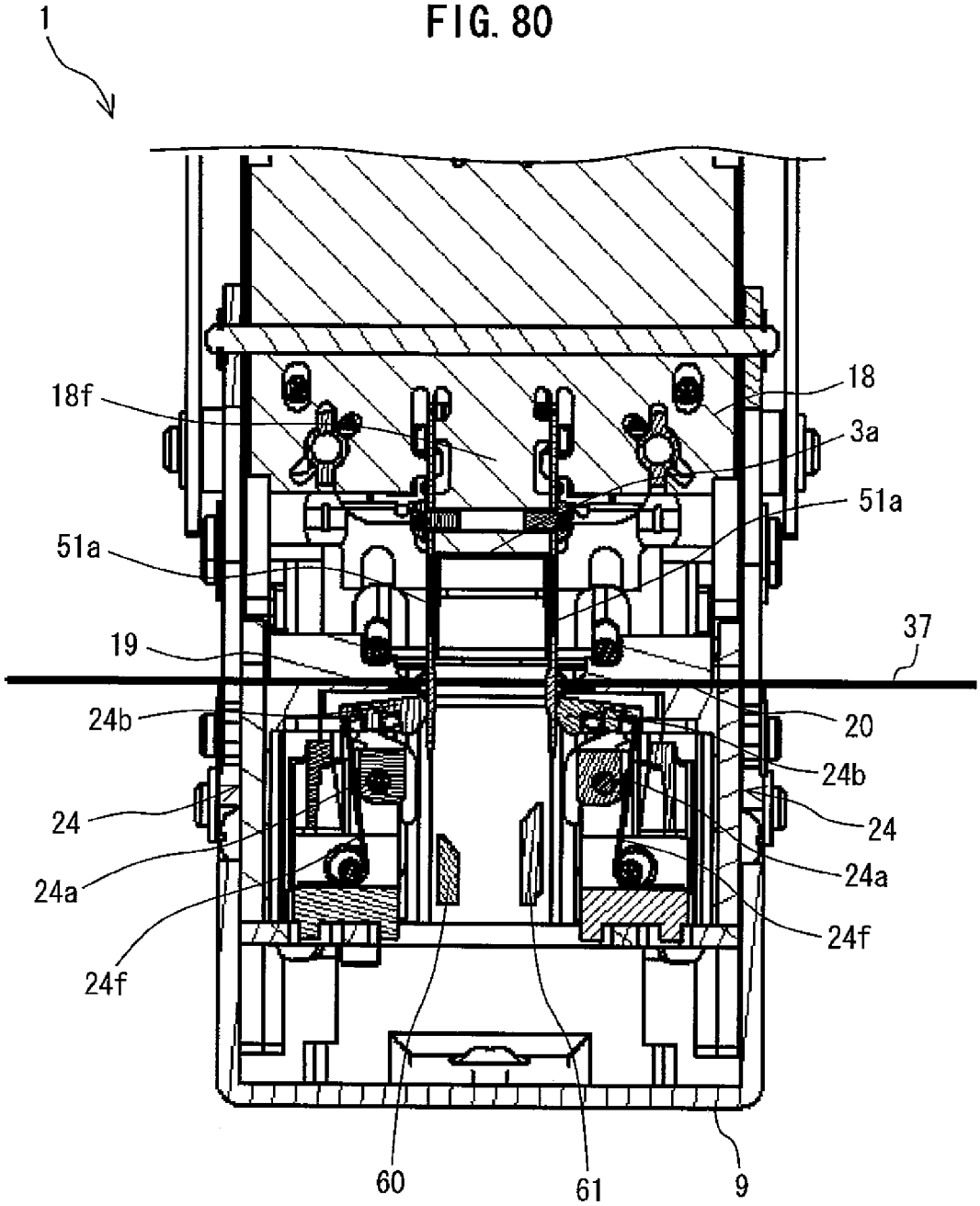

Consequently, as shown in FIG. 97A and FIG. 97B, the slider arm 26*a* and the slider arm 26*b* of the slider 26 abut against the claw portions 24*d* which are positioned at the rear side of each of the pushing-out units 24 respectively, and the cam 24*a* rotates as shown by an arrow of FIG. 36B. Thus, the push-out pusher 24*b* of each of the pushing-out units 24 rotates in the direction of the push-out position from the stand-by position. Thus, as shown in FIG. 80, the push-out portion 24*ba* of each of the push-out pushers 24*b* becomes in a state of abutting against the outside surfaces of the punching blades 51 which penetrate the binding sheets 37.

Figure 46:
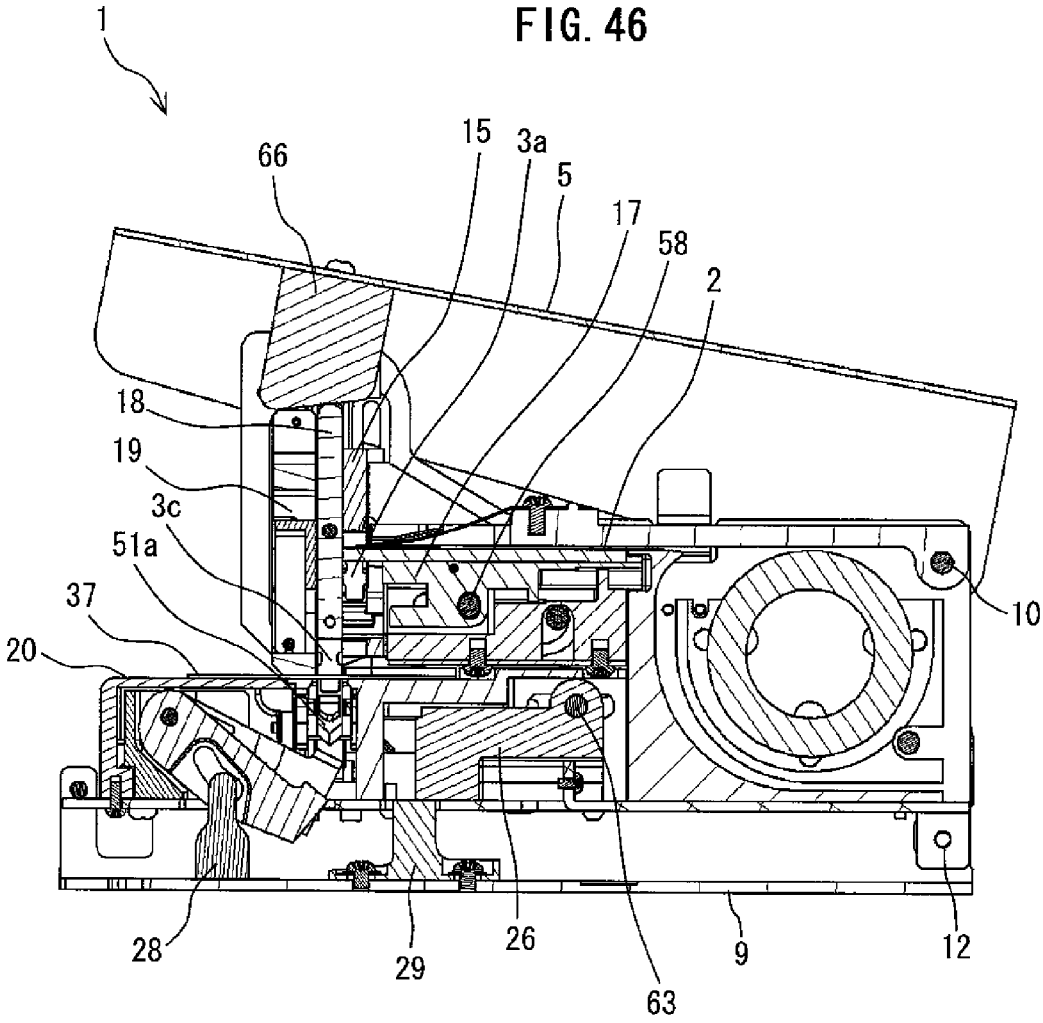
FIG. 46 is a cross-sectional view of a stapler showing a state in which shaping of a staple is completed.
Figure 66:
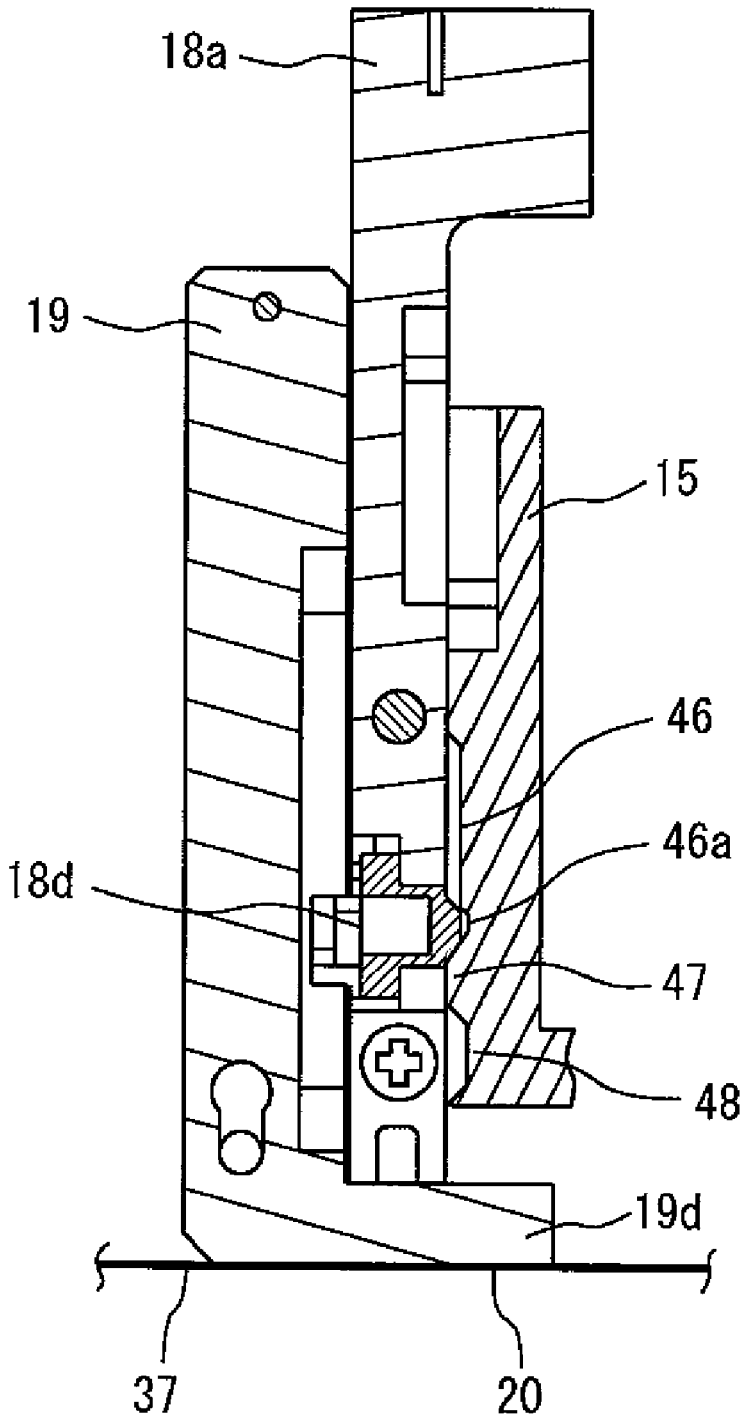
FIG. 66 is a cross-sectional view of the stapler cutoff shaping unit—penetration unit showing a state in which shaping of a staple is completed.
Figure 81:
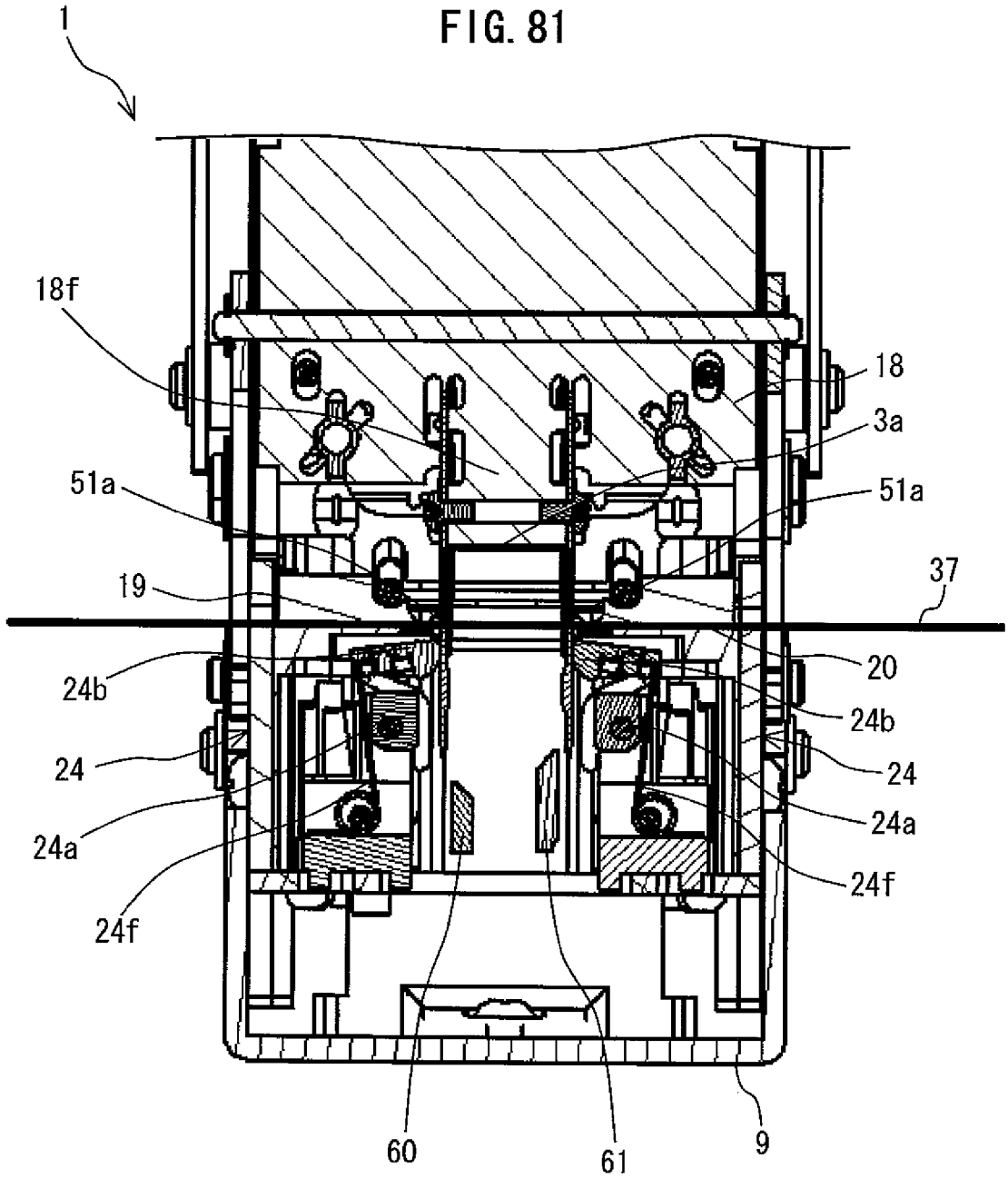

FIG. 46, FIG. 66 and FIG. 81 are explanatory diagrams showing a state of the respective portions of the stapler 1 in a state in which shaping of the staple 3*a* is completed. By pushing down the handle 5 further from a state in which shaping of the staple 3*a* starts and which is shown in FIG. 44, FIG. 65 and FIG. 79, the handle 5 rotates counterclockwise in FIG. 46 on the handle & staple cover rotating shaft 10 and the driver 18 is pushed down further by the driver pusher 66. Thus, as shown in FIG. 46 and FIG. 81, the punching blades 51 which are attached to the driver 18 penetrate further the binding sheets 37 which are placed on the table 20 and which are held down by the paper-sheet pusher 19, and both the leg portions 36 of the staple 3*c* which are positioned in the punching blades 51 penetrate the binding sheets 37.

Also, the forming plate 15 descends together with the driver 18 in a state in which the protrusion pins 18*d* are engaged with the lower end portions 46*a* of the V-grooves 46, as shown in FIG. 66, by descending the driver 18. Thus, the convex portions 15*d* of the forming plate 15 are contacted with lower edge portions of the side grooves 50 of the frame 8, and the forming plate 15 descends until the position in which the forming plate 15 does not descend with respect to the frame 8. Thus, as shown in FIG. 25D and FIG. 28A, by the staple shaping unit 15*a* of the forming plate 15, the staple 3*a* placed on the receiving table portion 13*c* is shaped into a shape having the crown portion 35 and both the leg portions 36, in which both the edges are bent to one direction.

Also, the link 57 rotates further in the direction shown by an arrow E of FIG. 2 by pushing down the driver 18 further, and the slider 26 moves backward further together with the slider shaft 63 which is engaged with the protrusion portions 57*c* of the links 57.

Figure 47:
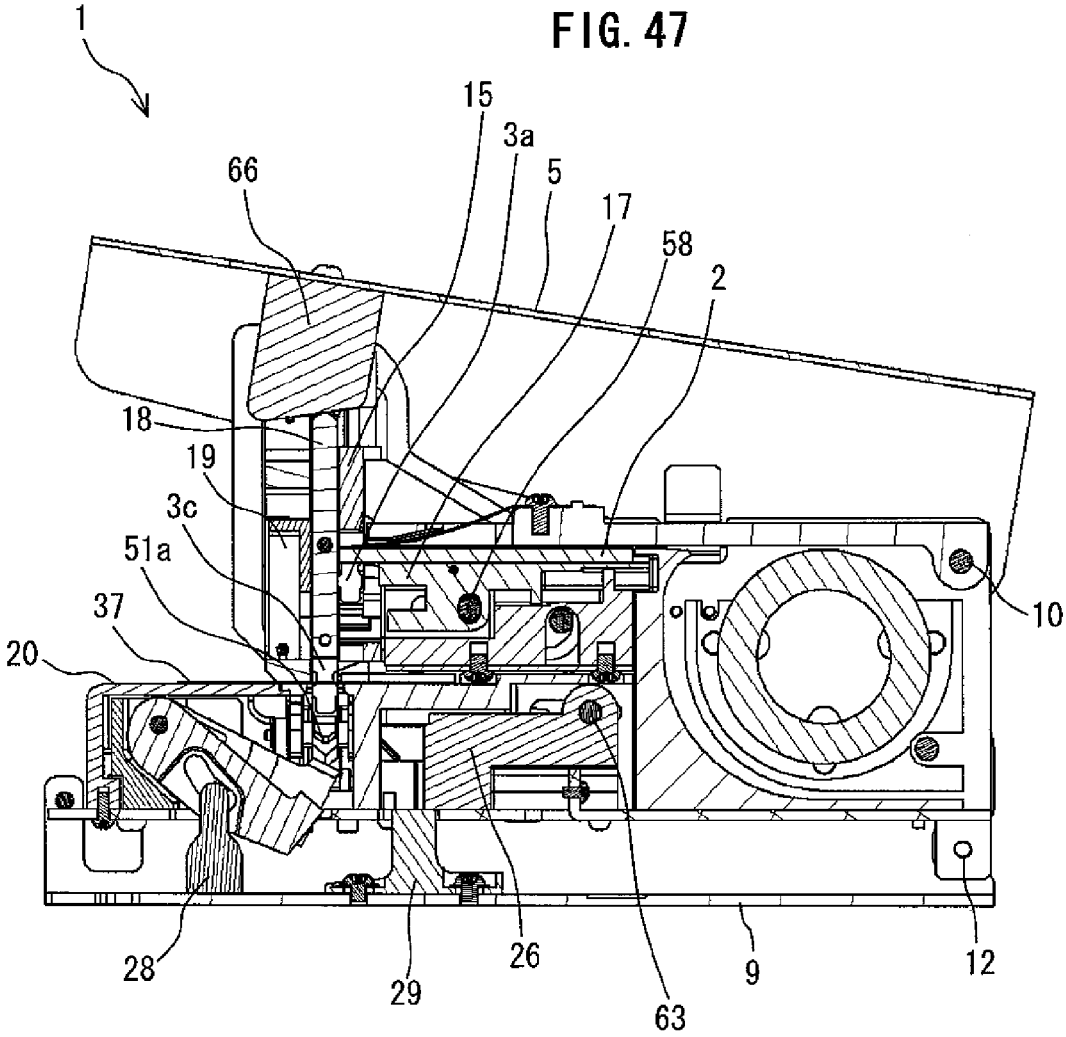
FIG. 47 is a cross-sectional view of the stapler showing a state in which protrusion pins run on flat portions.
Figure 67:
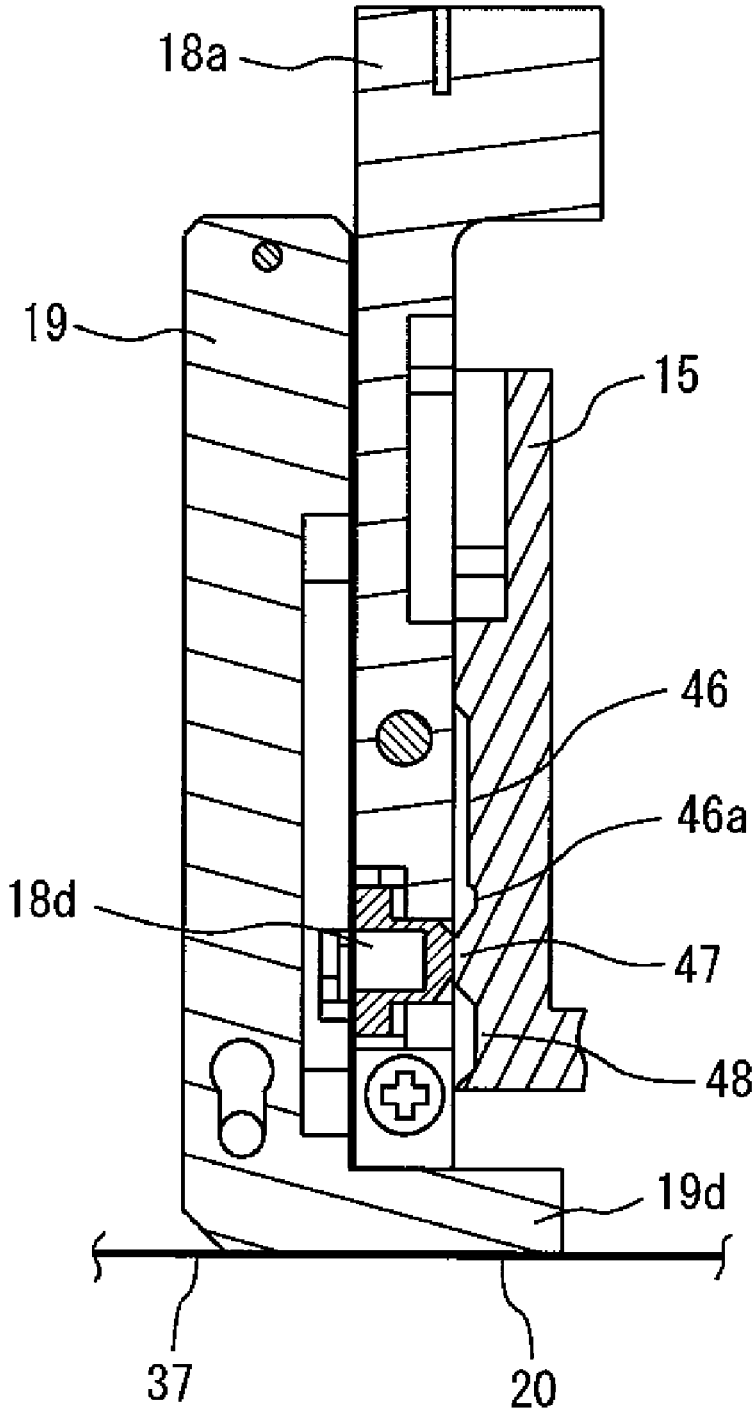
FIG. 67 is a cross-sectional view of the stapler cutoff shaping unit—penetration unit showing a state in which the protrusion pin runs on the flat portion.
Figure 82:
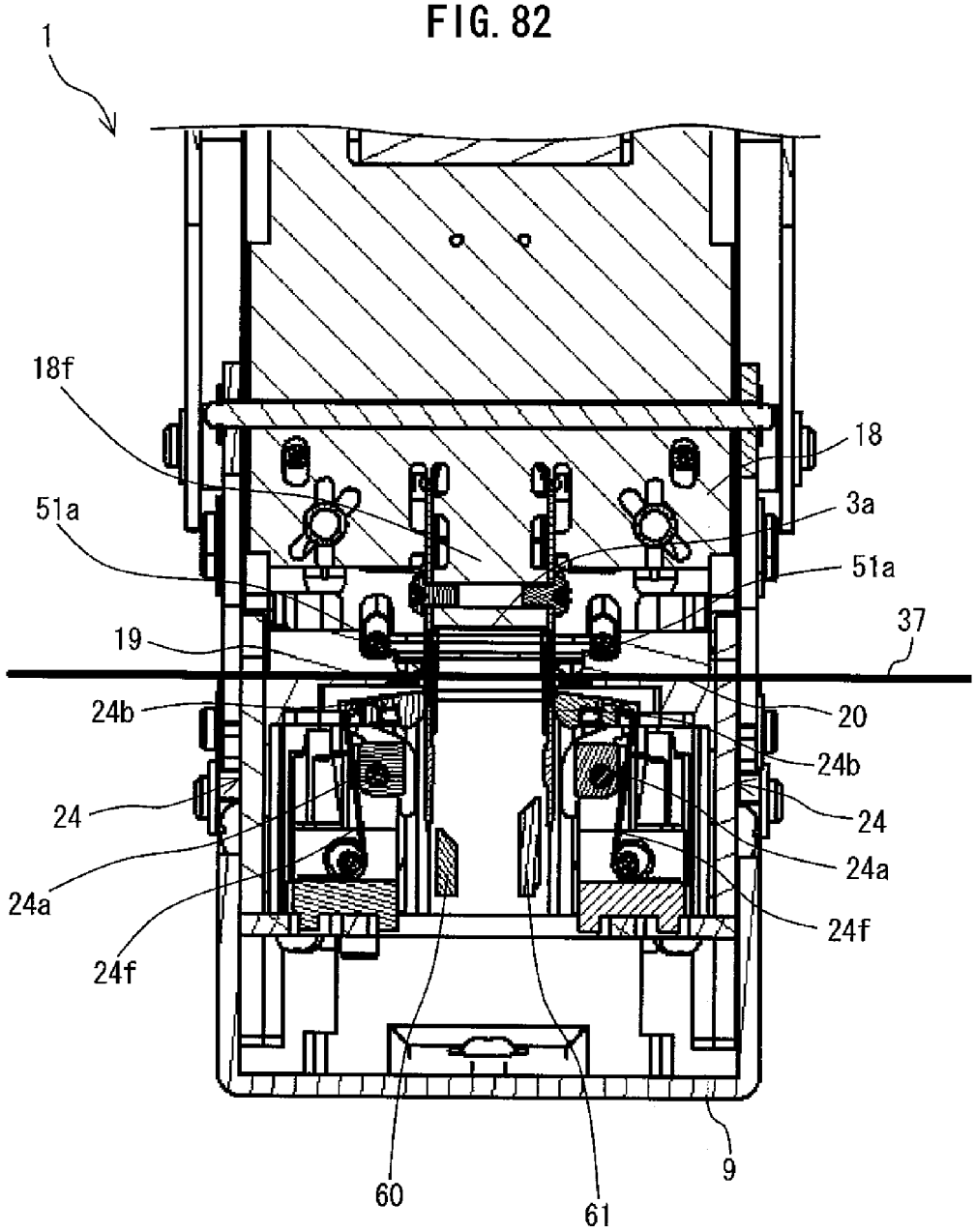

FIG. 47, FIG. 67 and FIG. 82 are explanatory diagrams showing a state of the respective portions of the stapler 1 in a state in which the protrusion pins 18*d* run on the flat portions 47. By pushing down the handle 5 further from a state in which shaping of the staple 3*a* is completed and which is shown in FIG. 46, FIG. 66 and FIG. 81, the handle 5 rotates counterclockwise in FIG. 47 on the handle & staple cover rotating shaft 10 and the driver 18 is pushed down further by the driver pusher 66. Thus, as shown in FIG. 47 and FIG. 82, the punching blades 51 which are attached to the driver 18 penetrate further the binding sheets 37 which are placed on the table 20 and which are held down by the paper-sheet pusher 19, and both the leg portions 36 of the staple 3*c* which are positioned in the punching blades 51 penetrate the binding sheets 37 further.

Also, as shown in FIG. 67, each of the protrusion pins 18*d* run on the flat portion 47 positioned between the V-groove 46 and the V-groove 48 of the forming plate 15 by descending the driver 18. Also, by pushing down the driver 18 further, the links 57 rotate further in the direction shown by an arrow E of FIG. 2 and the slider 26 moves backward further together with the slider shaft 63 which is engaged with the protrusion portions 57*c* of the links 57.

Figure 48:
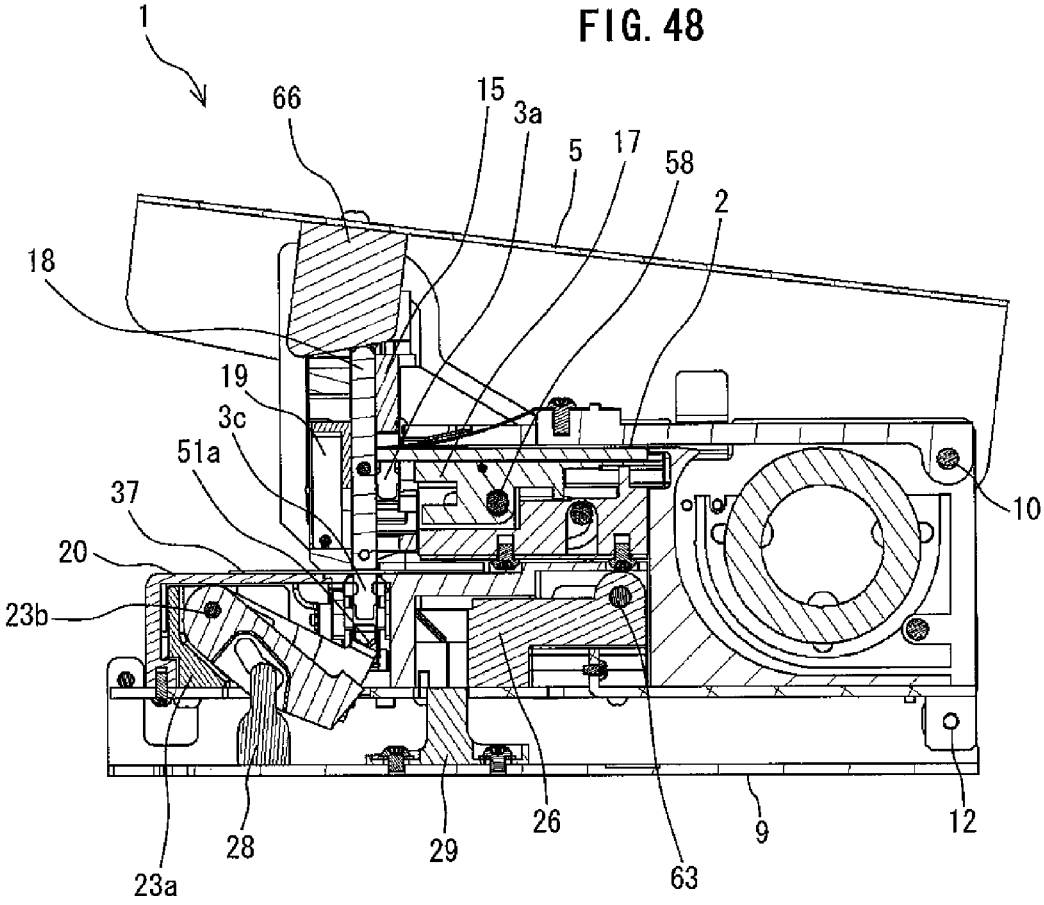
FIG. 48 is a cross-sectional view of the stapler showing a state in which penetration of a staple is completed and a slider is disengaged from a slider holder.
Figure 83:
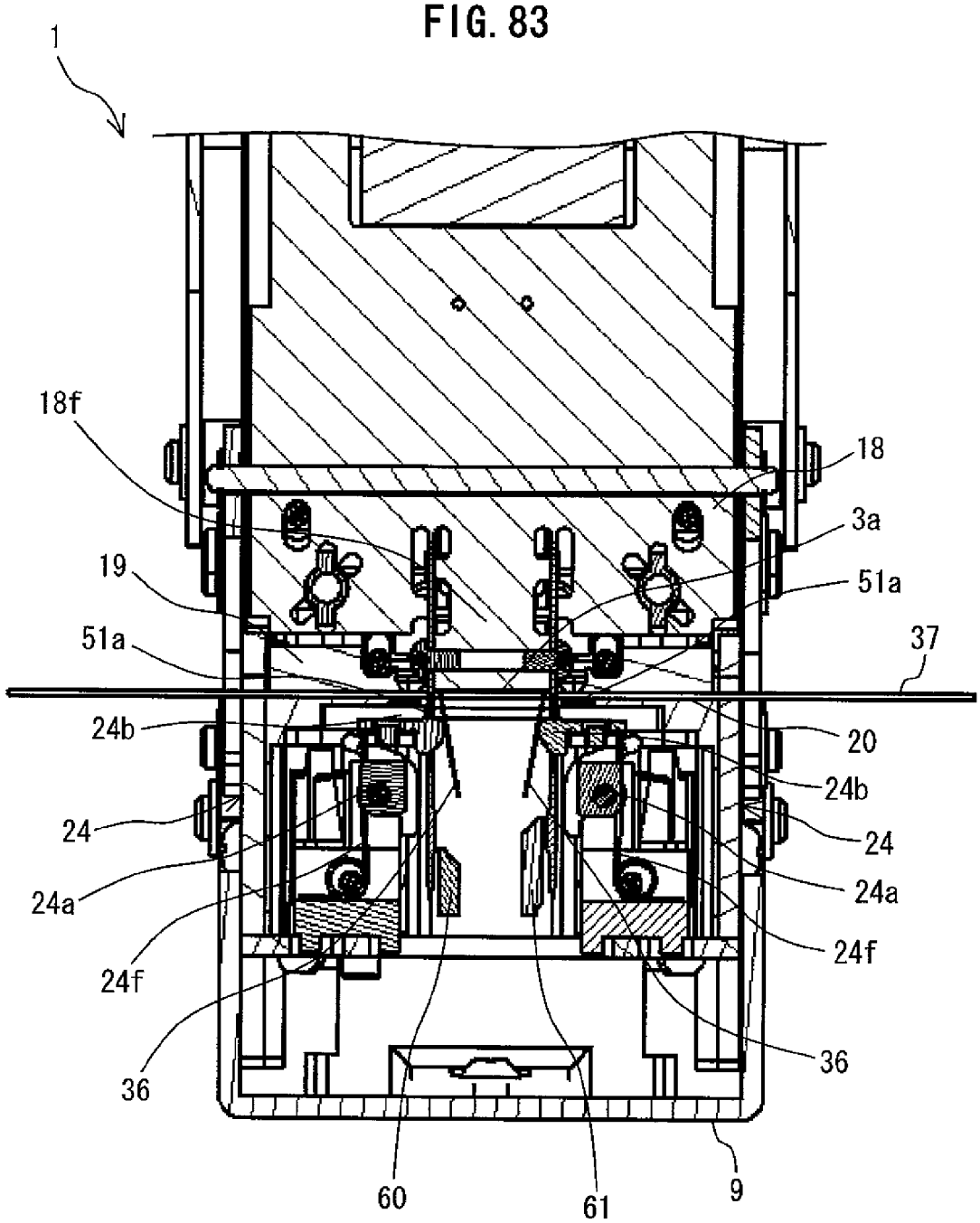

FIG. 48, FIG. 68, FIG. 83, FIG. 98A and FIG. 98B are explanatory diagrams showing a state of the respective portions of the stapler 1 in a state in which penetration of the staple 3C is completed and the slider 26 is disengaged from the slider holder 29. By pushing down the handle 5 further from a state in which the protrusion pins 18*d* run on the flat portions 47 and which is shown in FIG. 47, FIG. 67 and FIG. 82, the handle 5 rotates counterclockwise in FIG. 48 on the handle & staple cover rotating shaft 10 and the driver 18 is pushed down further by the driver pusher 66. Thus, as shown in FIG. 48 and FIG. 83, the punching blades 51 which are attached to the driver 18 penetrate further the binding sheets 37 which are placed on the table 20 and which are held down by the paper-sheet pusher 19, and both the leg portions 36 of the staple 3*c* which are positioned in the punching blades 51 penetrate the binding sheets 37 perfectly.

Also, as shown in FIG. 83, the push-out portions 24*ba* of the respective push-out pushers 24*b* in a state of abutting against the outside surfaces of the respective punching blades 51, which is biased by the respective double torsion springs 24*f*, are inserted into the push-out holes 51*c* of the respective punching blades 51. Thus, by pushing both the leg portions 36 of the staple 3*a* inside by the respective push-out portions 24*ba* and bending them, they become in a state of being apart from the respective punching blades 51.

Figure 68:
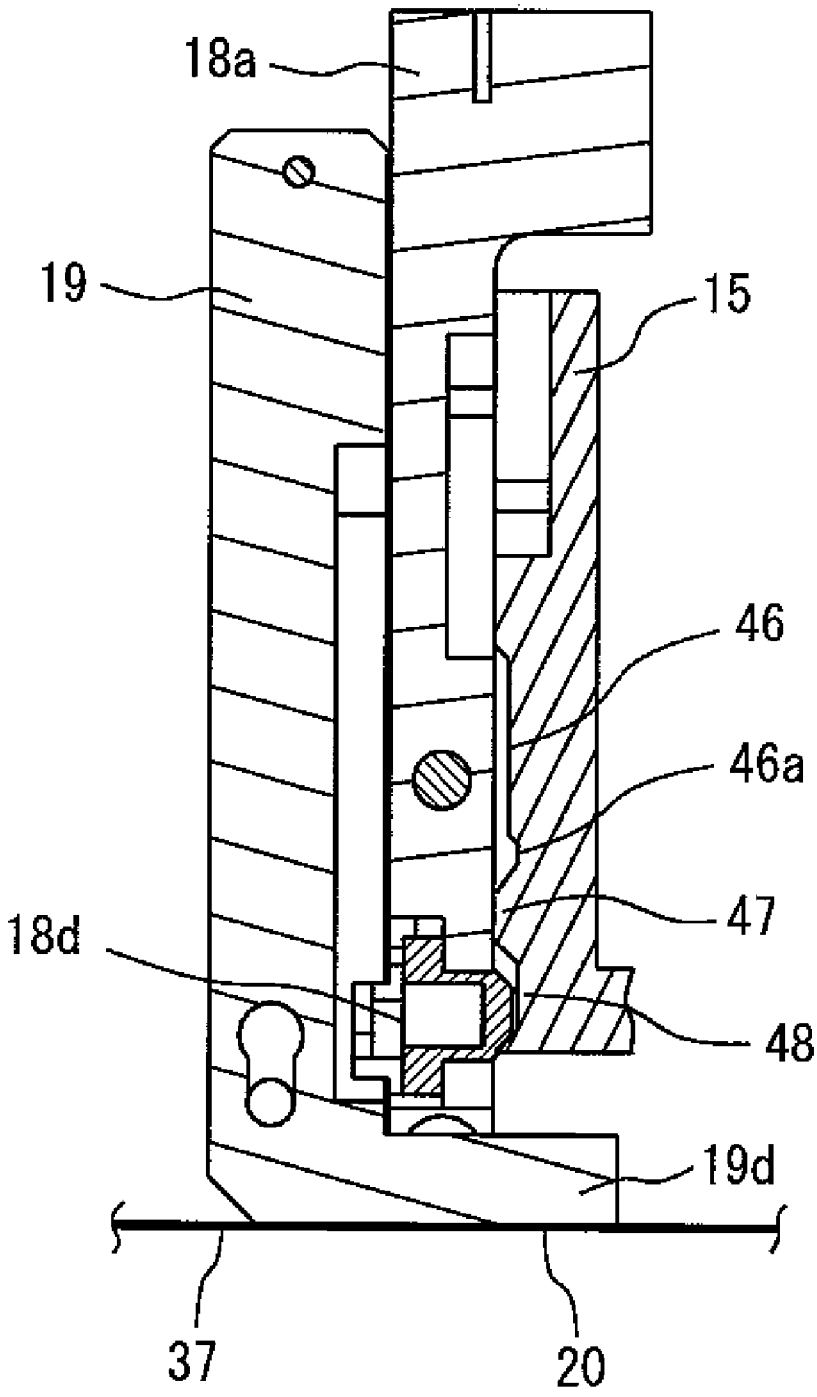
FIG. 68 is a cross-sectional view of the stapler cutoff shaping unit—penetration unit showing a state in which penetration of the staple is completed and the slider is disengaged from the slider holder.

Also, the protrusion pins 18*d* move in the V-grooves 48 by descending the driver 18 as shown in FIG. 68. Further, the links 57 rotate further in the direction shown by an arrow E of FIG. 2, and by moving the slider 26 together with the slider shaft 63 which is engaged with the protrusion portions 57*c* of the links 57 backward further, as shown in FIG. 48, the slider 26 becomes in a state of being disengaged from the slider holder 29. Furthermore, as shown in FIG. 98A and FIG. 98B, the front edge portions of the slider arms 26*a* and 26*b* become in a state of being disengaged backward from a position between the respective claw portions 24*d* of the respective pushing-out units 24.

Figure 49:
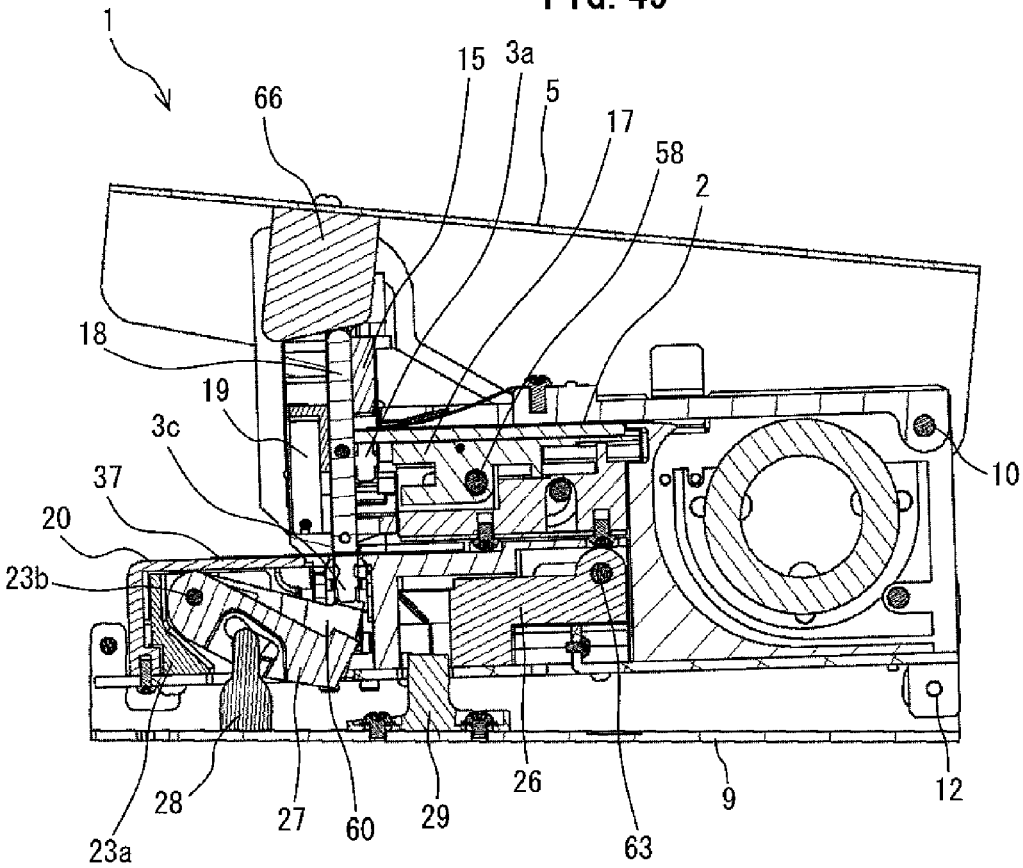
FIG. 49 is a cross-sectional view of the stapler showing a state in which a clincher right is opened to a right direction in a clincher holder.
Figure 84:
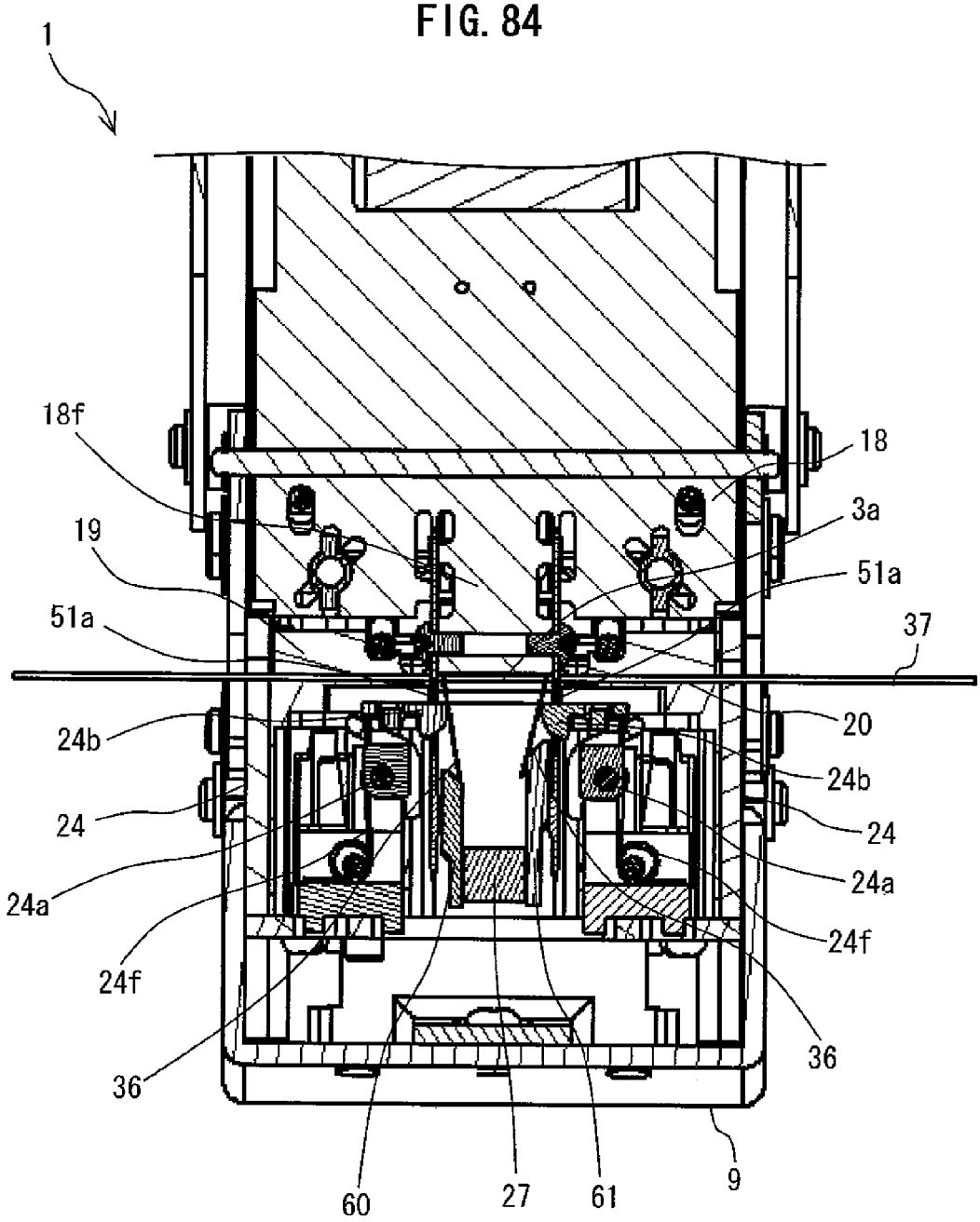

FIG. 49 and FIG. 84 are explanatory diagrams showing a state of the respective portions of the stapler 1 in a state in which the clincher right 61 is opened to a right direction by the clincher holder 23*a*. By pushing down the handle 5 further from a state in which penetration of the staple 3*c* is completed and the slider 26 is disengaged from the slider holder 29, which is shown in FIG. 48, FIG. 68, FIG. 83, FIG. 98A and FIG. 98B, the frame 8 rotates counterclockwise in FIG. 49 with respect to the base 9 on the frame rotating shaft 12.

Consequently, the clincher center 27 rotates on the clincher shaft 23*b* depending on the clincher lifter 28 and becomes in a state of being lifted upward with respect to the clincher holder 23*a*. By lifting up the clincher center 27 upward with respect to the clincher holder 23*a*, the clincher left 60 and the clincher right 61 which are biased upward with respect to the clincher center 27 by the screw coil springs also rotate on the clincher shaft 23*b*, and are lifted upward with respect to the clincher holder 23*a*.

Also, in the clincher right 61, the upper dead point thereof with respect to the clincher center 27 is set on an upward position more than that of the clincher left 60. Consequently, by rotating the clincher center 27 on the clincher shaft 23*b* and lifting it upward, the clincher right 61 comes in contact with the leg portion 36 of the right side of the staple 3*a* from the outside and the leg portion 36 of the right side of the staple 3*a* starts bending inside.

Here, as shown in FIG. 35B, the side walls of the clincher holder 23*a* are formed such that their lower portions (portion shown by Y) are thicker than their upper portion (portion shown by W) and the width inside the clincher holder 23*a* is formed such that that of the upper portion is broader than that of the lower portion. Further, the screw coil springs provided amongst the clincher center 27, the clincher left 60 and the clincher right 61 work also as compressed springs, and biases the clincher left 60 and the clincher right 61 in the direction in which they are pushed and spread to the right and the left with respect to the clincher center 27.

Consequently, by lifting the clincher right 61 upward with respect to the clincher holder 23*a*, the clincher right 61 is pushed and spread on the right side and the bending unit 61*a* of a tip of the clincher right 61 enters between the punching blade 51 and the leg portion 36 of the right side reliably. At that time, the tip of the clincher right 61 contacts to the inside surface of the punching blade 51 and the leg portion 36 of the right side is bent from the base.

Figure 50:
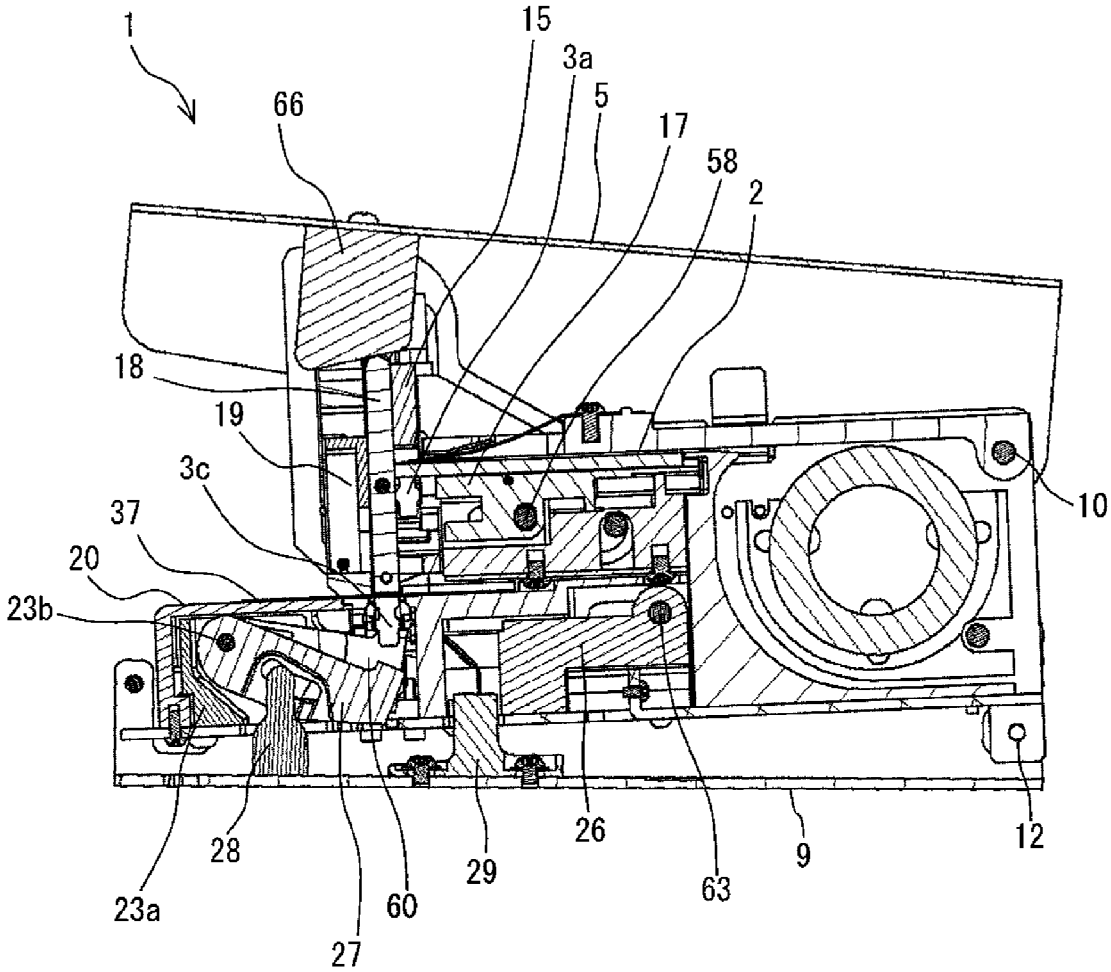
FIG. 50 is a cross-sectional view of the stapler showing a state in which a clincher left is opened to a left direction in the clincher holder and a cam at a pushing-out unit of the right returns to a stand-by position thereof.
Figure 85:
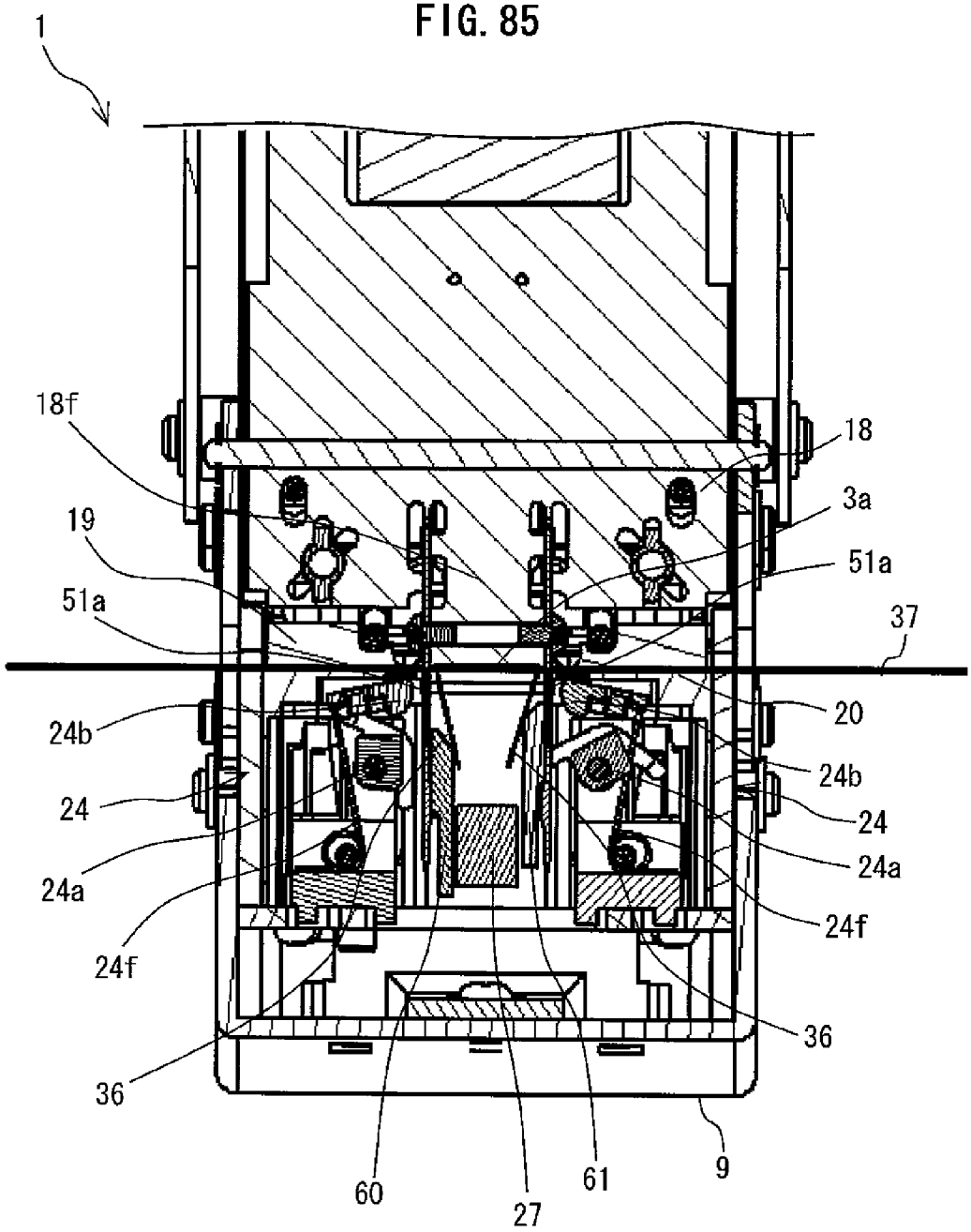

FIG. 50 and FIG. 85 are explanatory diagrams showing a state of the respective portions of the stapler 1 in a state in which the clincher left 60 is opened in the left direction in the clincher holder 23*a* and the cam 24*a* of the pushing-out unit 24 of the right side is returned to the stand-by position. By pushing down the handle 5 further from a state in which the clincher right 61 is opened in the right direction by the clincher holder 23*a* and which is shown in FIG. 49 and FIG. 84, the frame 8 rotates counterclockwise in FIG. 50 with respect to the base 9 on the frame rotating shaft 12.

Consequently, the clincher center 27 rotates on the clincher shaft 23*b* and is lifted upward further with respect to the clincher holder 23*a* by the clincher lifter 28, and the clincher left 60 and the clincher right 61 rotate on the clincher shaft 23*b* and are lifted upward further with respect to the clincher holder 23*a*.

Consequently, the leg portion 36 of the right side of the staple 3*a* is bent inside further by the clincher right 61. Also, at that time, the claw portions 24*d* of the pushing-out unit 24 of the right side is pushed up from the lower side by the clincher right 61. Thus, the rotation of the cam 24*a* of the pushing-out unit 24 of the right side starts toward the stand-by position in the reverse direction with respect to an arrow of FIG. 36B.

Also, the clincher left 60 is lifted up further with respect to the clincher holder 23*a* and contacts with the leg portion 36 of the left side of the staple 3*a* from the outside, and the bending to the inside of the leg portion 36 on the left side of the staple 3*c* starts. Here, the width inside the clincher holder 23*a* is formed such that that of the upper portion is broader than that of the lower portion, and the clincher left 60 is biased in the left direction by the screw coil spring. Consequently, by lifting the clincher left 60 upward with respect to the clincher holder 23*a*, the clincher left 60 is pushed and spread on the left side and the bending unit 60*a* of a tip of the clincher left 60 enters between the punching blade 51 and the leg portion 36 of the left side reliably. At that time, the tip of the clincher left 60 contacts with the inside surface of the punching blade 51 and the leg portion 36 of the left side is bent from the base.

Figure 51:
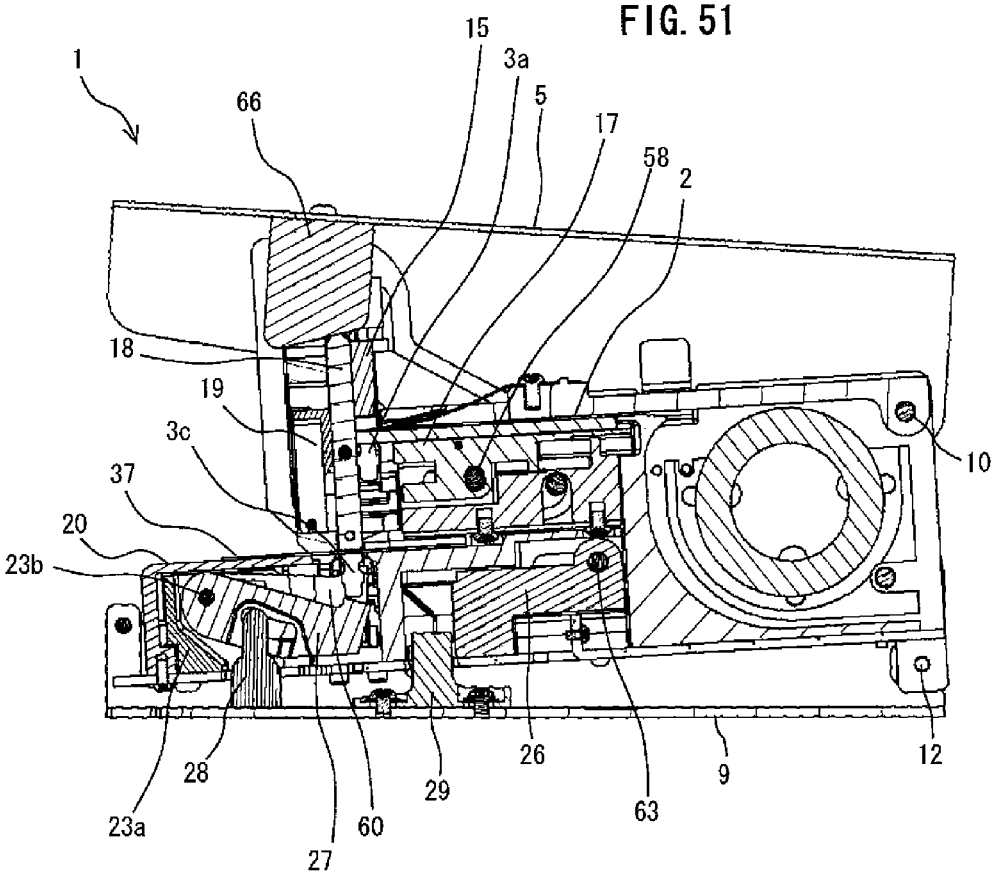
FIG. 51 is a cross-sectional view of the stapler showing a state in which a right leg portion is clinched and a cam at the pushing-out unit of the left returns to a stand-by position thereof.
Figure 86:
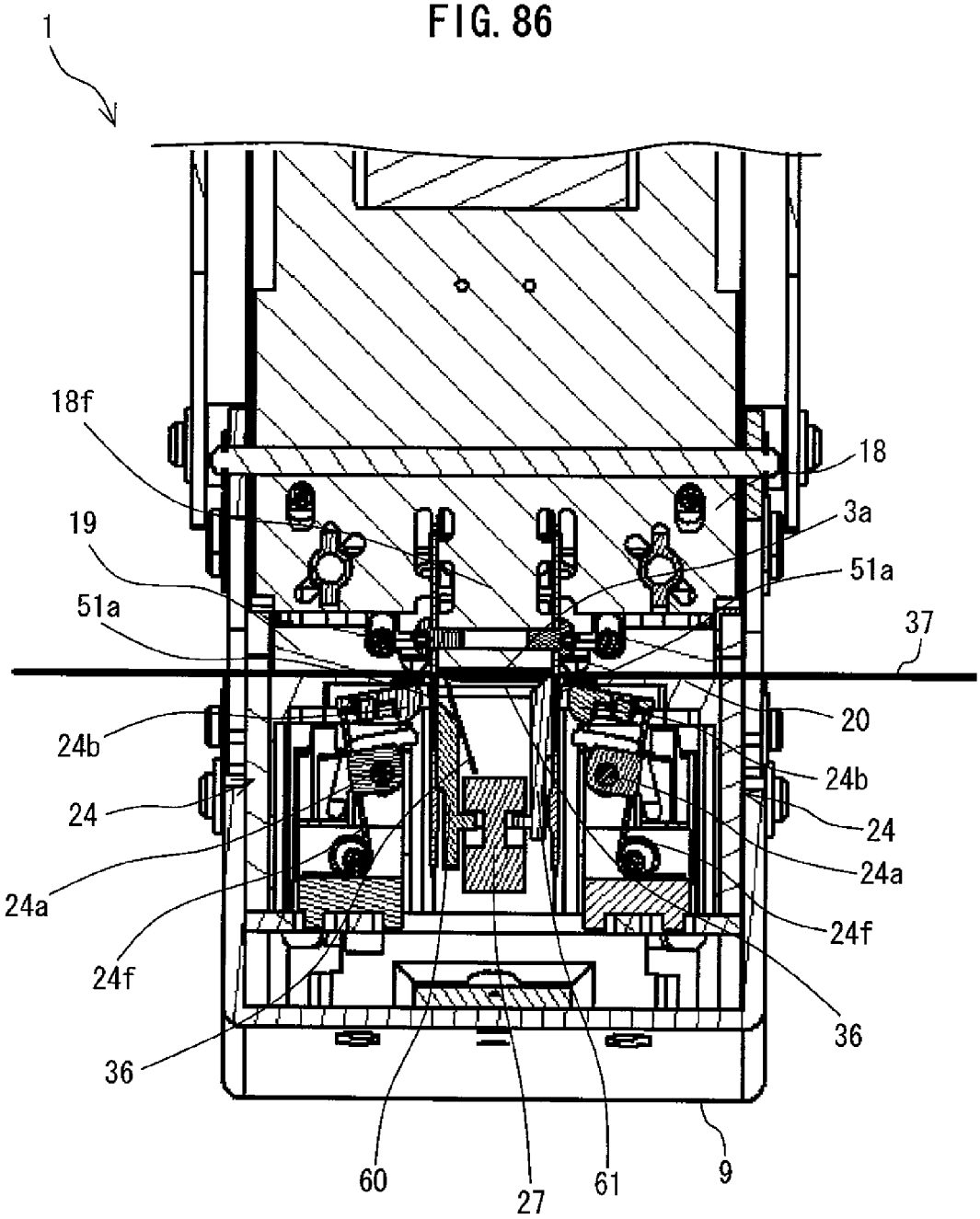

FIG. 51 and FIG. 86 are explanatory diagrams showing a state of the respective portions of the stapler 1 in a state in which the right leg portion 36 is clinched and the cam 24*a* of the pushing-out unit 24 of the left side returns. By pushing down the handle 5 further from a state in which the clincher right 60 is opened in the right direction in the clincher holder 23*a* and the cam 24*a* of the pushing-out unit 24 of the right is returned to the stand-by position, which is shown in FIG. 50 and FIG. 85, the frame 8 rotates counterclockwise in FIG. 51 with respect to the base 9 on the frame rotating shaft 12.

Consequently, the clincher center 27 rotates on the clincher shaft 23*b* and is lifted upward further with respect to the clincher holder 23*a* by the clincher lifter 28, and the clincher left 60 and the clincher right 61 rotate on the clincher shaft 23*b* and are lifted upward further with respect to the clincher holder 23*a*.

Consequently, as shown in FIG. 86, the leg portion 36 of the right side of the staple 3*c* becomes in a state of being perfectly bent inside along the binding sheets 37 and retained. Also, at that time, the claw portions 24*d* of the pushing-out unit 24 of the right side are pushed up further by the clincher right 61, and the cam 24*a* is returned to the stand-by position.

Also, the leg portion 36 of the left side of the staple 3*a* is bent inside further by the clincher left 60. Also, at that time, the claw portions 24*d* of the pushing-out unit 24 of the left side are pushed up from the lower side by the clincher left 60. Thus, the rotation of the cam 24*a* of the pushing-out unit 24 of the left side starts toward the stand-by position in the reverse direction with respect to the arrow of FIG. 36B.

Figure 52:
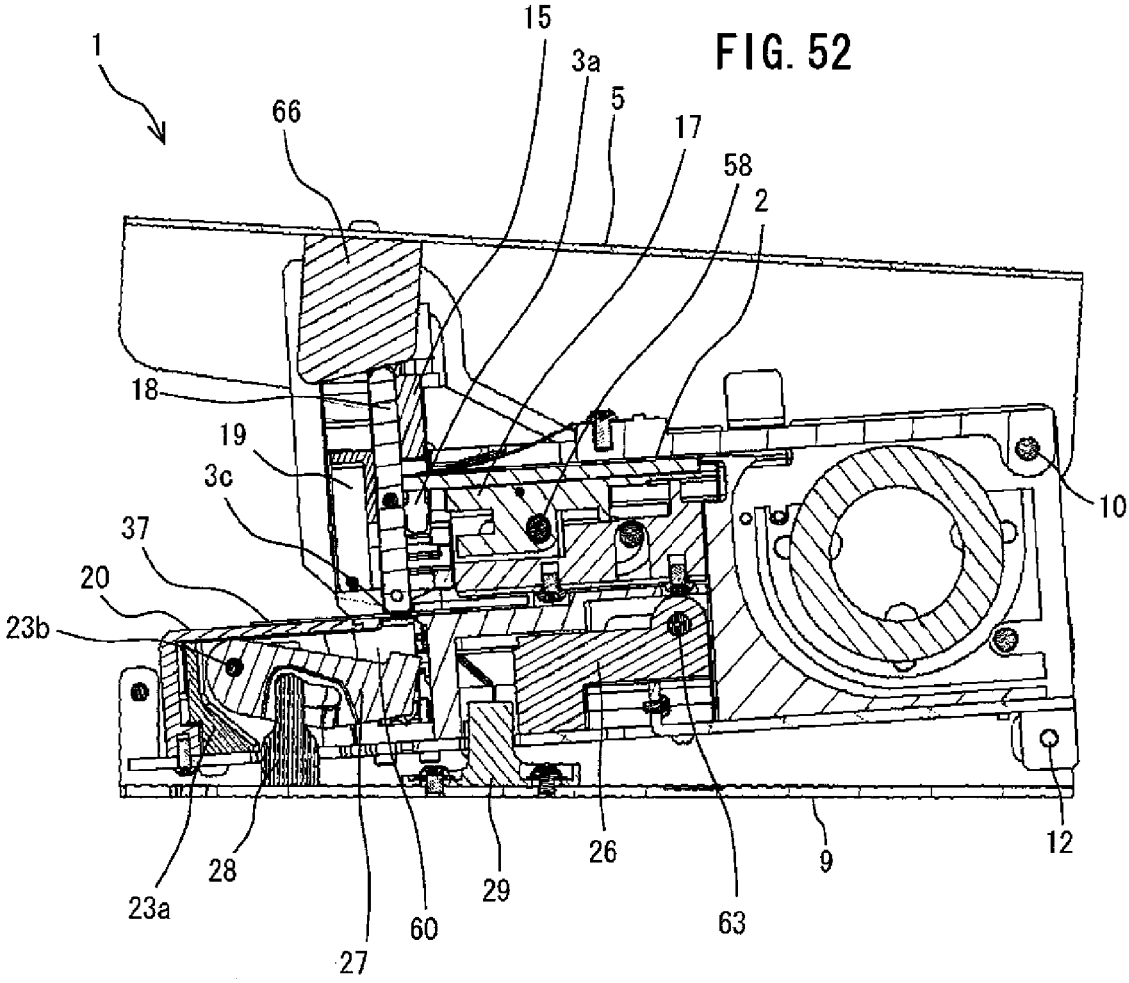
FIG. 52 is a cross-sectional view of the stapler showing a state in which a left leg portion is clinched.
Figure 87:
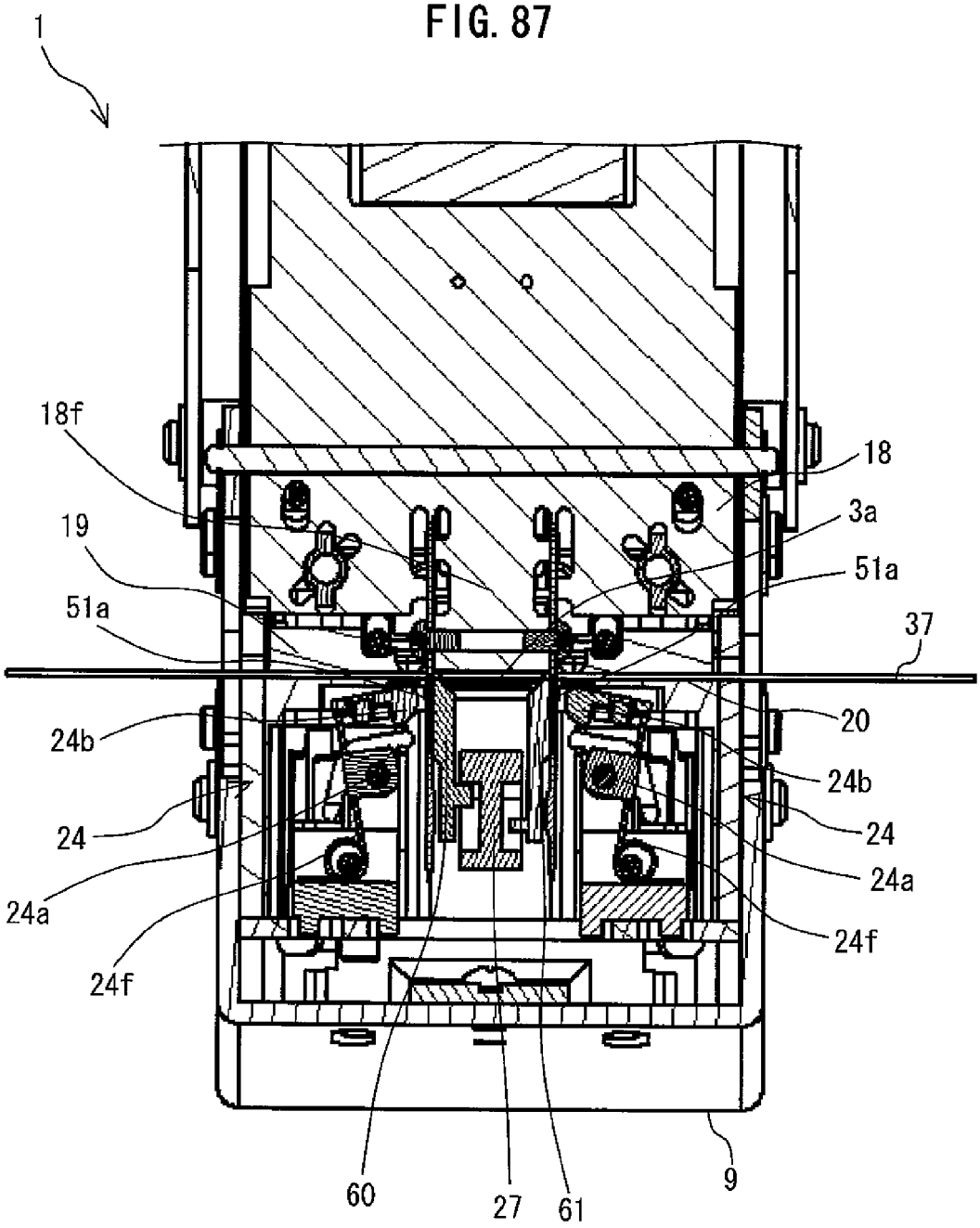

FIG. 52 and FIG. 87 are explanatory diagrams showing a state of the respective portions of the stapler 1 in a state in which the left leg portion 36 is clinched. By pushing down the handle 5 further from a state in which the right leg portion 36 is clinched and the cam 24*a* of the pushing-out unit 24 of the left returns, which is shown in FIG. 51 and FIG. 86, the frame 8 rotates counterclockwise in FIG. 52 with respect to the base 9 by the frame rotating shaft 12.

Consequently, the clincher center 27 rotates on the clincher shaft 23*b* and is lifted upward further with respect to the clincher holder 23*a* by the clincher lifter 28, and the clincher left 60 rotates on the clincher shaft 23*b* and is lifted upward further with respect to the clincher holder 23*a*.

Thus, as shown in FIG. 51 and FIG. 87, the leg portion 36 of the left side of the staple 3*c* becomes in a state of being perfectly bent inside along the binding sheets 37 and retained. Also, at that time, the claw portions 24*d* of the pushing-out unit 24 of the left side are pushed up further by the clincher left 60, and the cam 24*a* is returned to the stand-by position.

Figure 53:
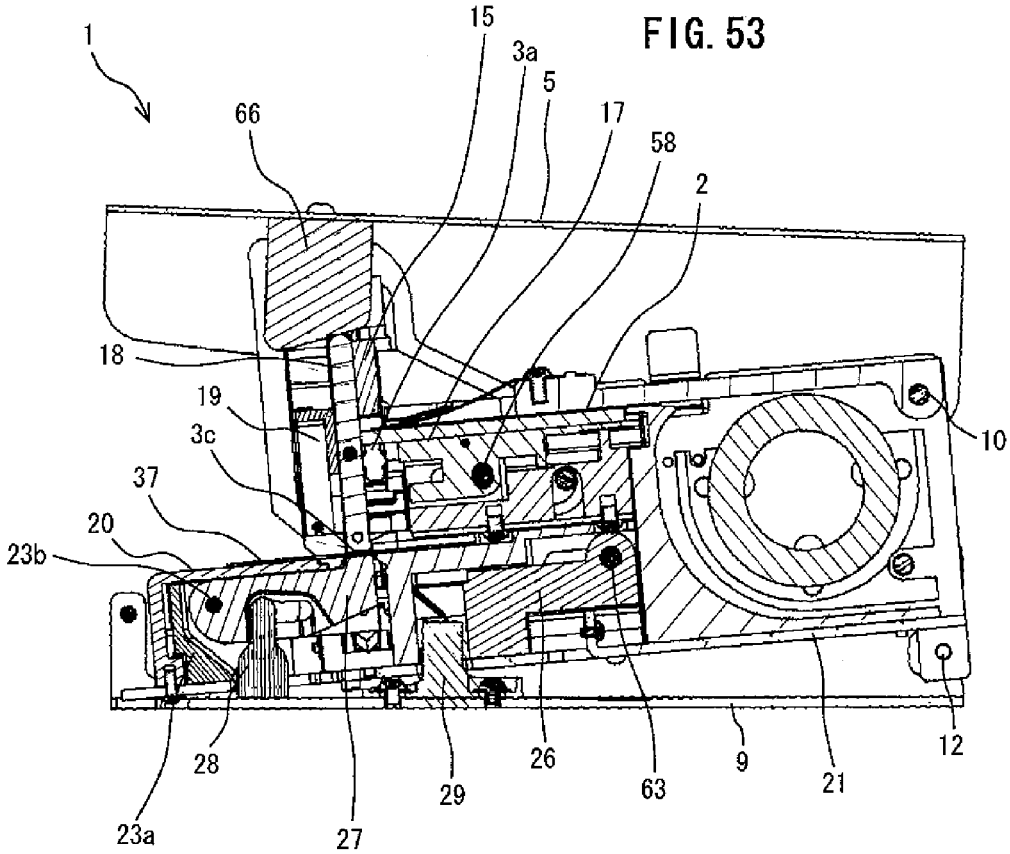
FIG. 53 is a cross-sectional view of the stapler showing a state in which clinch of a staple is completed.
Figure 88:
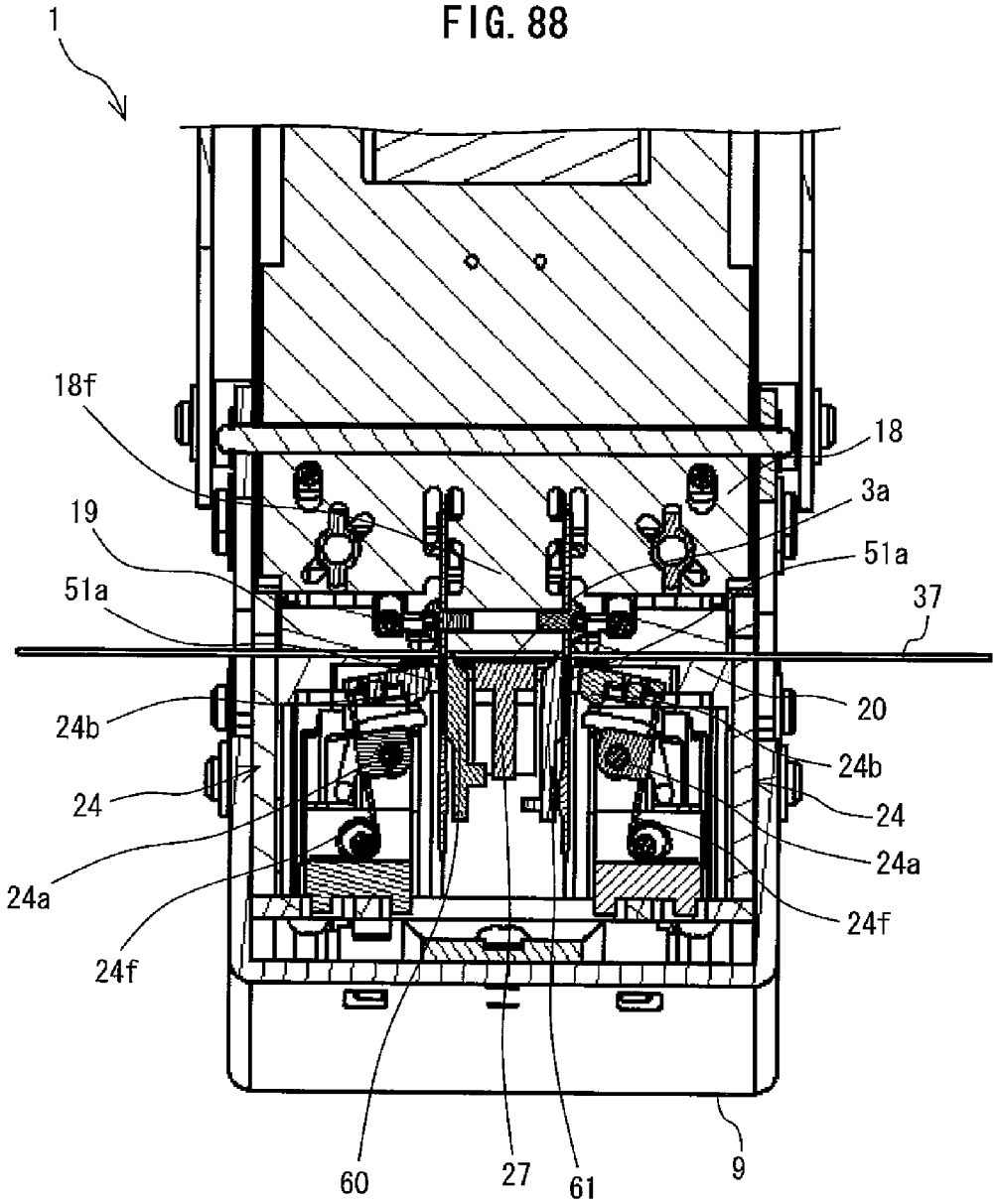

FIG. 53 and FIG. 88 are explanatory diagrams showing a state of the respective portions of the stapler 1 in a state in which clinch of the staple 3*c* is completed. By pushing down the handle 5 further from a state in which the left leg portion 36 is clinched, which is shown in FIG. 52 and FIG. 87, the frame 8 rotates counterclockwise in FIG. 53 with respect to the base 9 on the frame rotating shaft 12 and as shown in FIG. 53 and FIG. 88, the staple 3*c* and the binding sheets 37 become in a state of being sandwiched by the staple push down unit 18*c* of the driver 18 and the bonding portion 27*a* of the tip of the clincher center 27, and the pushdown operation of the handle 5 terminates. It should be noted that it is not possible to push down the handle 5 further from that state.

By pushing down the handle 5 further from a state shown in FIG. 52 and FIG. 87, the clincher center 27 rotates on the clincher shaft 23*b* and is lifted upward further with respect to the clincher holder 23*a* by the clincher lifter 28, and as shown in FIG. 53 and FIG. 88, overlapping portions of both the leg portions 36 of the staple 3*c* become in a state of being held down by the bonding portion 27*a* of the tip of the clincher center 27. Thus, as shown in FIG. 8C, it becomes in a state in which the adhesion portion 31 of the leg portion 36 of the left side of the staple 3*a* and the leg portion 36 of the right side are bonded and the adhesion portion 31 of the leg portion 36 of the right side and the binding sheets 37 are bonded, respectively.

Figure 54:
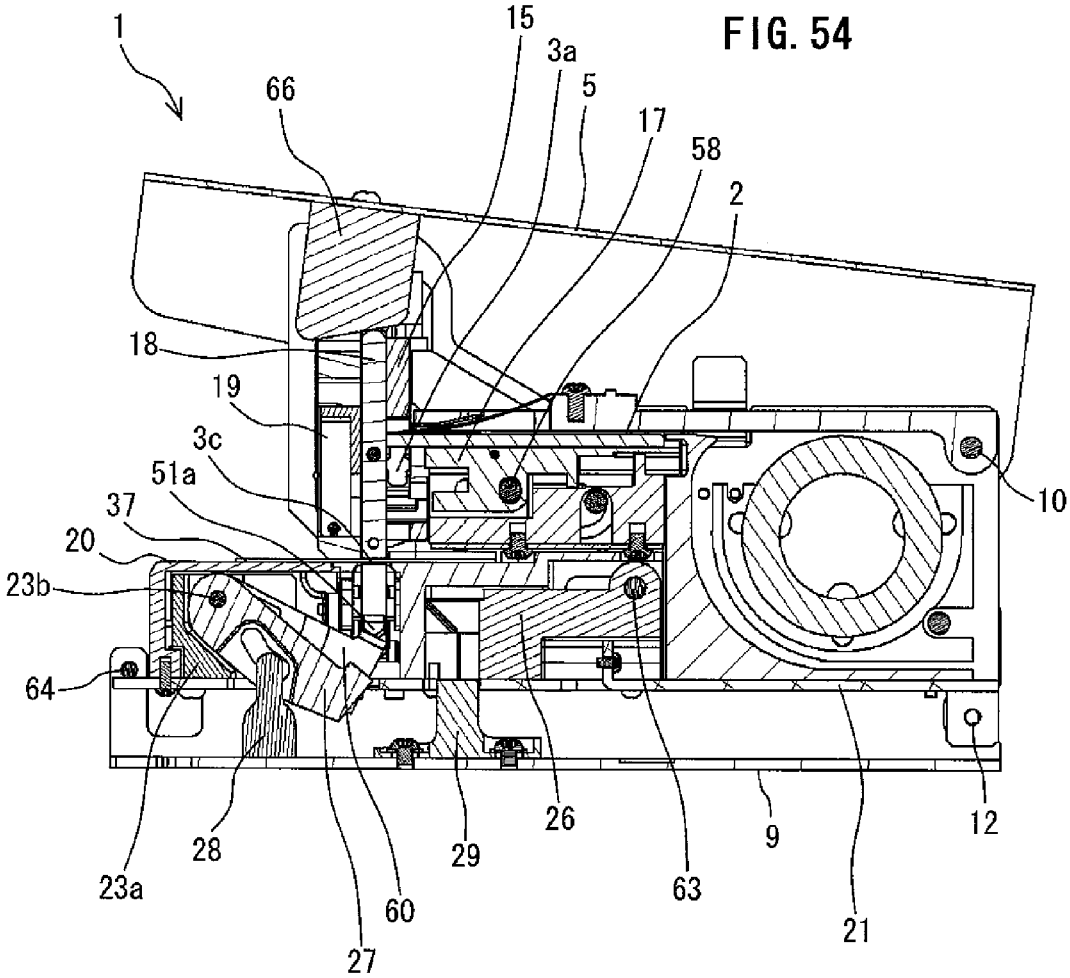
FIG. 54 is a cross-sectional view of the stapler showing a state in which return of a frame is completed and return of a driver starts.
Figure 89:
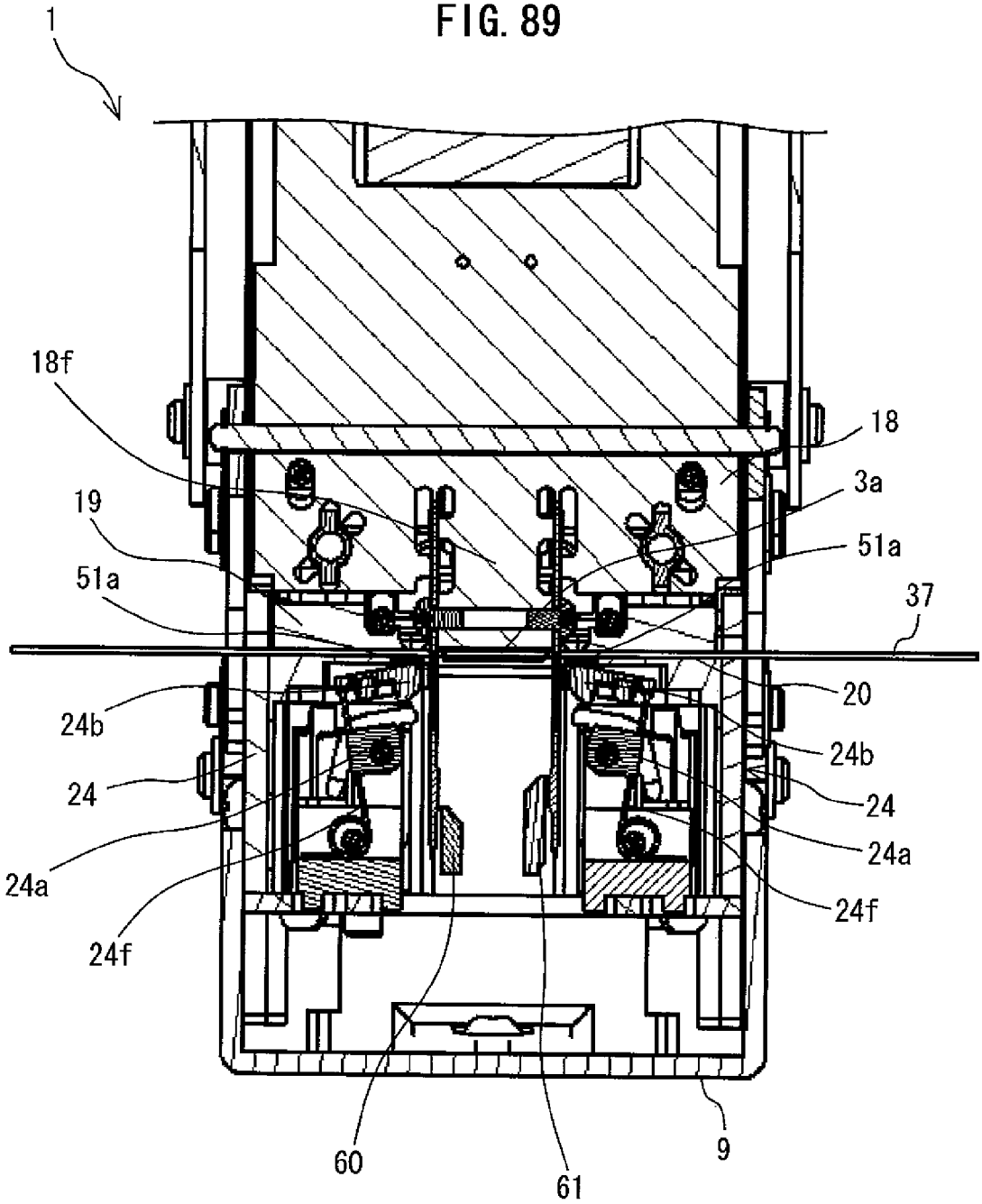

FIG. 54 and FIG. 89 are explanatory diagrams showing a state of the respective portions of the stapler 1 in a state in which return of the frame 8 is completed and return of the driver 18 starts. By releasing the push down of the handle 5 depending on a user from a state in which clinch of the staple 3*c* is completed, which is shown in FIG. 53 and FIG. 88, first, the frame 8 rotates clockwise in FIG. 54 with respect to the base 9 on the frame rotating shaft 12 depending on the return springs 22 which are provided at the base 9 shown in FIG. 2.

Figure 75:
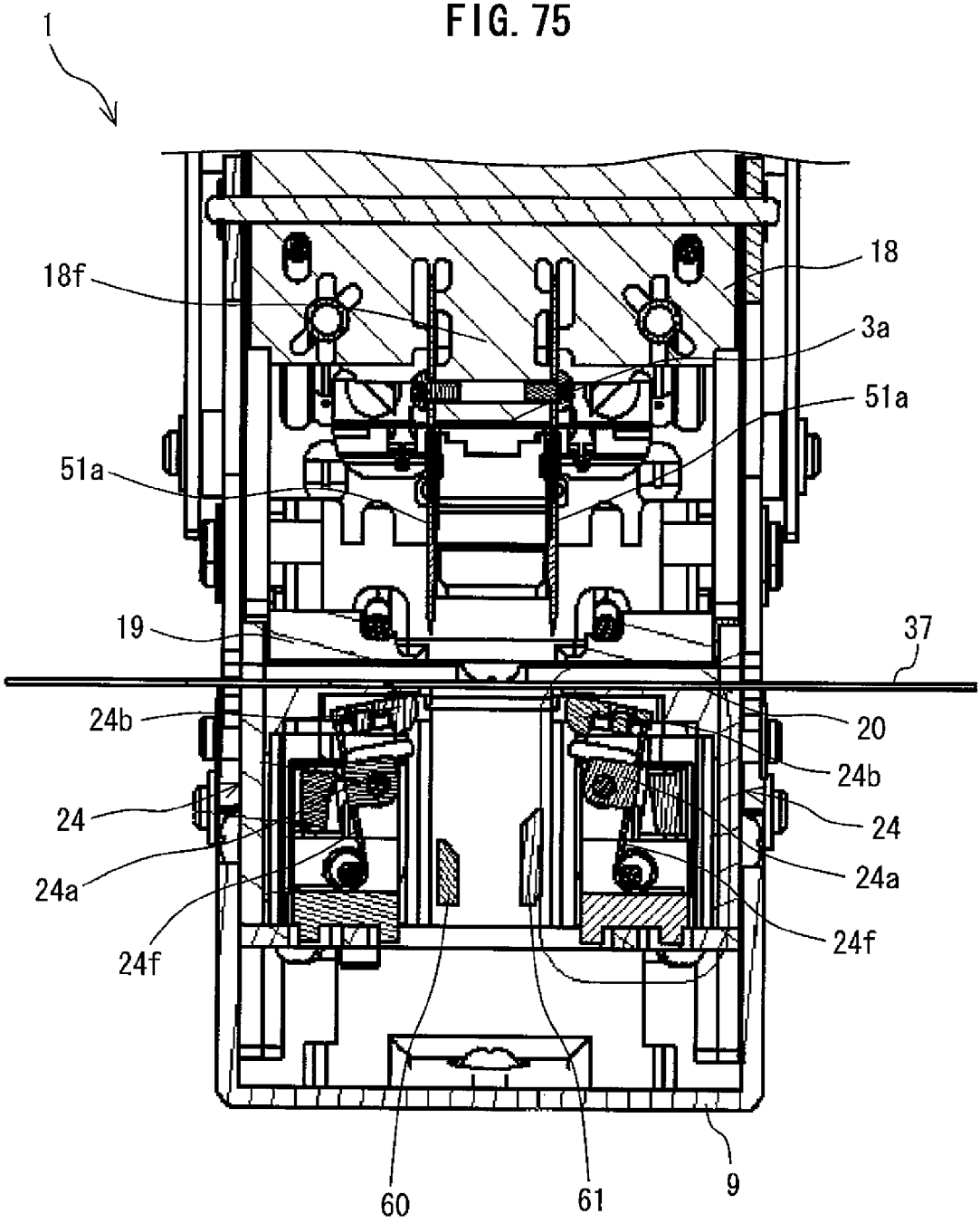
FIG. 75 is a cross-sectional view of the stapler showing the stand-by state thereof.

Thus, the front edge portion of the bending unit installation table 21 abuts against the shaft 64 which is fixed at the base 9, and the frame 8 and the base 9 become in the same position relationship as the stand-by state shown in FIG. 40 and FIG. 75. Also, the clincher center 27 is pulled down with respect to the clincher holder 23*a* by the clincher lifter 28, and the clincher holder 23*a*, the clincher left 60, the clincher center 27 and the clincher right 61 become in the same position relationship as the stand-by state shown in FIG. 40 and FIG. 75.

Also, the frame 8 rotates on the frame rotating shaft 12 depending on the return springs 22 and the front edge portion of the bending unit installation table 21 abuts against the shaft 64 and thereafter, the driver 18 starts moving upward by the screw coil springs 56 provided between the driver 18 and the paper-sheet pusher 19 shown in FIG. 13B.

Figure 55:
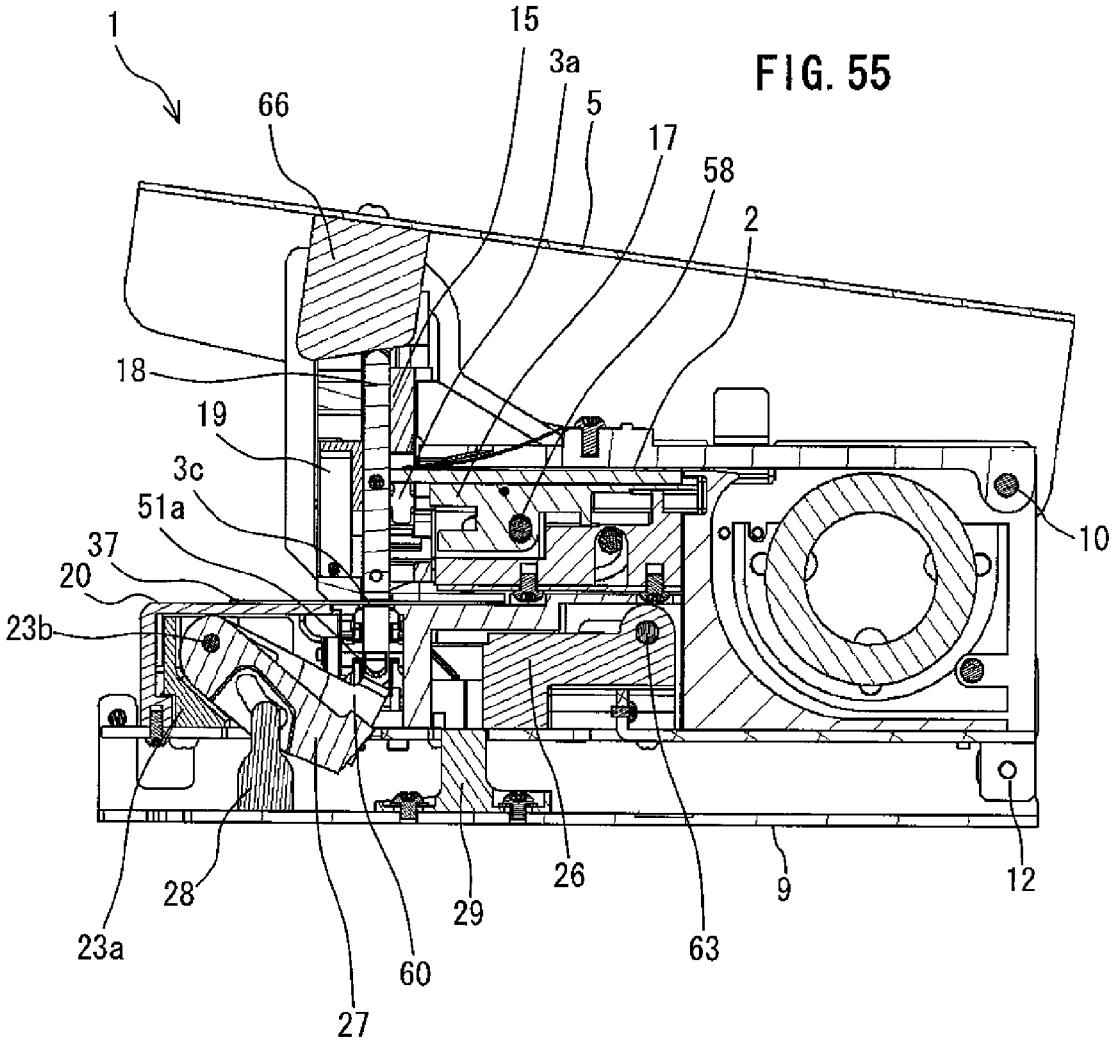
FIG. 55 is a cross-sectional view of the stapler showing a state in which return of the forming plate starts.
Figure 69:
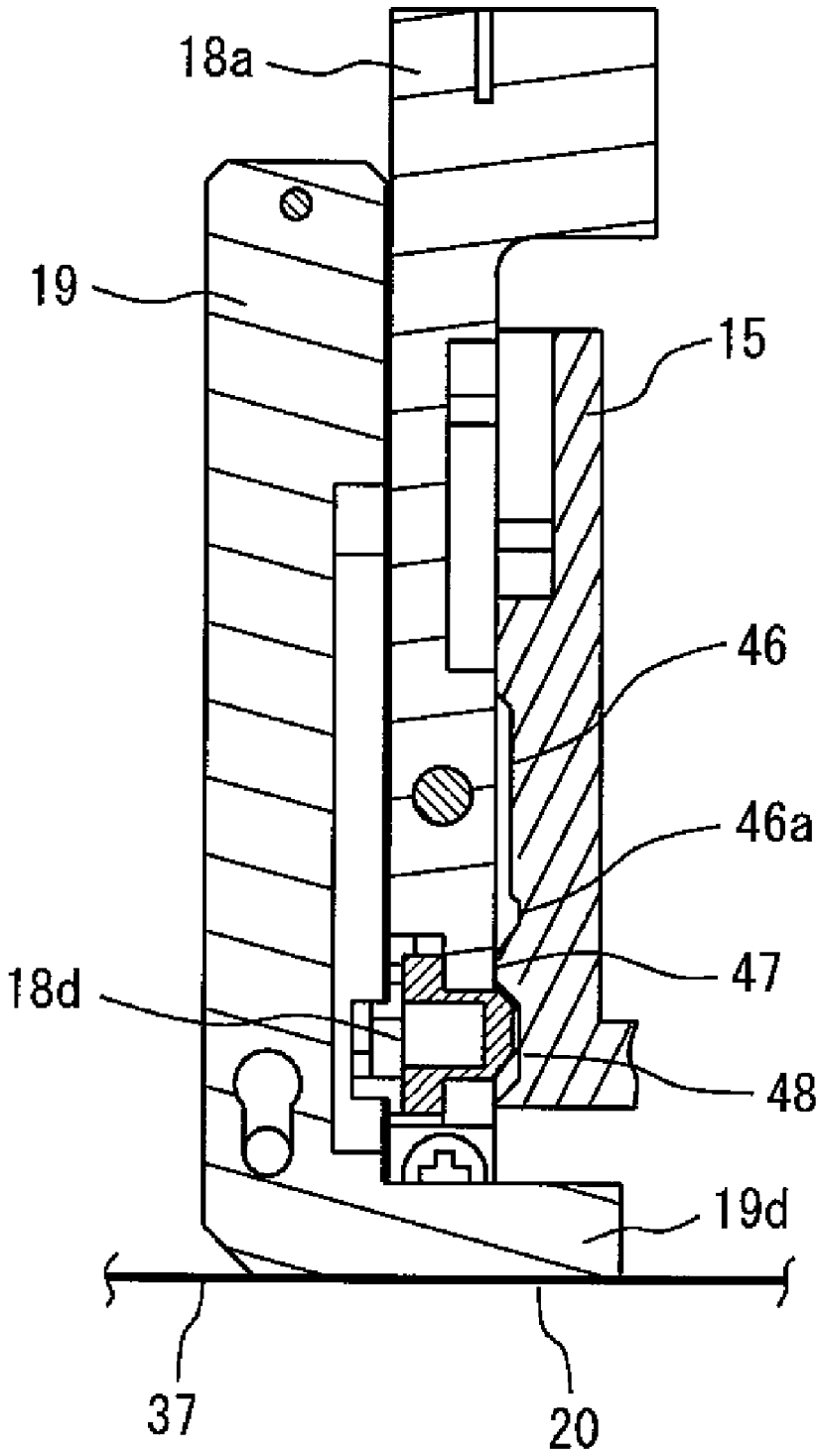
FIG. 69 is a cross-sectional view of the stapler cutoff shaping unit—penetration unit showing a state in which return of the forming plate starts.

FIG. 55, FIG. 69 and FIG. 90 are explanatory diagrams showing the respective portions of the stapler 1 in a state in which return of the forming plate 15 starts. The driver 18 moves upward by the screw coil springs 56 from a state in which return of the frame 8 is completed and return of the driver 18 starts, which is shown in FIG. 54 and FIG. 89.

Thus, as shown in FIG. 69, the protrusion pins 18*d* move upward in the V-grooves 48, the protrusion pin 18*d* becomes in a state of being engaged at upper edge portions of the V-grooves 48 and the driver 18 moves upward and the forming plate 15 moves upward too.

Also, the links 57 rotate in the reverse direction of an arrow E of FIG. 2 by moving the driver 18 upward. Thus, the protrusion portions 57*c* of the links 57 which push the slider shaft 63 backward move in the reverse direction of an arrow E and the slider 26 which is biased by the slider spring 25 starts moving forward.

Figure 56:
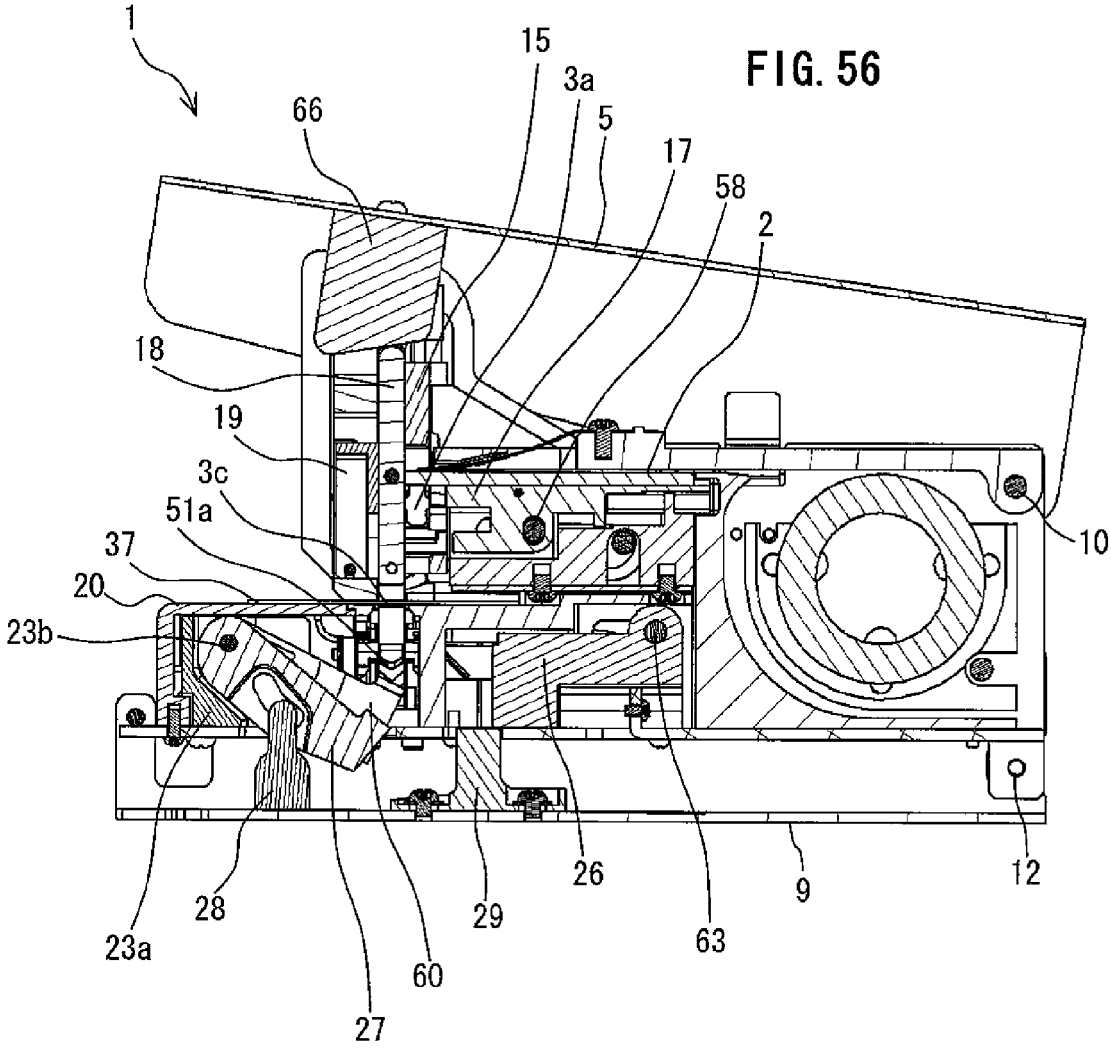
FIG. 56 is a cross-sectional view of the stapler showing a state in which both the leg portions are retained by the spread-retainers.
Figure 70:
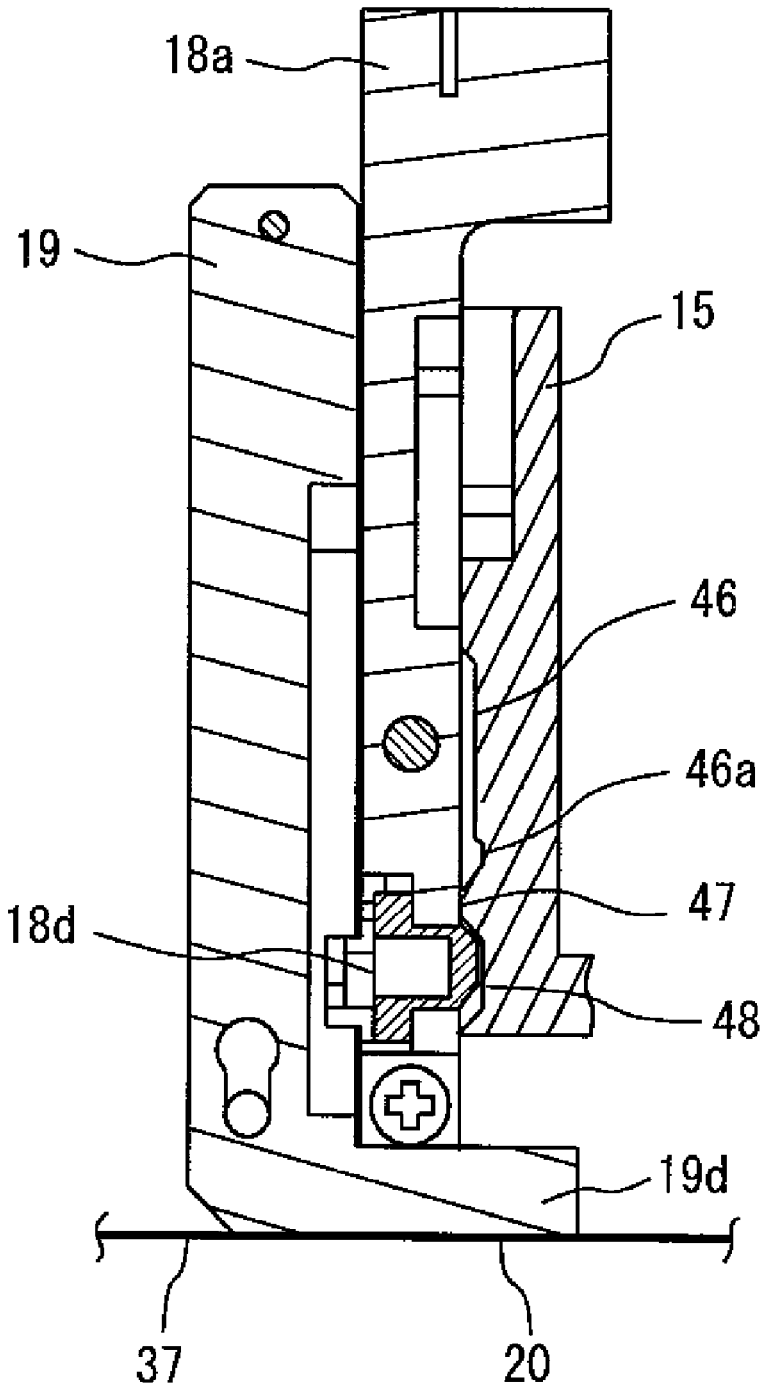
FIG. 70 is a cross-sectional view of the stapler cutoff shaping unit—penetration unit showing a state in which both the leg portions are retained by the spread-retainers.

FIG. 56, FIG. 70 and FIG. 91 are explanatory diagrams showing a state of the respective portions of the stapler 1 in a state in which both the leg portions 36 are retained by the spread-retainers 15*c*. The driver 18 moves upward further by the screw coil springs 56*a* from a state in which return of the forming plate 15 starts, which is shown in FIG. 55, FIG. 69 and FIG. 90.

Thus, as shown in FIG. 70, in a state in which the protrusion pins 18*d* are engaged with upper ends in the V-grooves 48, the driver 18 moves upward and the forming plate 15 moves upward too. Thus, as shown in FIG. 28B, the tip portions of both the leg portions 36 of the staple 3*a* become in a state of being retained by the spread-retainers 15*c* of the forming plate 15.

Also, by moving the driver 18 upward, the links 57 rotate further in the reverse direction of an arrow E of FIG. 2, the protrusion portions 57*c* of the links 57 which hold down the slider shaft 63 move further in the reverse direction of the arrow E and the slider 26 which is biased by the slider spring 25 moves forward further.

Figure 57:
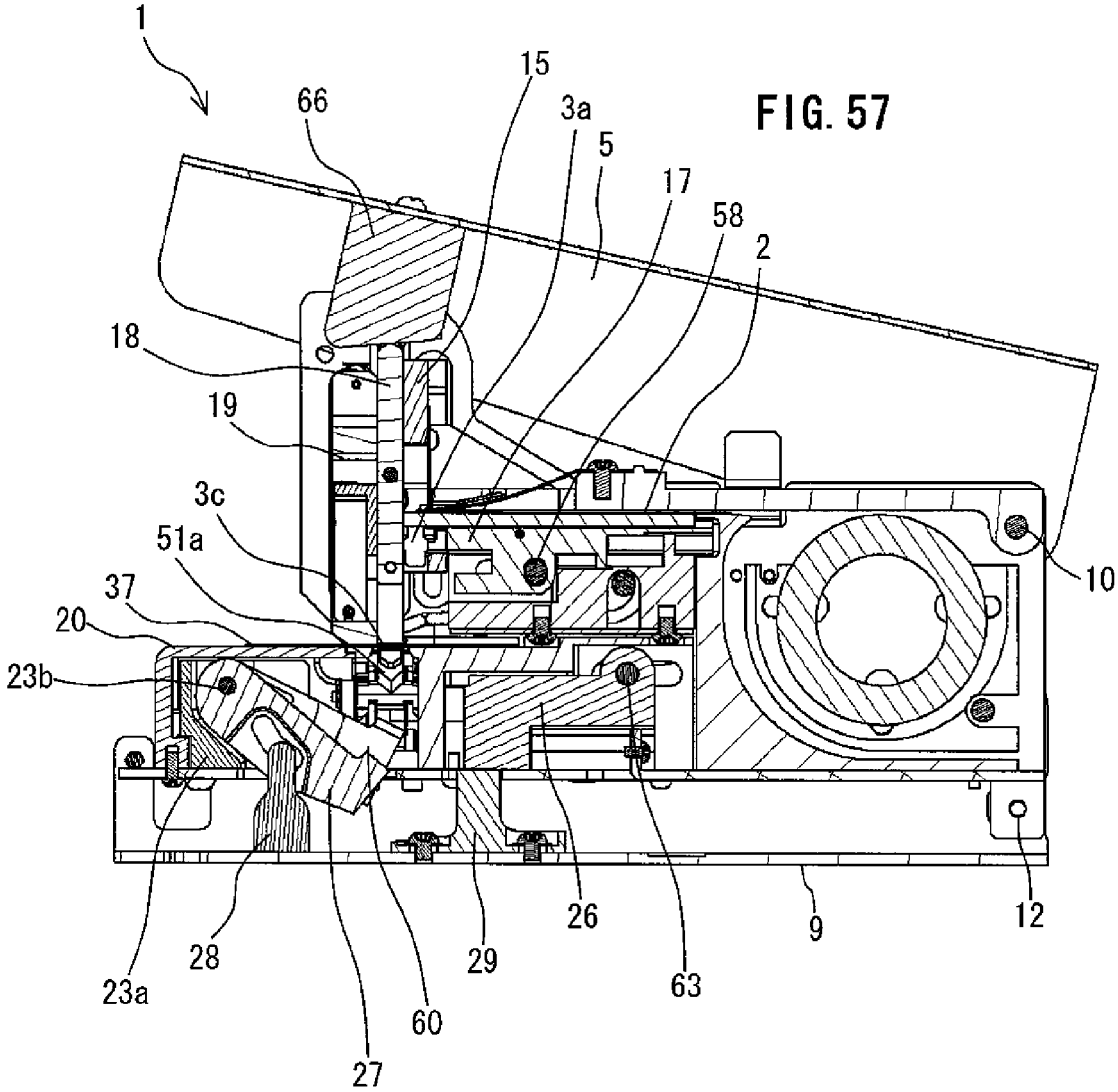
FIG. 57 is a cross-sectional view of the stapler showing a state in which return of the forming plate is completed.
Figure 71:
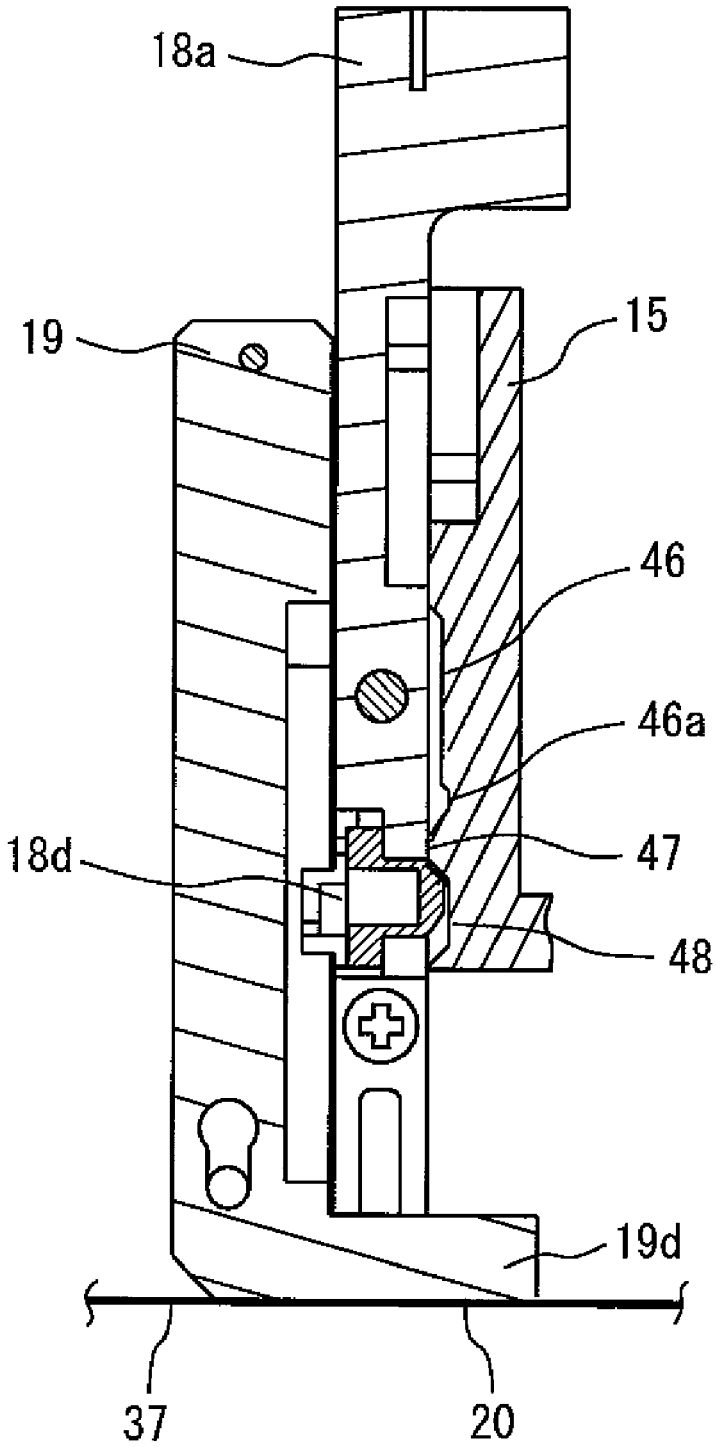
FIG. 71 is a cross-sectional view of the stapler cutoff shaping unit—penetration unit showing a state in which return of the forming plate is completed.

FIG. 57, FIG. 71 and FIG. 92 are explanatory diagrams showing a state of the respective portions of the stapler 1 in a state in which return of the forming plate 15 is completed. The driver 18 moves upward further by the screw coil springs 56 from a state in which both the leg portions 36 are retained by the spread-retainers 15*c*, which is shown in FIG. 56, FIG. 70 and FIG. 91.

Thus, as shown in FIG. 71, in a state in which the protrusion pins 18*d* are engaged with upper edges in the V-grooves 48, the driver 18 moves upward and the forming plate 15 moves until the upper edge portion. Thus, as shown in FIG. 28C, the tip portions of both the leg portions 36 of the staple 3*a* become in a state of being retained perfectly by the spread-retainers 15*c* of the forming plate 15.

Also, by moving the driver 18 upward, the links 57 rotate further in the reverse direction of an arrow E of FIG. 2, the protrusion portions 57*c* of the links 57 which hold down the slider shaft 63 moves further in the reverse direction of the arrow E and the slider 26 which is biased by the slider spring 25 moves forward further.

Figure 58:
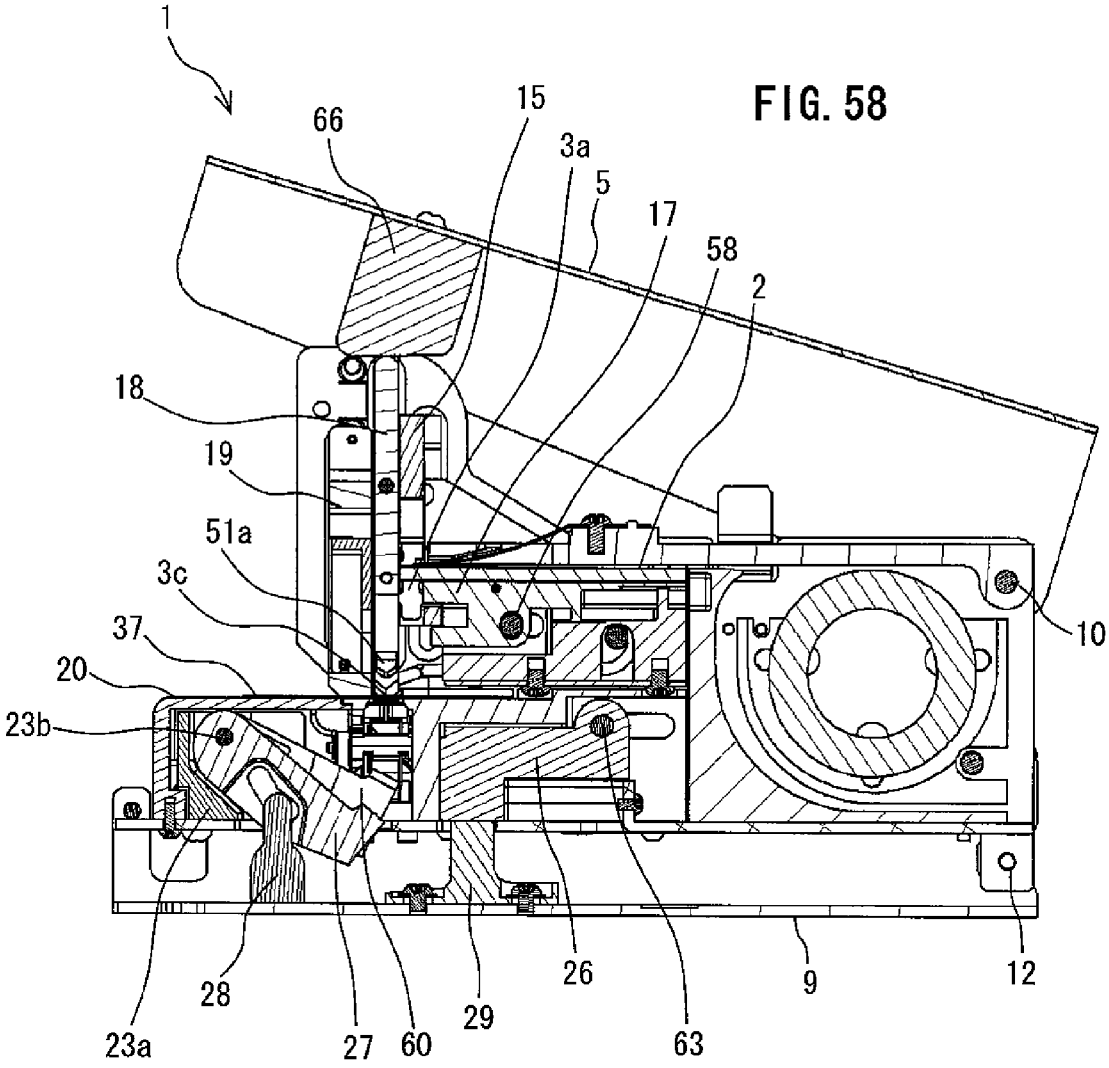
FIG. 58 is a cross-sectional view of the stapler showing a state in which a pusher starts moving forward.
Figure 72:
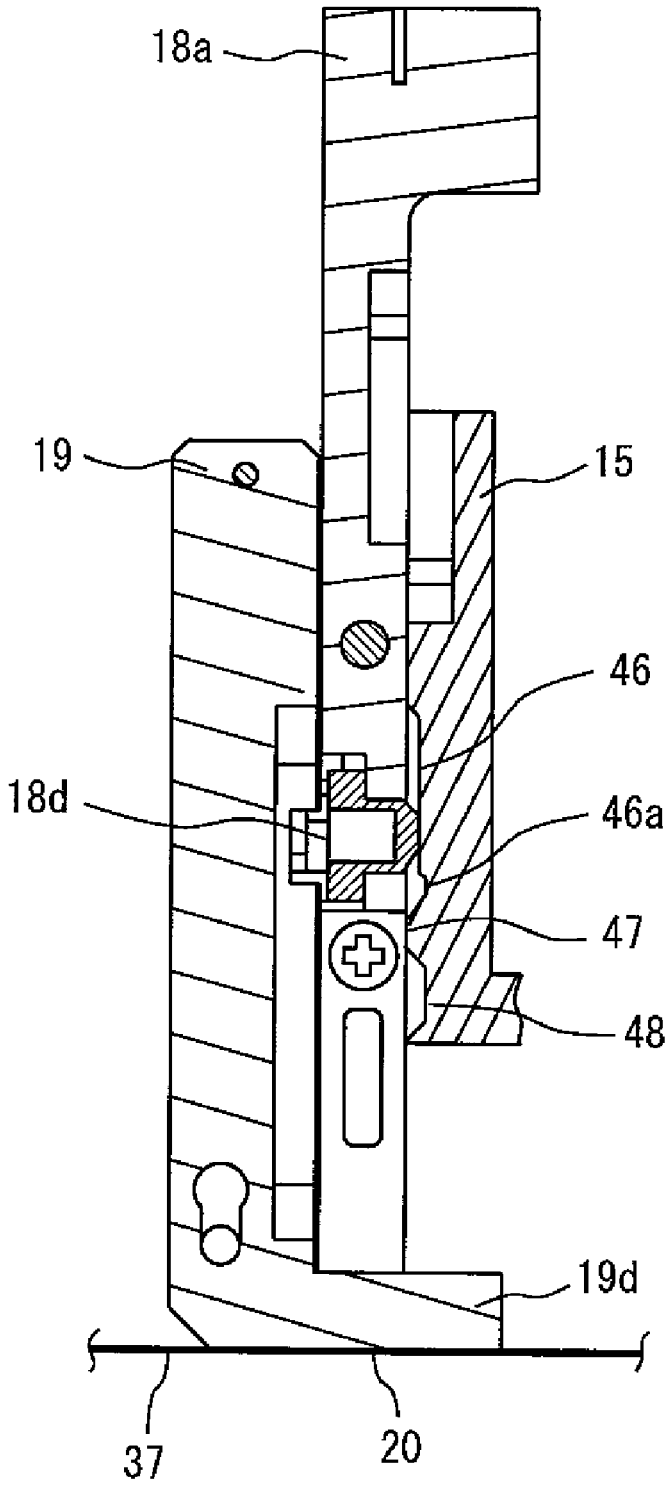
FIG. 72 is a cross-sectional view of the stapler cutoff shaping unit—penetration unit showing a state in which a pusher starts movement frontward.

FIG. 58, FIG. 72 and FIG. 93 are explanatory diagrams showing a state of the respective portions of the stapler 1 in a state in which the pusher 17 starts moving forward. The driver 18 moves upward further by the screw coil springs 56 from a state shown in FIG. 57, FIG. 71 and FIG. 92 in which return of the forming plate 15 is completed.

Thus, as shown in FIG. 72, the protrusion pins 18*d* go over the flat portions 47 from the V-grooves 48 and moves upward in the V-grooves 46. Also, by moving the driver 18 upward, the links 57 rotate further in the reverse direction of the arrow E of FIG. 2, the protrusion portions 57*c* of the links 57 which hold down the slider shaft 63 move further in the reverse direction of the arrow E and the slider 26 which is biased by the slider spring 25 moves to the same position as the stand-by state shown by FIG. 40 and FIG. 75.

Further, by moving the long hole 57*a* of the link 57 which holds down the pusher shaft 58, the pusher 17 biased by the pusher spring 16 starts moving forward. Thus, as shown in FIG. 25E, the interlinked staples 2 are fed forward by the feeding claws 44. At that time, as shown in FIG. 10, the release coated paper 30 is peeled by the peeling block 38 from the interlinked staples 2 which are pulled out of the roll shaped staple 4 loaded in the staple holder 11. Also, the peeled release coated paper 30 is discharged from the release coated paper outlet 39 by way of the release coated paper discharge path 40. Also, the staple 3*a* is pushed out between the respective punching blades of the driver 18 by the staple pushing unit 17*a* of the pusher 17 which is not shown in FIG. 25E. The pushed-out staple 3*a* becomes a new staple 3*c* shown in FIG. 40 through a state shown in FIG. 60 mentioned later.

Figure 59:
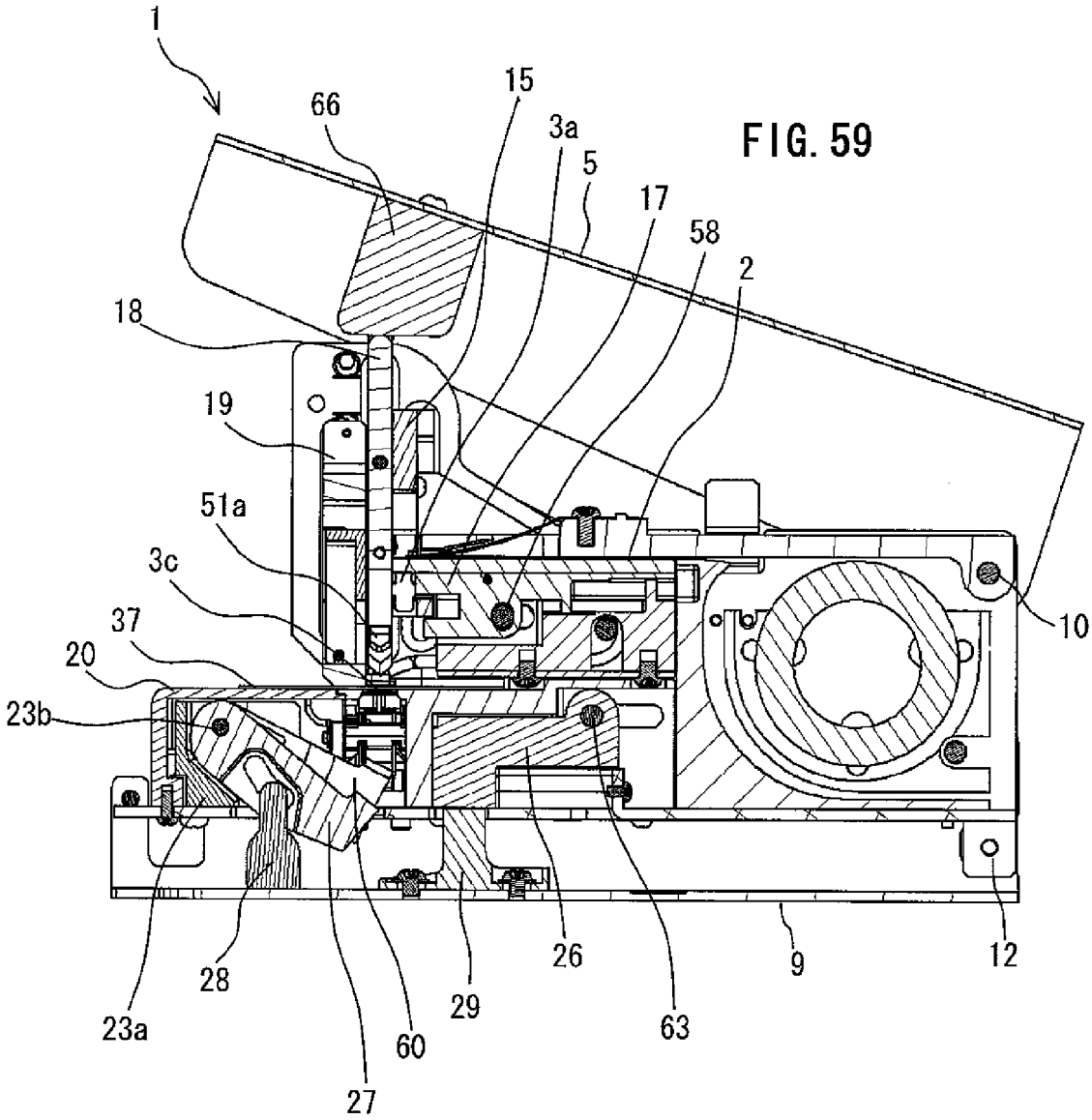
FIG. 59 is a cross-sectional view of the stapler showing a state in which return of a paper-sheet pusher starts.
Figure 73:
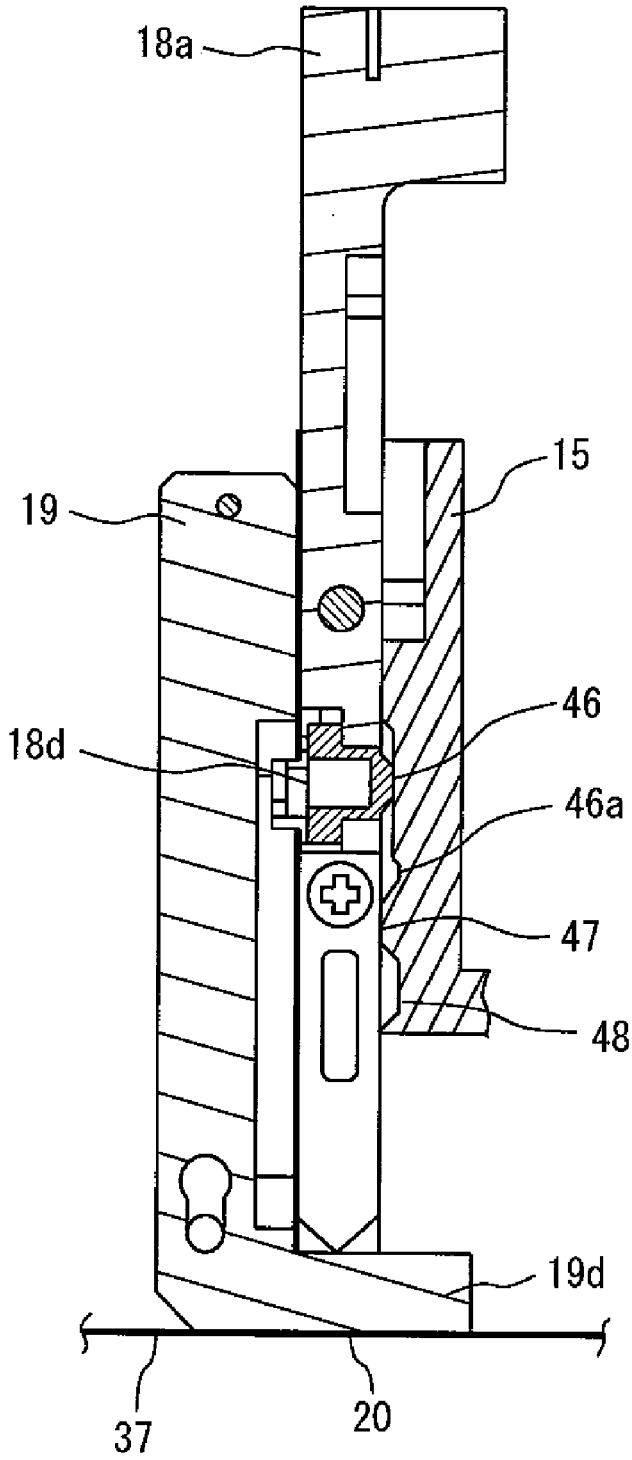
FIG. 73 is a cross-sectional view of the stapler cutoff shaping unit—penetration unit showing a state in which return of a paper-sheet pusher starts.

FIG. 59, FIG. 73 and FIG. 94 are explanatory diagrams showing a state of the respective portions of the stapler 1 in a state in which return of the paper-sheet pusher 19 starts. The driver 18 moves upward further by the screw coil springs 56 from a state in which the pusher 17 starts moving forward, which is shown in FIG. 58, FIG. 72 and FIG. 93. Thus, as shown in FIG. 73, the protrusion pins 18*d* move upward in the V-grooves 46 to a predetermined position.

The driver 18 ascends to a predetermined position by the screw coil springs 56 and thereafter, the lifting upward of the paper-sheet pusher 19 and the driver 18 with respect to the frame 8 starts by the tension spring 55 provided between the frame 8 and the paper-sheet pusher 19, which is shown in FIG. 4.

Figure 60:
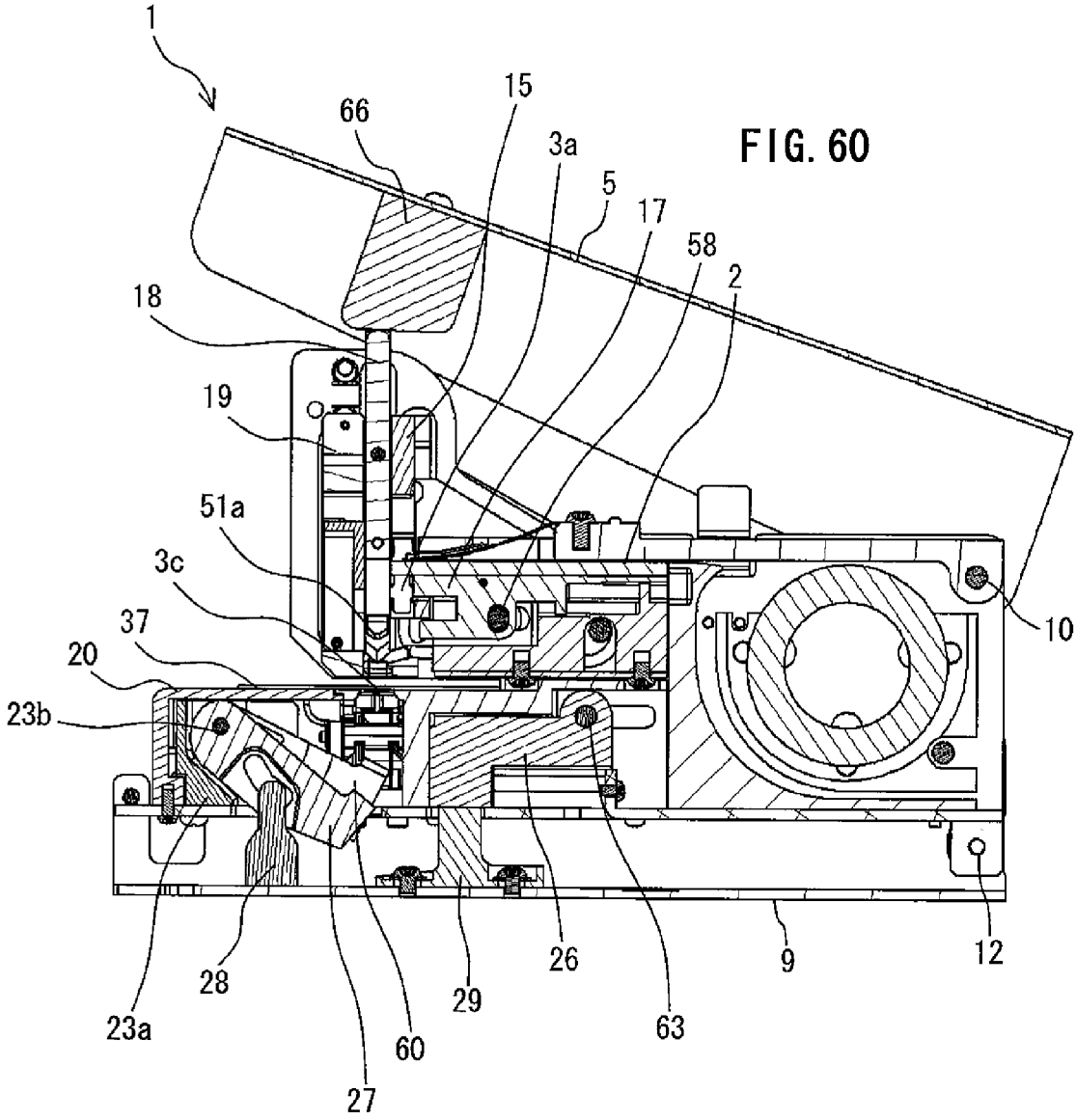
FIG. 60 is a cross-sectional view of the stapler showing a state just before return of the pusher.
Figure 74:
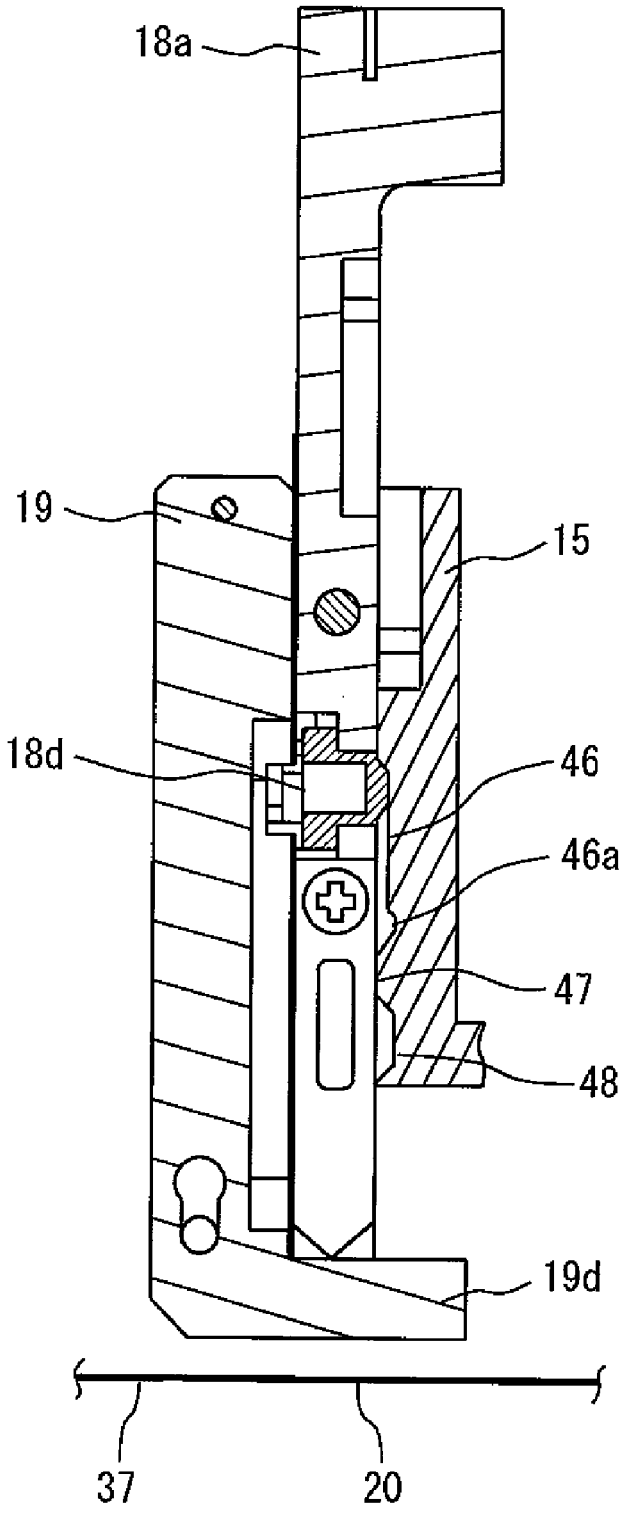
FIG. 74 is a cross-sectional view of the stapler cutoff shaping unit—penetration unit showing a state in which return of the pusher starts.

FIG. 60, FIG. 74 and FIG. 95 are explanatory diagrams showing a state of the respective portions of the stapler 1 in a state just before return of the pusher 17. The paper-sheet pusher 19 and the driver 18 are lifted upward further with respect to the frame 8 by the tension spring 55 from a state in which return of the paper-sheet pusher 19 starts, which is shown in FIG. 59, FIG. 73 and FIG. 94.

By moving the driver 18 upward, rotating the links 57 in the reverse direction of the arrow E in FIG. 2 further and moving the long hole 57*a* of the link 57 which holds down the pusher shaft 58, the pusher 17 biased by the pusher spring 16 moves to the same position as the stand-by state shown by FIG. 40 and FIG. 75. It should be noted that when the driver becomes in the stand-by state perfectly, a front of the staple which is shaped into a shape in which both the edges are bent to one direction is opened, so that the pusher 17 moves forward depending on elasticity of the pusher spring 16 which has been in a compressed state. Consequently, the feeding operation of the staple shaped into a shape in which both the edges are bent to one direction and the feeding operation of other staples are executed approximately simultaneously.

The binding sheets 37 placed on the table 20 in the paper-sheet insertion port are bound by the staple 3*a* depending on the operation of the respective portions of the stapler 1 as mentioned above.

The stapler 1 of the present invention shapes the staple 3 into a shape in which the predetermined both edges are bent to one direction and subsequently, penetrates them through the binding sheets 37 and bends and bonds both the leg portions 36. Thus, it becomes possible for the binding sheets 37 to be bound reliably by using the easily deformable paper-made staple 3.

For the stapler 1 of the present invention, as shown in FIG. 8A, there is used the interlinked staples 2 in which the approximately straight lined staples 3 are interlinked. Also, as shown in FIG. 9A, the interlinked staples 2 in which a plurality of the approximately straight lined staples 3 are interlinked in parallel can be wound around in a roll shape as a roll shaped staple 4. Thus, it becomes possible for the staple 1 of the present invention to load a lot of staples 3 at once as the roll shaped staple 4.

According to the stapler 1 of the present invention, the paper-sheet pusher 19 is provided with the open-close freely square window 19*b*. Thus, when the staple 3 is moved to the punching blades 51 or the like and in a case in which the staple 3 is jammed during the operation of the stapler 1, it becomes possible for the jammed staple 3 to be removed easily by opening the square window 19*b* and accessing to the jammed staple 3.

The stapler 1 of the present invention cuts and shapes the staple 3*a* which is positioned at the edge portion of the interlinked staples 2 by pushing down the forming plate 15 depending on the pushing-down of the handle 5, and performs penetration of the staple 3*c* through the binding sheets 37 by pushing down the driver 18. Thus, it becomes possible by one operation to execute the cutoff and shaping of the staple 3 and the penetration thereof through the binding sheets 37.

Also, in the stapler 1 of the present invention, as shown in FIG. 40 or the like, the penetration of the staple 3 through the binding sheets 37; bending and bonding of both the penetrated leg portions 36; and the like are executed in a state in which the binding sheets 37 placed on the table 20 is held down by the paper-sheet pusher unit 19*d* of the paper-sheet pusher 19. Thus, it becomes possible to accurately execute operations of the penetration of the staple 3 through the binding sheets 37; the bending and bonding of both the penetrated leg portions 36; and the like.

Also, in the stapler 1 of the present invention, the driver 18 is pushed down with respect to the binding sheets 37 by being pushed by means of the driver pusher 66 attached to the handle 5. Also, the forming plate 15 is pushed down together with the driver 18 with respect to the staple 3 by a fact that the protrusion pins 18*d* are engaged with the lower edge portions 46*a* of the V-grooves 46.

Further, in the stapler 1 of the present invention, the driver 18 is pushed upward from the binding sheets 37 by being pushed by means of the screw coil springs 56 provided between the driver 18 and the paper-sheet pusher 19. Also, the forming plate 15 is pushed up together with the driver 18 from the staple 3 by a fact that the protrusion pins 18*d* are engaged with the V-grooves 48*a*.

Also, the protrusion pins 18*d* are not engaged with the V-grooves 46 and the flat portions 47 other than the lower edge portions 46*a*, only the driver 18 moves up and down, and the forming plate 15 does not move up and down. Namely, in the stapler 1 of the present invention, it becomes possible only at the predetermined positions of up and down of the driver 18 to mutually cooperate the movements of the push-down and the push-up of the driver 18 and the forming plate 15.

Also, with respect to the stapler 1 of the present invention, in one operation shown in FIG. 40 to FIG. 60, cutoff and shaping of the staple 3*a* are executed by the forming plate 15; penetration of the staple 3*c* through the binding sheets 37 is executed by the driver 18; and the movement of the staple 3*a*, which is cut off and shaped by the forming plate 15, toward the driver 18 by means of the pusher 17 is executed. Namely, it is a constitution in which cutoff and shaping with respect to one staple 3 and penetration thereof through the binding sheets 37 are executed at different positions and by different operations, respectively.

Thus, as compared with a constitution in which cutoff and shaping with respect to one staple 3 and penetration thereof through the binding sheets 37 are executed at the same place by one time operation, it is possible to shorten stroke in the up and down direction of the respective operation members and it becomes possible to constitute the height of the staple to be low.

Also, the stapler 1 of the present invention has the feeding path grooves 13*a* for avoiding contact with the adhesion portion 31 of the rear surface of each staple 3 at the feeding path 13 on which the interlinked staples 2 are fed. Consequently, when the interlinked staples 2 are fed on the feeding path 13, the adhesion portion 31 of the rear surface of each staple 3 does not contact with the feeding path 31 so that it becomes possible to execute the feed of the interlinked staples 2 smoothly.

Also, in the stapler 1 of the present invention, when the staple interlinking portions 34 between the staple 3*a* positioned at the edge portion of the interlinked staples 2 and the staple 3*b* adjacent to the staple 3*a* are cut off by the cutting blades 49, the staple 3*a* and the staple 3*b* are pushed down with respect to the feeding path 13 by the reverse stopper springs 59 respectively. Consequently, it becomes possible to execute the cutoff of the staple 3*a* positioned at the edge portion of the interlinked staples 2 highly accurately.

Also, in the stapler 1 of the present invention, the respective blade edges 49*a* are pushed against in the opposite directions respectively toward the outside from the inside of the staple 3 with respect to the respective staple interlinking portions 34, and the respective staple interlinking portions 34 are cut off. Thus, on an occasion of the cutoff of each of the staple interlinking portions 34, it becomes in a state in which opposite forces are applied to a longitudinal direction of the each staple 3 by means of each of the blade edges 49*a* simultaneously.

Thus, it is unnecessary for supporting the staple 3*a* of a cutoff object and the staple 3*b* adjacent to the staple 3*a* of the cutoff object in wide range, and it becomes possible to execute the cutoff of the staple 3 stably with a simple constitution by holding down by means of the reverse stopper spring 59.

Also, the stapler 1 of the present invention is provided with the cutting blade of a shape having the linear portion which become continuous from one edge portion to the other edge portion in a longitudinal direction by forming the protrusion portion 51*d* by protruding a portion of the width direction as the punching blade 51 which provides the notch opening for executing penetration of the staple 3 on the binding sheets 37. Thus, the strength of the punching blade 51 when penetrating the binding sheets 37 is secured, and it becomes possible to execute penetration of the staple 3 through the binding sheets 37 reliably.

Also, according to the stapler 1 including the first punching blade 51*a* shown in FIG. 21A, FIG. 21B and FIG. 21C, when both the leg portions 36 of the staple 3 penetrate the binding sheets 37, as shown in FIG. 21D, the notch opening 52*a* having the wide width in the arrow direction is formed. Thus, it becomes possible for both the leg portions 36 of the staple 3 to be inserted through the binding sheets 37 reliably.

Also, according to the stapler 1 including the second punching blade 51*b* shown in FIG. 22A, FIG. 22B and FIG. 22C, when both the leg portions 36 of the staple 3 penetrate the binding sheets 37, as shown in FIG. 22D, the notch opening 52*b* having the wide width in the arrow direction is formed over the whole width, which is different from the notch opening 52*a*. Thus, it becomes possible for both the leg portions 36 of the staple 3 to be inserted through the binding sheets 37 more reliably as compared with the stapler 1 including the first punching blade 51*a*.

The stapler 1 of the present invention binds both the leg portions 36 of the staple 3 penetrated through the binding sheets 37 in order in the directions which are faced to each other along the binding sheets 37 by the clincher right 61 and the clincher left 60 and retains them, and bonds the bent and retained overlapping portions of both the leg portions mutually by being pressed by means of the clincher center 27. Thus, the stapler 1 of the present invention can execute the bending and the bonding of both the leg portions 36 of the paper-made staple 3 which penetrates the binding sheets 37 reliably.

INDUSTRIAL APPLICABILITY

The present invention is applied to a stapler which binds binding sheets by a paper-made staple.

The invention claimed is:

1. A stapler including:

a staple cutting portion for cutting off a staple positioned at a leading portion of interlinked staples from the interlinked staples in which a plurality of approximately straight lined paper-made staples are interlinked in parallel;

a shaping portion for shaping the staple cut off by the staple cutting portion such that a crown portion and leg portions bent approximately perpendicularly from the right and left sides of the crown portion are formed;

a staple penetration portion for penetrating both the leg portions of the staple shaped by the shaping portion through binding sheets; and a staple bending portion for bending both the leg portions of the staple penetrated through the binding sheets by the staple penetration portion along the binding sheets and for bonding them mutually, wherein the staple penetration portion includes:

a pushing unit for pushing down the staple with respect to the binding sheets; and two pieces of insertion-cutting blades which are provided concurrently at an interval in response to a length of the crown portion and which are provided with protrusion portions formed by protruding portions in the width direction at a predetermined height of the surfaces facing each other, each of the insertion-cutting blades including a push-out hole into which the staple bending portion is insertable, and wherein the respective insertion-cutting blades penetrate the binding sheets in a state in which both the leg portions of the staple that is shaped by the shaping portion into a shape in which both the edges thereof are bent to one direction are attached on the surfaces facing each other with respect to the respective insertion-cutting blades on the upside of the respective protruding portions, and the staple is pushed down by the pushing unit with respect to the binding sheets and the staple bending portion inserted into the push-out hole bends both the leg portions of the staple along the binding sheets and bonds them mutually.

2. The stapler according to claim 1, wherein each of the insertion-cutting blades is provided with protrusion portions which are formed at both the edge portions of the width direction by sandwiching a flat surface portion, at a predetermined height of the surfaces facing each other.

3. The stapler according to claim 1, wherein the staple bending portion contains two pushing-out units that are disposed so that the pushing-out units are positioned outside the staple penetration portion when pushing the staple penetration portion down.

4. The stapler according to claim 3, wherein each of the pushing-out units contains a push-out pusher provided with a push-out section and the push-out section of the push-out pusher is inserted into the push-out hole of the insertion-cutting blade.

* * * * *